US010034491B1

(12) United States Patent
Bavar et al.

(10) Patent No.: US 10,034,491 B1
(45) Date of Patent: Jul. 31, 2018

(54) DOMED WATER PIPE WITH SUPPORTING TRAY

(71) Applicant: KALOUD, INC., Los Angeles, CA (US)

(72) Inventors: Reza Bavar, Los Angeles, CA (US); Tylor Garland, Los Angeles, CA (US); Michael Latham, Los Angeles, CA (US); Stephen Bradford, Los Angeles, CA (US); Richard Seimer, Los Angeles, CA (US); Mark Hummel, Los Angeles, CA (US); Wilson Reniers, Los Angeles, CA (US); Stephen Harper, Los Angeles, CA (US); Andrew Castro, Los Angeles, CA (US)

(73) Assignee: KALOUD, INC., Los Angeles, CA (US)

( * ) Notice: Subject to any disclaimer, the term of this patent is extended or adjusted under 35 U.S.C. 154(b) by 0 days.

(21) Appl. No.: 15/422,433

(22) Filed: Feb. 1, 2017

(51) Int. Cl.

| | |
|---|---|
| ***A24F 1/00*** | (2006.01) |
| ***A24F 1/30*** | (2006.01) |
| ***A24F 47/00*** | (2006.01) |
| ***A24F 1/24*** | (2006.01) |
| ***A24F 1/32*** | (2006.01) |

(52) U.S. Cl.
CPC ..... *A24F 1/30* (2013.01); *A24F 1/24* (2013.01); *A24F 1/32* (2013.01); *A24F 47/00* (2013.01)

(58) Field of Classification Search
None
See application file for complete search history.

(56) References Cited

U.S. PATENT DOCUMENTS

| | | | | |
|---|---|---|---|---|
| 5,738,116 | A * | 4/1998 | Truelove | A24F 1/30 131/173 |
| 2010/0101590 | A1 | 4/2010 | Pflaum | |
| 2010/0212679 | A1 | 8/2010 | Bishara | |
| 2013/0330680 | A1 | 12/2013 | Bavar | |
| 2016/0143352 | A1 | 5/2016 | Bavar | |

FOREIGN PATENT DOCUMENTS

| | | |
|---|---|---|
| WO | WO 2016/023325 A1 | 2/2016 |
| WO | WO PCT/US2017/016102 | 8/2017 |

* cited by examiner

*Primary Examiner* — Michael J Felton
*Assistant Examiner* — Katherine Will
(74) *Attorney, Agent, or Firm* — ONE LLP; Joseph K. Liu

(57) ABSTRACT

A multi-chambered water pipe comprising an inner chamber and exterior chamber.

20 Claims, 142 Drawing Sheets

DETAIL B
SCALE 2 : 1

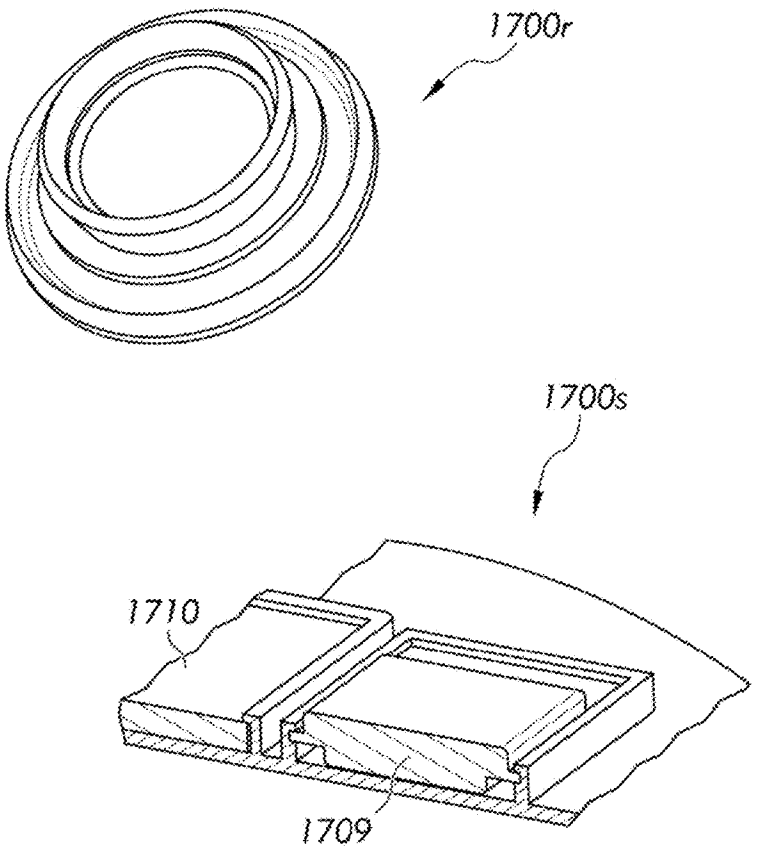
FIG. 17F
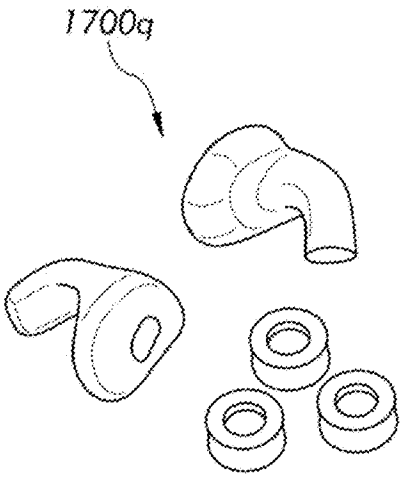

DOMED WATER PIPE WITH SUPPORTING TRAY

CROSS-REFERENCE TO RELATED APPLICATIONS

This application is related to U.S. Pat. No. 9,237,770; U.S. patent application Ser. No. 14/994,907; U.S. patent application Ser. No. 14/549,435; U.S. patent application Ser. No. 14/948,168; and U.S. patent application Ser. No. 14/948,186, each of which are hereby incorporated by reference in their entirety herein for all purposes.

BACKGROUND OF THE INVENTION

The subject matter described herein relates generally to a system, device, and method of preparing tobacco, or other organic material, for smoking using a water pipe. Existing and traditional water pipes generally include a plate for supporting charcoal, a head for containing tobacco, a body including an internal pipe, a base for containing water, and a hose. Typically, a user will first fill the base with water and then place the internal pipe into the water such that the body creates an airtight seal with the base. The head is then filled with tobacco, or other organic material, and placed over the internal pipe such that an airtight seal is created between the internal pipe and the head. Next the user places the plate over the head, places one or more lit charcoals on the plate and these charcoals serve to heat the tobacco, or other organic material, underneath the plate. The hose is typically attached to the body such that it has an airtight connection with air above the water in the base. The user can inhale through the hose, which draws smoke from the heated tobacco, or other organic material, in the head through the internal pipe, through the water contained in the base, through the hose and into the user's lungs.

U.S. Patent Publ. No. 2013/0330680 shows an example of a common water pipe and is incorporated by reference herein in its entirety.

While standard water pipes are known, the embodiments provided herein teach features and advantages heretofore untaught by the prior art, as will be clear to one of ordinary skill in the art.

SUMMARY OF THE INVENTION

Provided herein are embodiments of systems, devices and methods for preparing, storing, heating and smoking tobacco, or other organic material, through a water pipe. The water pipe is different in form and function from traditional water pipes and provides a new experience for users, unknown in the industry.

A hookah is a water pipe known for centuries that has maintained a single, basic form. Traditional hookah pipes commonly include single chamber for holding water or other liquid that resembles a vase, and a pipe, hose, and bowl for holding tobacco. When being used for smoking or storing in an upright orientation, traditional hookahs have a center of gravity that is often located some distance above the surface on which the hookah pipe is resting. This high center of gravity can be prone to tipping over, especially when multiple users are sharing a smoking experience, where they may be passing hoses between each other. In a departure from the traditional orientation, the water pipe device disclosed herein has a low center of gravity and is therefore much more stable and less prone to falling over. As such, the water pipe devices disclosed herein provide improved safety and cleanliness compared with traditional hookah pipes since there is a reduced likelihood that the water pipe will tip over, causing coals or other heating implements to burn property or individuals and there is a reduced likelihood that the liquid holding chamber will spill or break. Similar advantages are also disclosed with respect to new bowl mechanics that are disclosed herein, providing mechanisms for securely coupling tobacco, or other organic material, holding bowls to the new water pipe devices and thus improving safety and cleanliness over prior art hookah pipes.

Operation of a traditional hookah pipe includes heating tobacco, or other organic material, in a bowl, drawing smoke from the heated tobacco, or other organic material, through a pipe and into water in the liquid chamber and then into the user's lungs. This has traditionally offered a smoke, which can be cooler in temperature, smoother in experience, and cleaner than other smoking implements, such as cigarettes and cigars. The water pipes disclosed herein further improve on the traditional hookah pipe in that they can provide users a cooler temperature and smoother smoking experience than a traditional hookah pipe. Disclosed herein are water pipes that provide various mechanisms for achieving these improvements including an increased surface area for smoke to cool, improved, and as yet unknown, purge valves and other inventive advancements not heretofore known.

To elaborate, various new types of water pipes are disclosed herein. In particular, some of these water pipes include a bowl that is pushed into a neck or hole from one direction. Some of these water pipes utilize two part downstem systems that separate to allow for upper and lower sections to create a seal over a hole in a glass dome from two directions. For these embodiments, once the seal is formed by screwing, or otherwise coupling the upper and lower sections to one another, there is a nipple at the top of the downstem to which a silicone bowl can be coupled. This allows for an airtight system, which is ideal for smoking and is an improvement on traditional hookah pipes that rely on a male or female bowl that connects with a stem and allow for smoke to travel from the bowl through the stem and into the base where water is held.

The devices and components described herein also promote improved social and personal smoking experiences by incorporating lighting, music, new smoking aesthetics, and improved storage abilities over traditional hookah pipes.

Other features and advantages of the present invention will become apparent from the following more detailed description, taken in conjunction with the accompanying drawings, which illustrate, by way of example, the principles of the present invention.

BRIEF DESCRIPTION OF THE SEVERAL VIEWS OF THE DRAWING(S)

Illustrated in the accompanying drawing(s) is at least one of the best mode embodiments of the present invention. In such drawing(s):

FIG. 3I shows an example embodiment of a fully assembled domed water pipe.

Figure 5A:
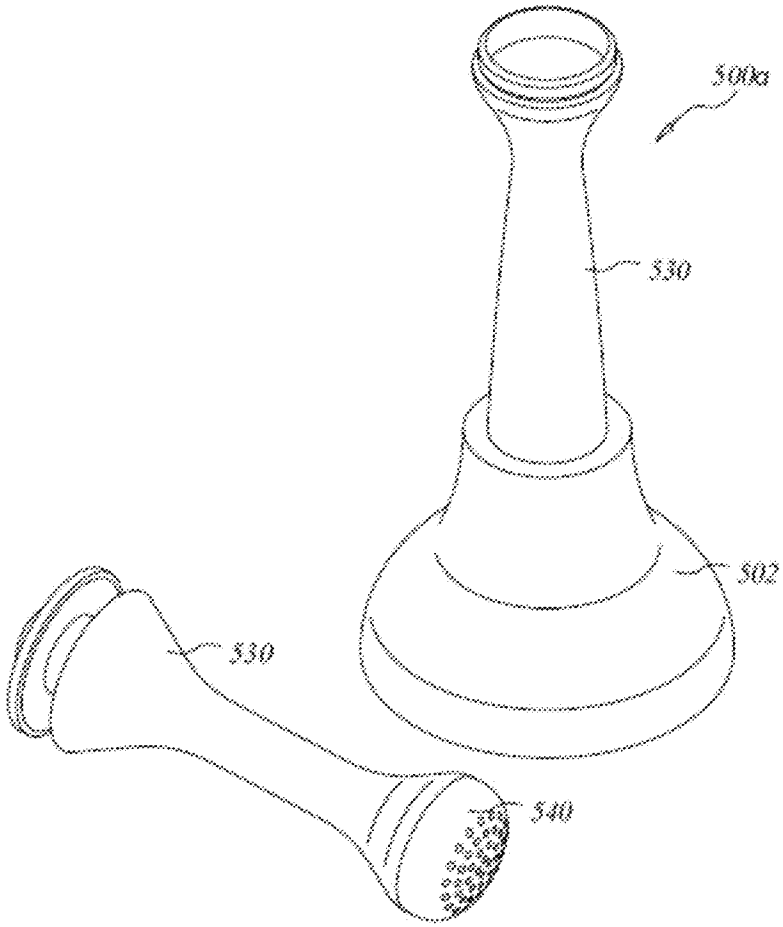
FIG. 5A shows an example embodiments of down stem assemblies attached to a silicone bowl as well as unattached.
Figure 5B:
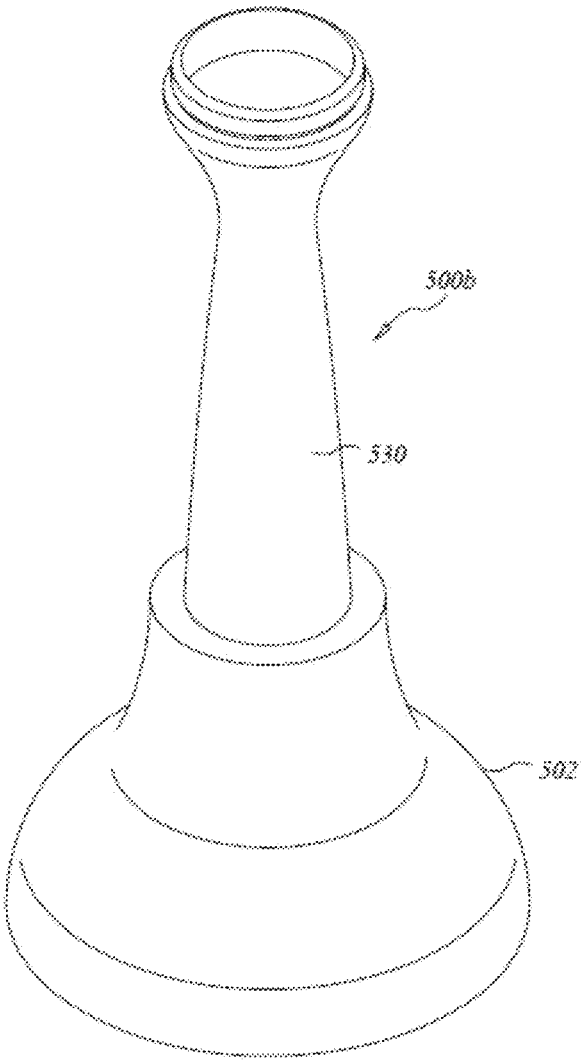
FIG. 5B shows an example embodiment of a down stem assembly attached to a silicone bowl.
Figure 5C:
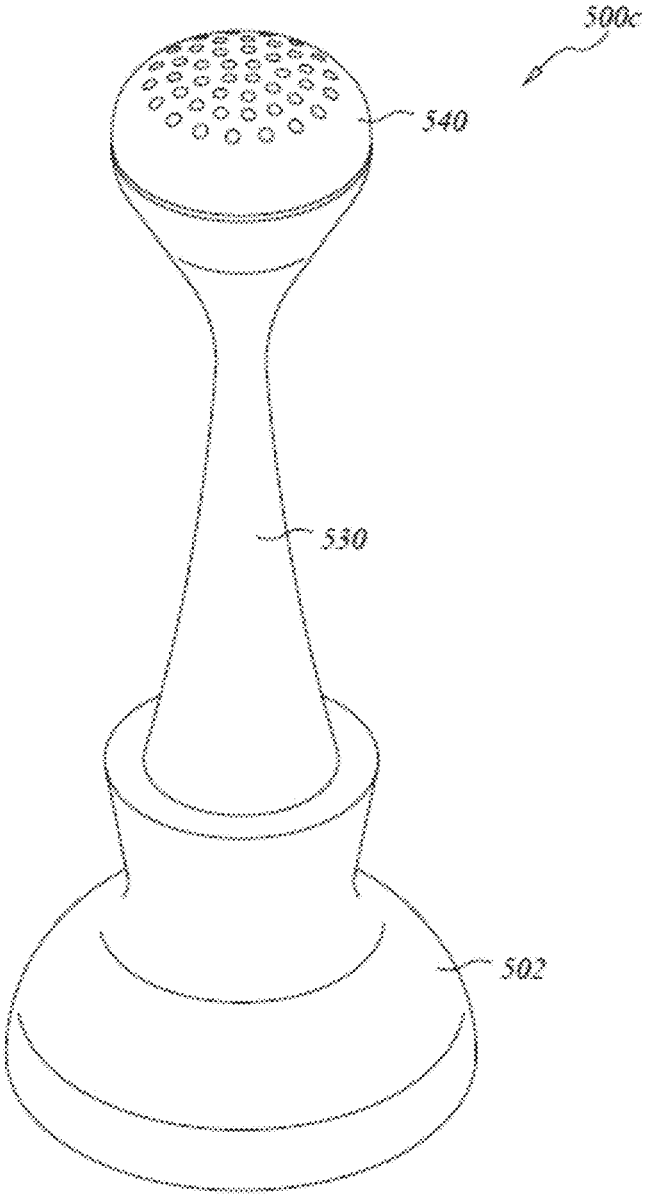
FIG. 5C shows an example embodiment of a down stem assembly coupled with a silicone bowl and a coupled silicone diffuser.
Figure 5D:
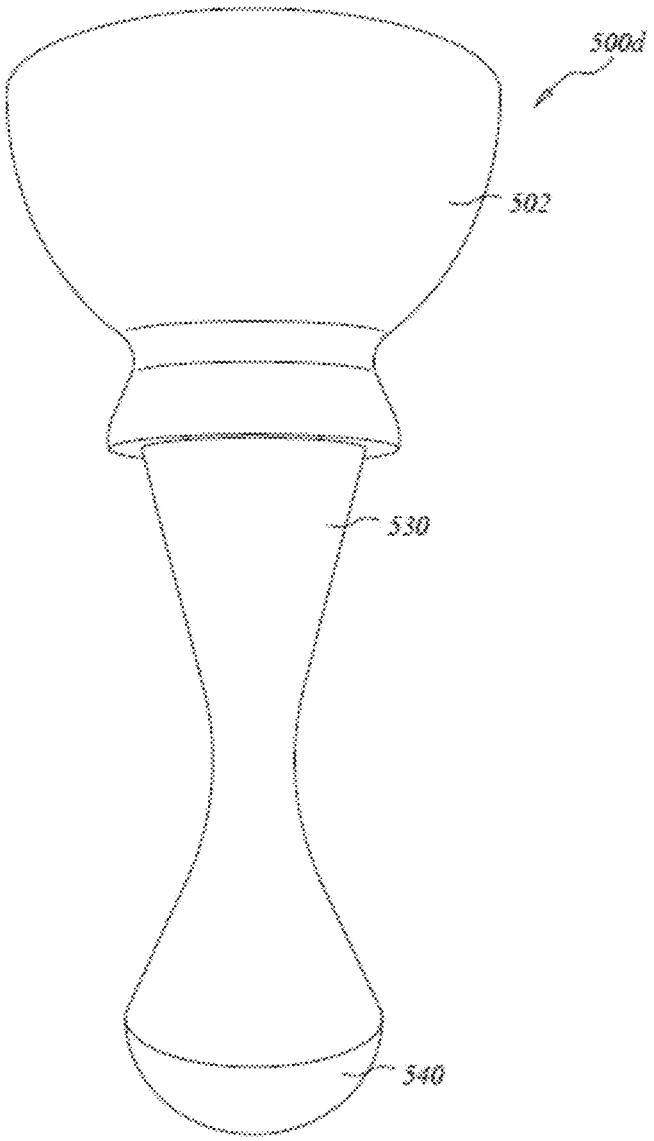
FIG. 5D shows an example embodiment of a down stem assembly coupled with a silicone bowl and a silicone diffuser.
Figure 5E:
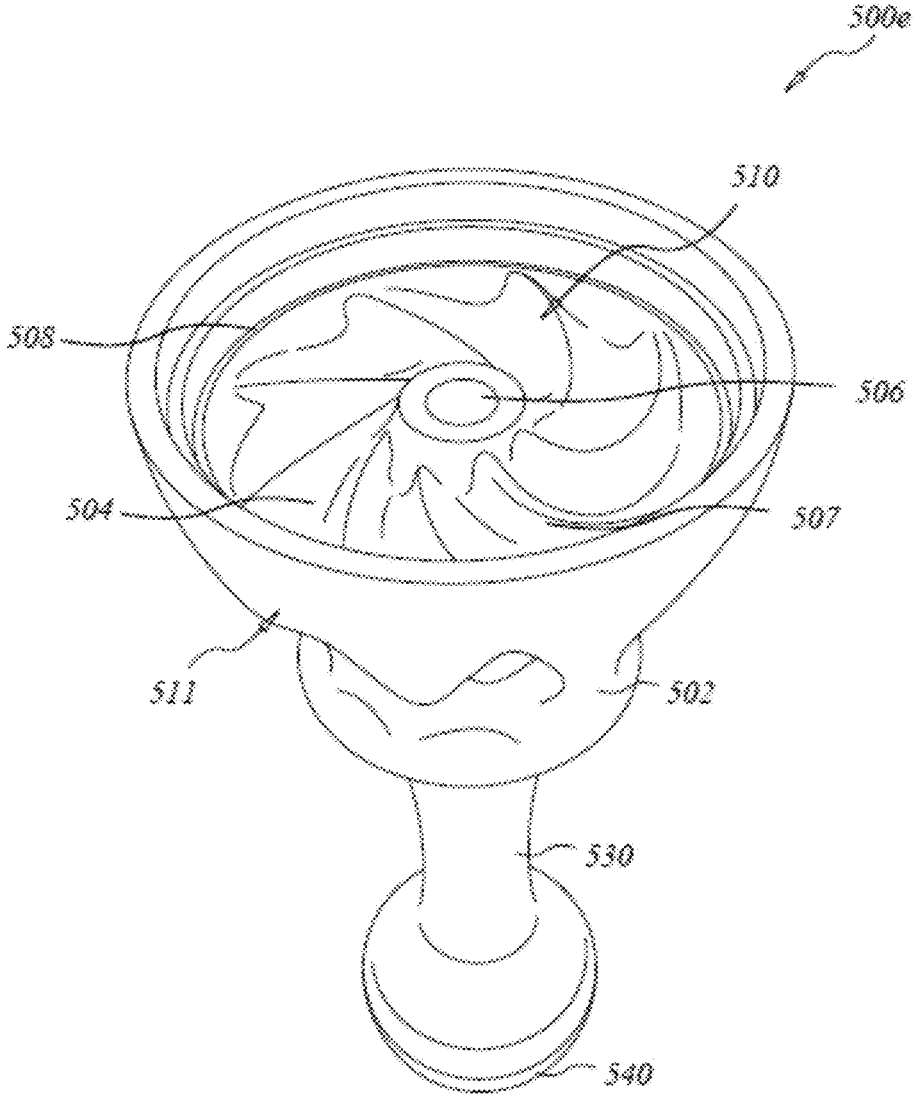
FIG. 5E shows an example embodiment of a down stem assembly attached to a silicone bowl.
Figure 5F:
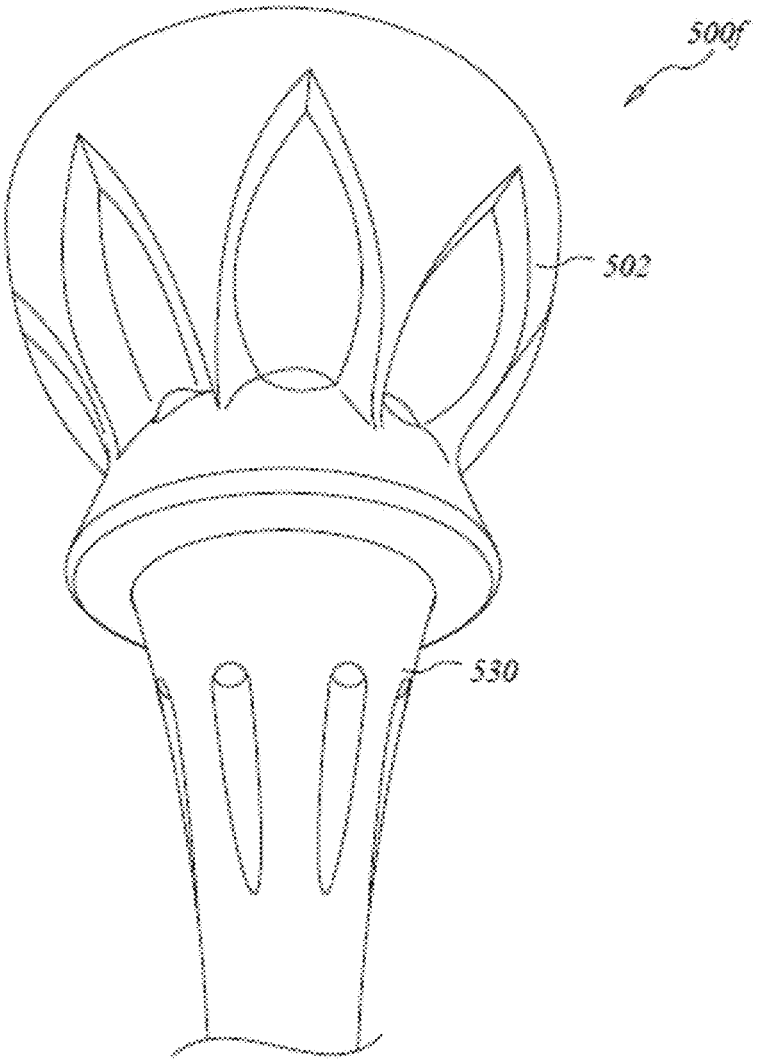
Figure 5G:
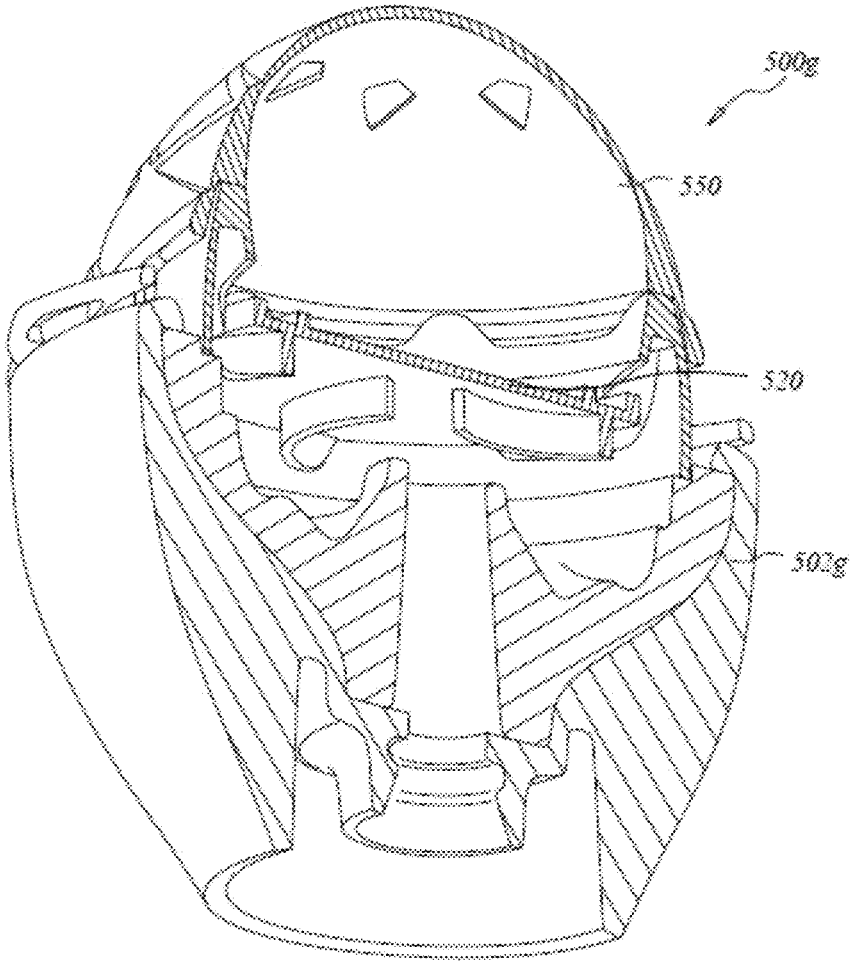
Figure 5H:
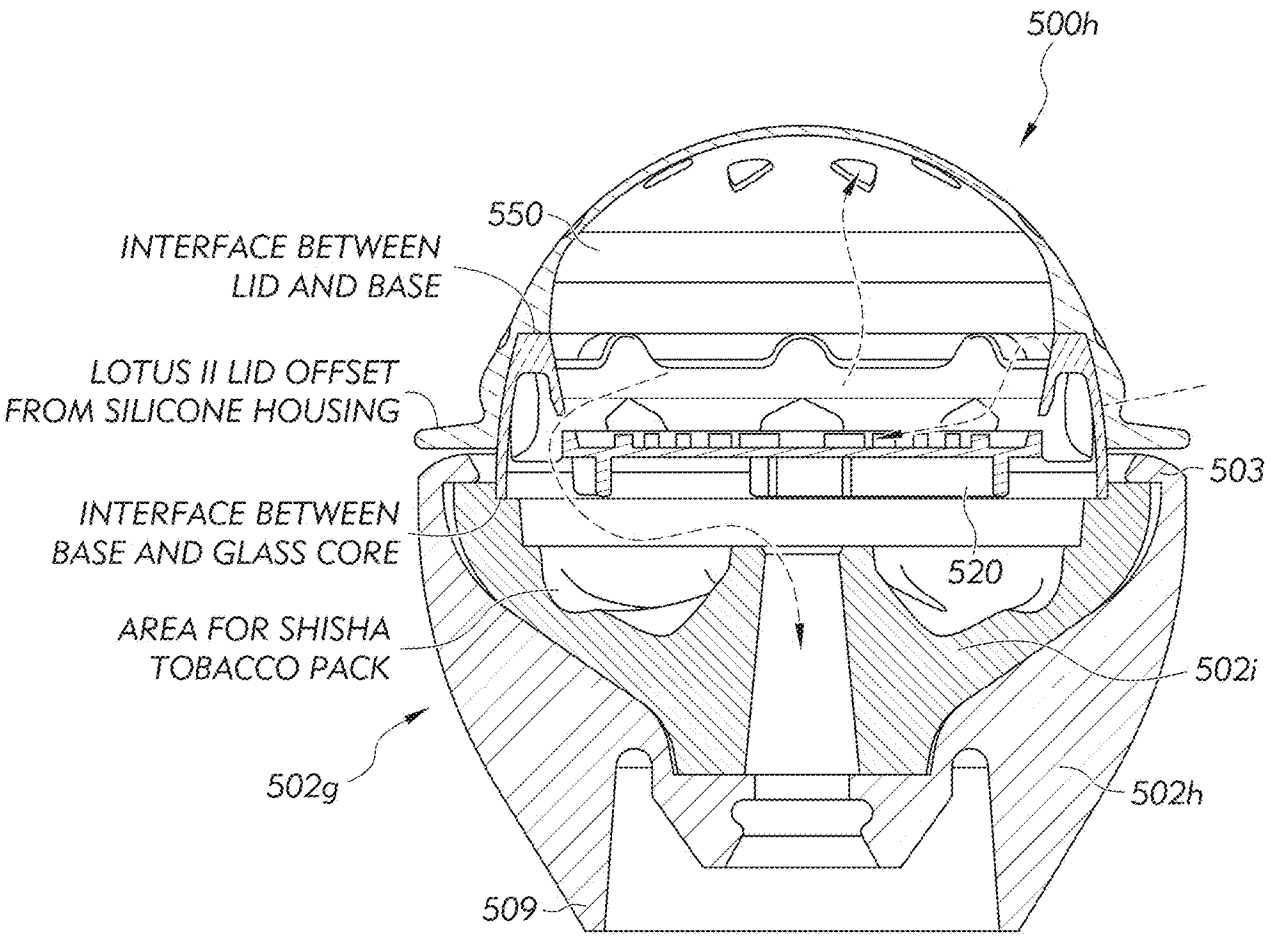

FIG. 5F shows an example embodiment of a down stem assembly attached to a silicone bowl and which has purge channels on a down stem FIG. 5G shows an example embodiment of a side cross-sectional view of a silicone housing, glass bowl, and a metal heat management device FIG. 5H shows an example embodiment of a side cross-sectional view of a silicone housing, glass bowl, and a metal heat management device with airflow.

Figure 5I:
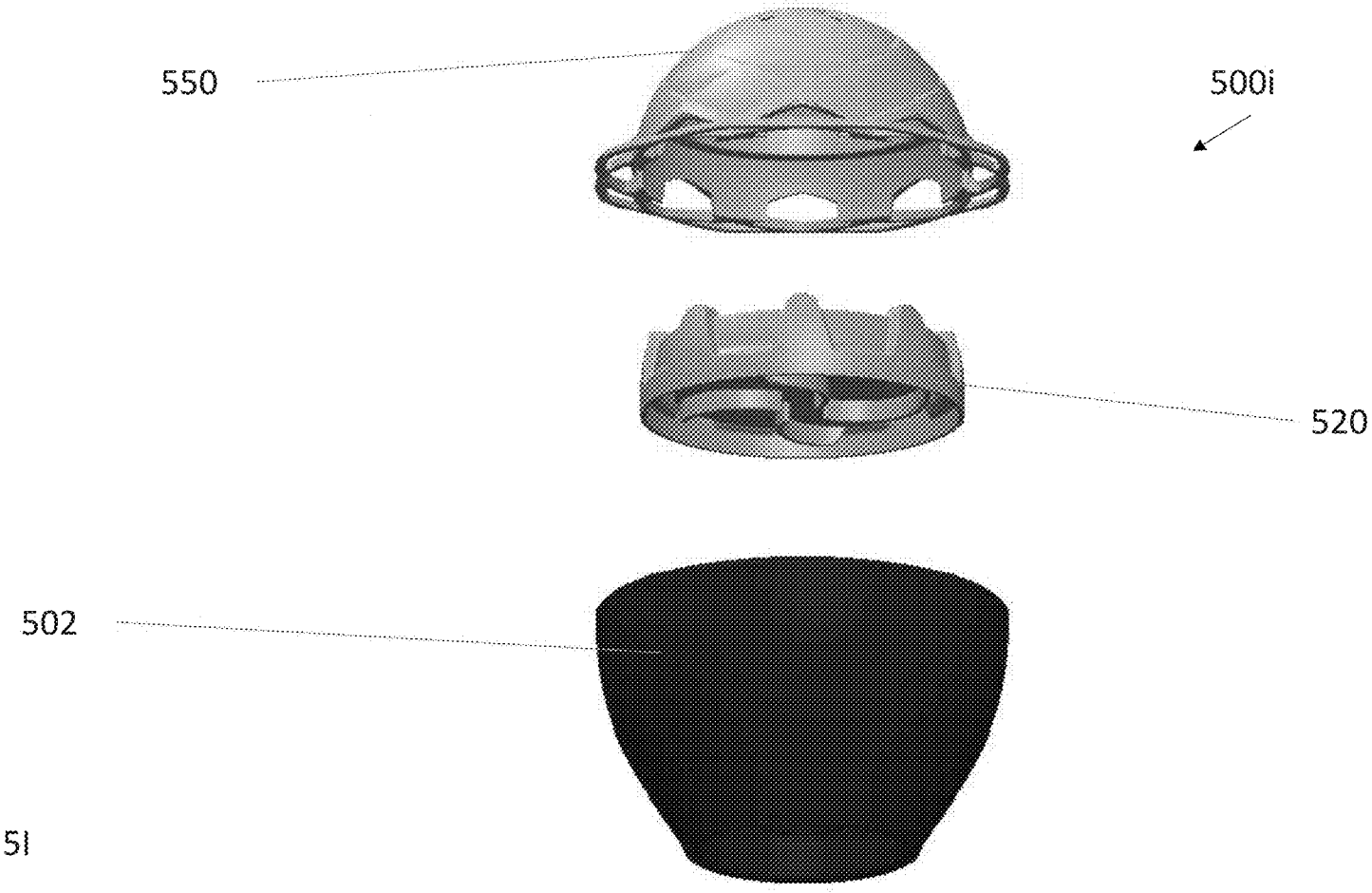

FIG. 5I shows an example embodiment of an exploded view of the silicone housing and a metal heat management device.

Figure 5J:
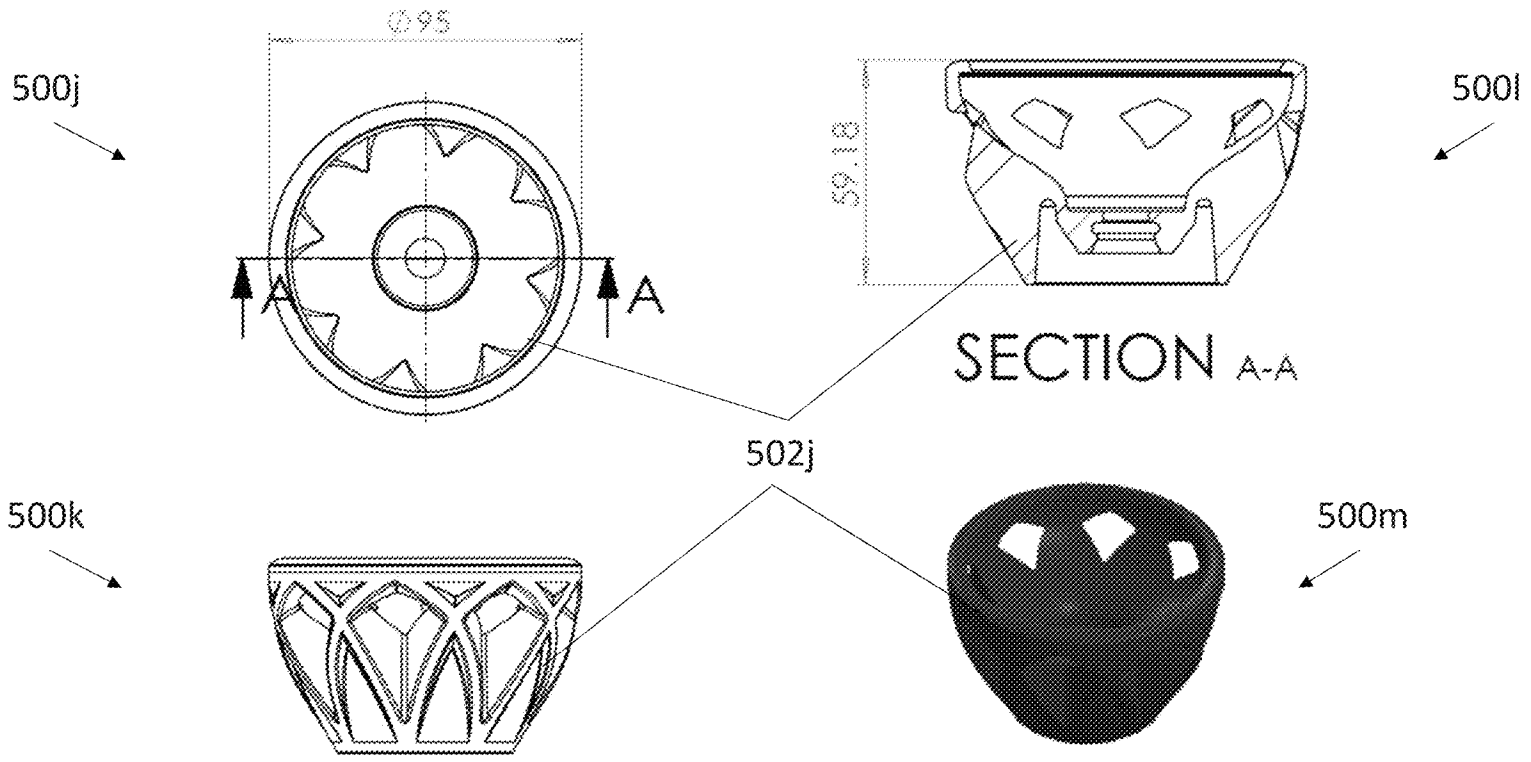

FIG. 5J shows an example embodiment of a silicone bowl housing.

Figure 5K:
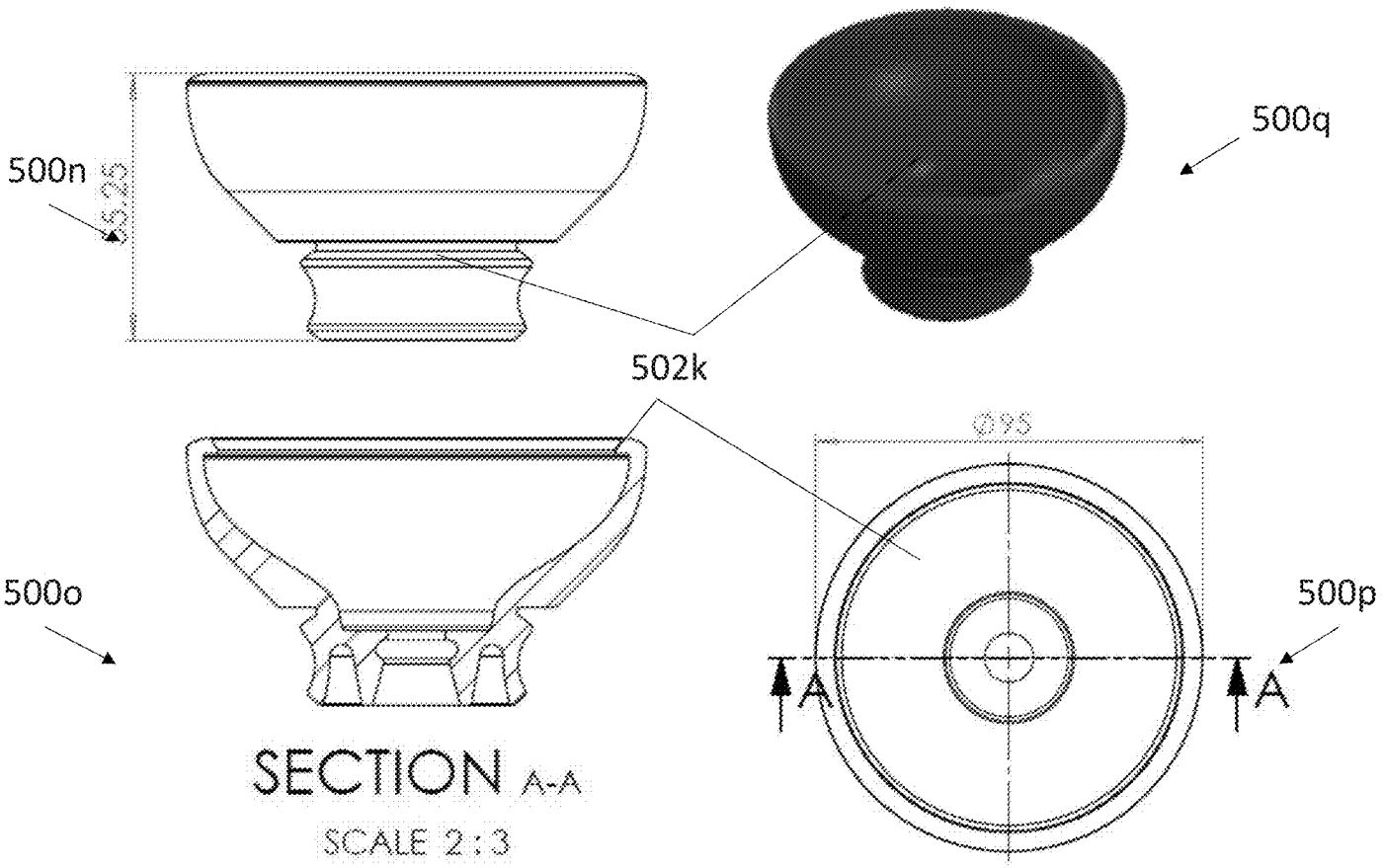

FIG. 5K shows an example embodiment of a silicone bowl housing.

Figure 5L:
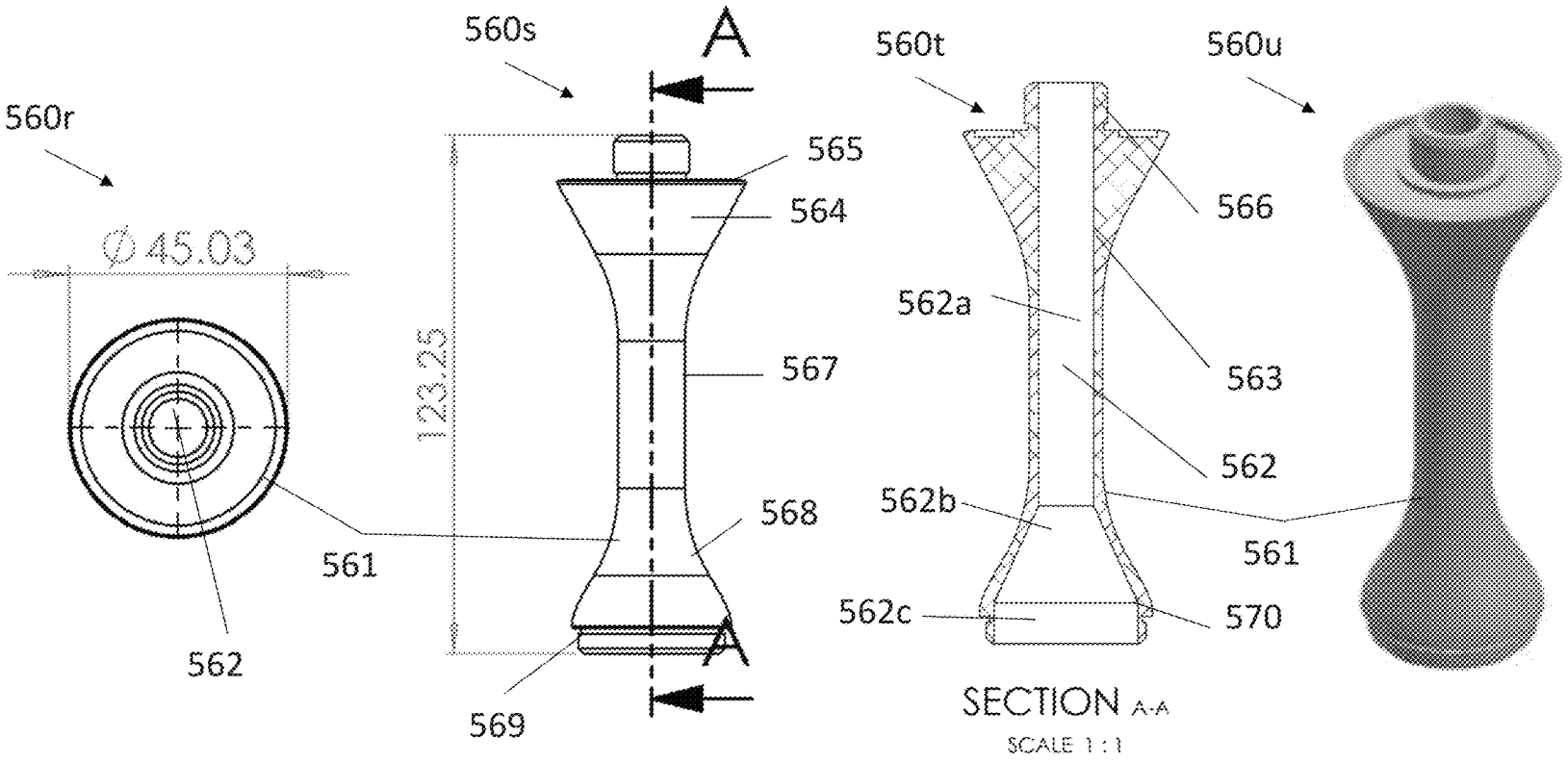

FIG. 5L shows an example embodiment of a down stem.

Figure 5M:
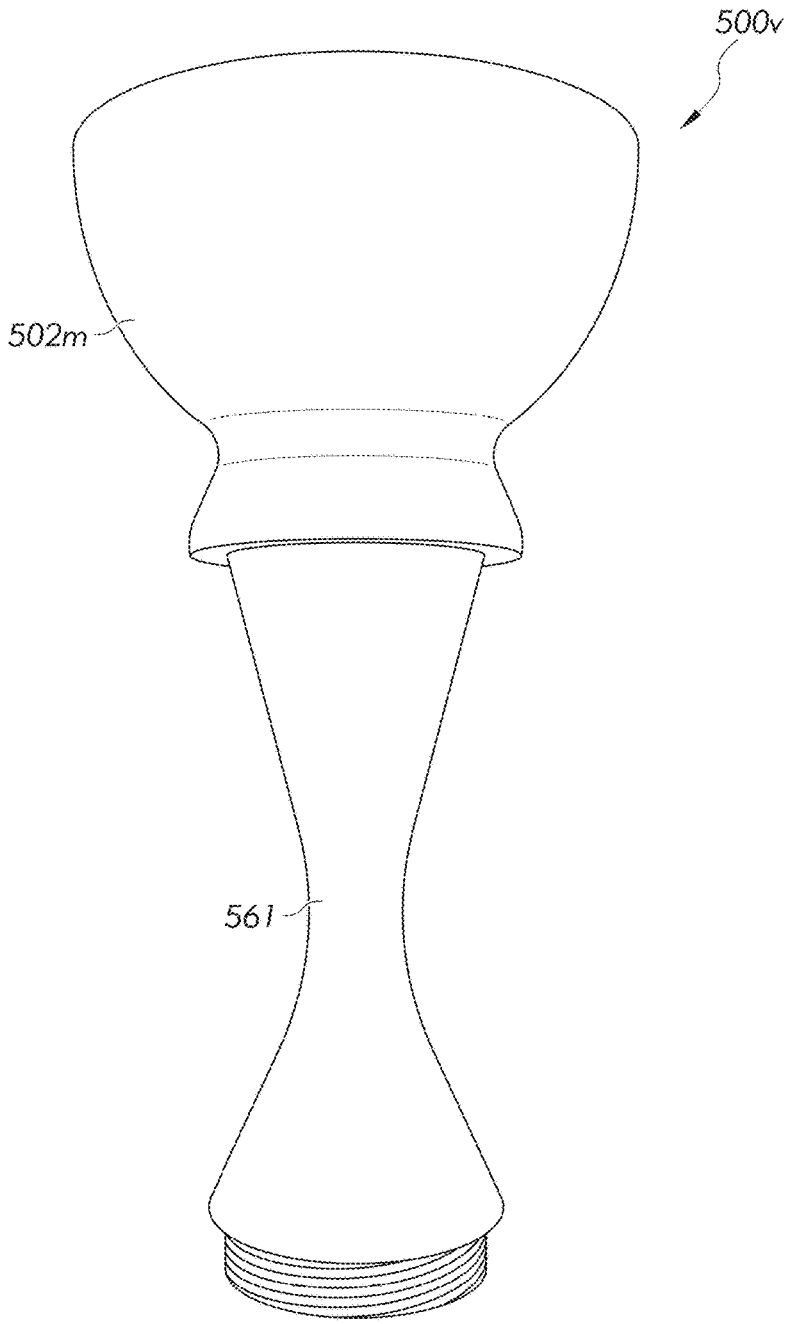
Figure 5N:
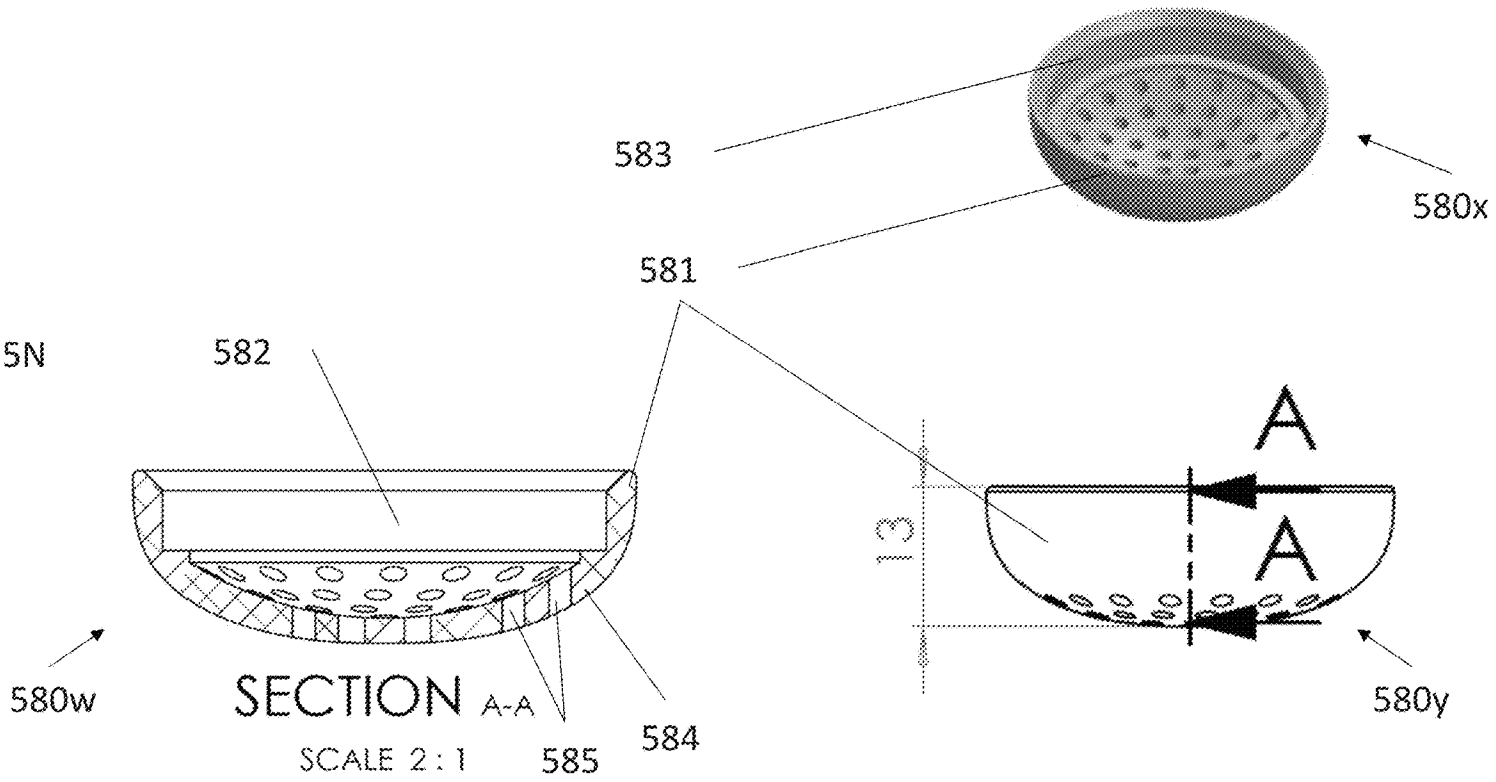

FIG. 5N shows an example embodiment of a diffuser.

Figure 5O:
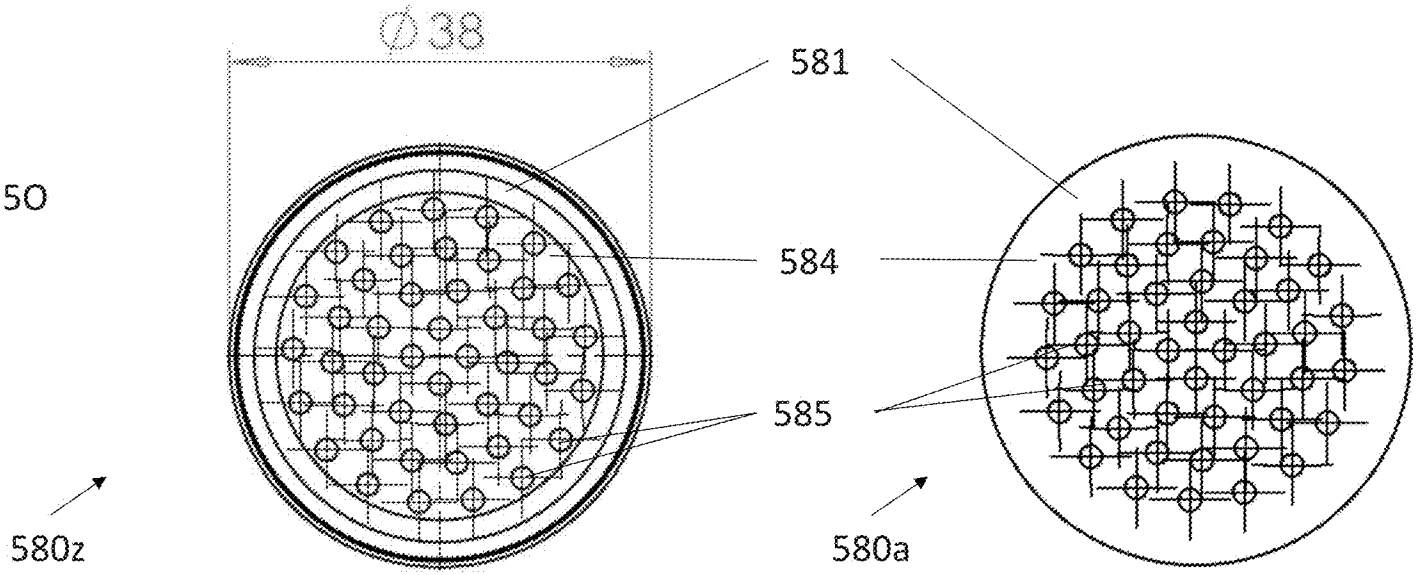

FIG. 5O shows an example embodiment of a diffuser from top and bottom views.

FIG. 5M shows an example embodiment of an assembled bowl with a down stem attached.

Figure 6A:
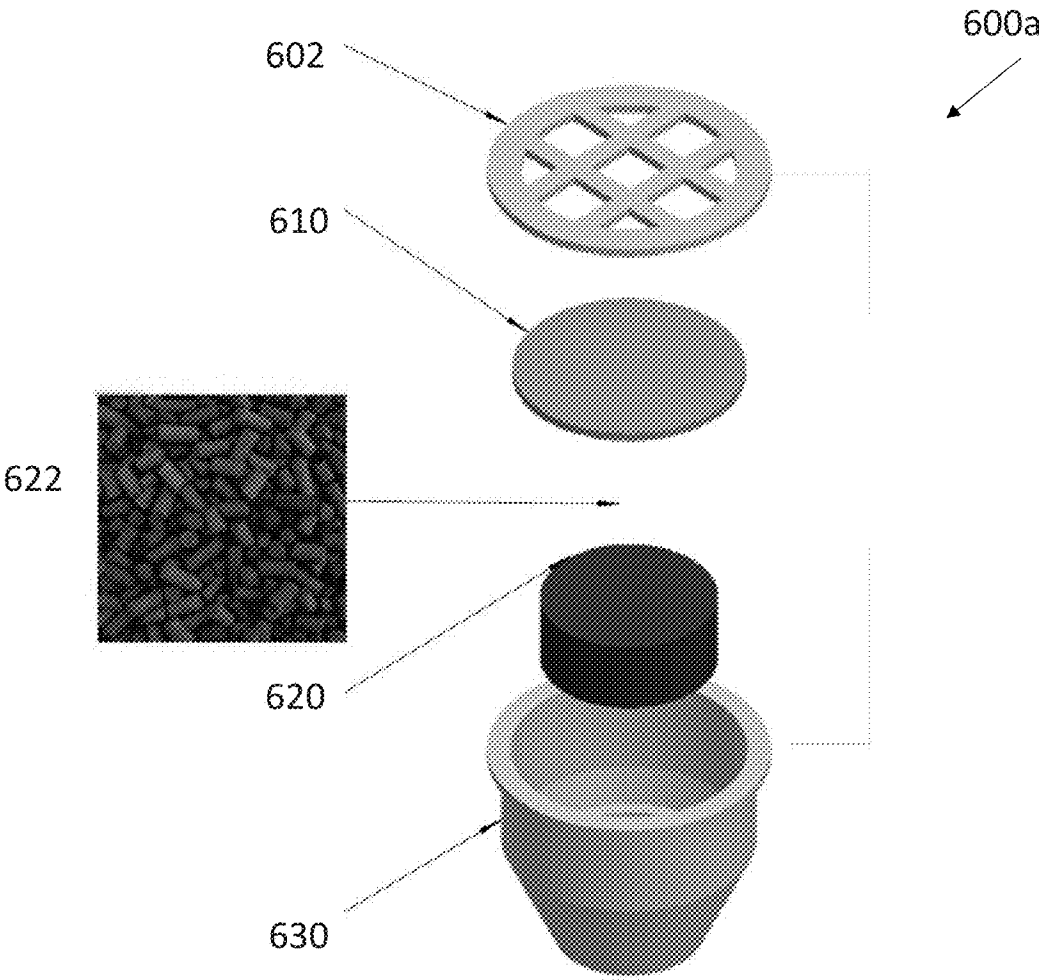

FIG. 6A shows an example embodiment of an exploded view of a carbon filter assembly exploded view.

Figure 6B:
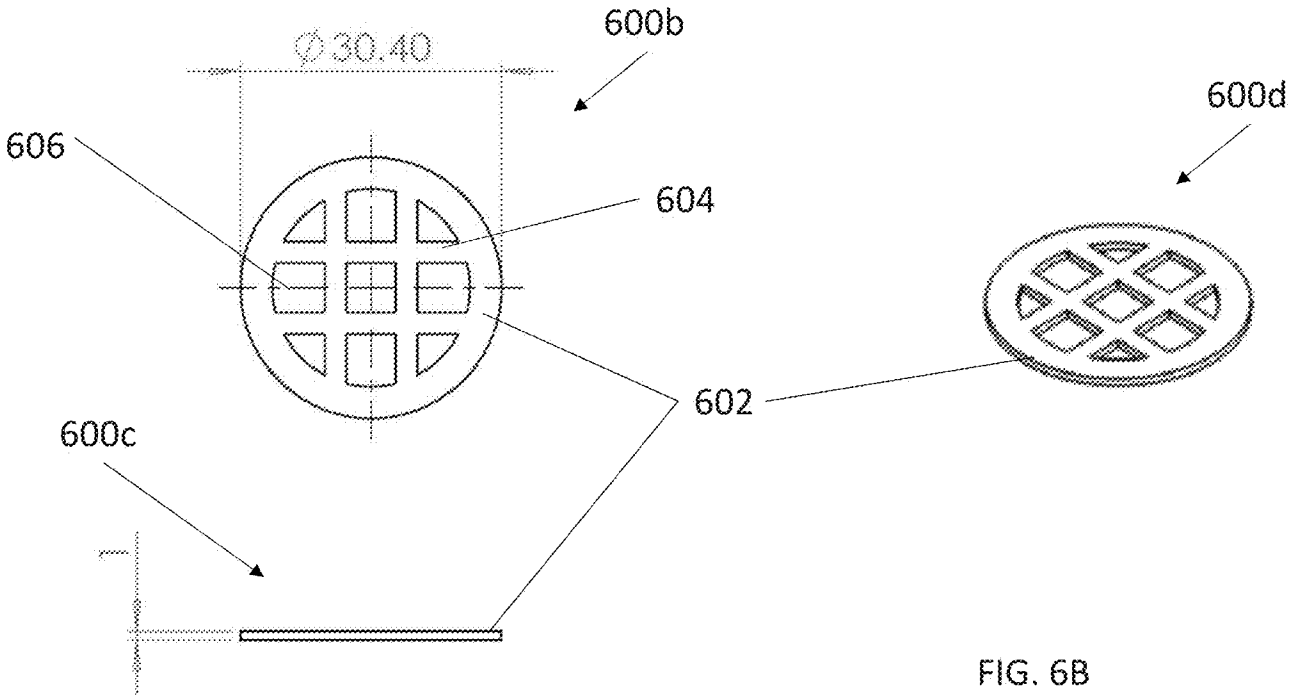

FIG. 6B shows an example embodiment the top of a carbon filter.

Figure 6C:
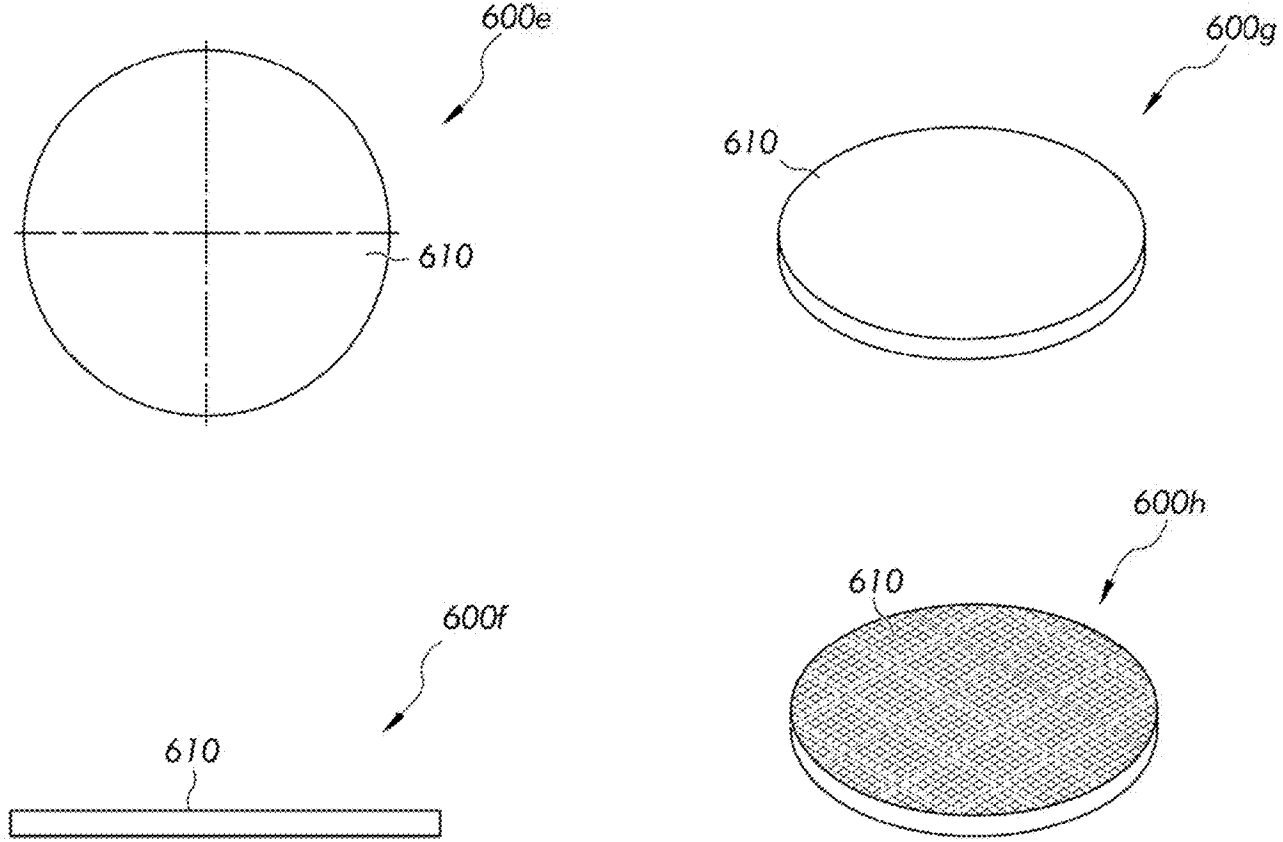

FIG. 6C shows an example embodiment of a mesh for the carbon filter.

Figure 6D:
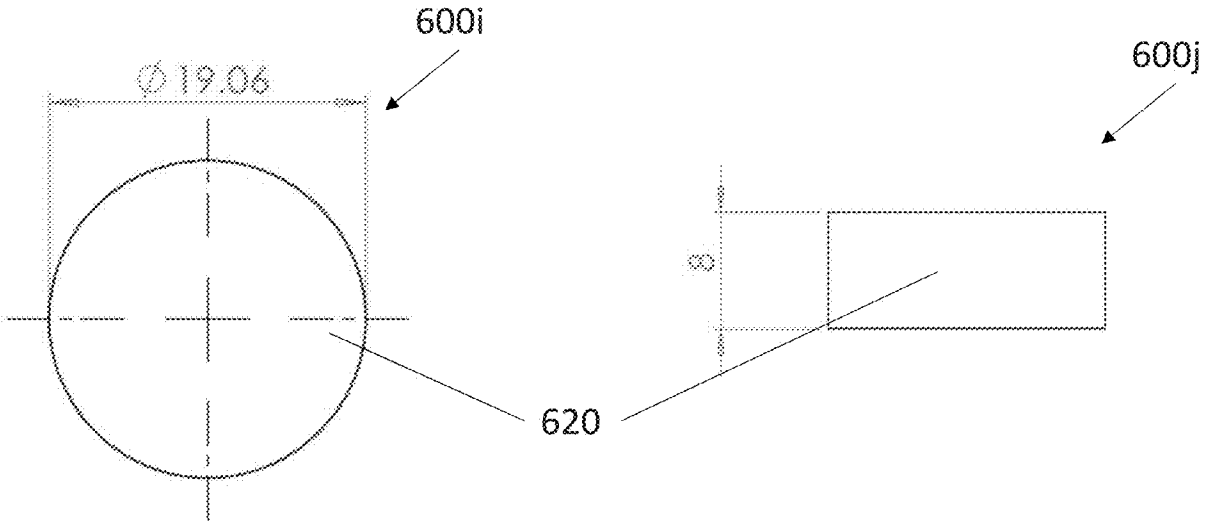

FIG. 6D shows an example embodiment of a carbon sponge for the carbon filter.

Figure 6E:
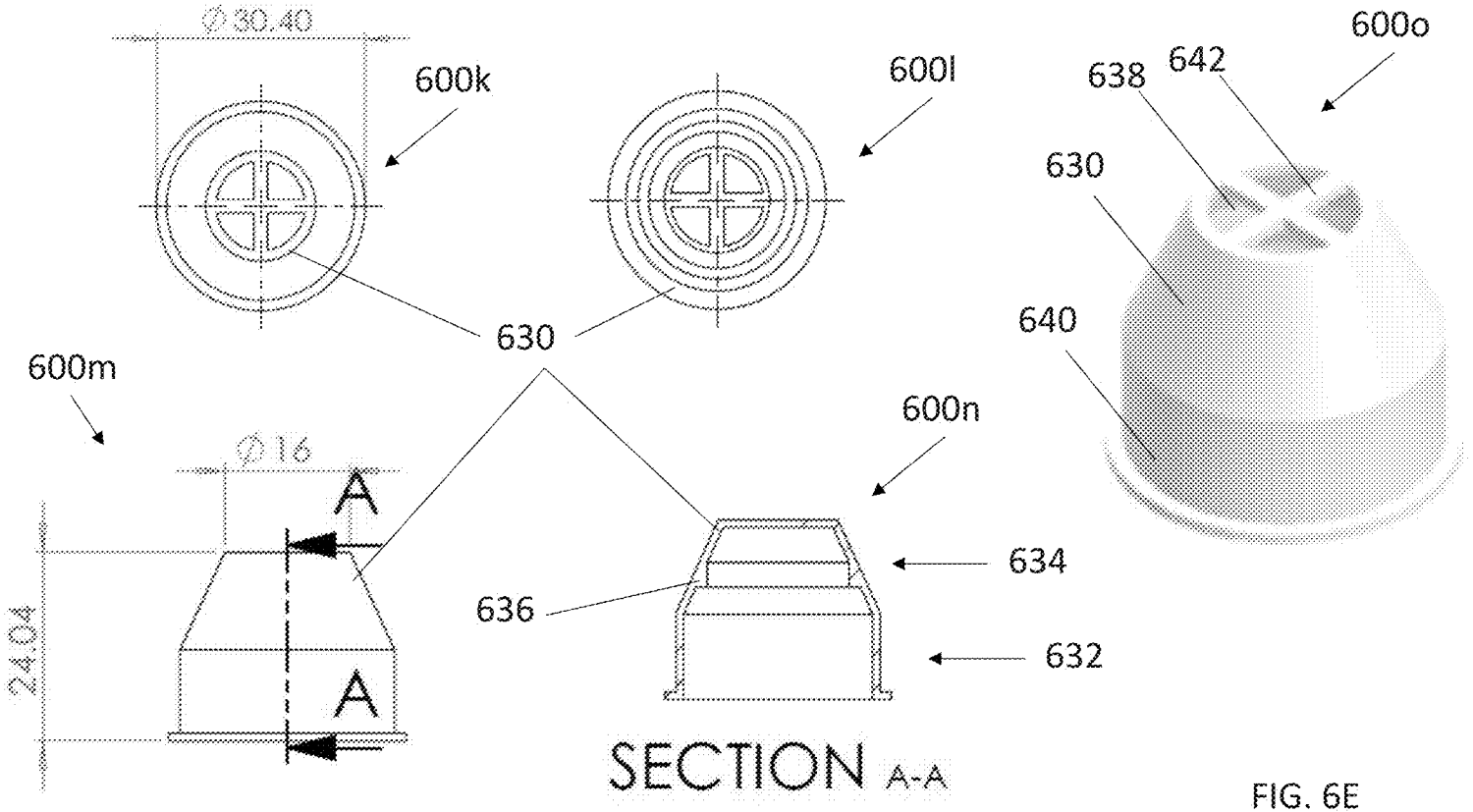

FIG. 6E shows an example embodiment of a carbon filter body.

Figure 7A:
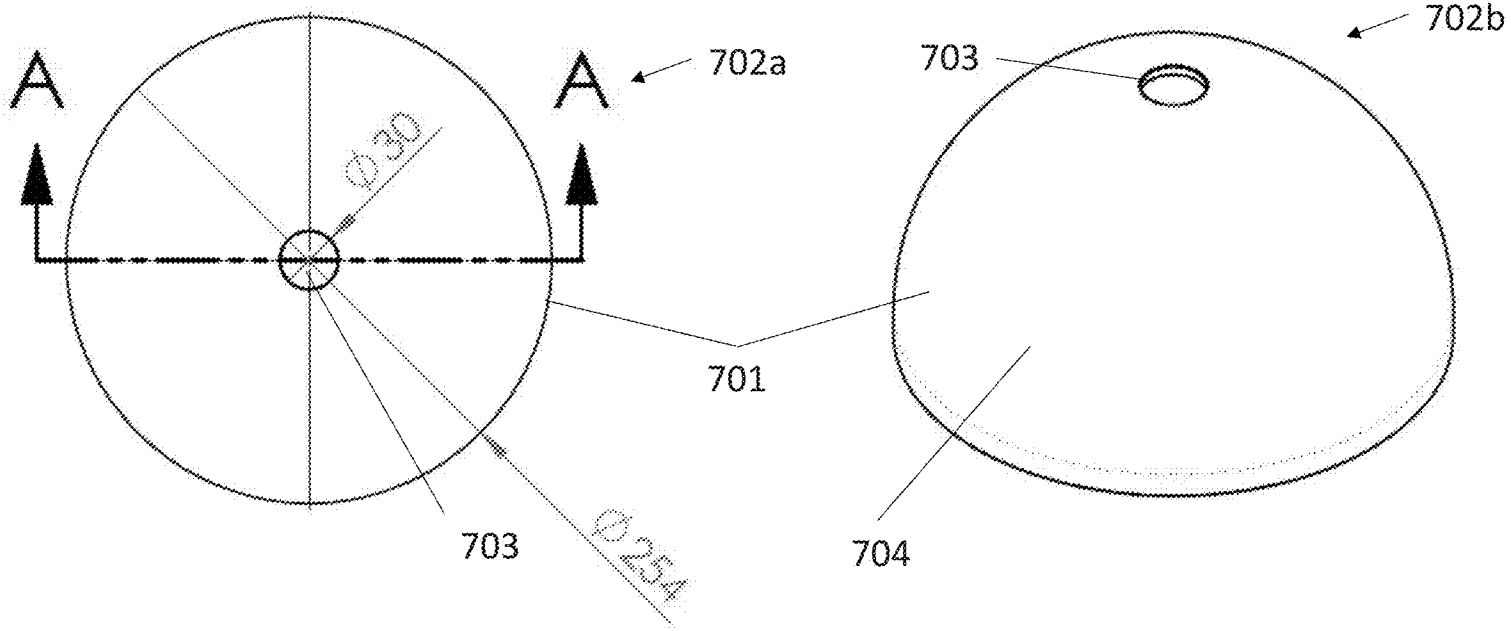

FIG. 7A shows an example embodiment of an outer vessel top view diagram and isometric view diagram.

Figure 7B:
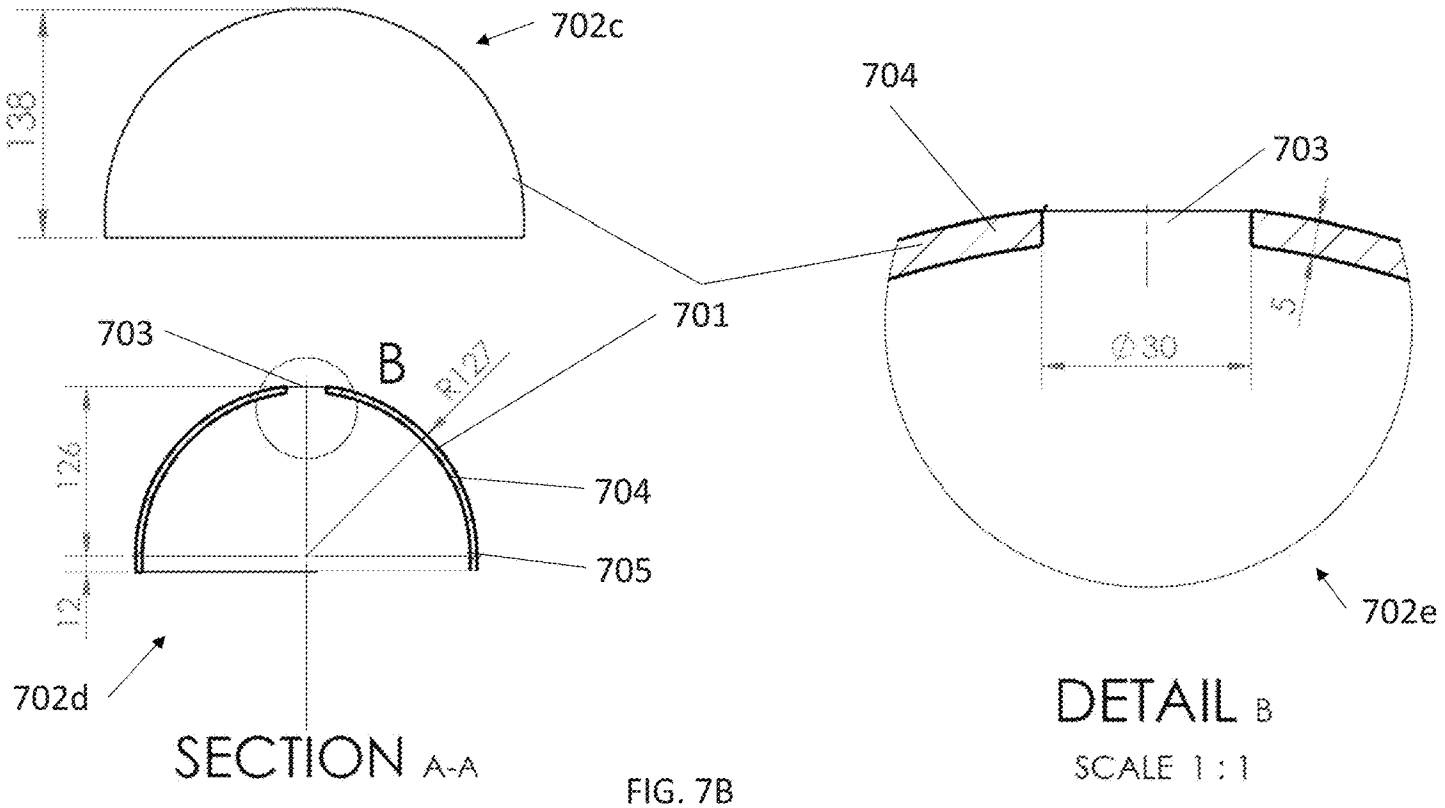

FIG. 7B shows an example embodiment of an outer vessel side view diagram, side cross-sectional diagram and side cross-sectional detail diagram.

Figure 7C:
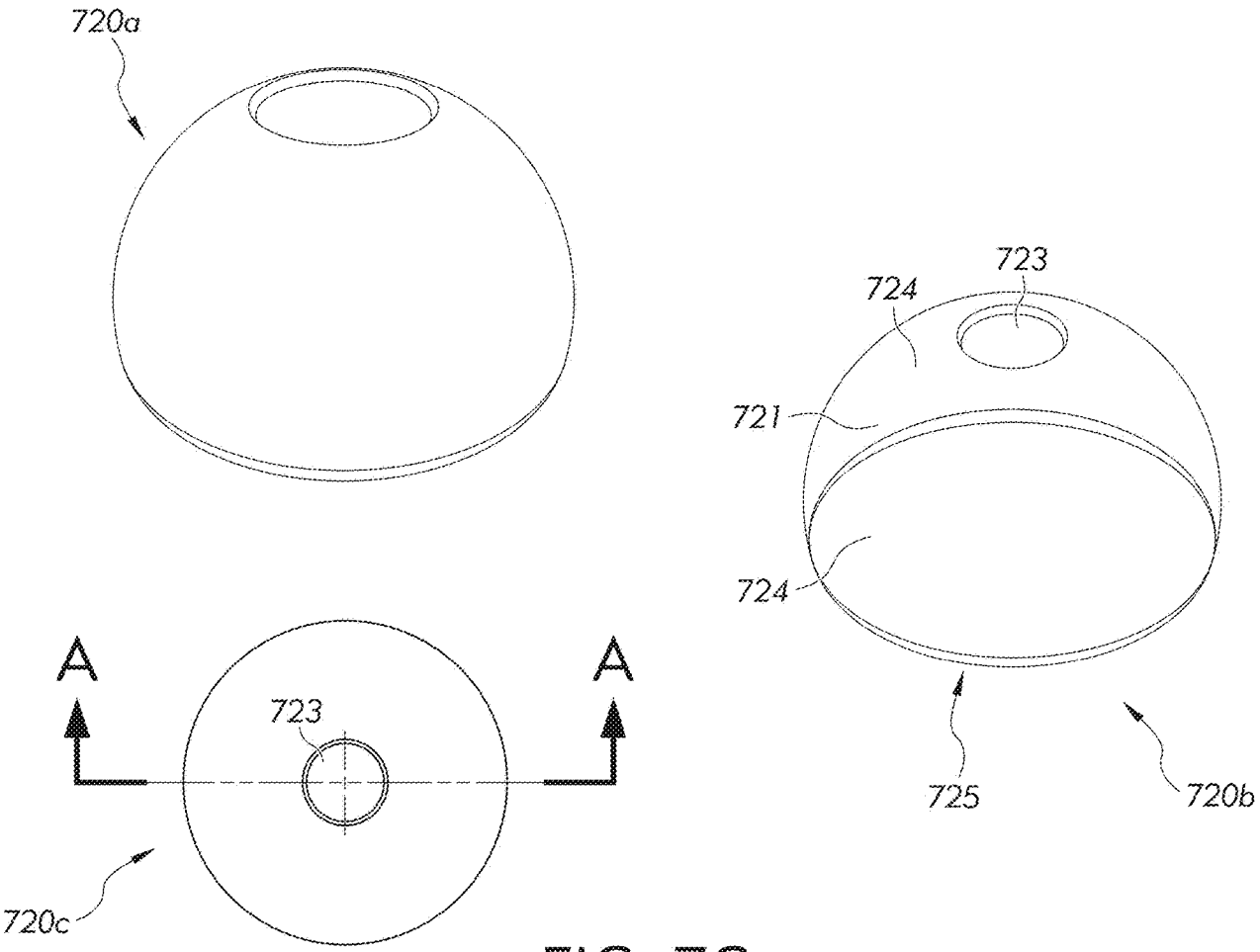

FIG. 7C shows an example embodiment of an inner vessel an inner vessel picture, mockup and top view diagram.

Figure 7D:
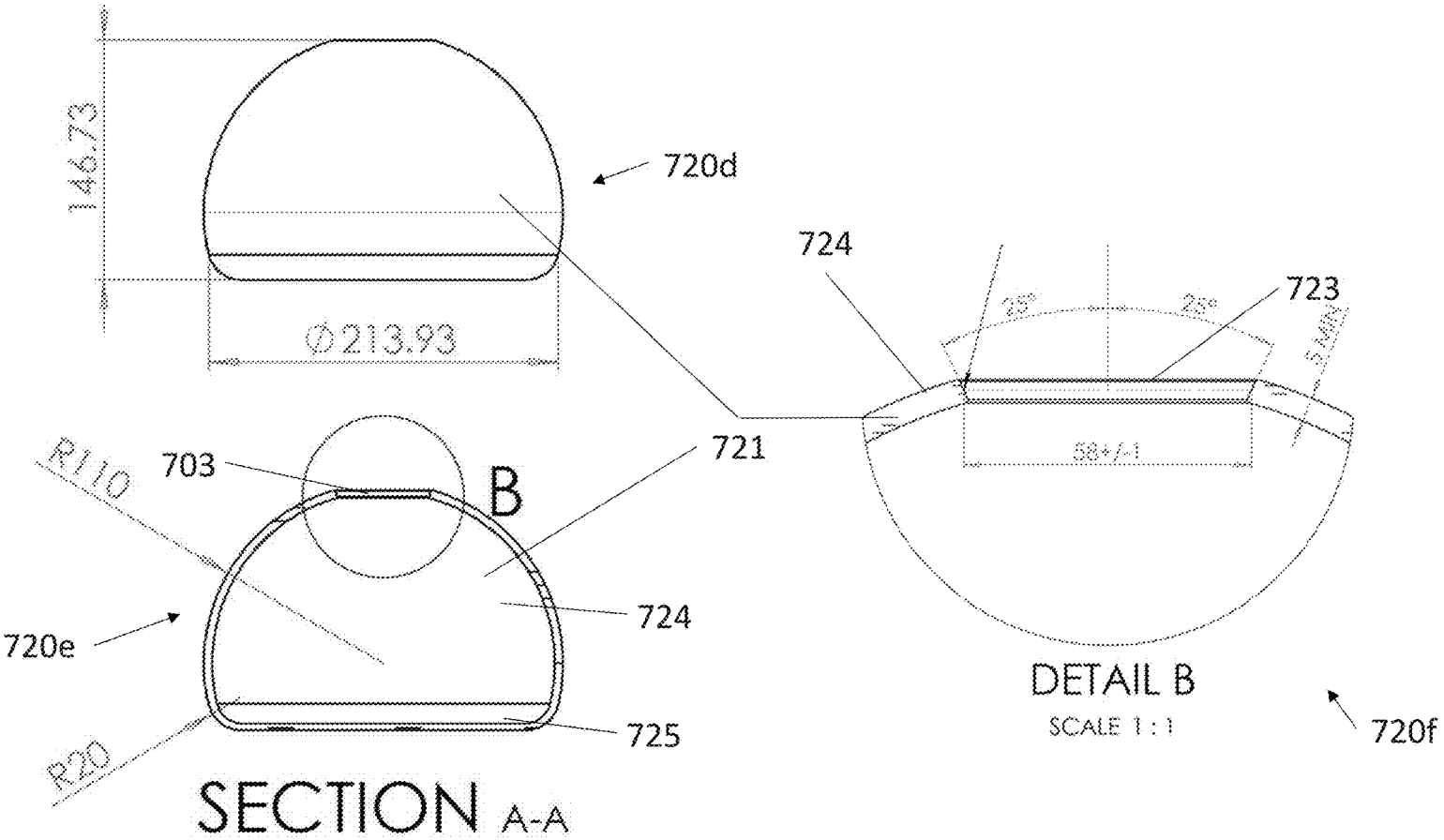

FIG. 7D shows an example embodiment of an inner vessel side view diagram, side cross-sectional diagram and side cross-sectional detail diagram.

Figure 7E:
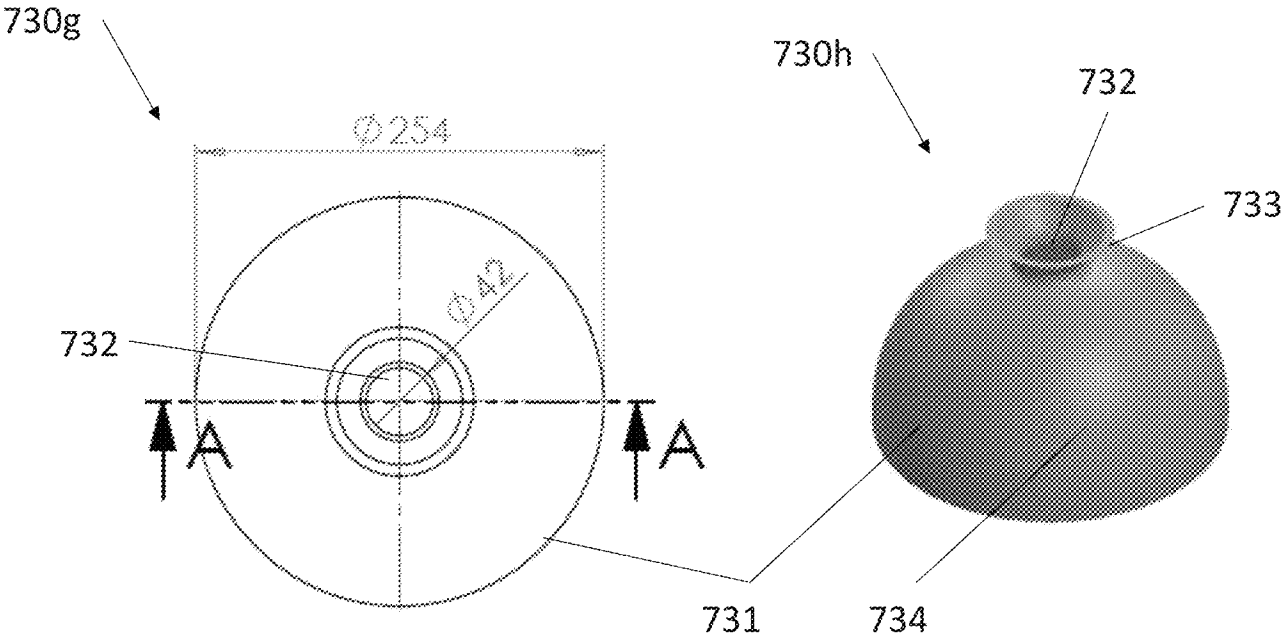

FIG. 7E shows an example embodiment of an outer vessel top view diagram and isometric view diagram.

Figure 7F:
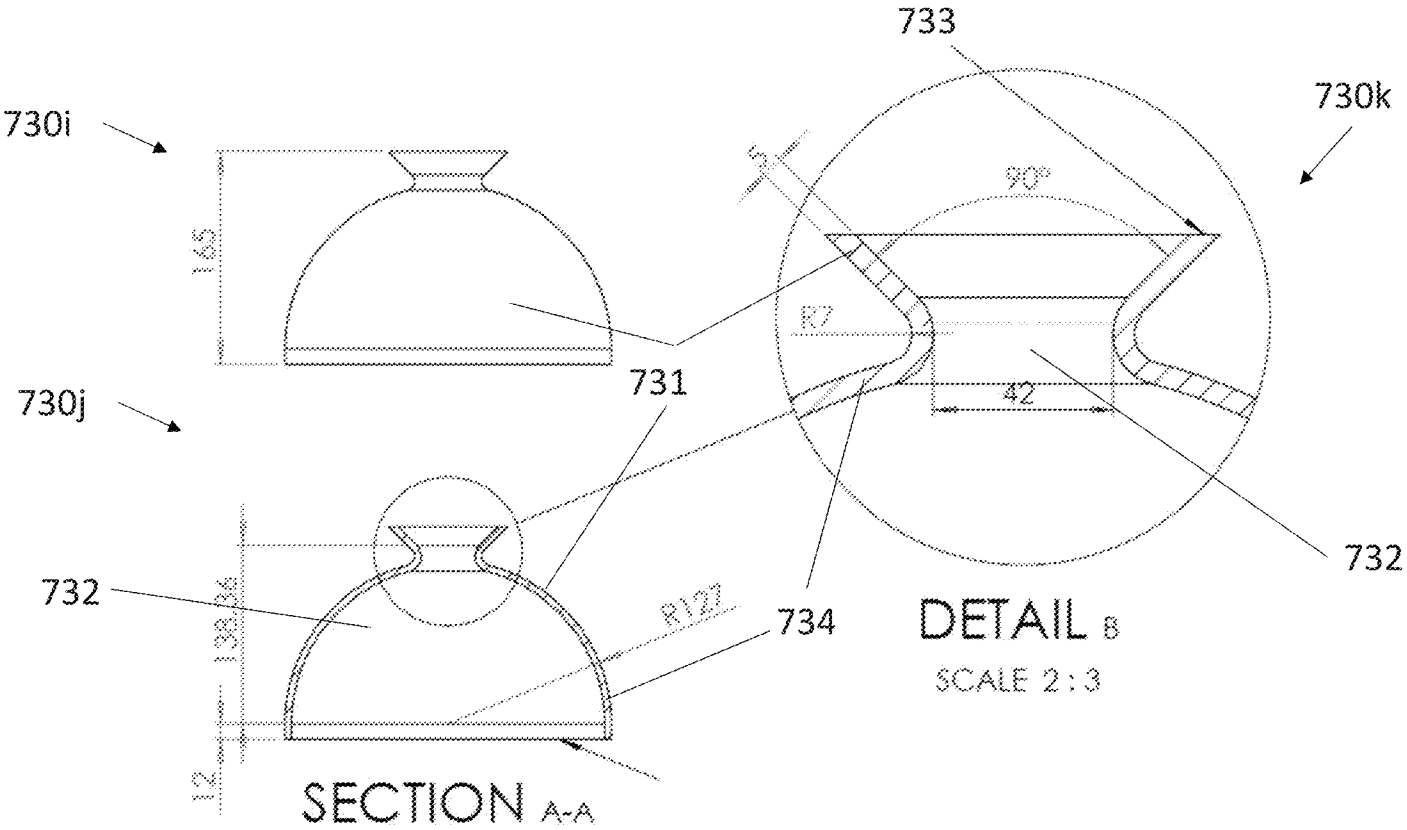

FIG. 7F shows an example embodiment of an outer vessel side view diagram, side cross-sectional diagram and side cross-sectional detail diagram.

Figure 7G:
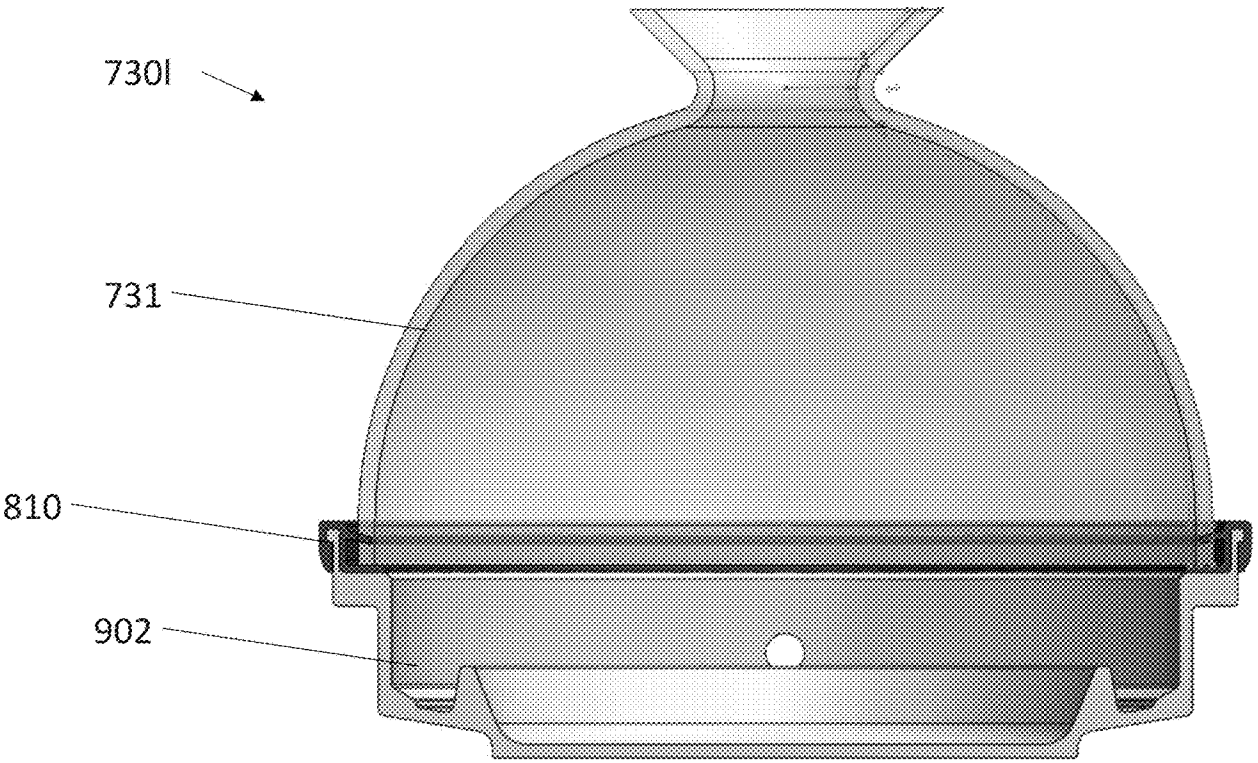

FIG. 7G shows an example embodiment of an outer vessel side view diagram, side cross-sectional diagram and side cross-sectional detail diagram as it sits on a manifold.

Figure 7H:
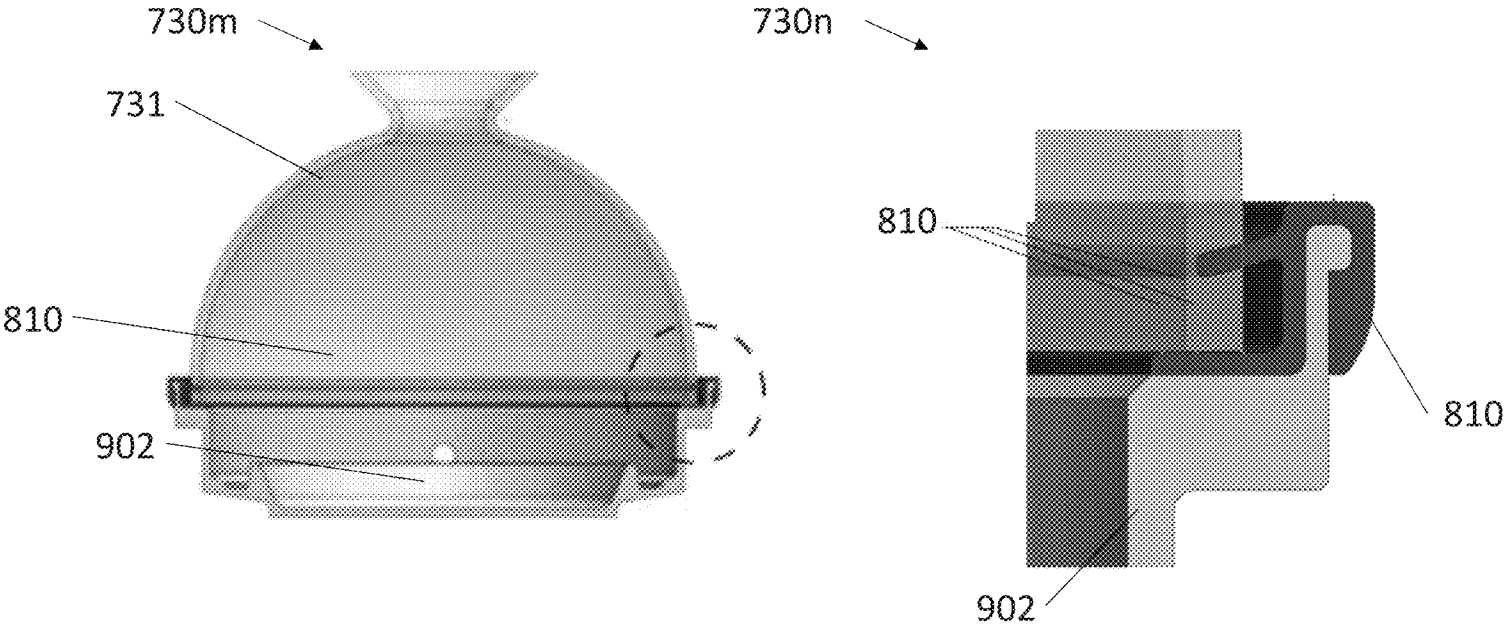

FIG. 7H shows an example embodiment of an outer vessel side view diagram, side cross-sectional diagram and side cross-sectional detail diagram as it sits on a manifold with a close-up of a silicone seal and outer vessel interface.

Figure 7I:
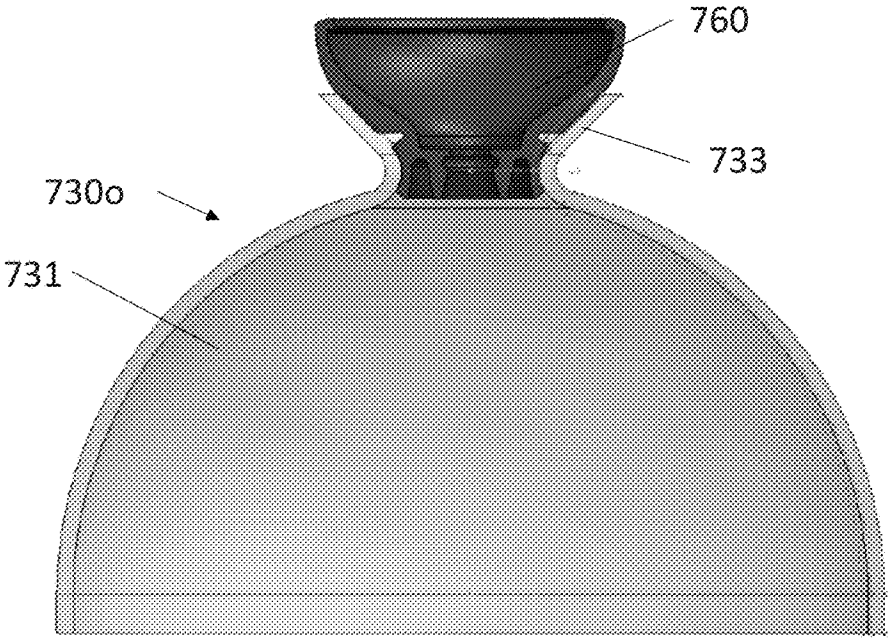

FIG. 7I shows an example embodiment of an outer vessel side view diagram, side cross-sectional diagram and side cross-sectional detail diagram with a silicone housing inserted in a top opening of the outer vessel.

Figure 7J:
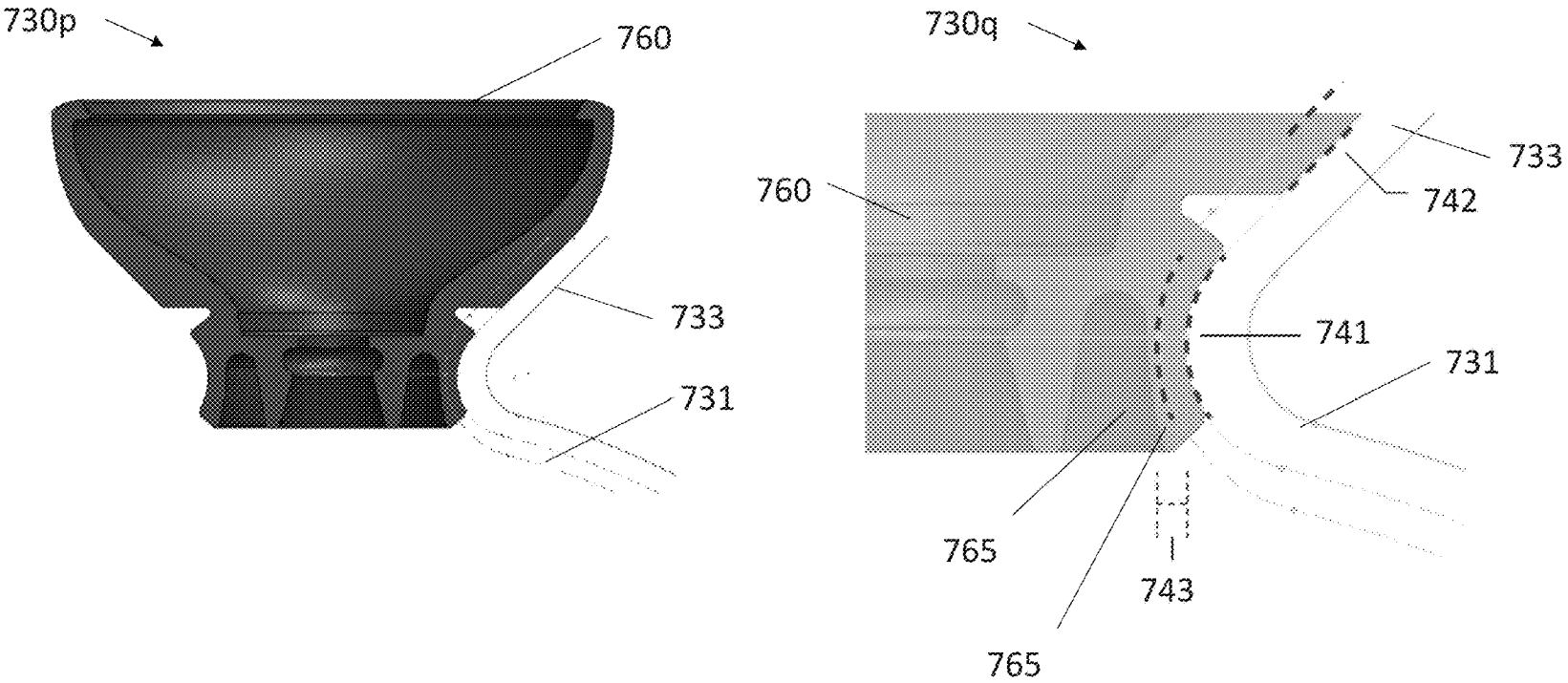

FIG. 7J shows an example embodiment of a silicone housing side view diagram, side cross-sectional diagram and side cross-sectional detail diagram of a silicone and glass interface.

Figure 8A:
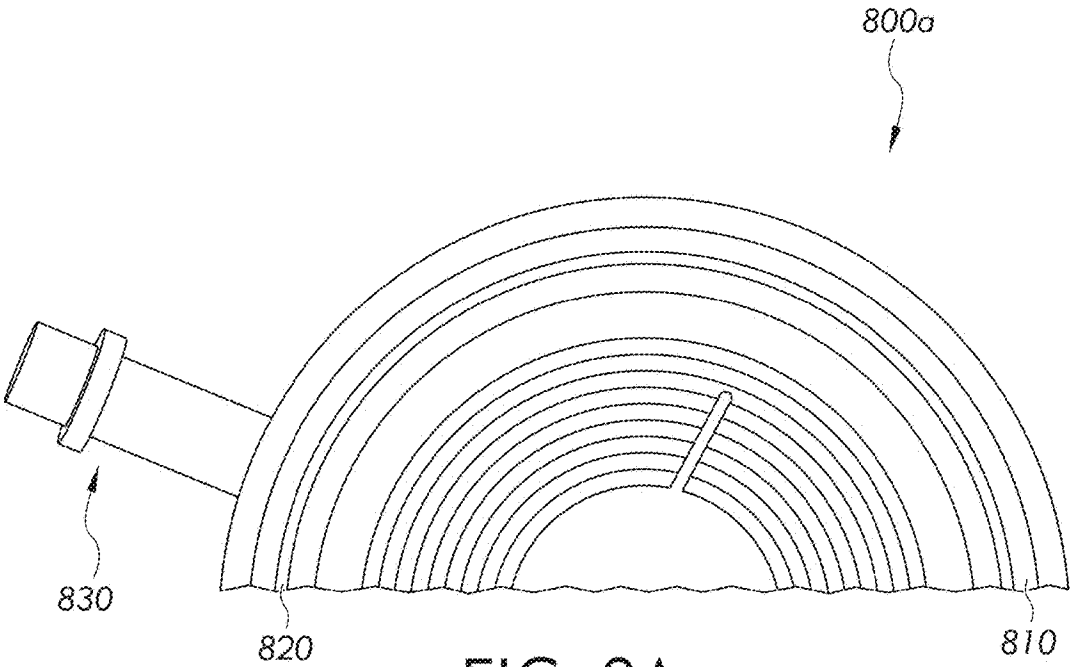

FIG. 8A shows an example image of a purge valve assembly coupled with a manifold, and manifold coupled with a main seal.

Figure 8B:
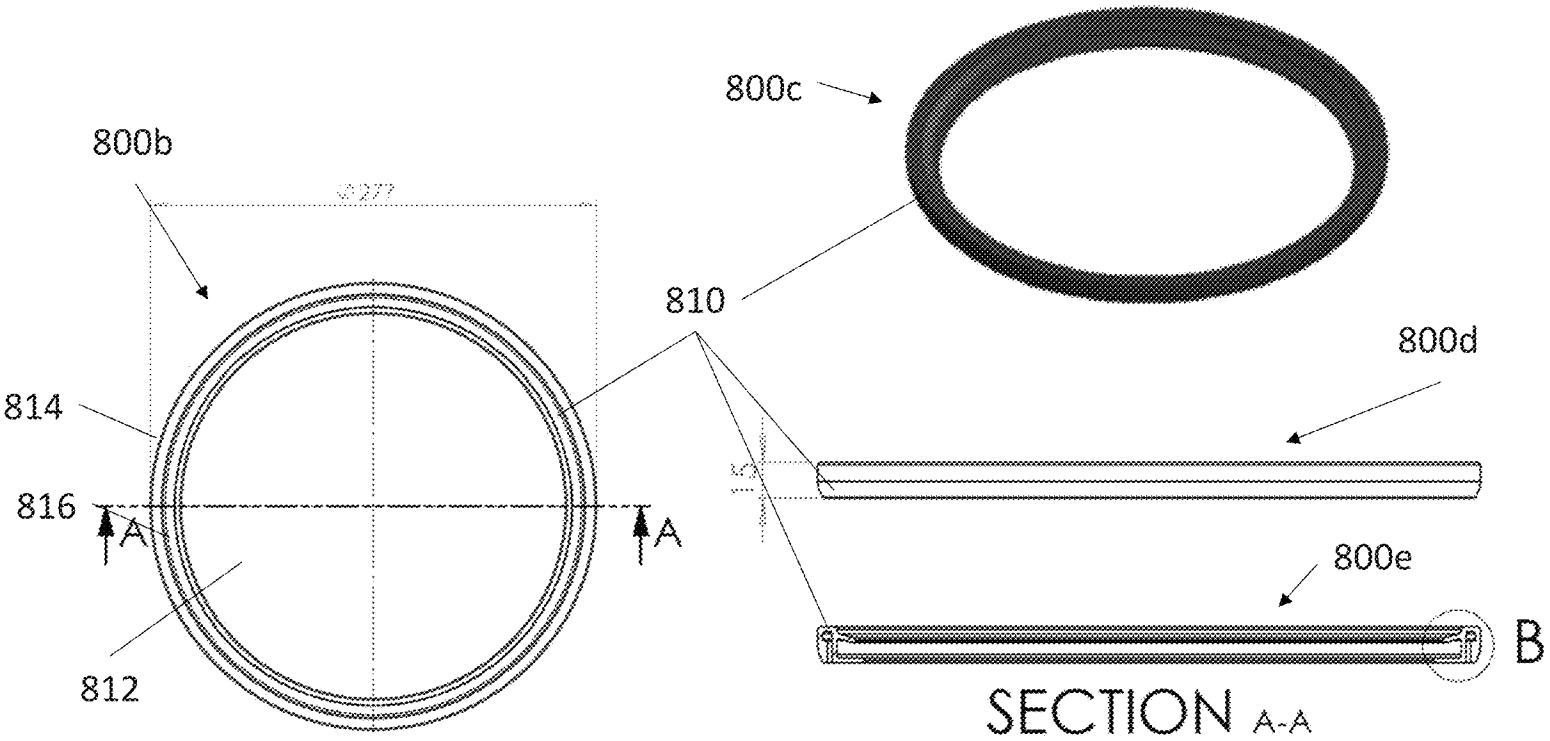

FIG. 8B shows an example embodiment of a main seal top diagram, side diagram, side cross-sectional diagram and mockup.

Figure 8C:
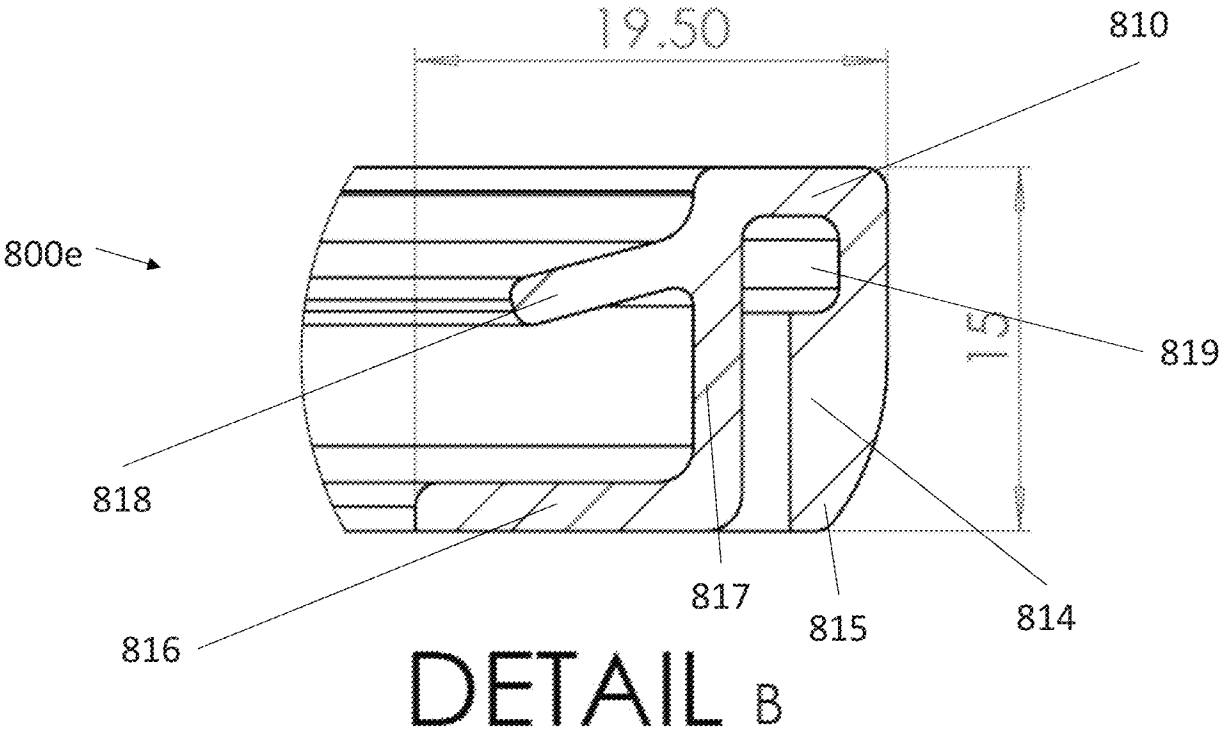

FIG. 8C shows an example embodiment of a main seal side cross-sectional detail diagram.

Figure 8D:
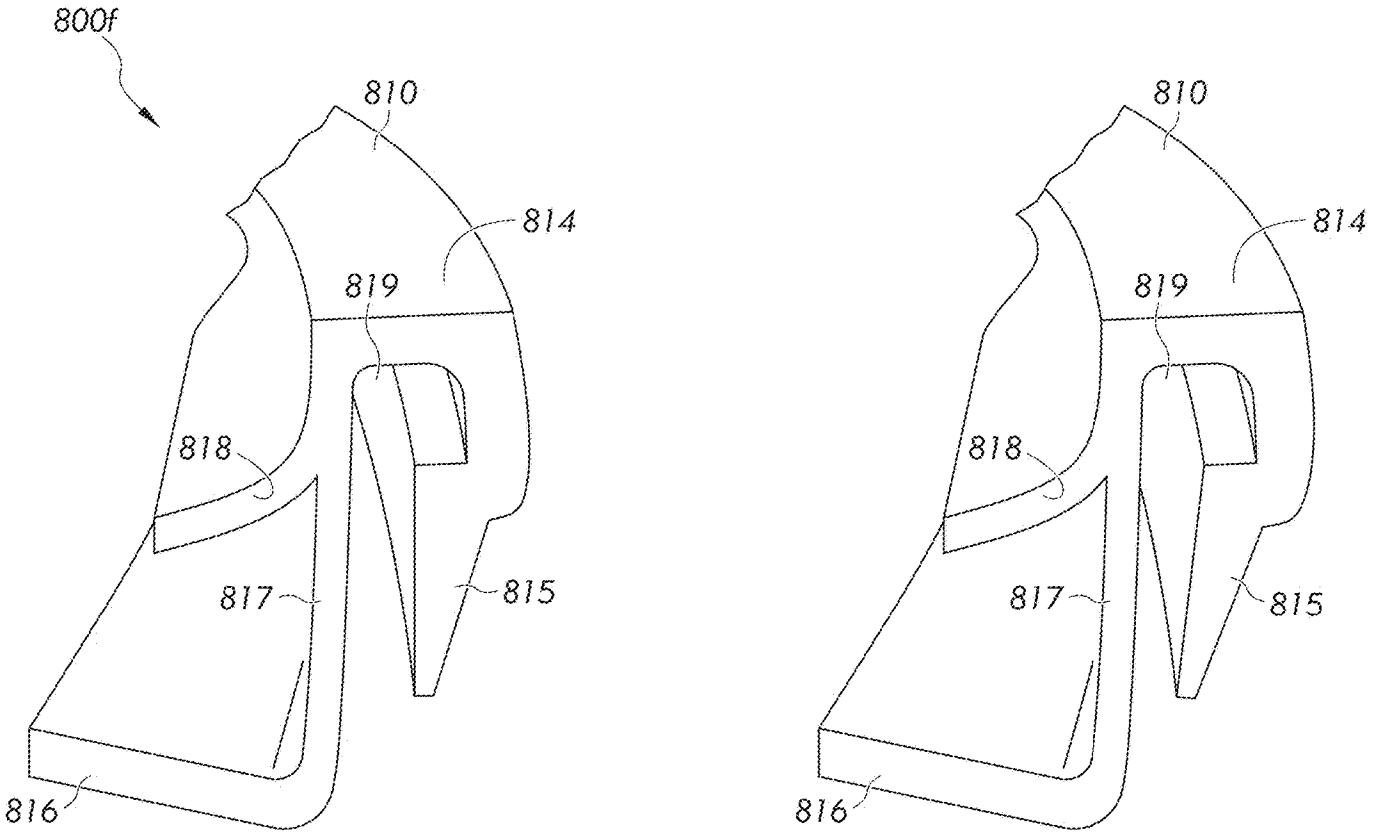

FIG. 8D shows an example embodiment of two images of a main seal cross section.

Figure 9A:
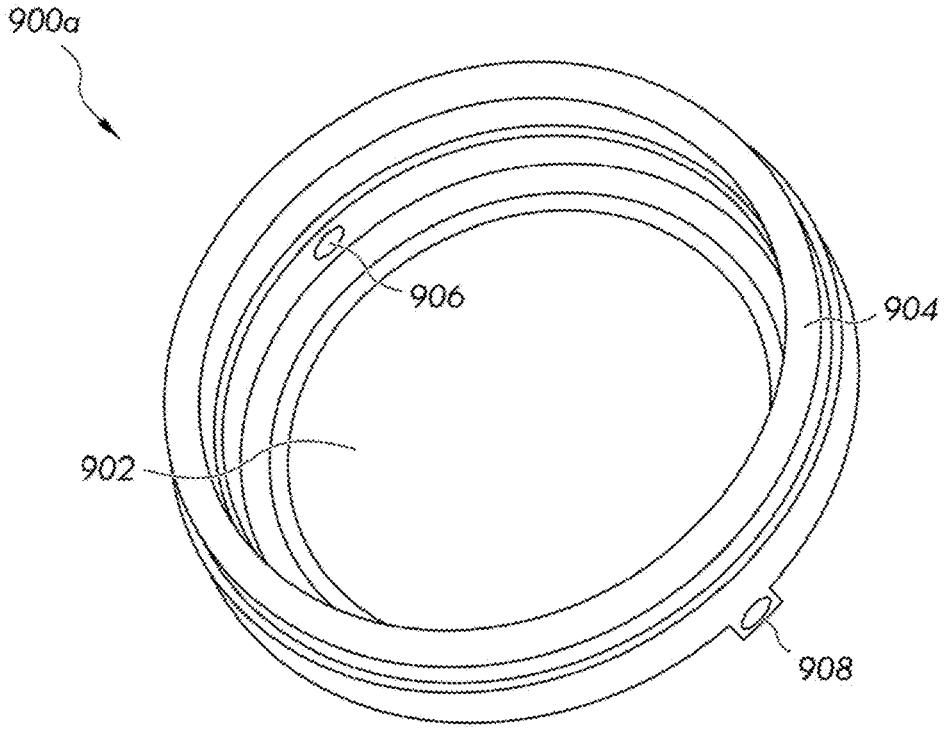

FIG. 9A shows an example embodiment image of a manifold from a top perspective view that is coupled with a main seal.

Figure 9B:
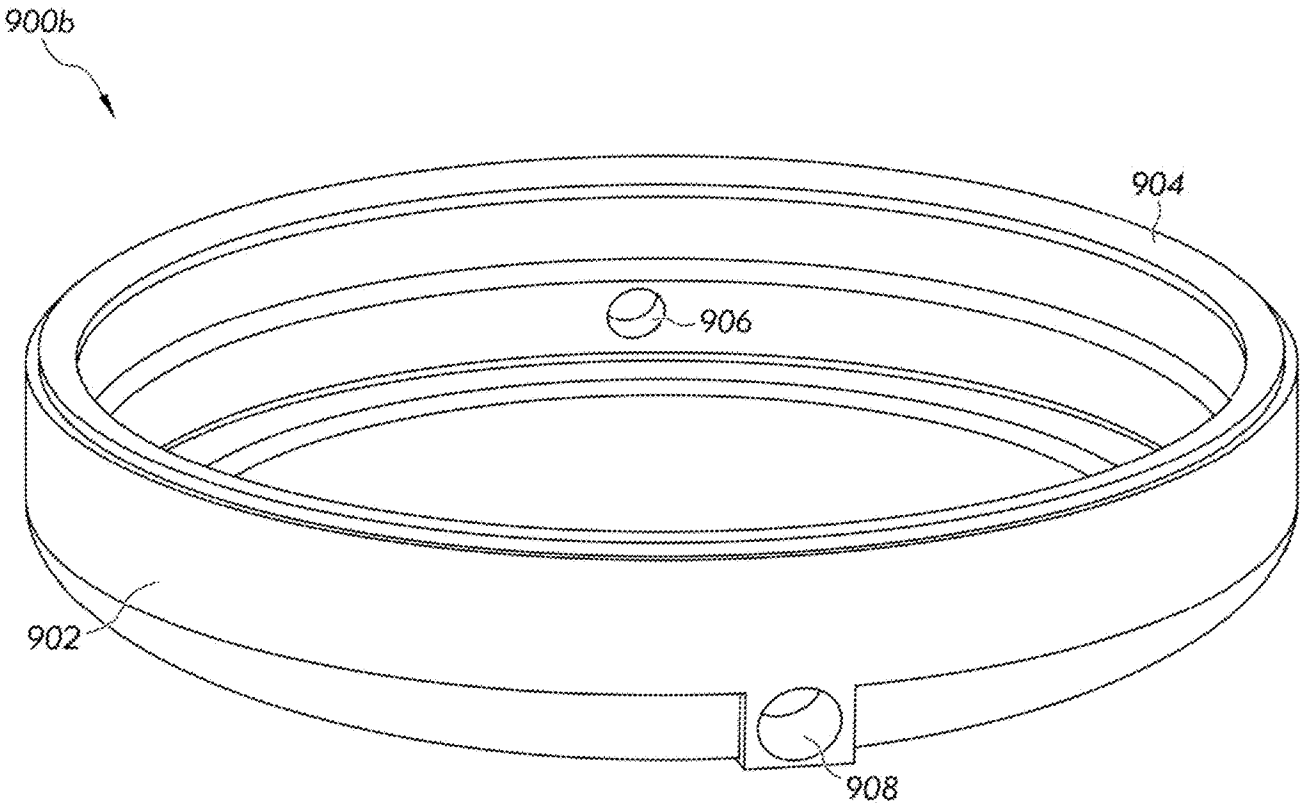

FIG. 9B shows an example embodiment image of a manifold from a side perspective view that is coupled with a main seal.

Figure 9C:
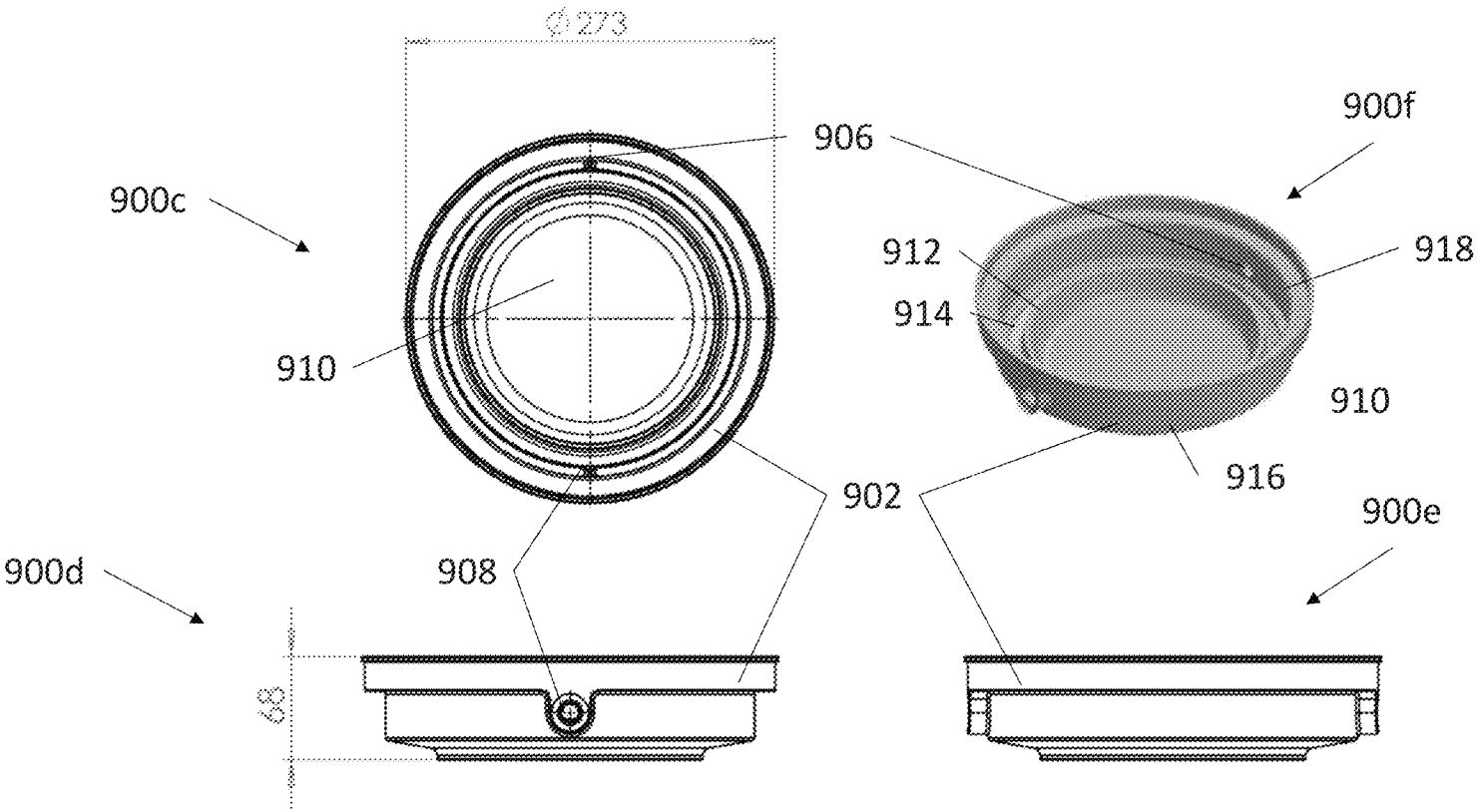

FIG. 9C shows an example embodiment of a manifold top view diagram, side view diagram, side cross-sectional diagram and mockup.

Figure 9D:
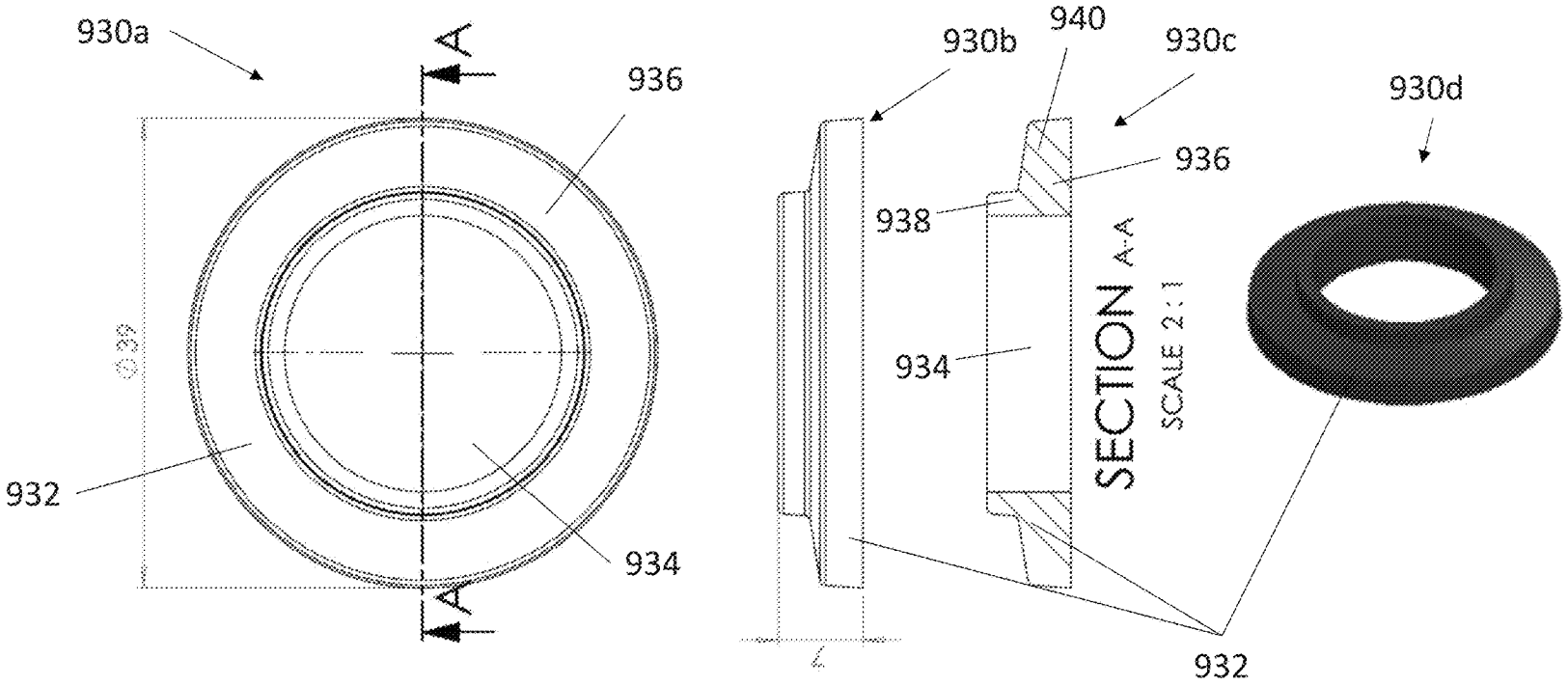

FIG. 9D shows an example embodiment of a bottom seal from a top view diagram, side view diagram, side cross-sectional diagram and mockup.

Figure 10A:
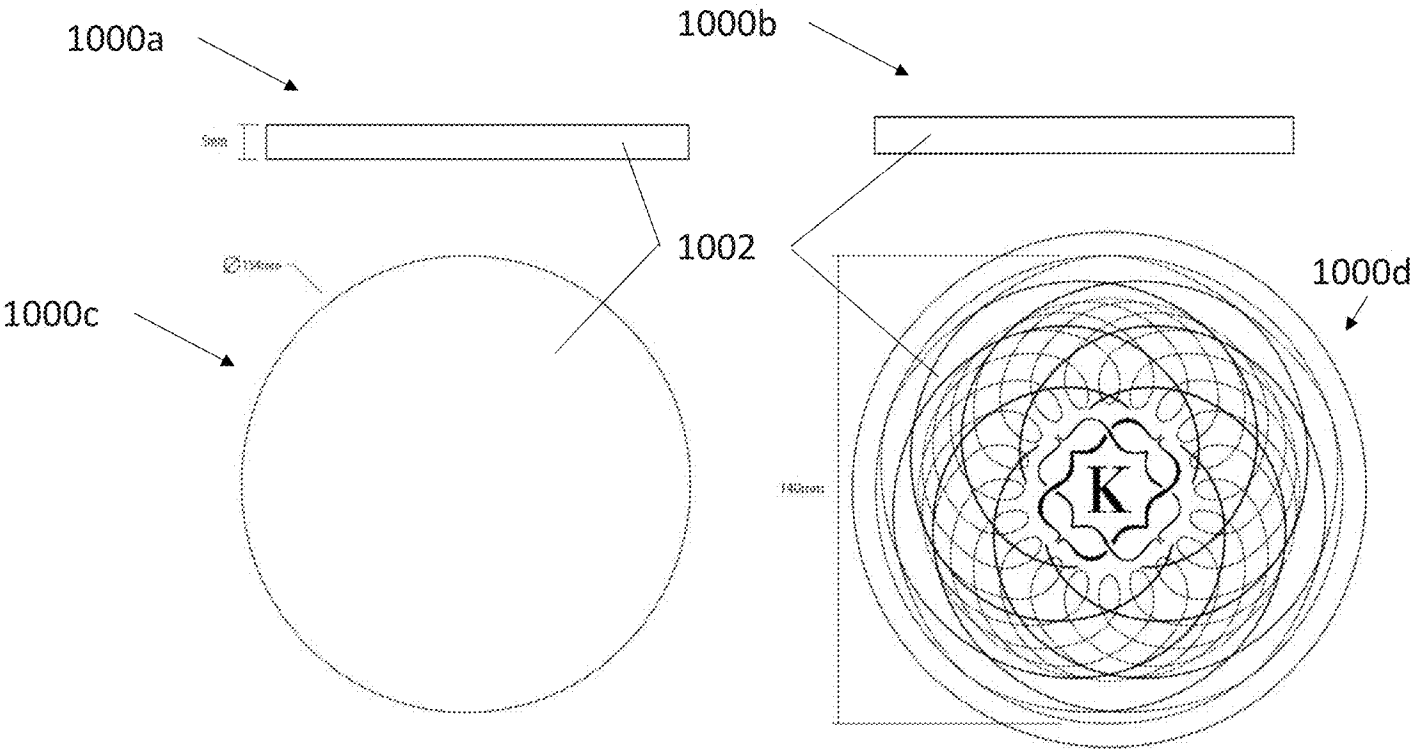

FIG. 10A shows an example embodiment of a puck glass side diagram, bottom diagram and top diagram.

Figure 10B:
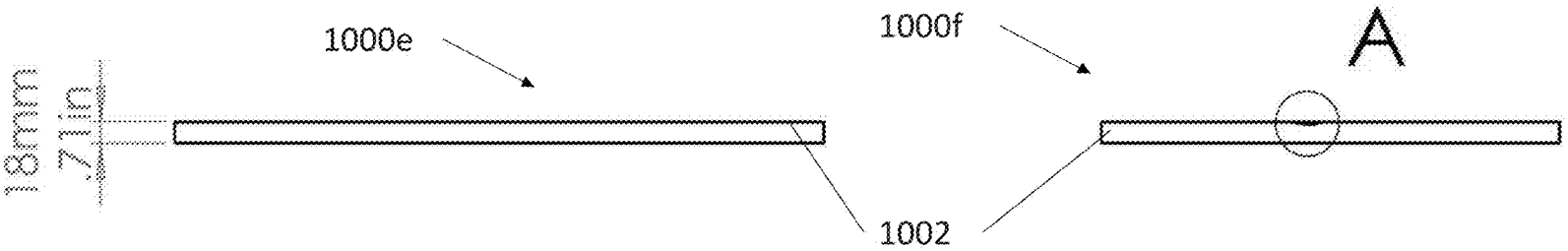

FIG. 10B shows an example embodiment of puck glass side diagrams.

Figure 10C:
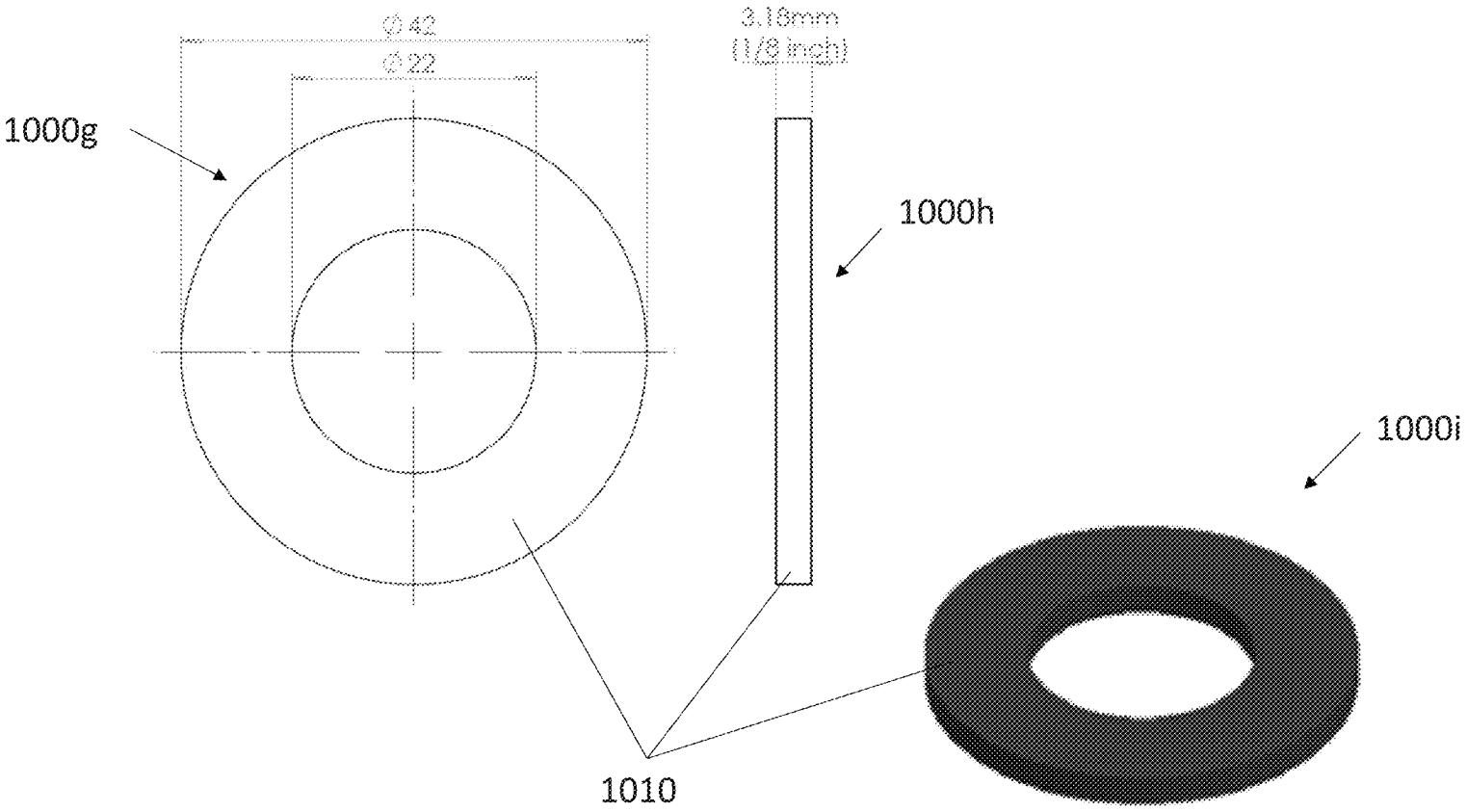

FIG. 10C shows an example embodiment of a vessel gasket top view diagram, side view diagram and mockup.

Figure 10D:
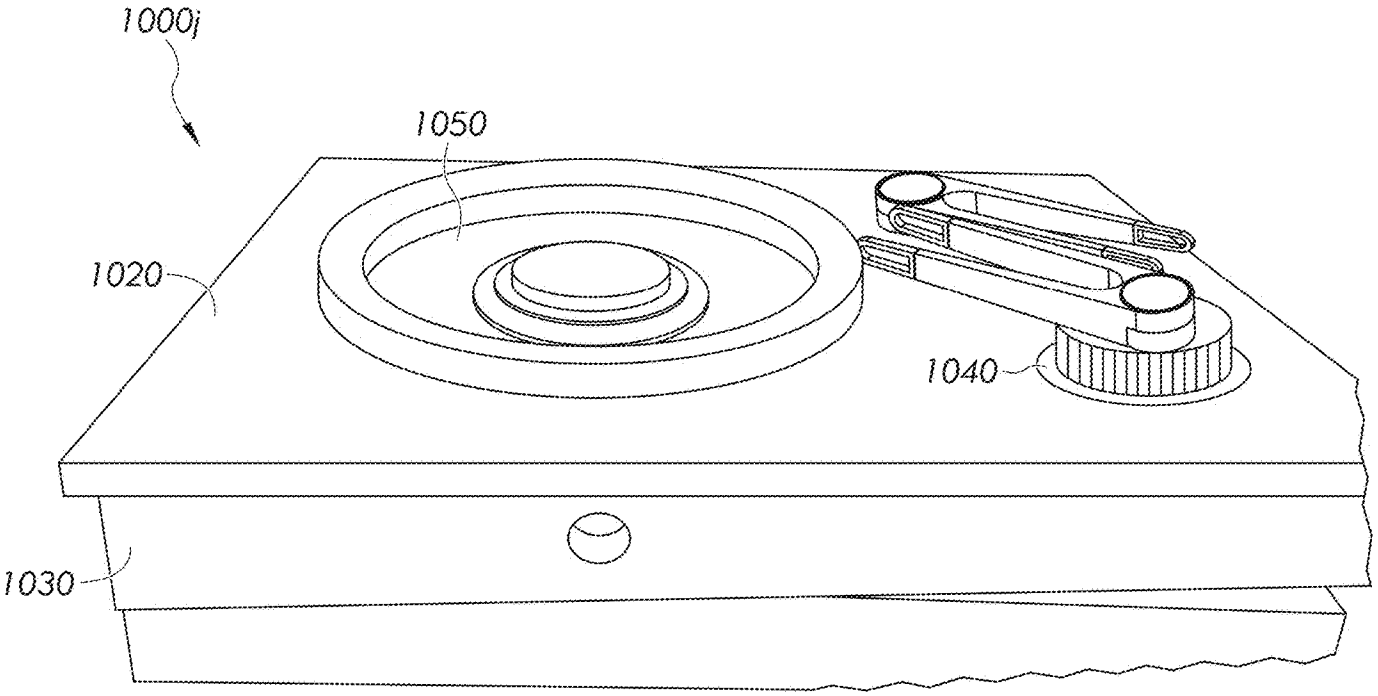

FIG. 10D shows an example embodiment of a cover image coupled with a base, ashtray and manifold.

Figure 10E:
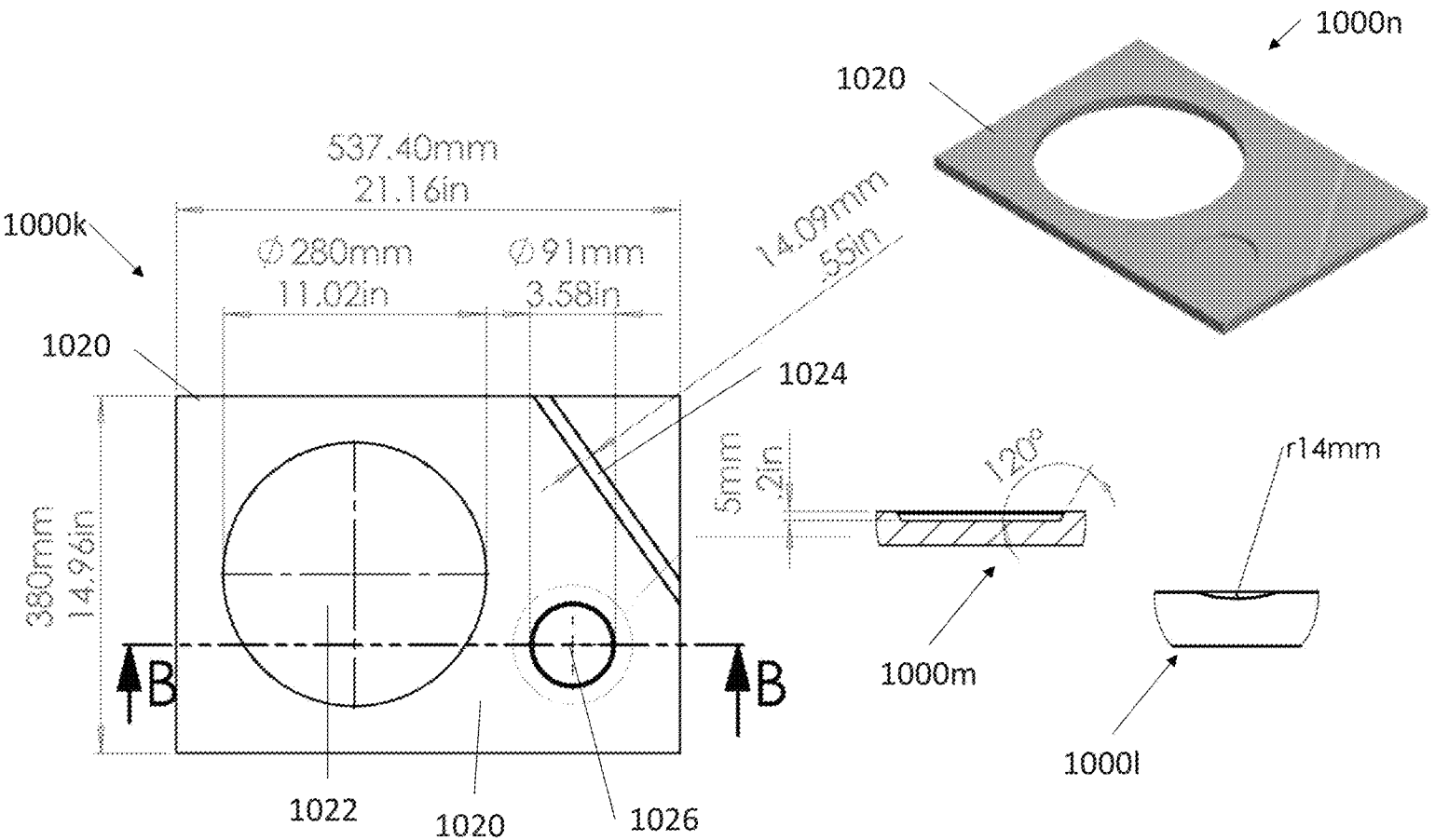

FIG. 10E shows an example embodiment of a cover top view diagram, cover channel side view diagram and cover channel side cross-sectional diagram.

Figure 11A:
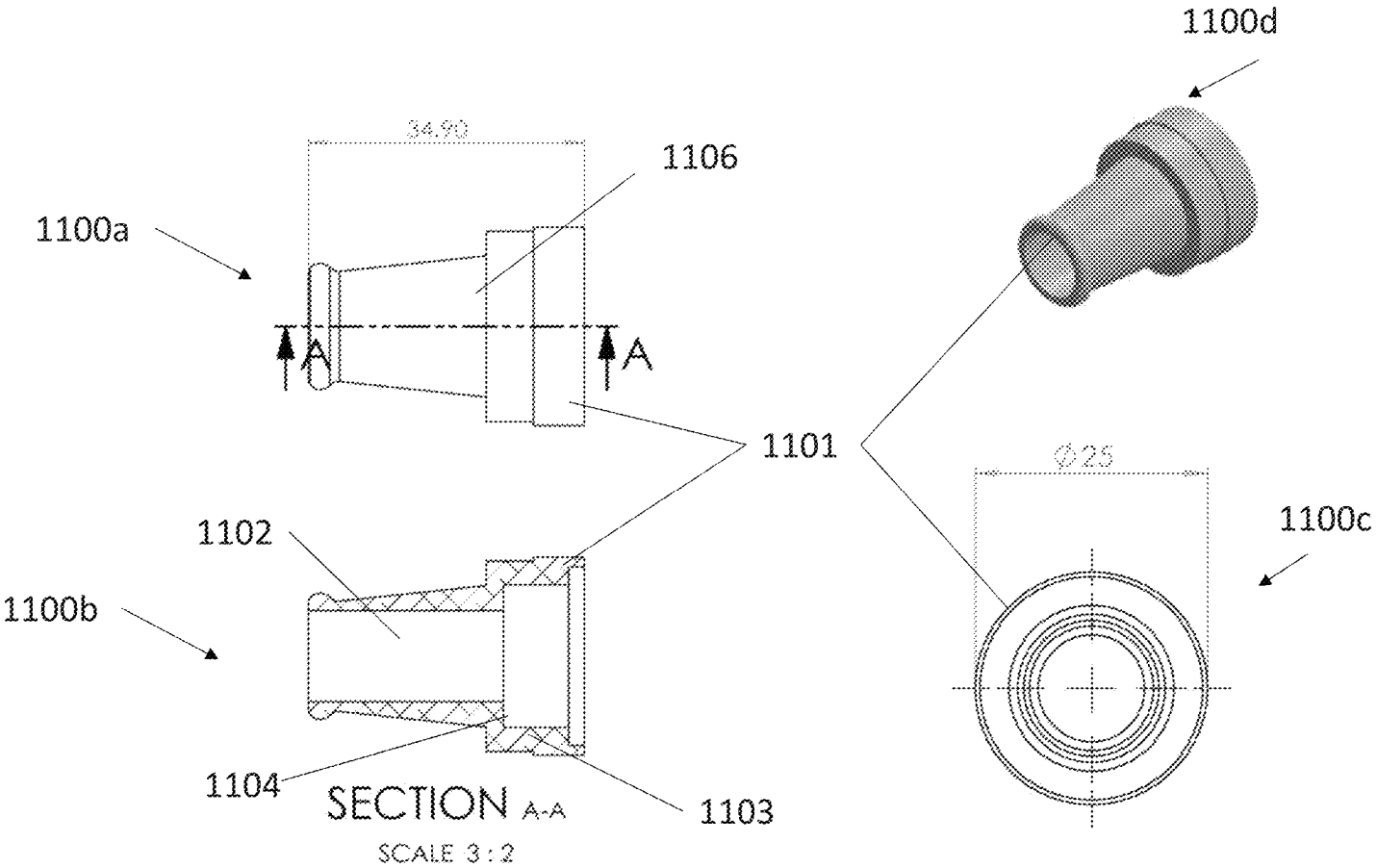

FIG. 11A shows an example embodiment of a purge nipple side view diagram, side cross-sectional diagram, end diagram and mockup.

Figure 11B:
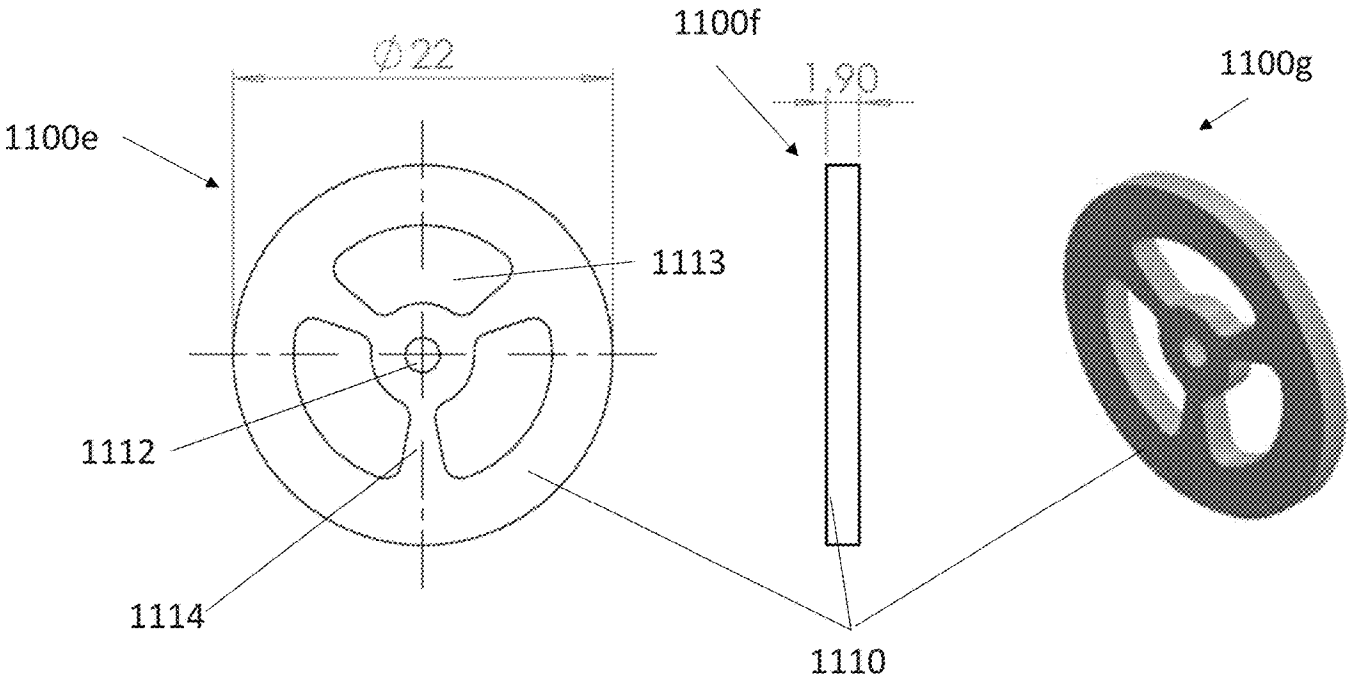

FIG. 11B shows an example embodiment of a purge plate end view diagram, side diagram and mockup.

Figure 11C:
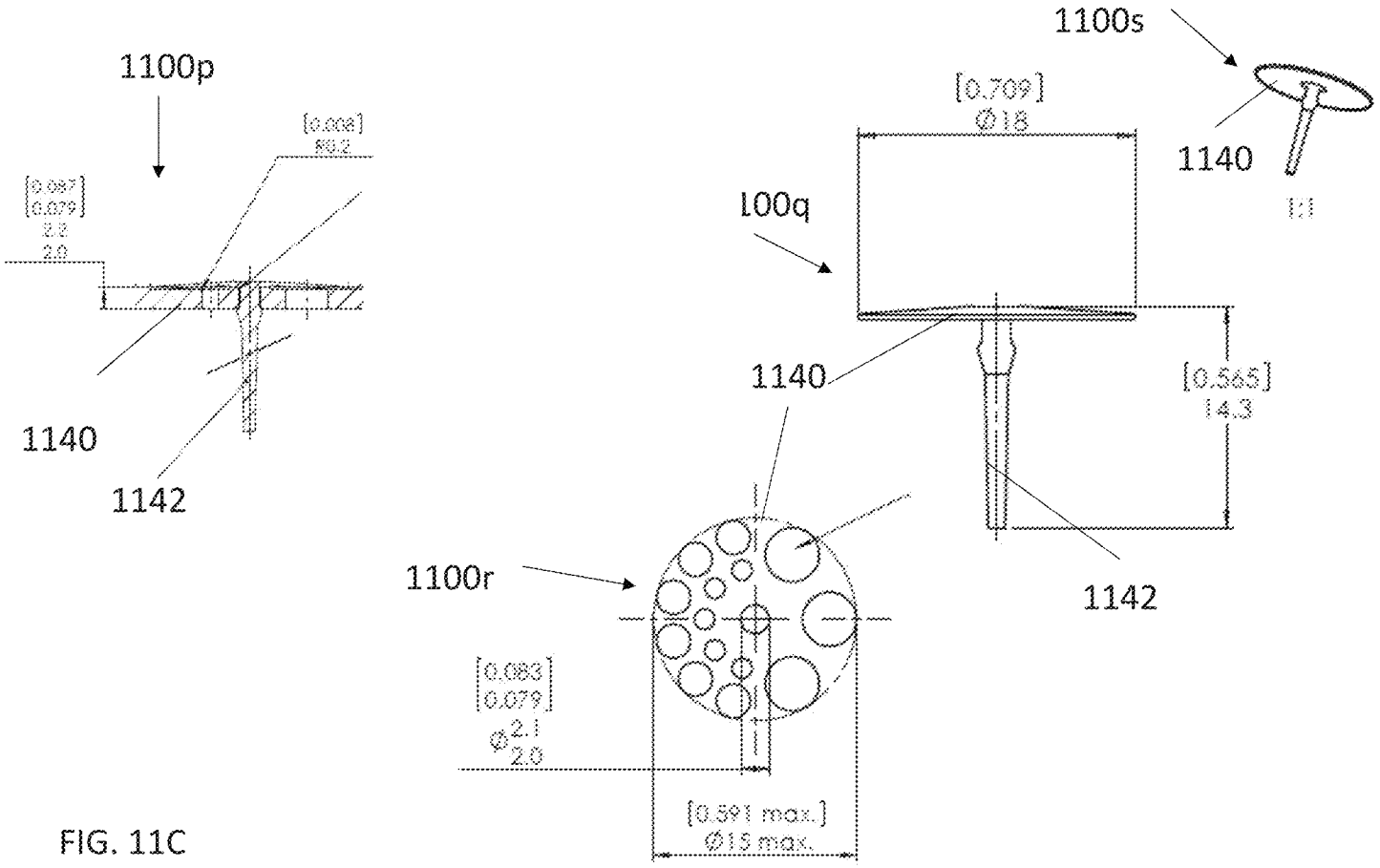

FIG. 11C shows an example embodiment of an umbrella valve.

Figure 11D:
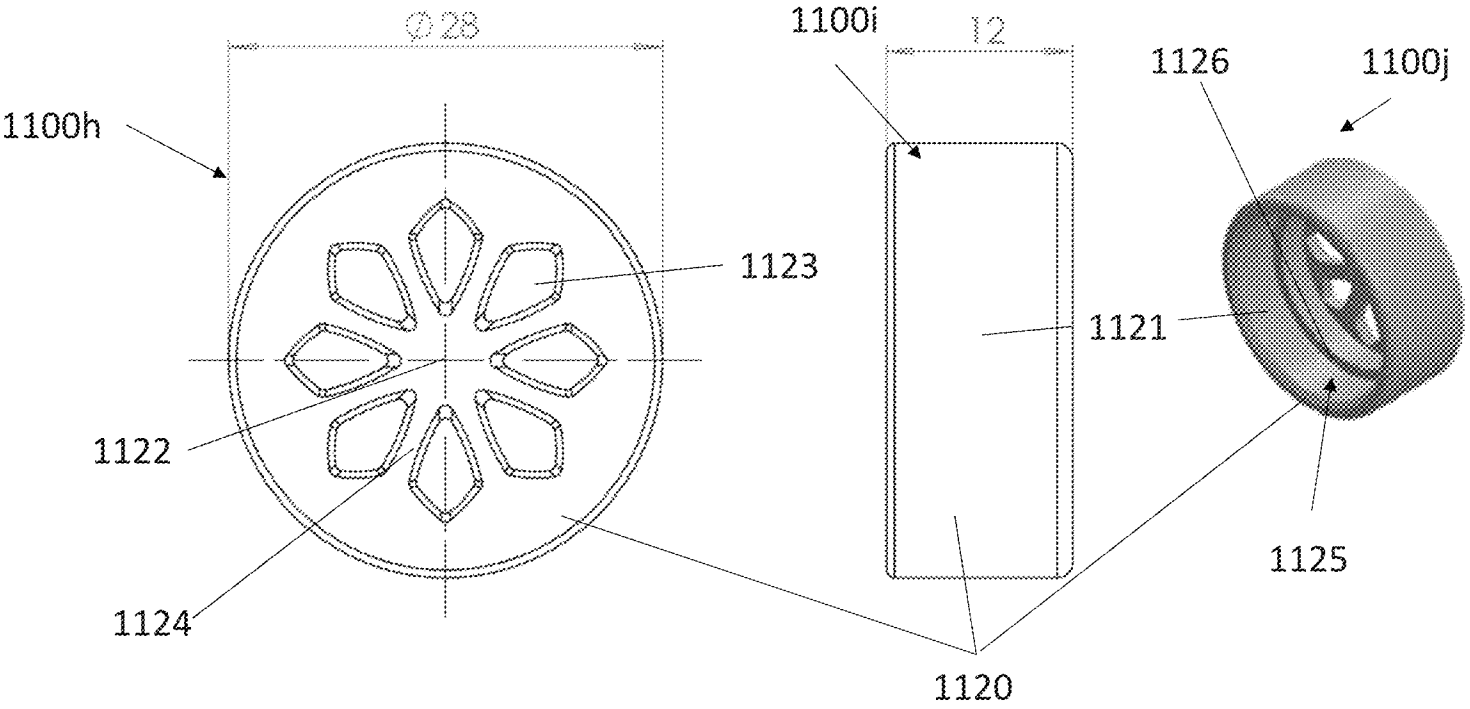

FIG. 11D shows an example embodiment of a purge cap end view diagram, side view diagram and mockup.

Figure 11E:
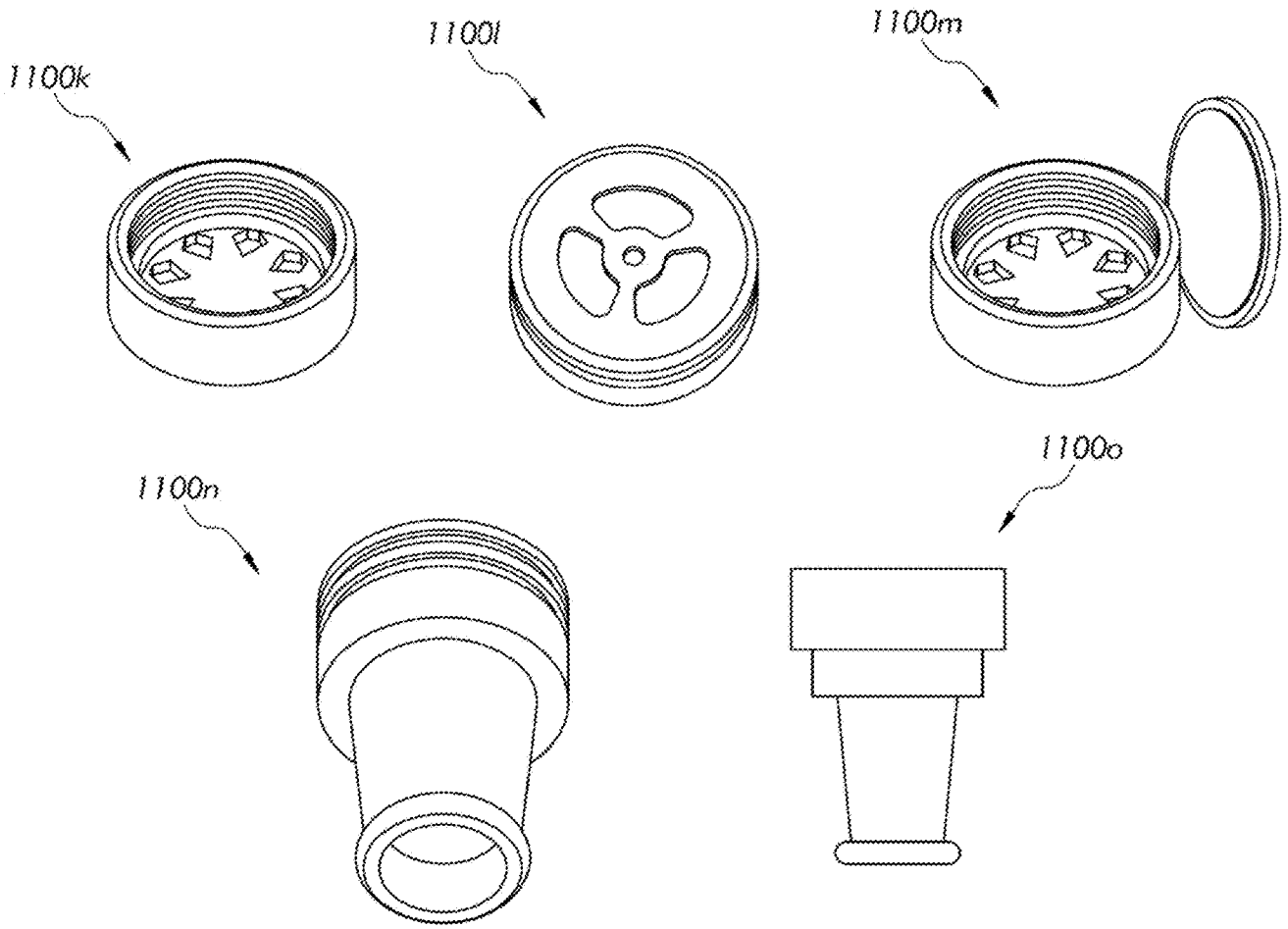

FIG. 11E shows an example embodiment of a fully assembled and disassembled purge valve assembly.

Figure 12A:
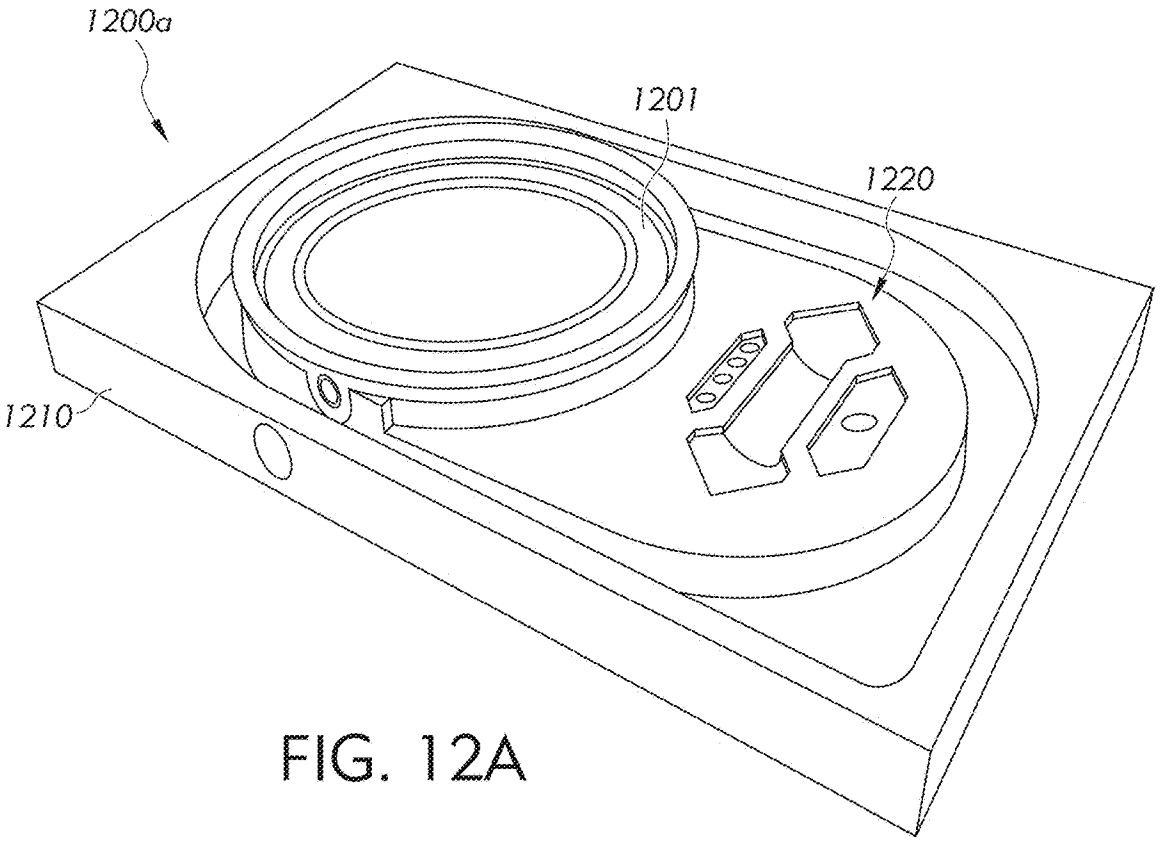

FIG. 12A shows an example embodiment of a tray coupled with a manifold in an image from a perspective view.

Figure 12B:
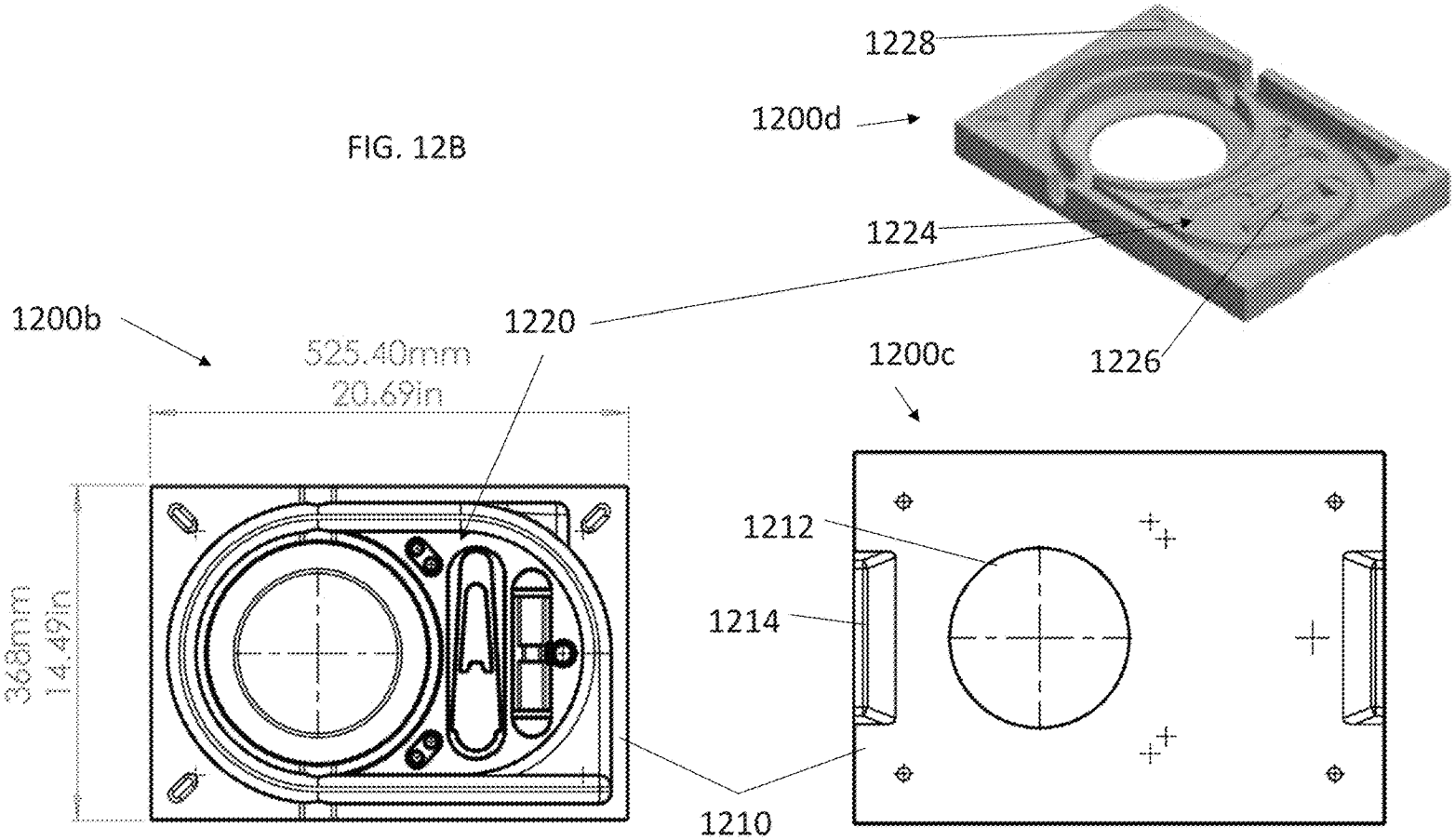

FIG. 12B shows an example embodiment of a tray from a top view diagram, bottom view diagram and mockup.

Figure 12C:
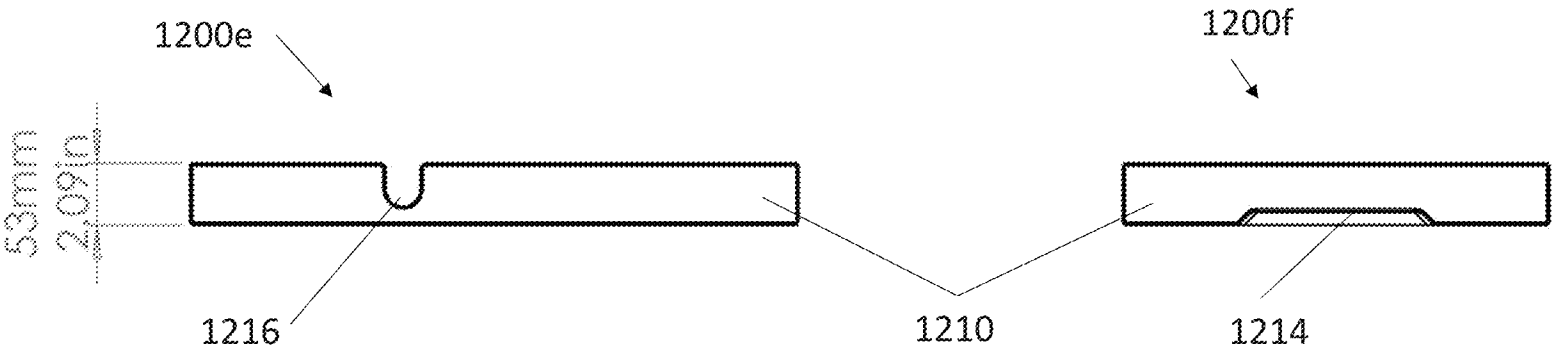

FIG. 12C shows an example embodiment of a tray from a lengthwise side diagram view and widthwise side diagram view.

Figure 12D:
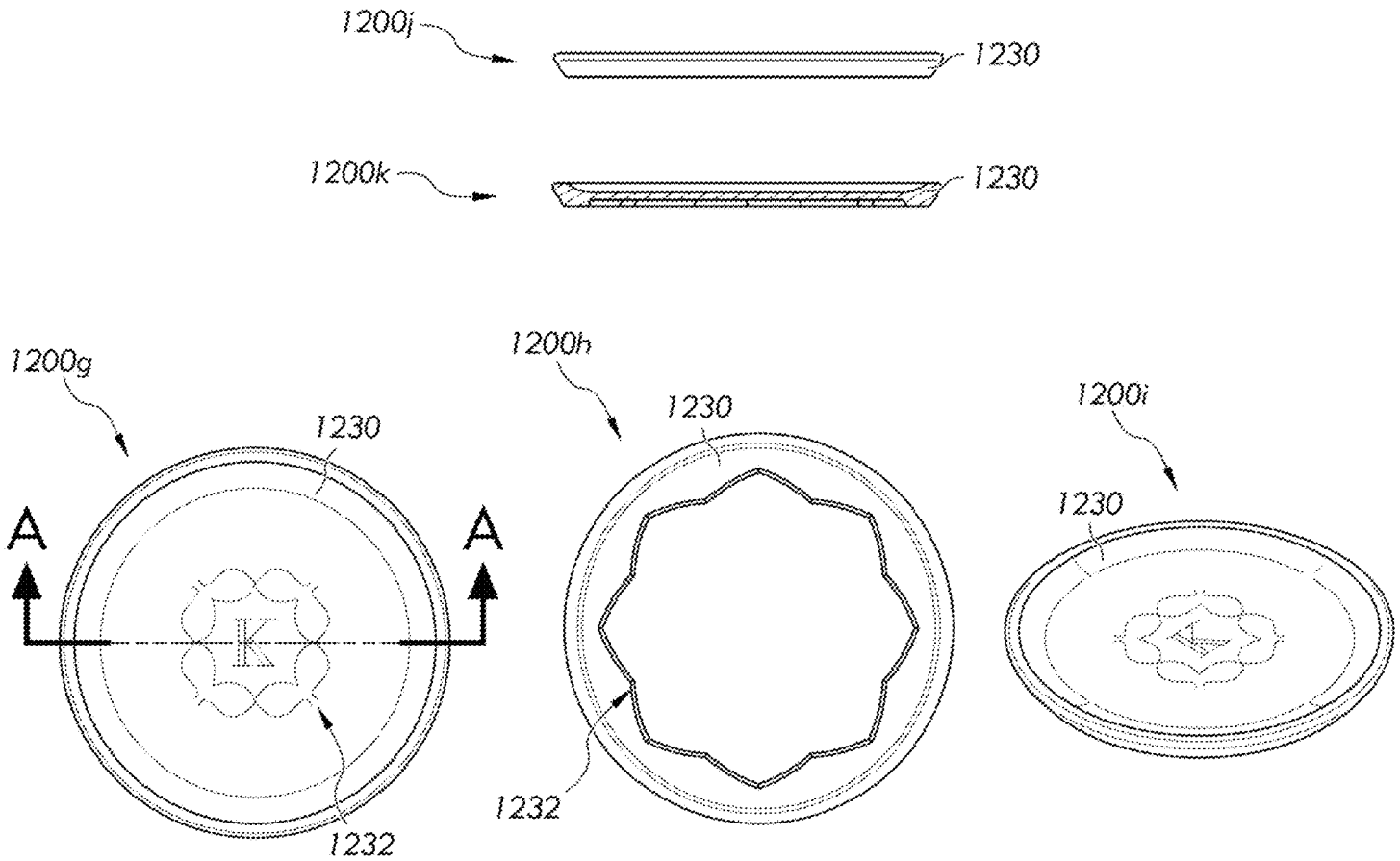

FIG. 12D shows an example embodiment of an ash tray from a side diagram view, side-cross sectional diagram view, top diagram view, bottom diagram view and mockup.

Figure 13A:
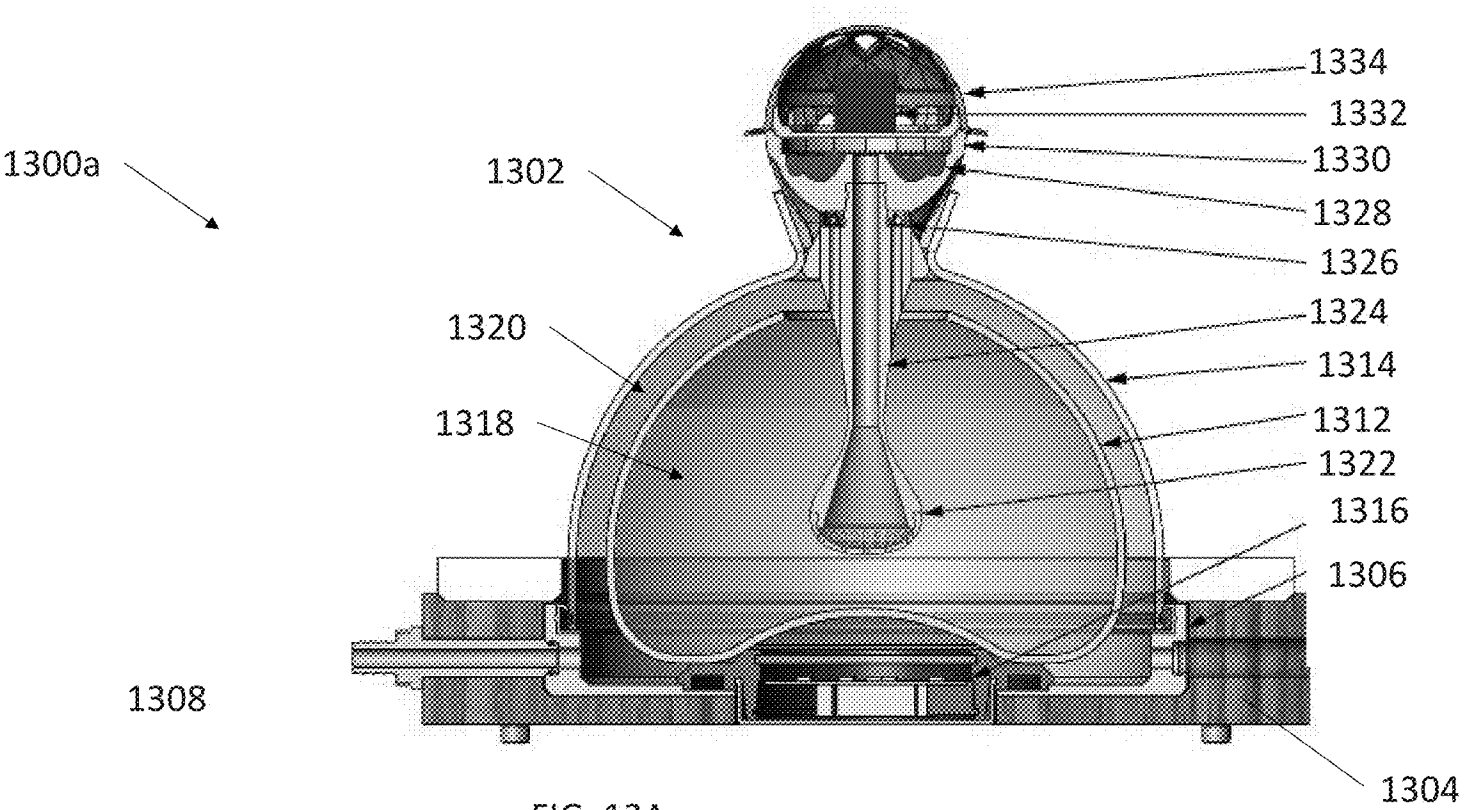

FIG. 13A shows an example embodiment a side cross-sectional diagram view of a domed water pipe with supporting tray.

Figure 13B:
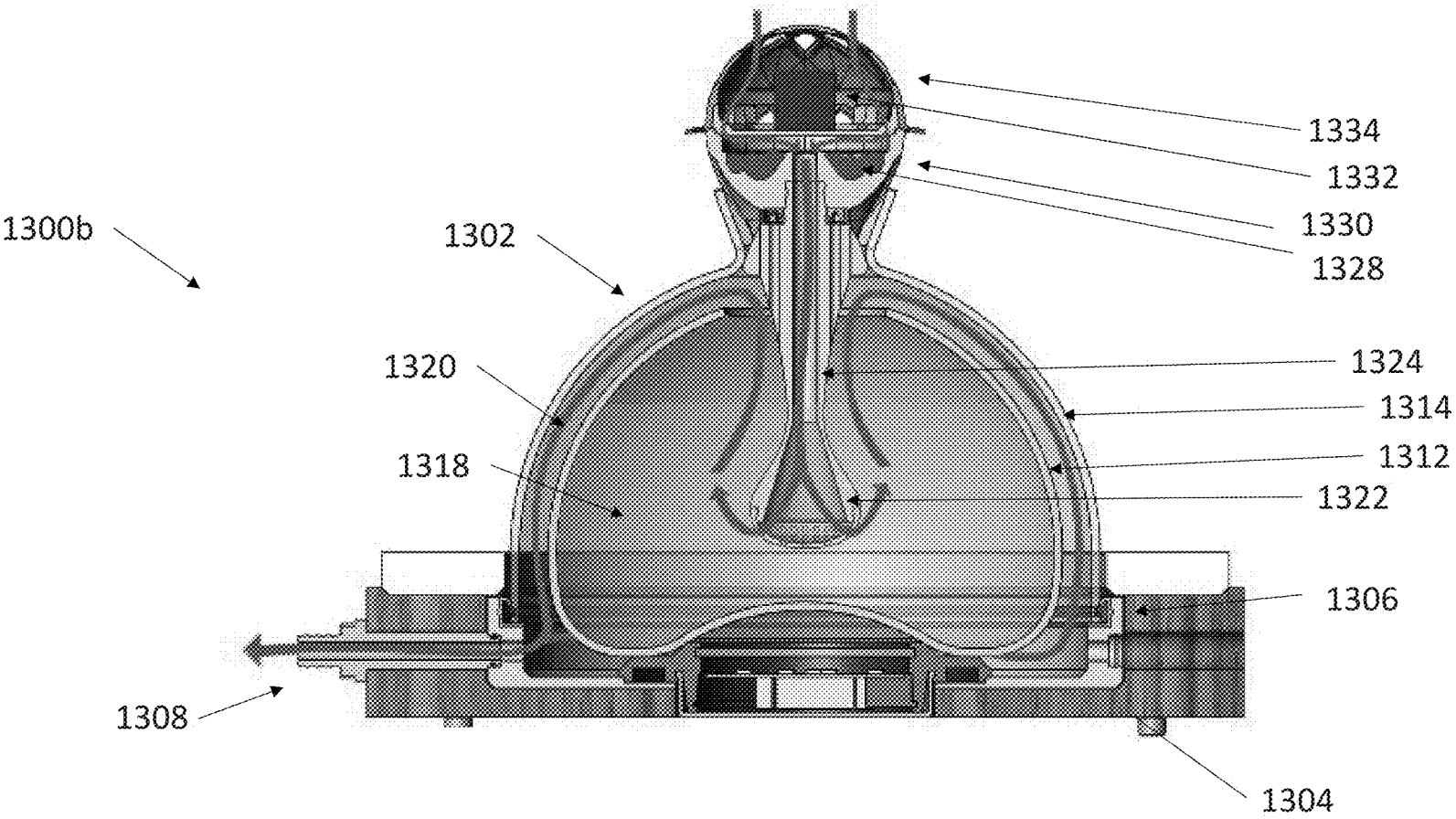

FIG. 13B shows an example embodiment of a side cross-sectional diagram view domed water pipe with supporting tray including an intake airflow cycle.

Figure 13C:
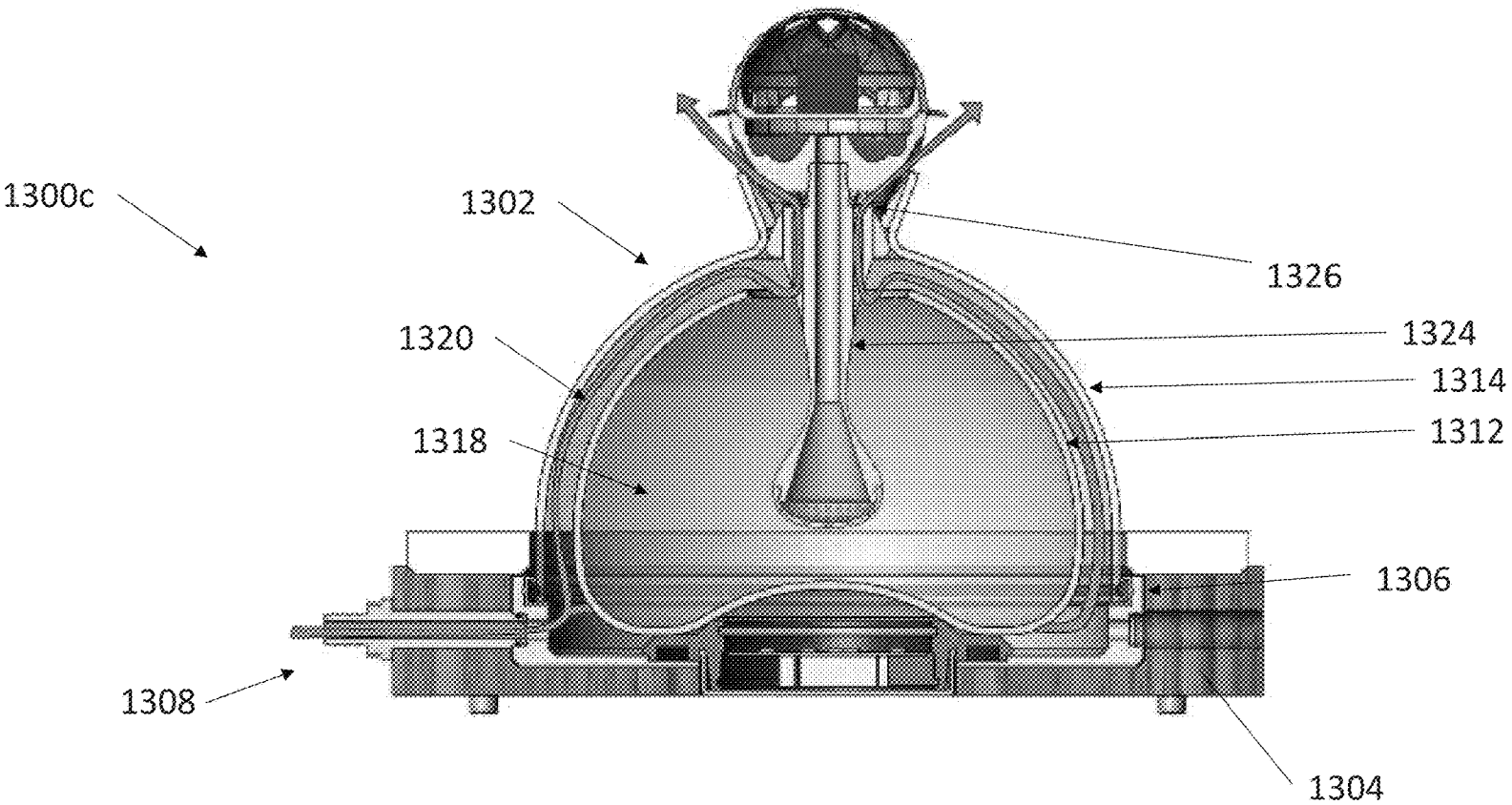

FIG. 13C shows an example embodiment of a side cross-sectional diagram view domed water pipe with supporting tray including a first purge airflow cycle.

Figure 13D:
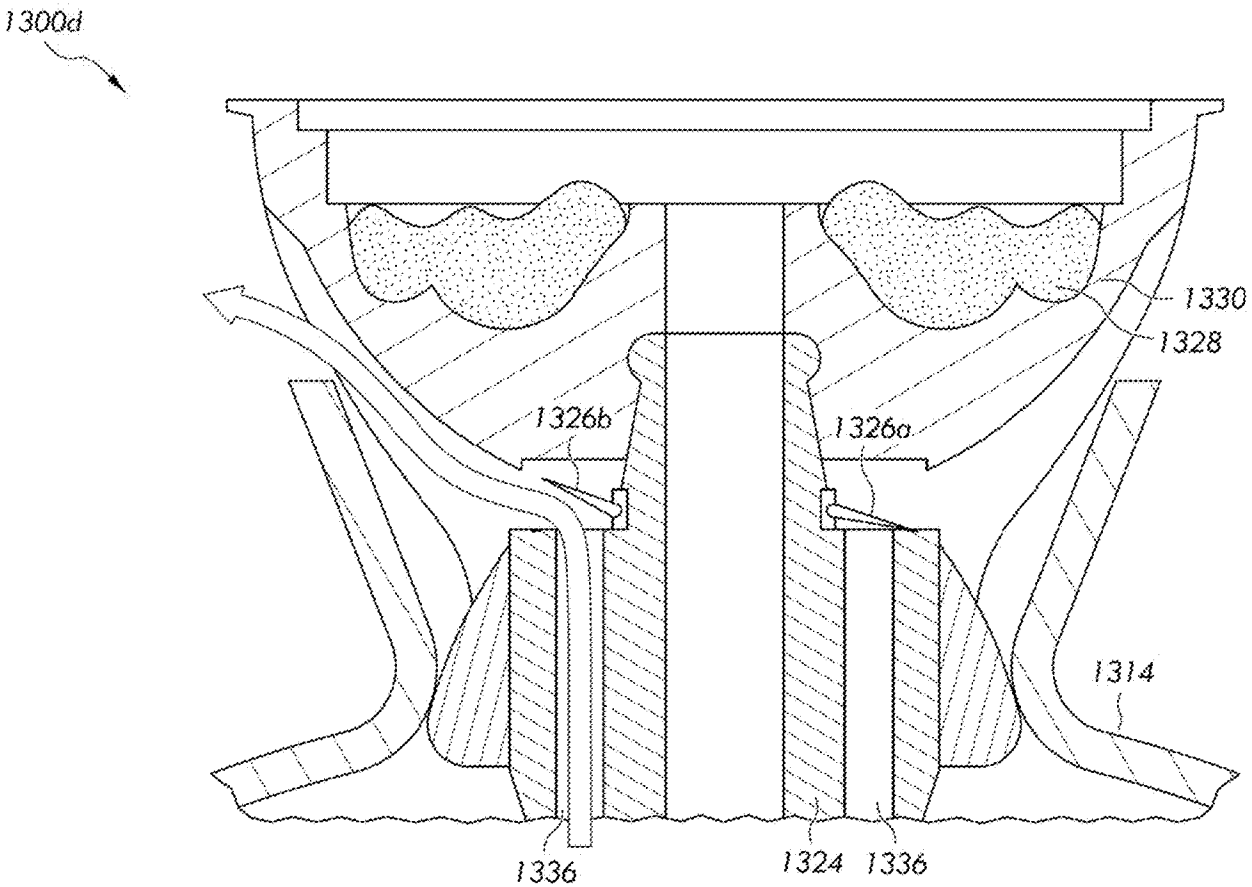

FIG. 13D shows an example embodiment of a side cross-sectional diagram view of domed water pipe head purge detail of a head area.

Figure 13E:
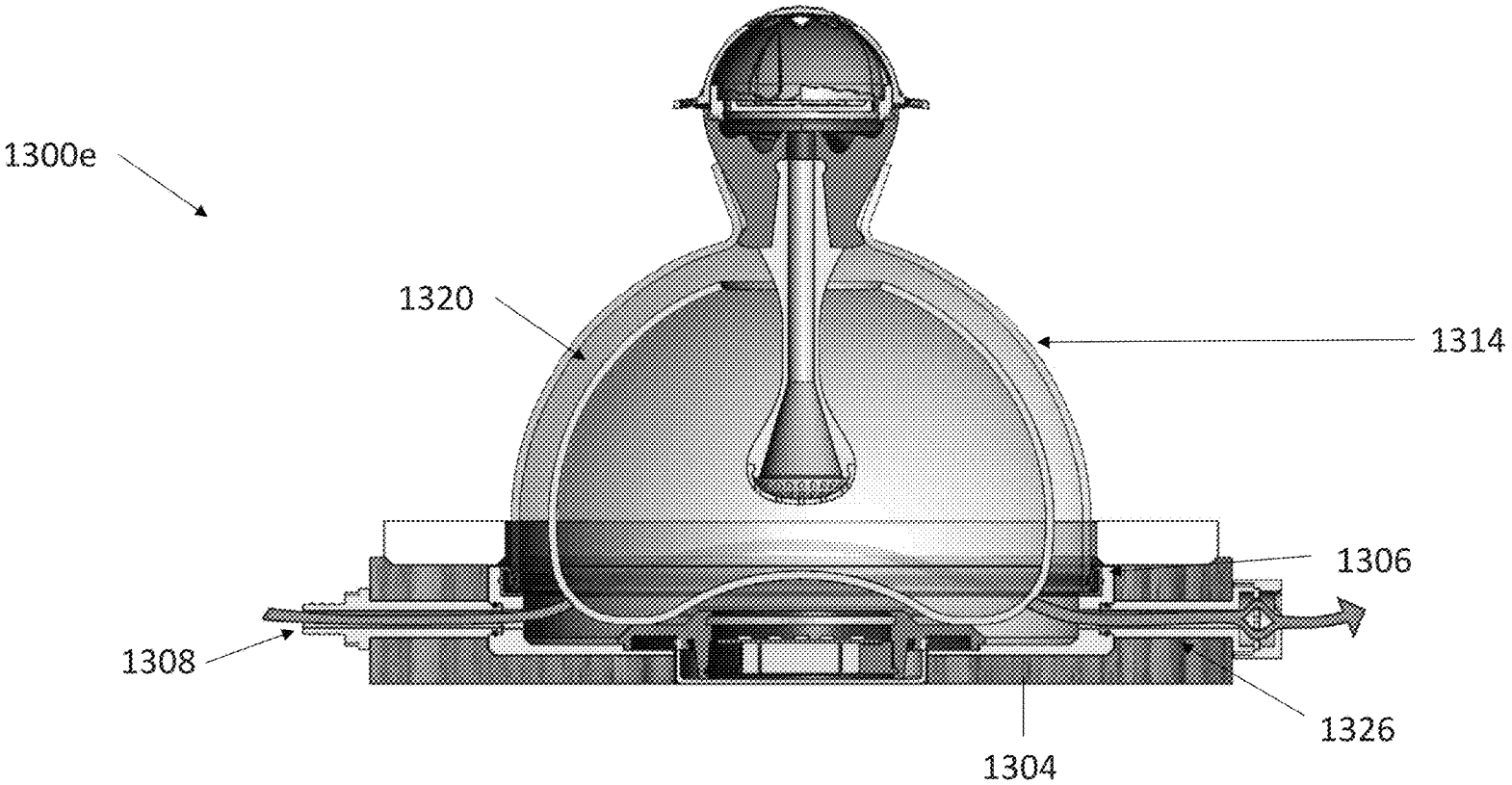

FIG. 13E shows an example embodiment of a side cross-sectional diagram view of domed water pipe with supporting tray including a second purge airflow cycle.

Figure 14A:
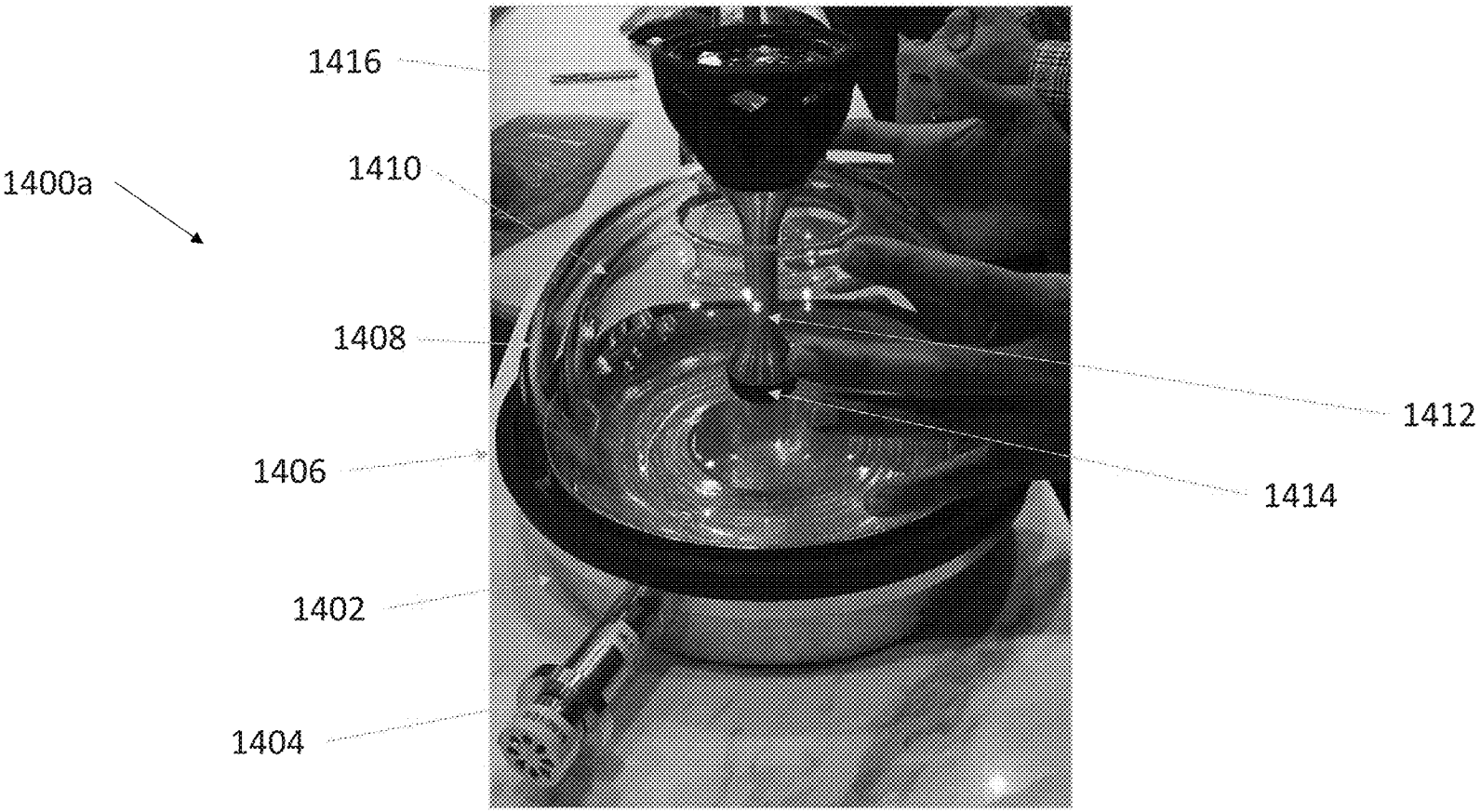

FIG. 14A shows an example embodiment a view of a domed water pipe.

Figure 14B:
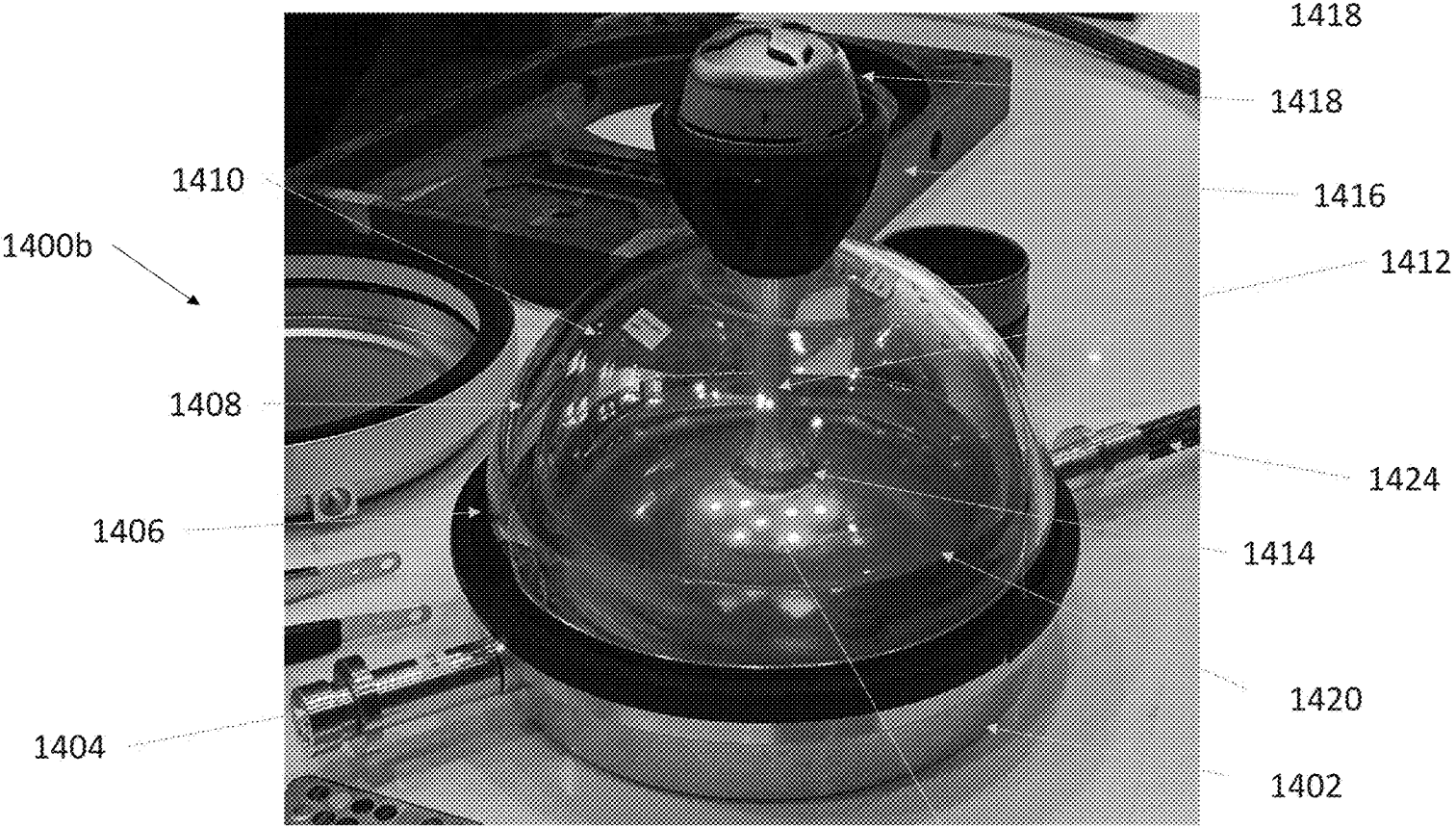

FIG. 14B shows an example embodiment a view of a domed water pipe with functional LED puck turned on.

Figure 14C:
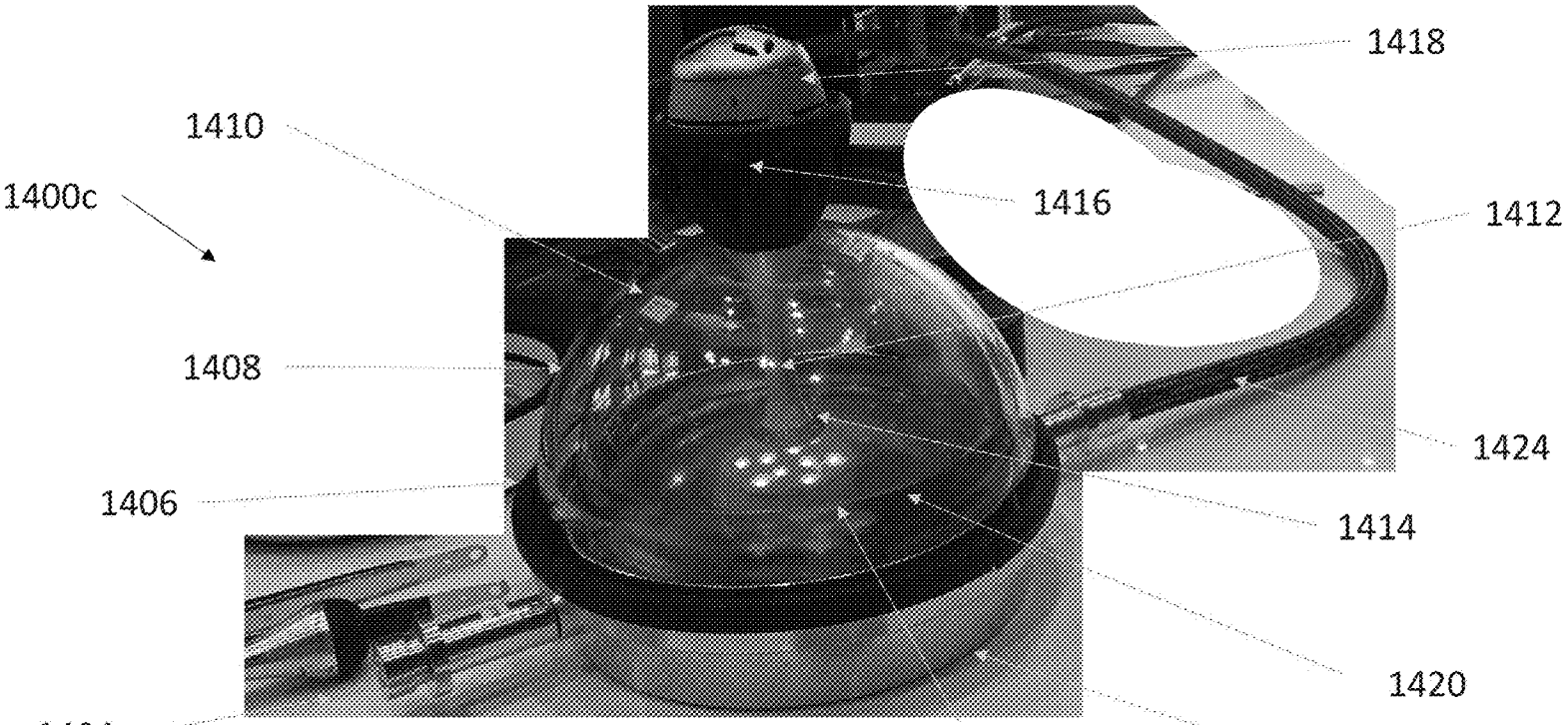

FIG. 14C shows an example embodiment a view of a domed water pipe with functional LED puck turned on.

Figure 14D:
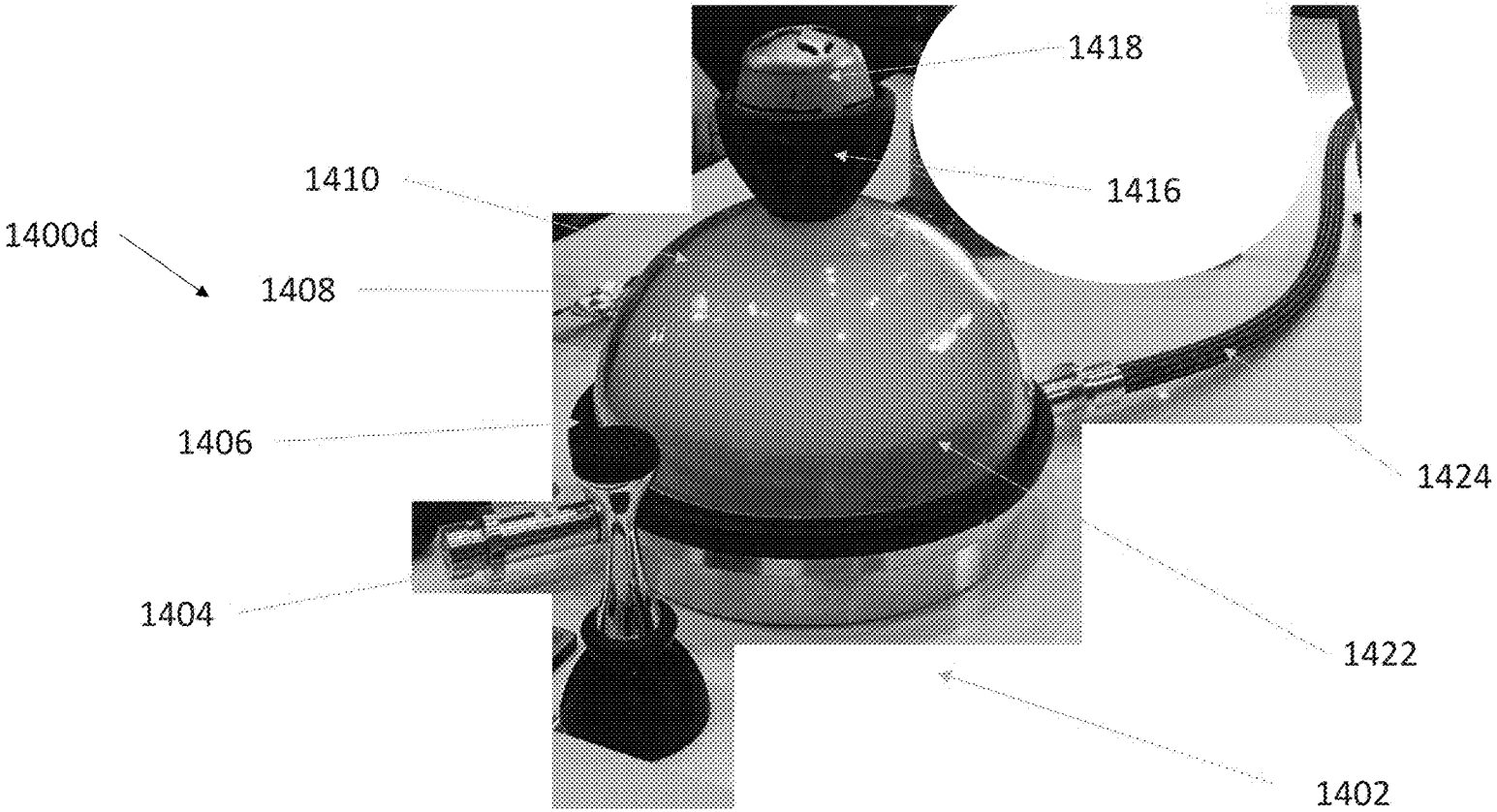

FIG. 14D shows an example embodiment a view of a domed water pipe with functional LED puck turned on and smoke inside the outer vessel.

Figure 14E:
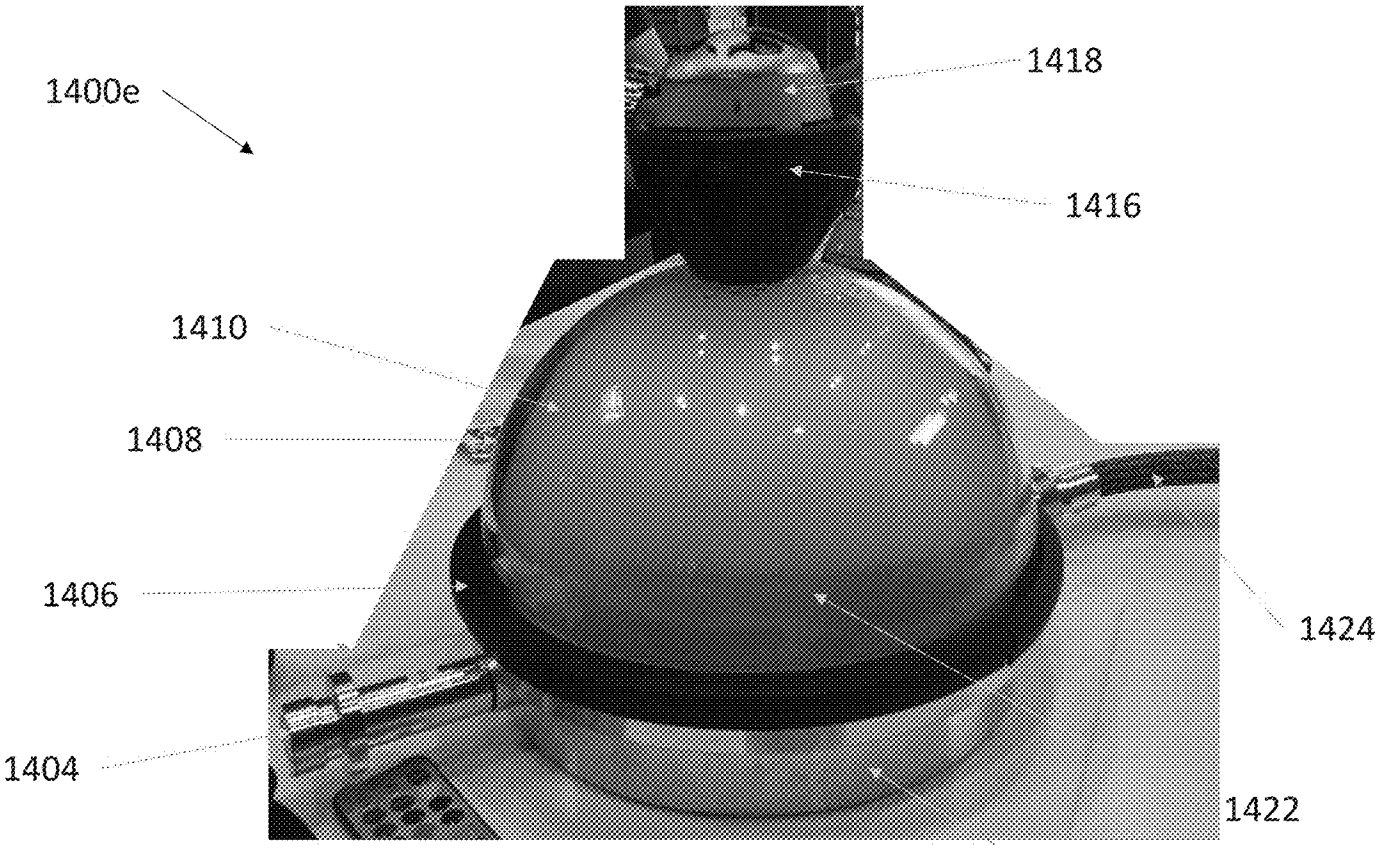

FIG. 14E shows an example embodiment a view of a domed water pipe with functional LED puck turned on and smoke inside the outer vessel.

Figure 15A:
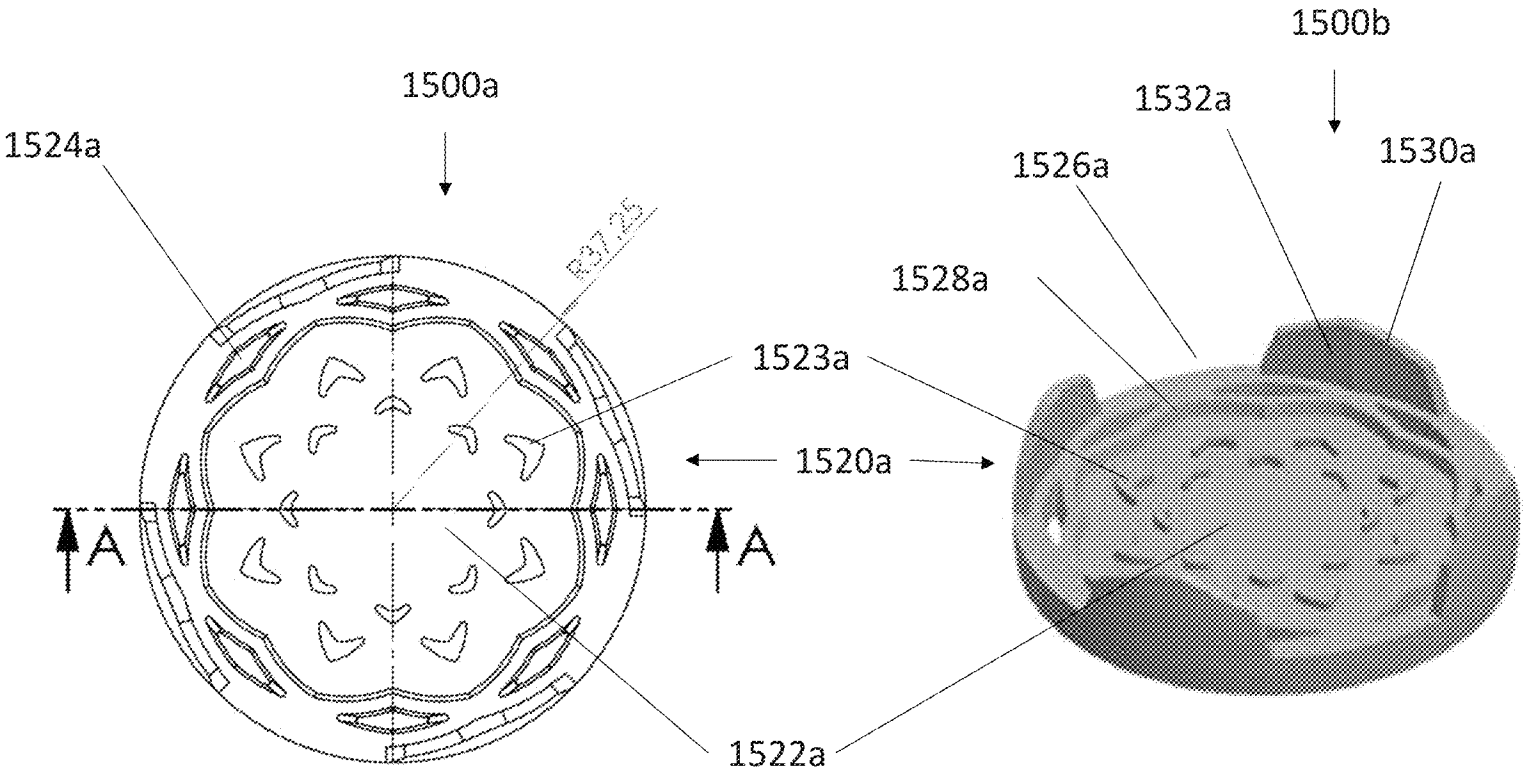

FIG. 15A shows an example embodiment of a heat management device base plate from a top view diagram and mockup.

Figure 15B:
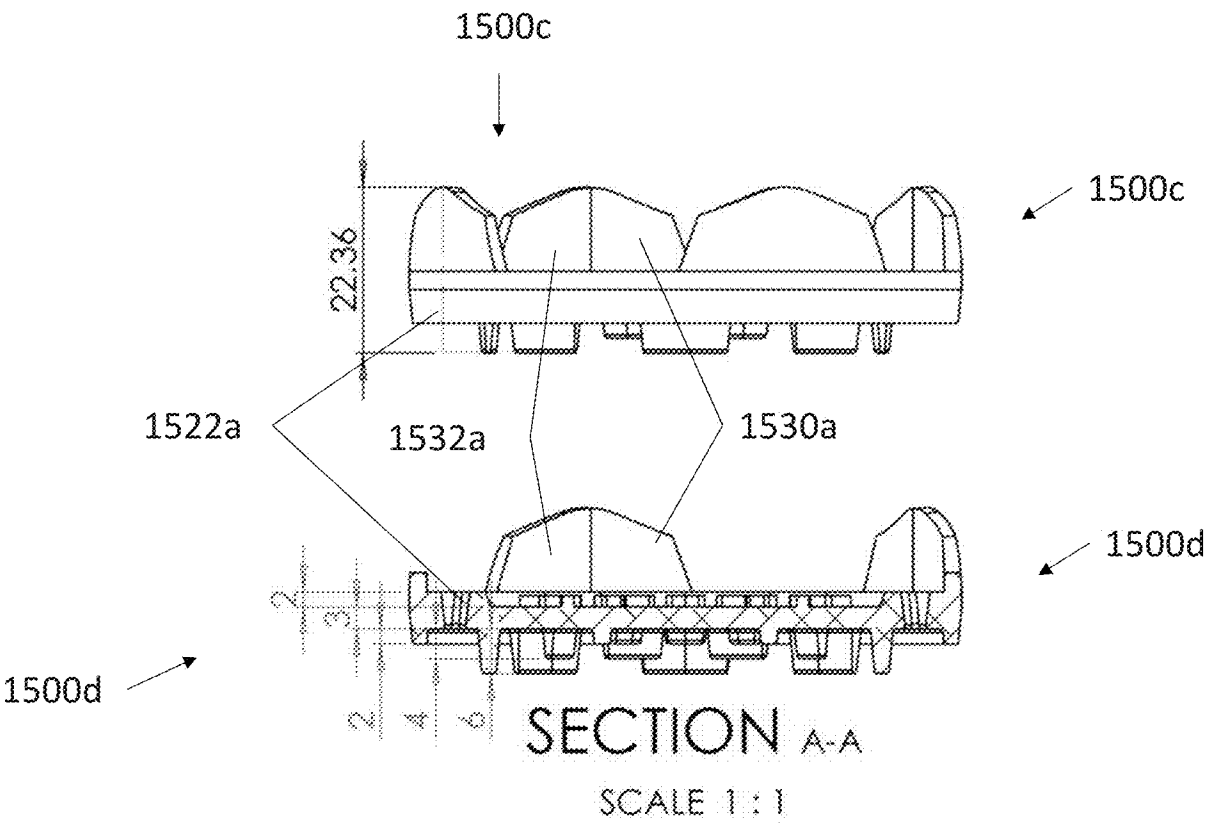

FIG. 15B shows an example embodiment of a heat management device base plate from a side view diagram and side cross-sectional diagram.

Figure 15C:
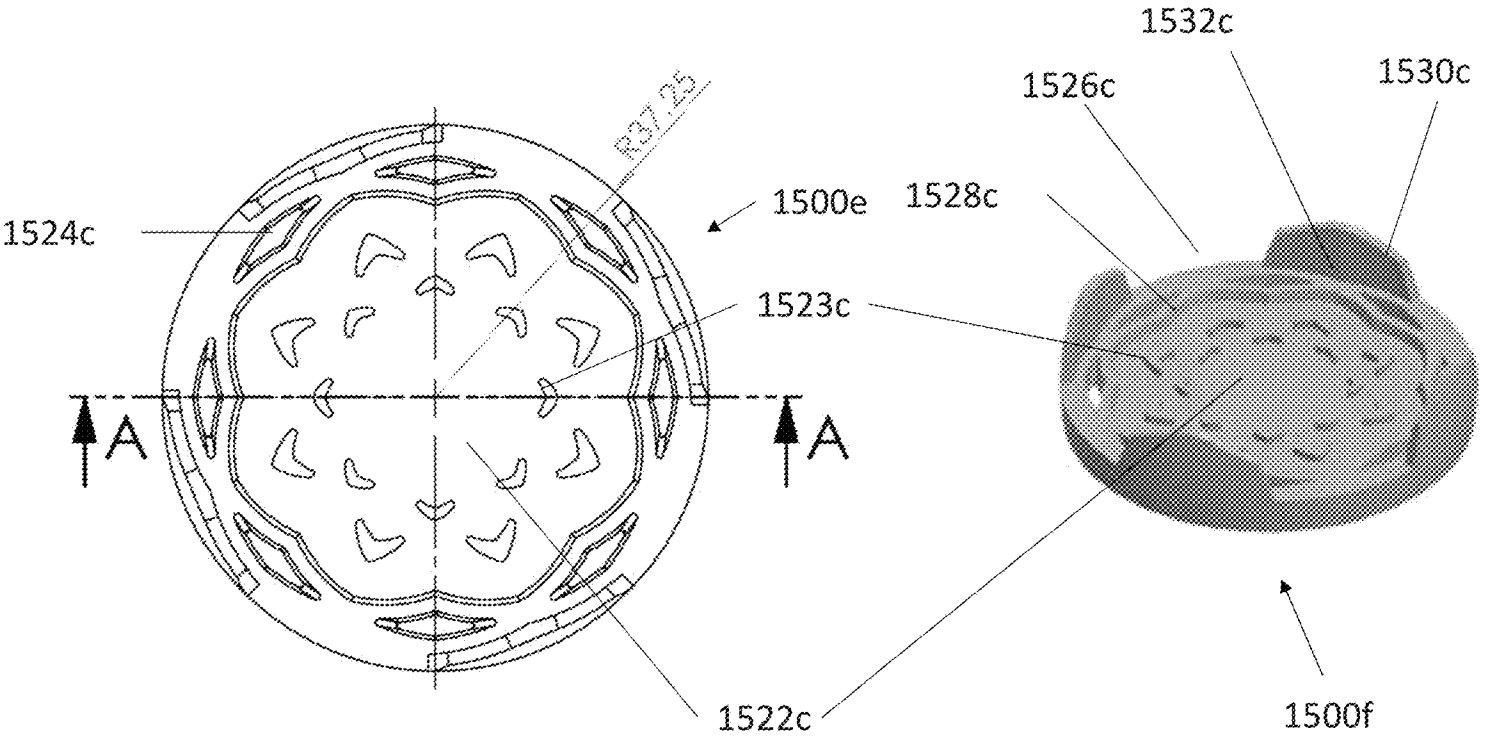

FIG. 15C shows an example embodiment of a heat management device base plate from a top view diagram and mockup.

Figure 15D:
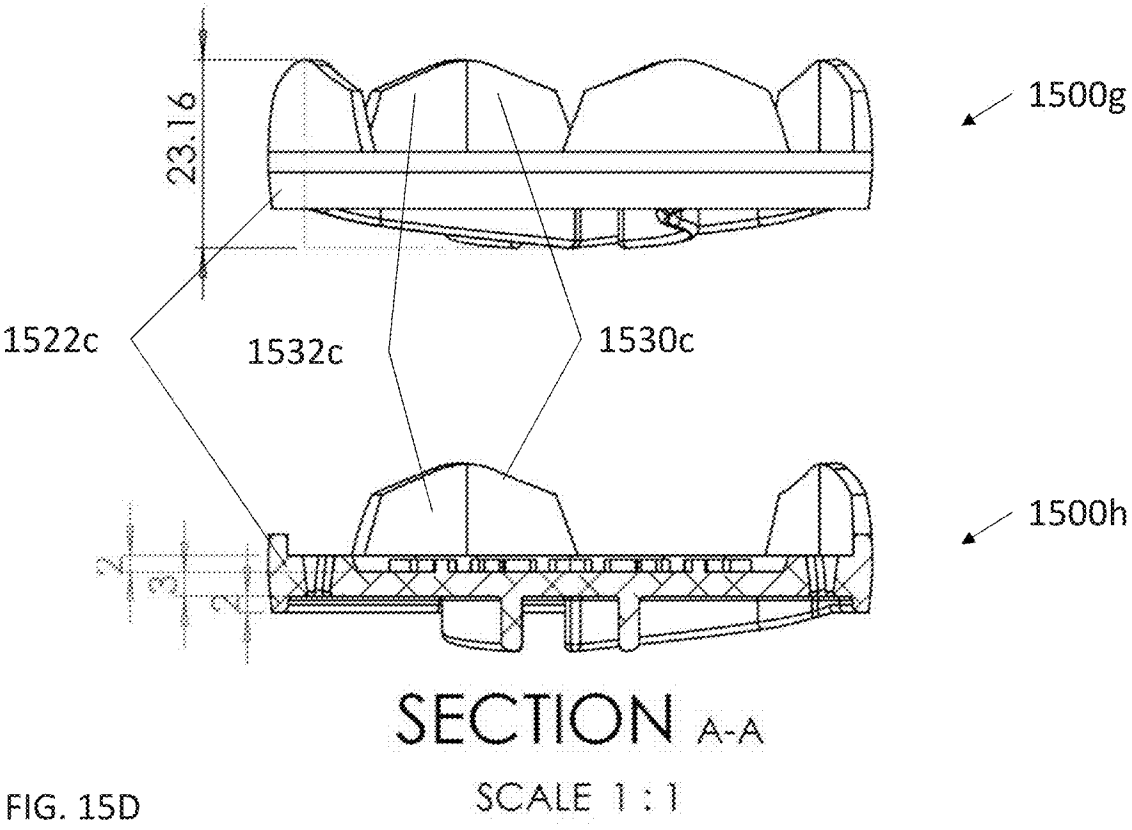

FIG. 15D shows an example embodiment of a heat management device base plate from a side view diagram and side cross-sectional diagram.

Figure 15E:
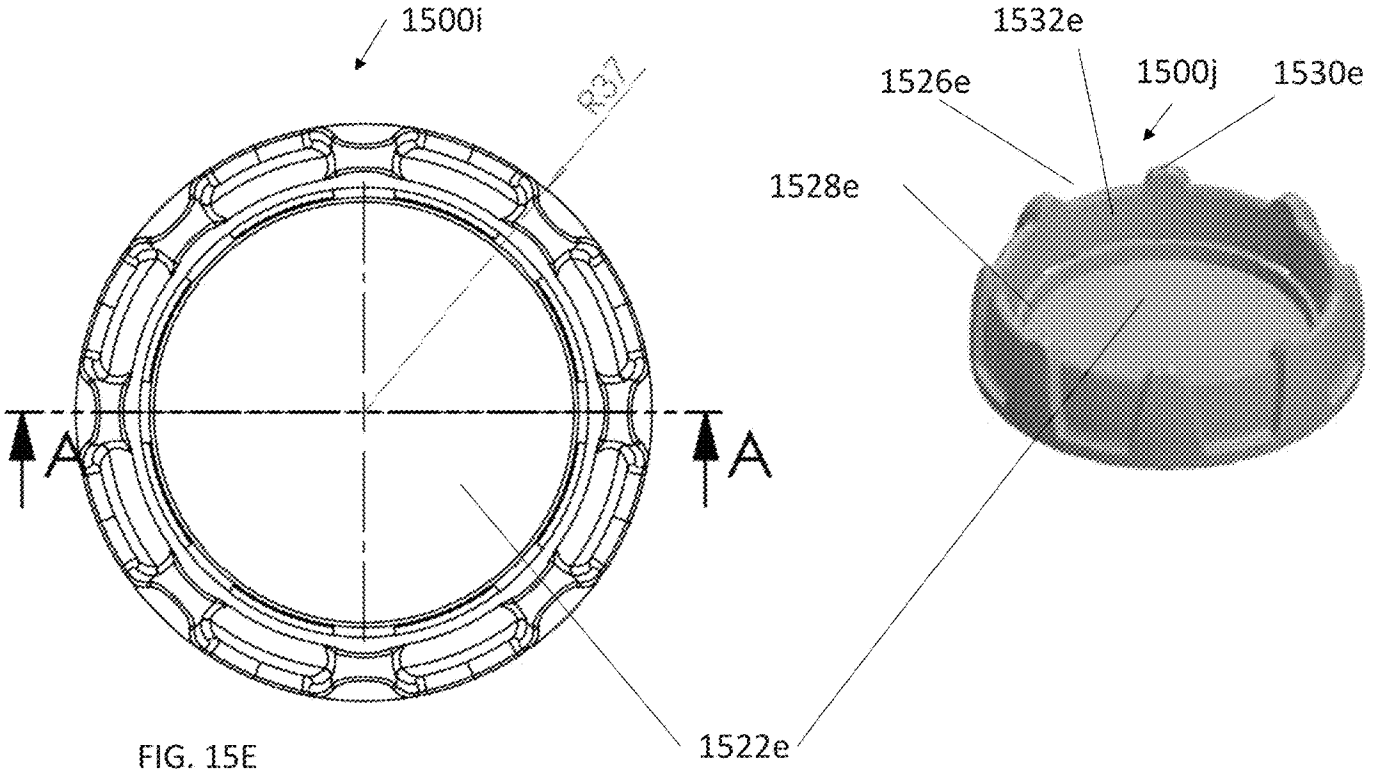

FIG. 15E shows an example embodiment of a heat management device base plate from a top view diagram and mockup.

Figure 15F:
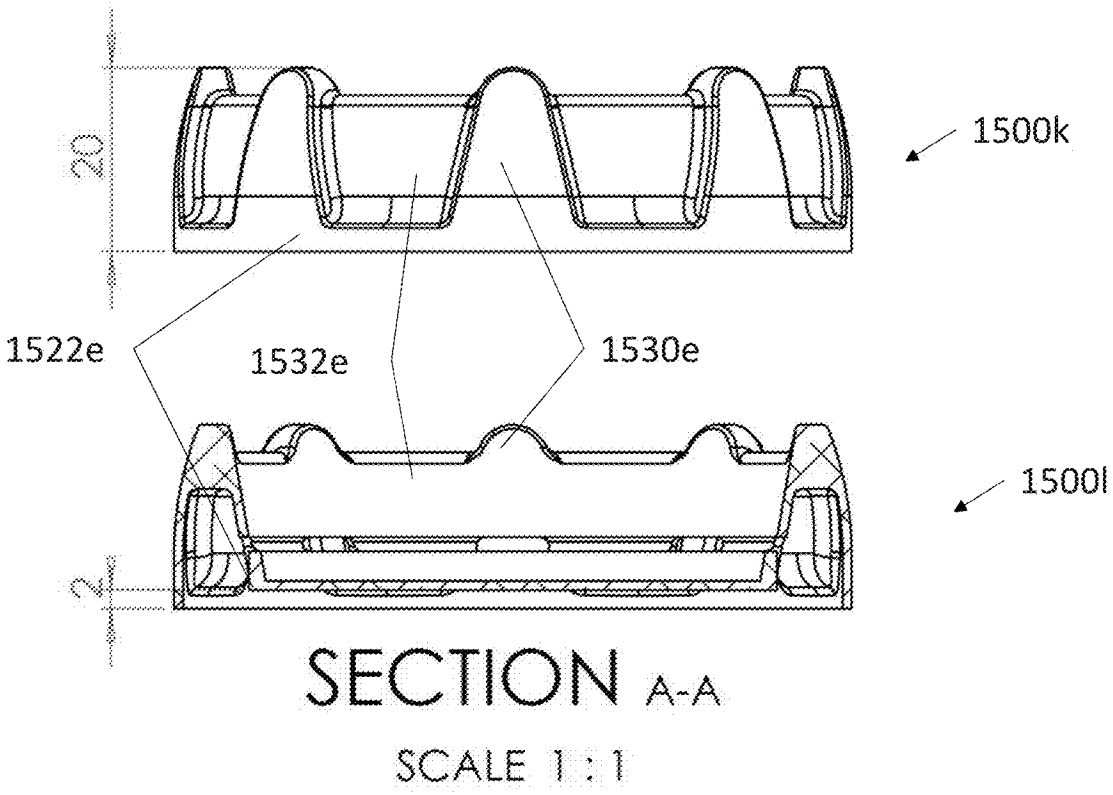

FIG. 15F shows an example embodiment of a heat management device base plate from a side view diagram and side cross-sectional diagram.

Figure 15G:
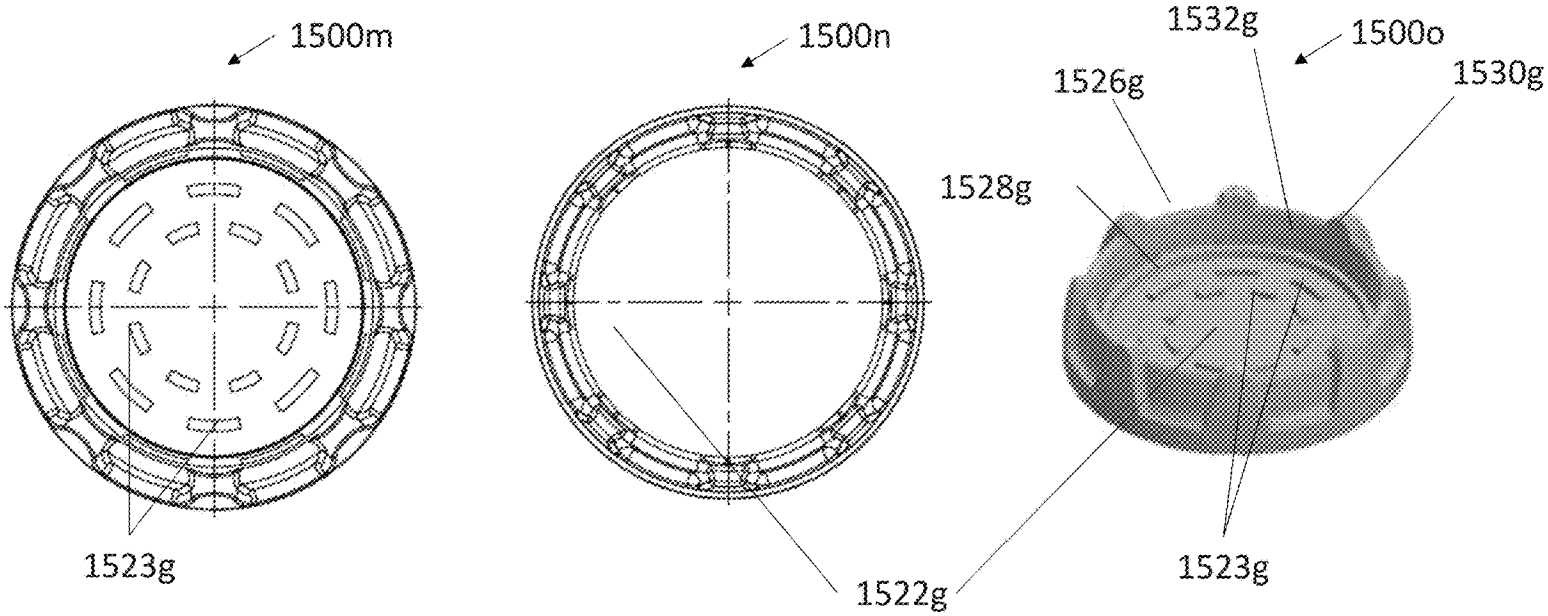

FIG. 15G shows an example embodiment of a heat management device base plate from a top view diagram, bottom view diagram and mockup.

Figure 15H:
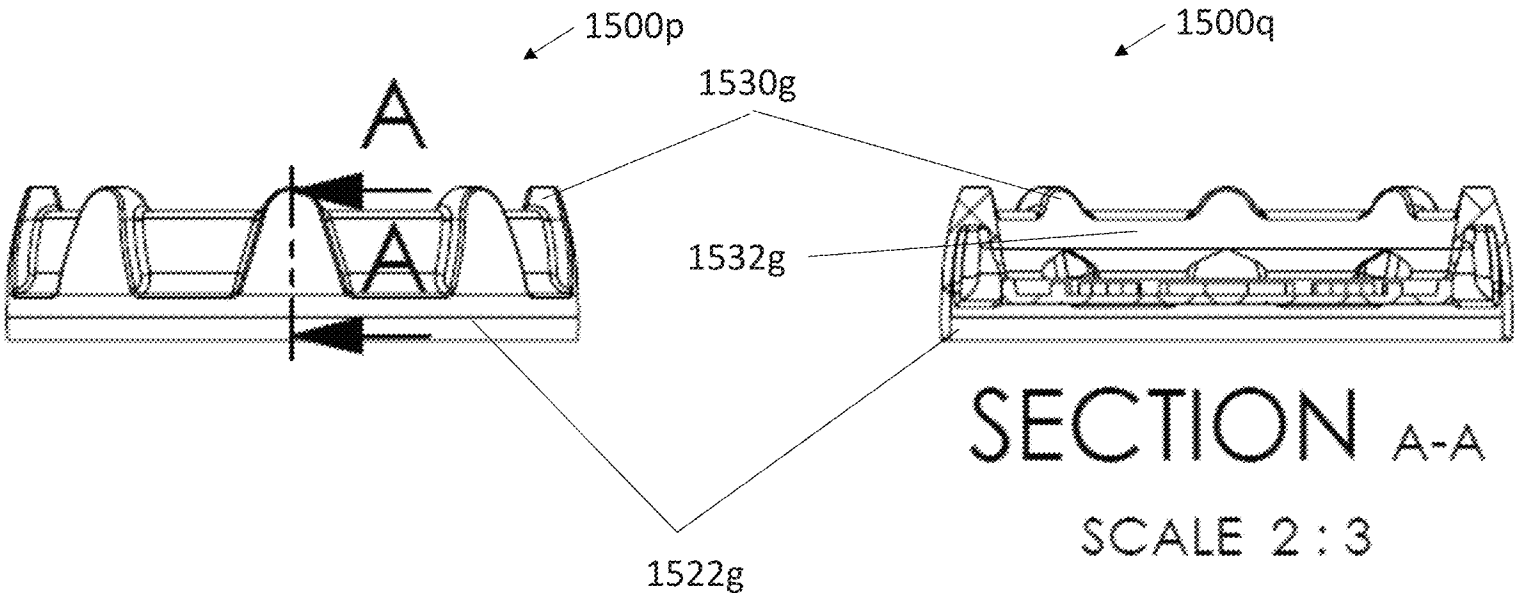

FIG. 15H shows an example embodiment of a heat management device base plate from a side view diagram and side cross-sectional diagram.

Figure 15I:
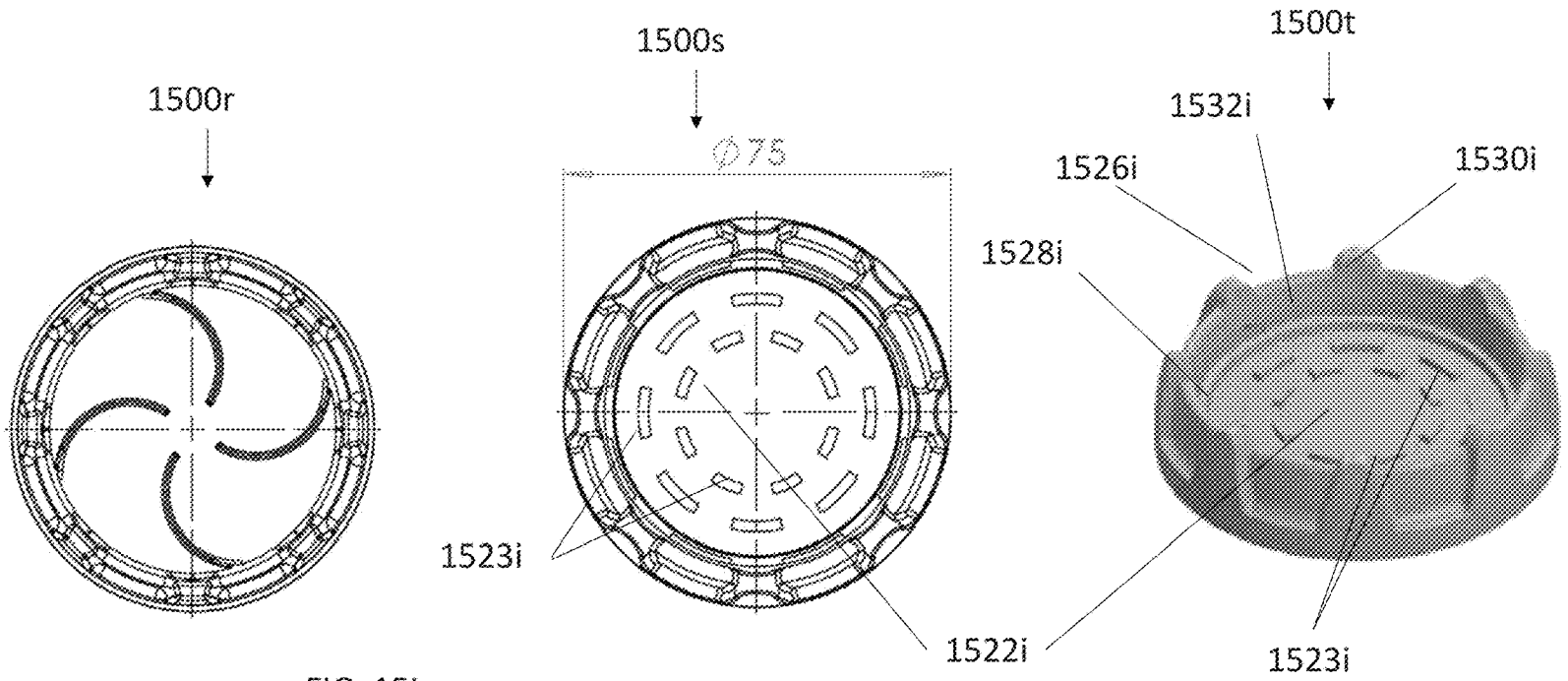

FIG. 15I shows an example embodiment of a heat management device base plate from a bottom view diagram, top view diagram and mockup.

Figure 15J:
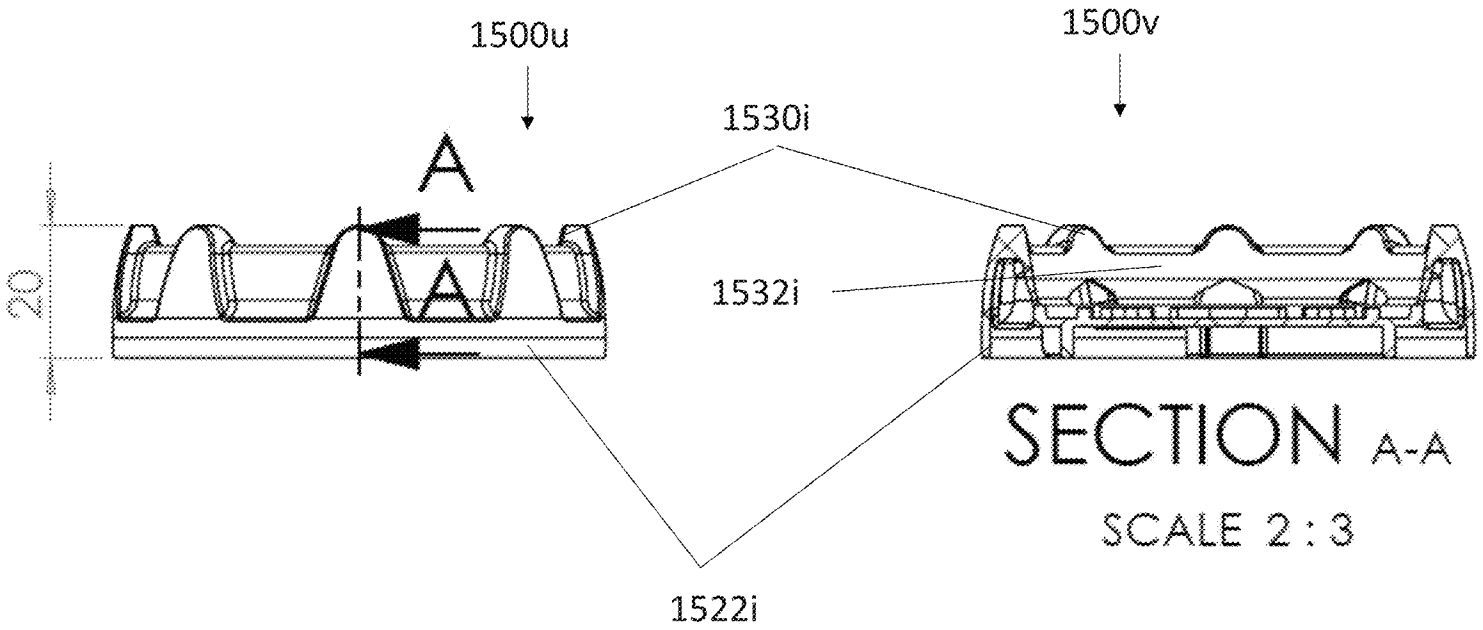

FIG. 15J shows an example embodiment of a heat management device base plate from a side view diagram and side cross-sectional diagram.

Figure 15K:
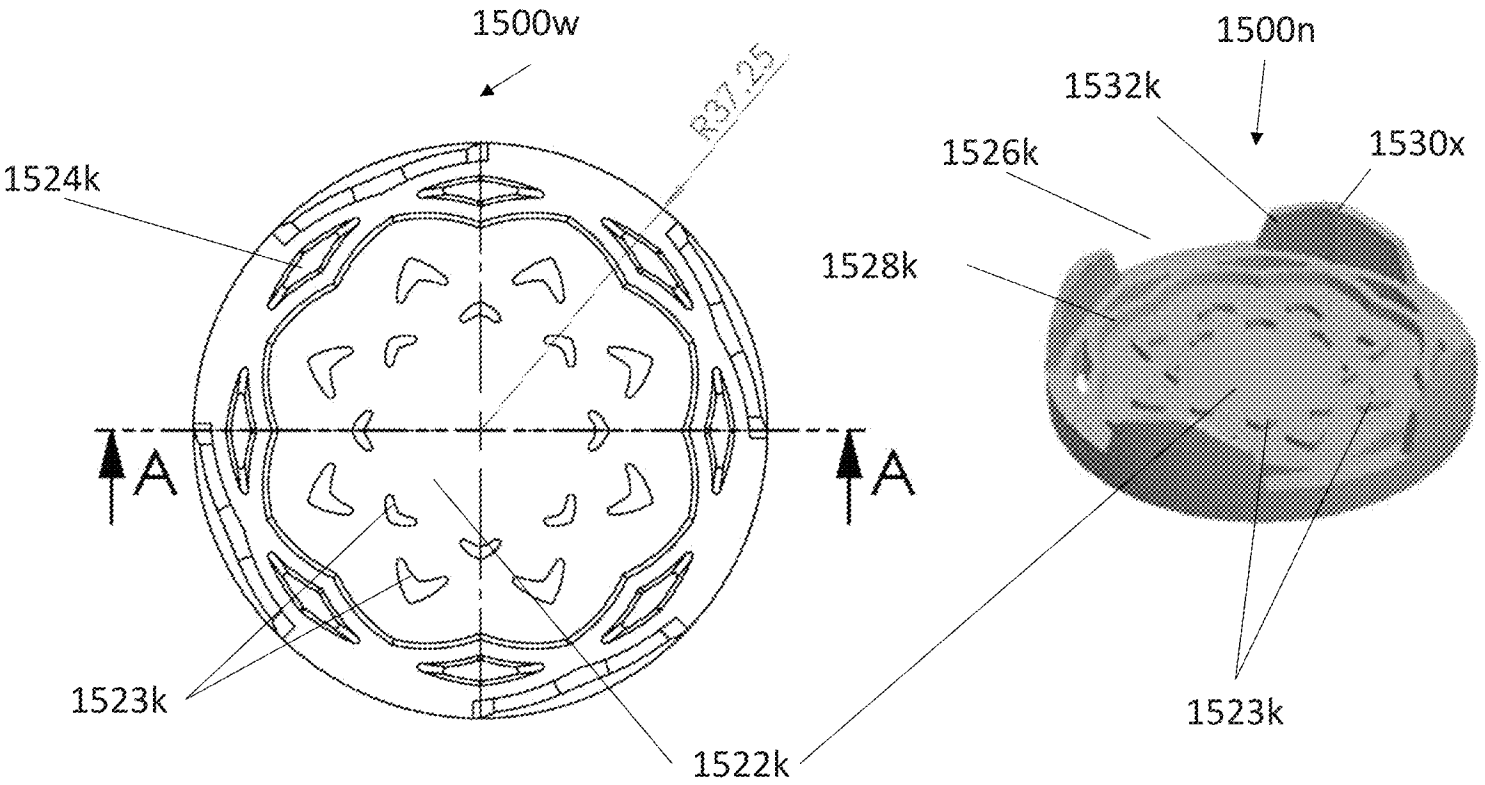

FIG. 15K shows an example embodiment of a heat management device base plate from a top view diagram and mockup.

Figure 15L:
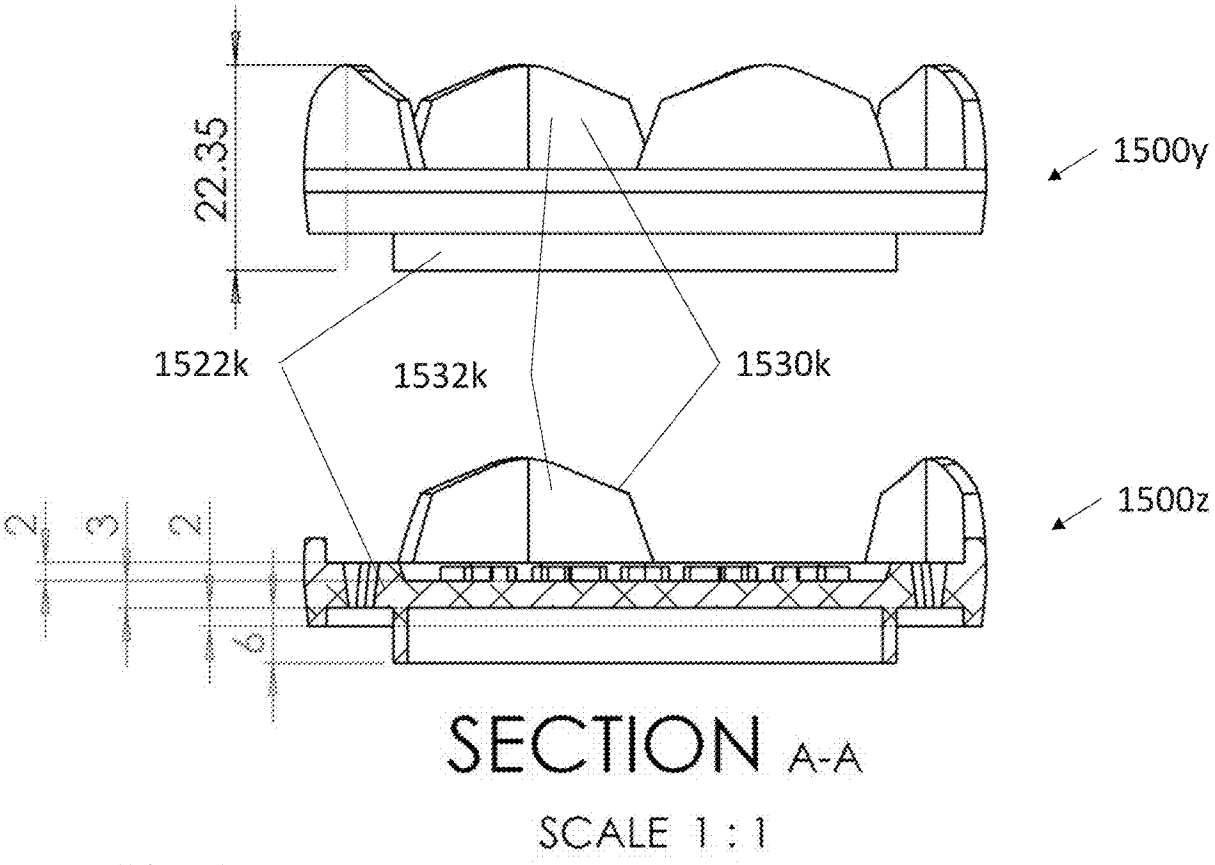

FIG. 15L shows an example embodiment of a heat management device base plate from a side view diagram and side cross-sectional diagram.

Figure 15M:
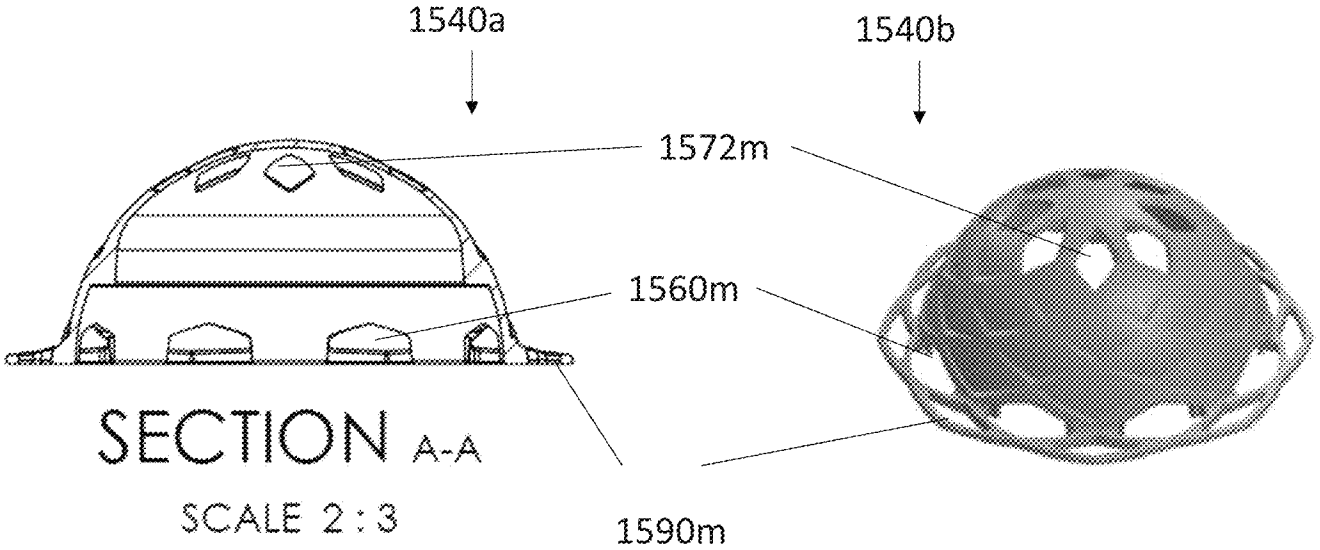

FIG. 15M shows an example embodiment of a heat management device domed lid from a side cross sectional view diagram and mockup.

Figure 15N:
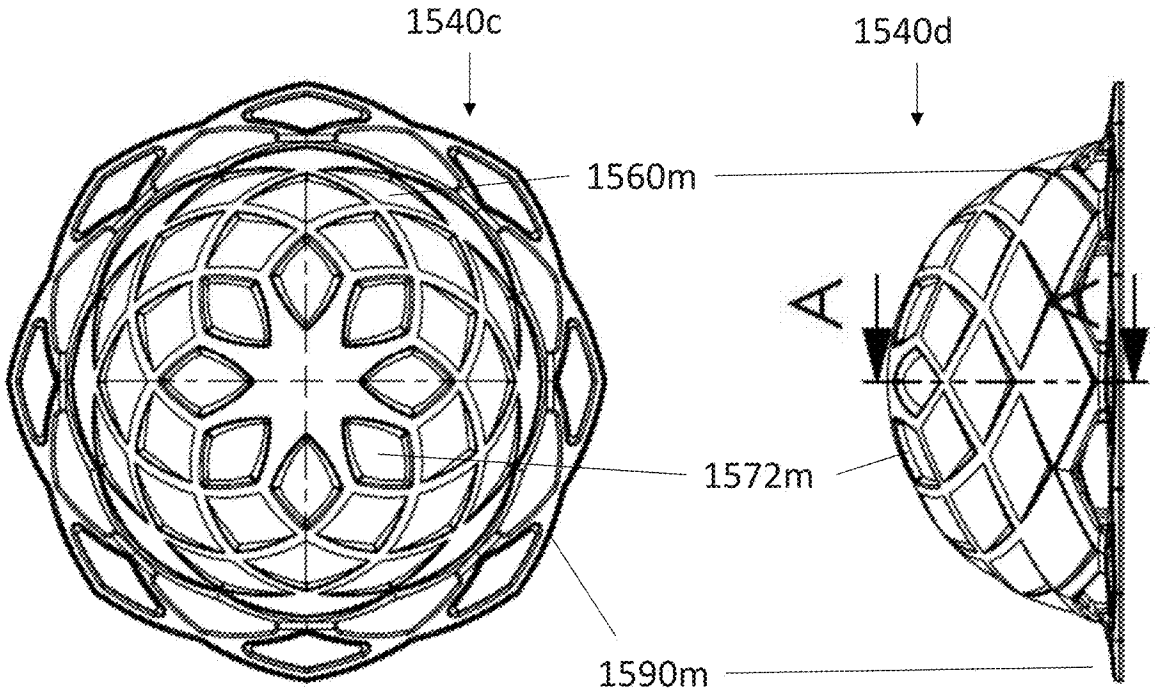

FIG. 15N shows an example embodiment of a heat management device domed lid from a top view and side view diagram.

Figure 15O:
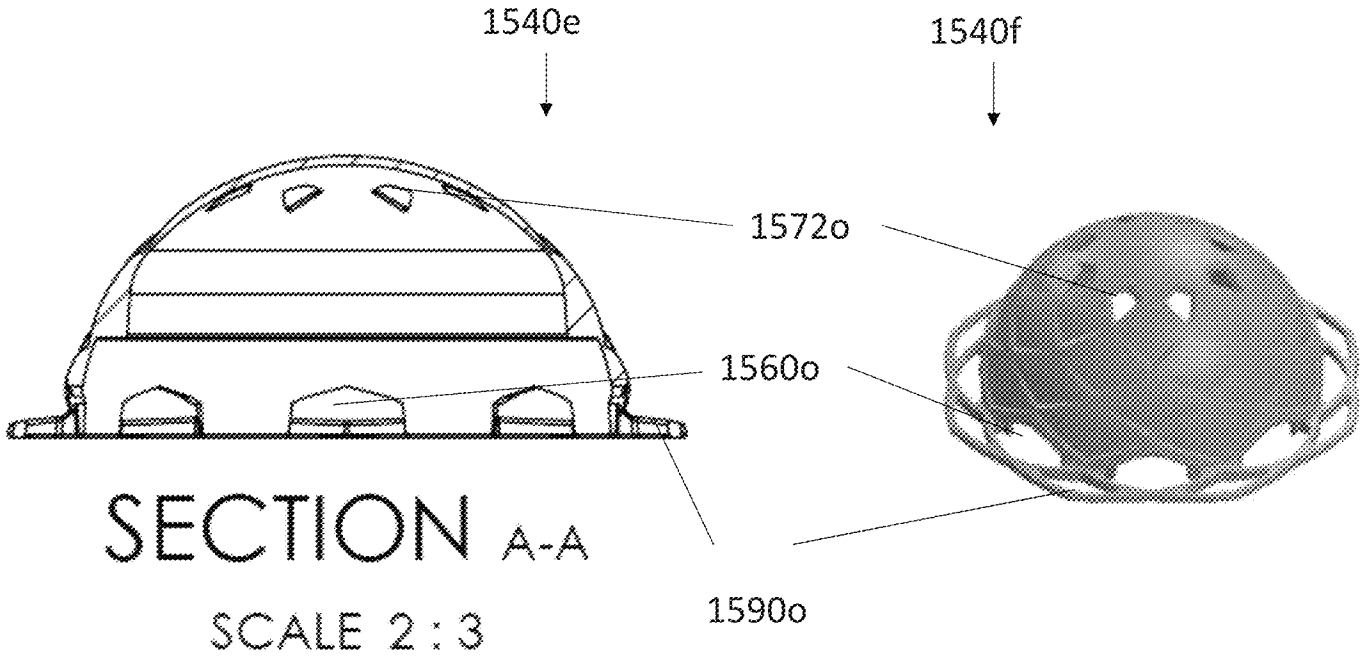

FIG. 15O shows an example embodiment of a heat management device domed lid from a top view and side view diagram.

Figure 15P:
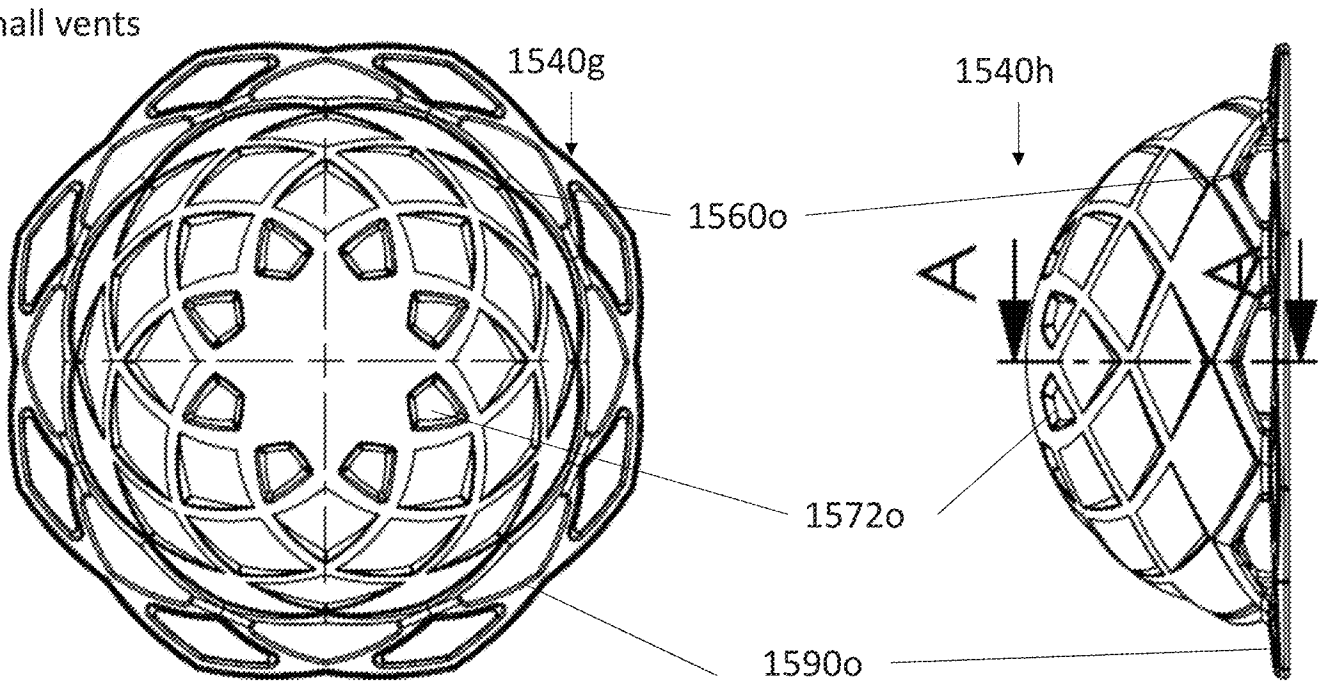

FIG. 15P shows an example embodiment of a heat management device domed lid from a top view and cross-sectional diagram.

Figure 15Q:
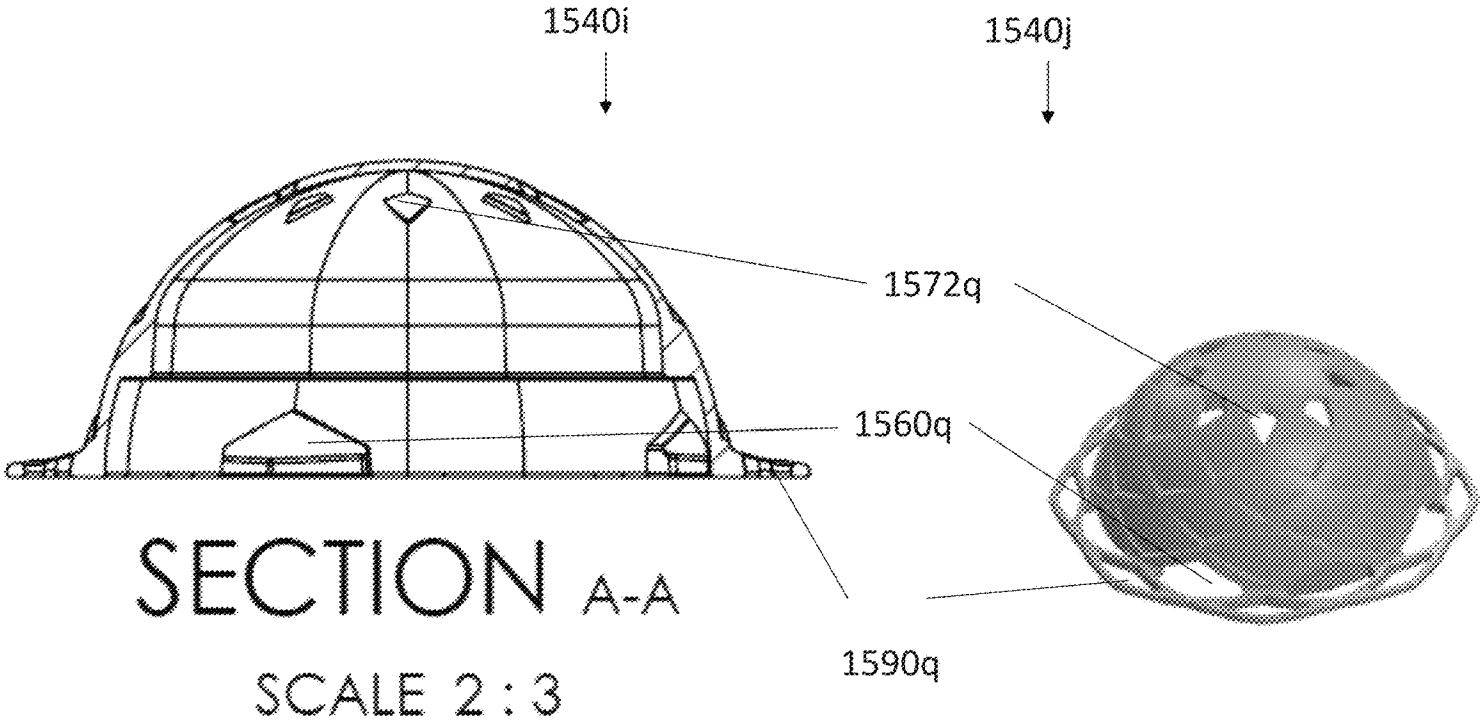

FIG. 15Q shows an example embodiment of a heat management device domed lid from a side cross sectional view diagram and mockup.

Figure 15R:
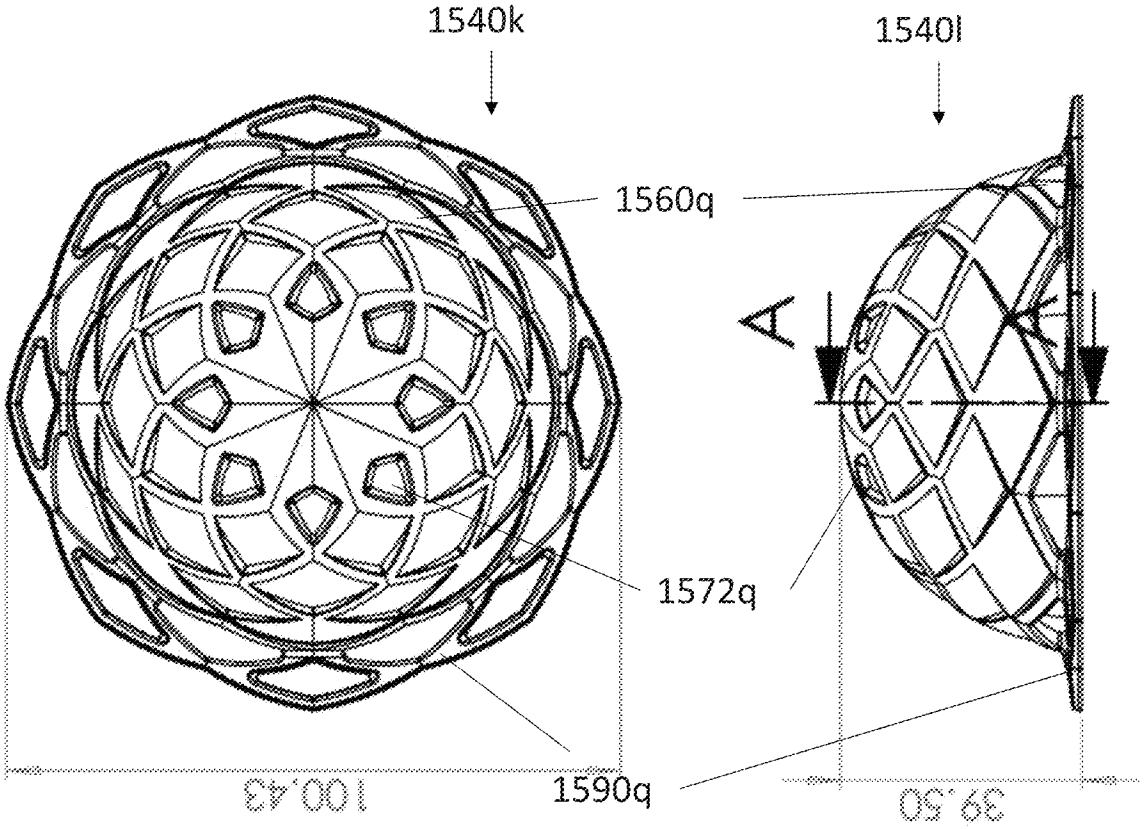

FIG. 15R shows an example embodiment of a heat management device domed lid from a top view and side view diagram.

Figure 15S:
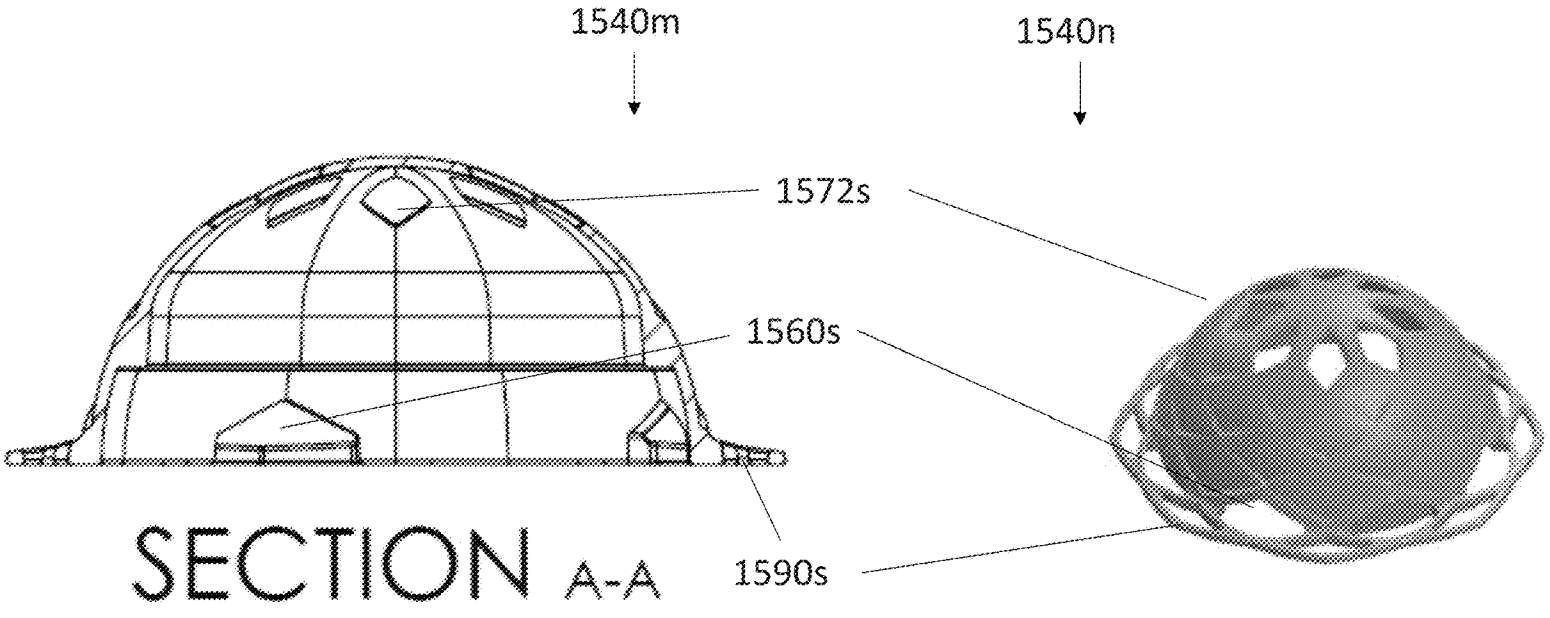

FIG. 15S shows an example embodiment of a heat management device domed lid from a side cross sectional view diagram and mockup.

Figure 15T:
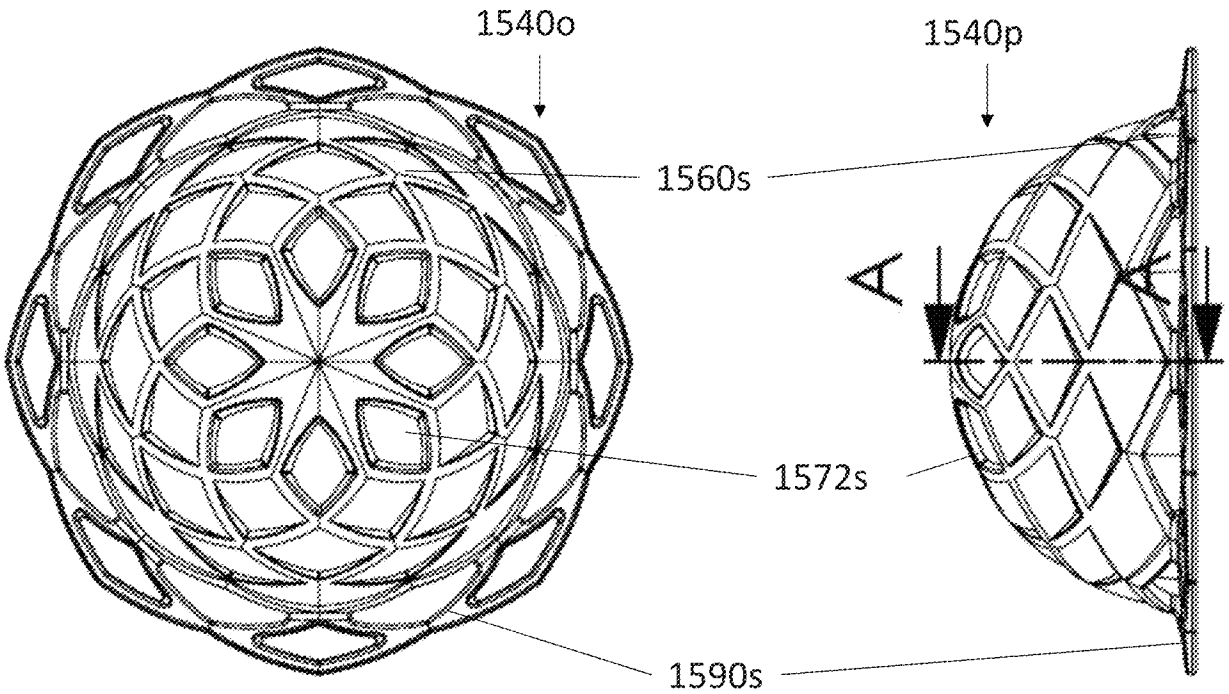

FIG. 15T shows an example embodiment of a heat management device base plate from a top view and side view diagram.

Figure 16A:
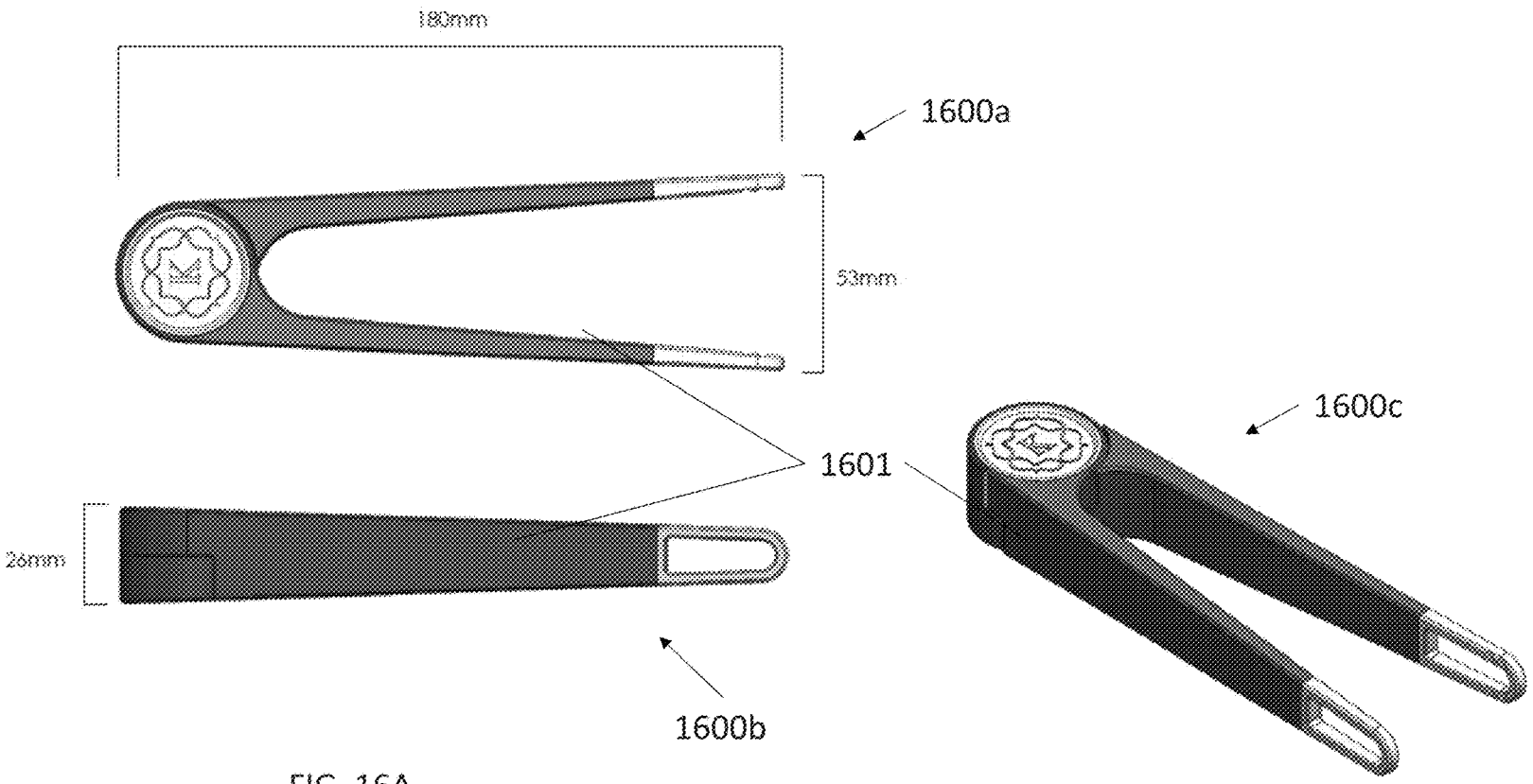

FIG. 16A shows an example embodiment of tongs from a top view, side view, and perspective view.

Figure 16B:
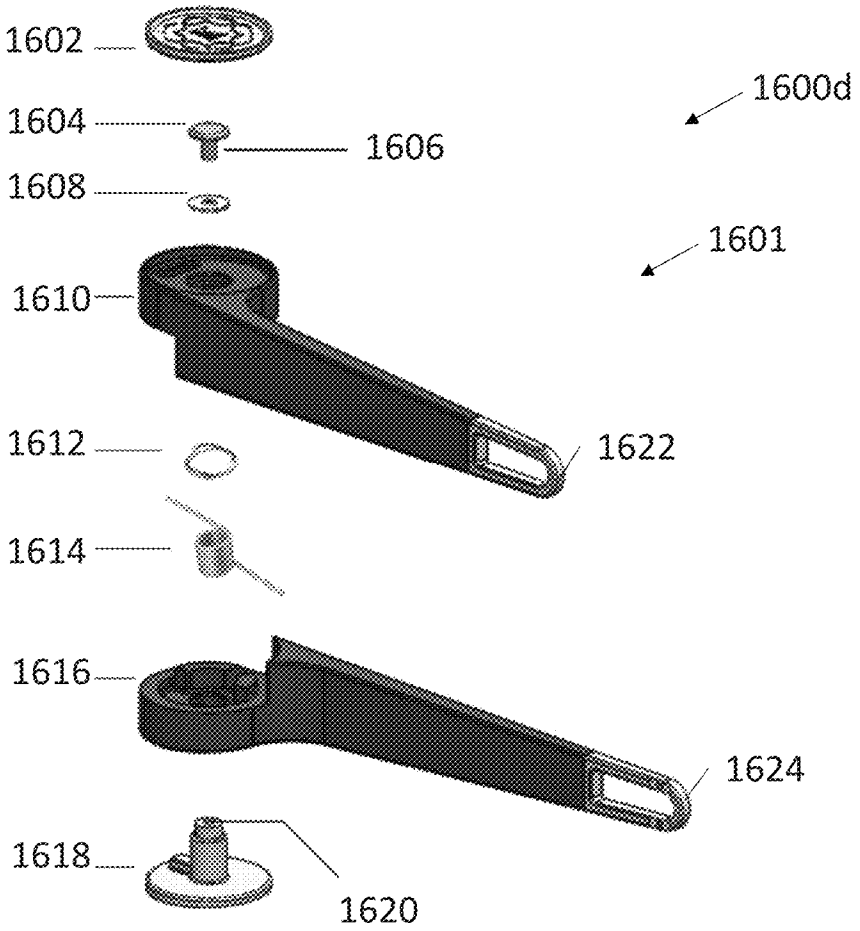

FIG. 16B shows an example embodiment of an exploded tongs diagram

Figure 16C:
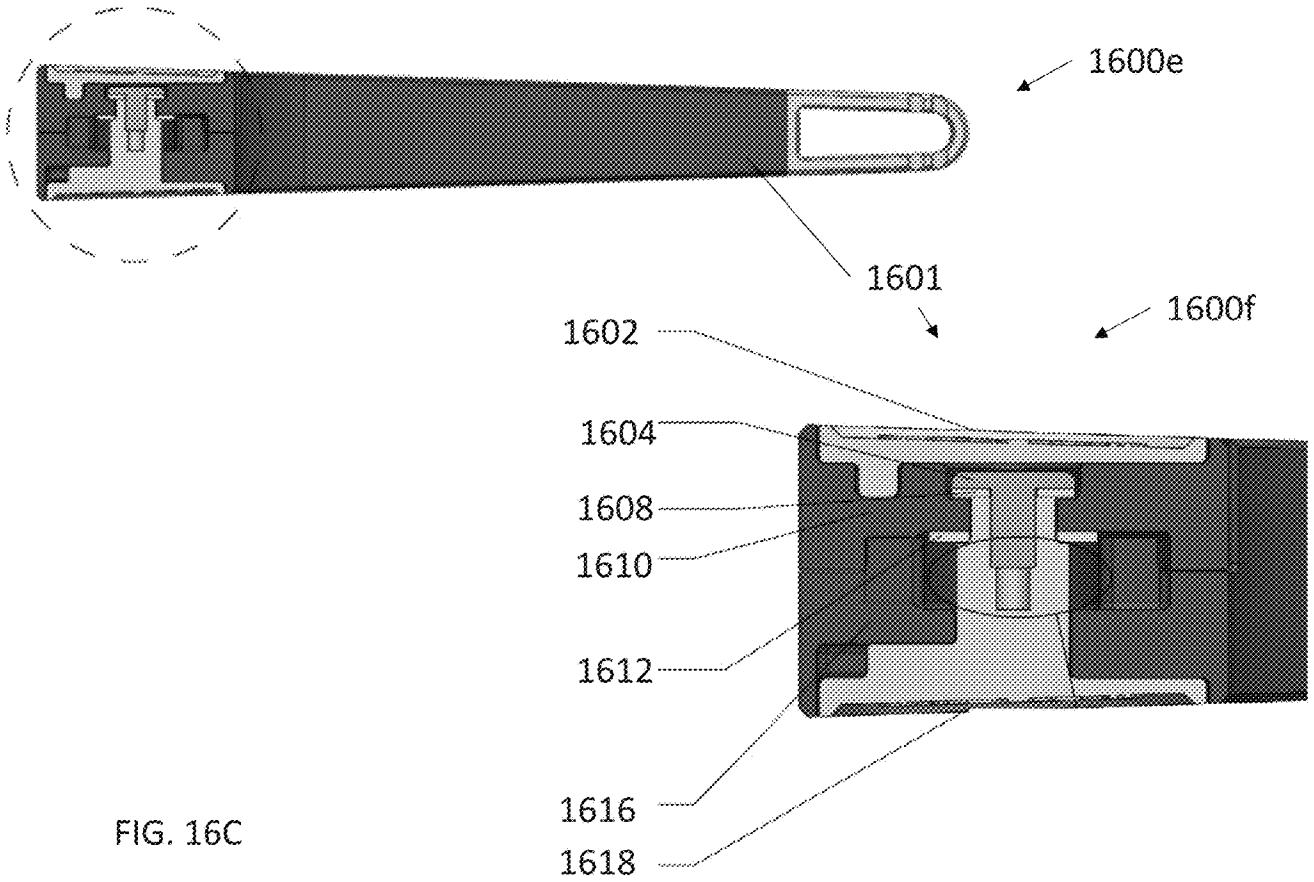

FIG. 16C shows an example embodiment of tongs side cross-sectional diagram and detail.

Figure 17A:
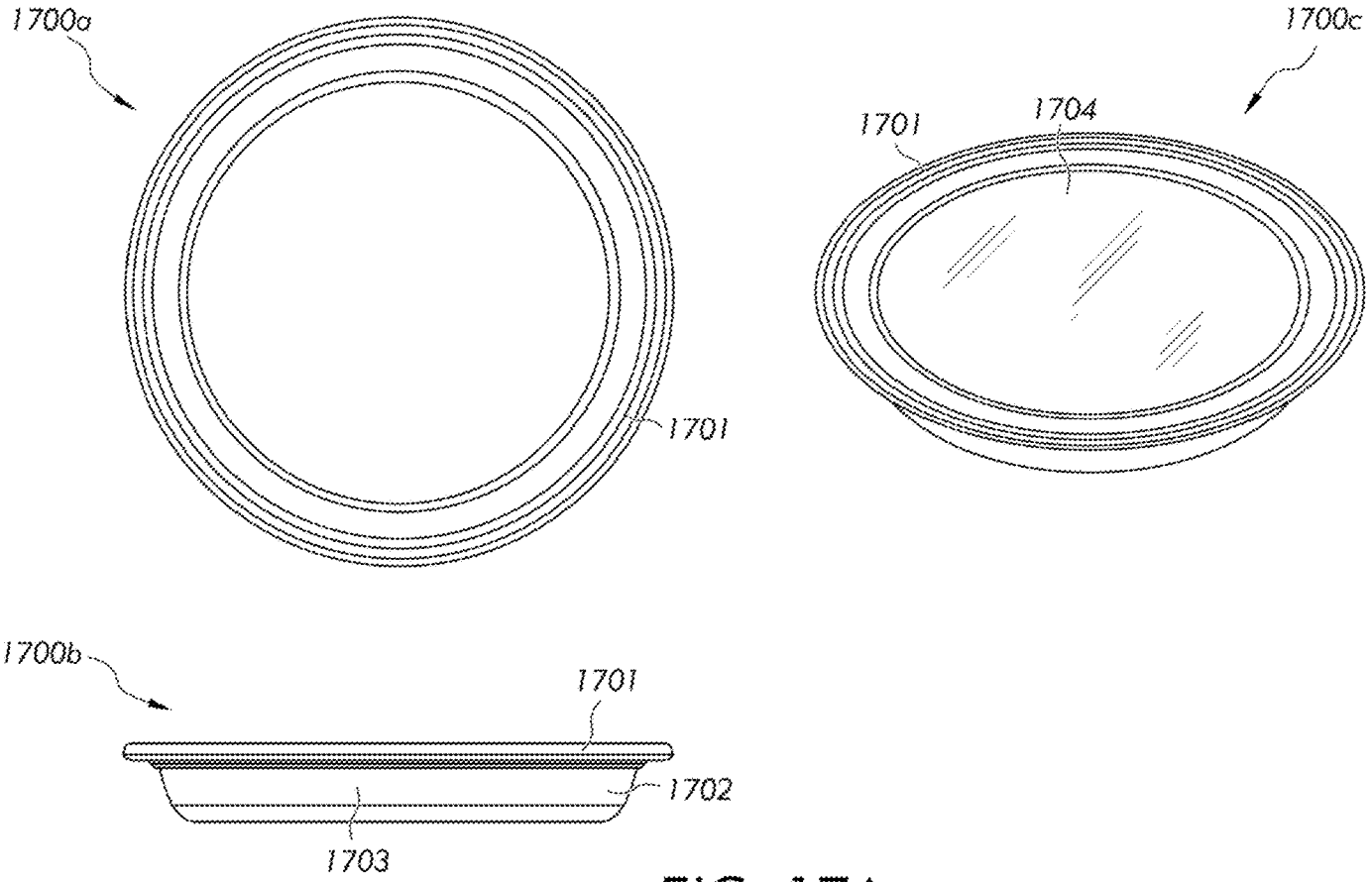

FIG. 17A shows an example embodiment of a lighting puck from a top view, side view and perspective view.

Figure 17B:
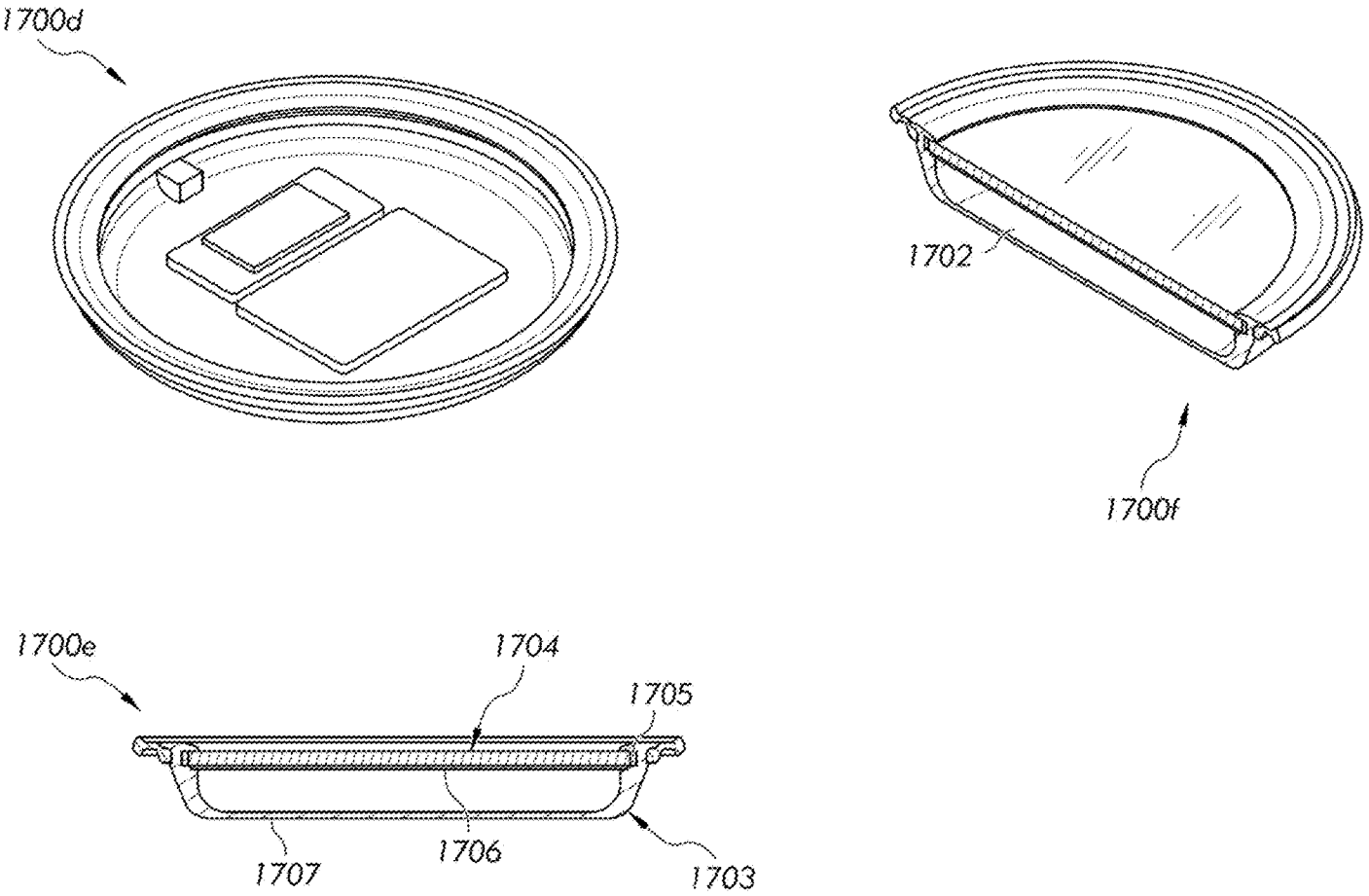

FIG. 17B shows an example embodiment of a lighting puck from a top perspective view, side cross sectional view and perspective cross sectional view.

Figure 17C:
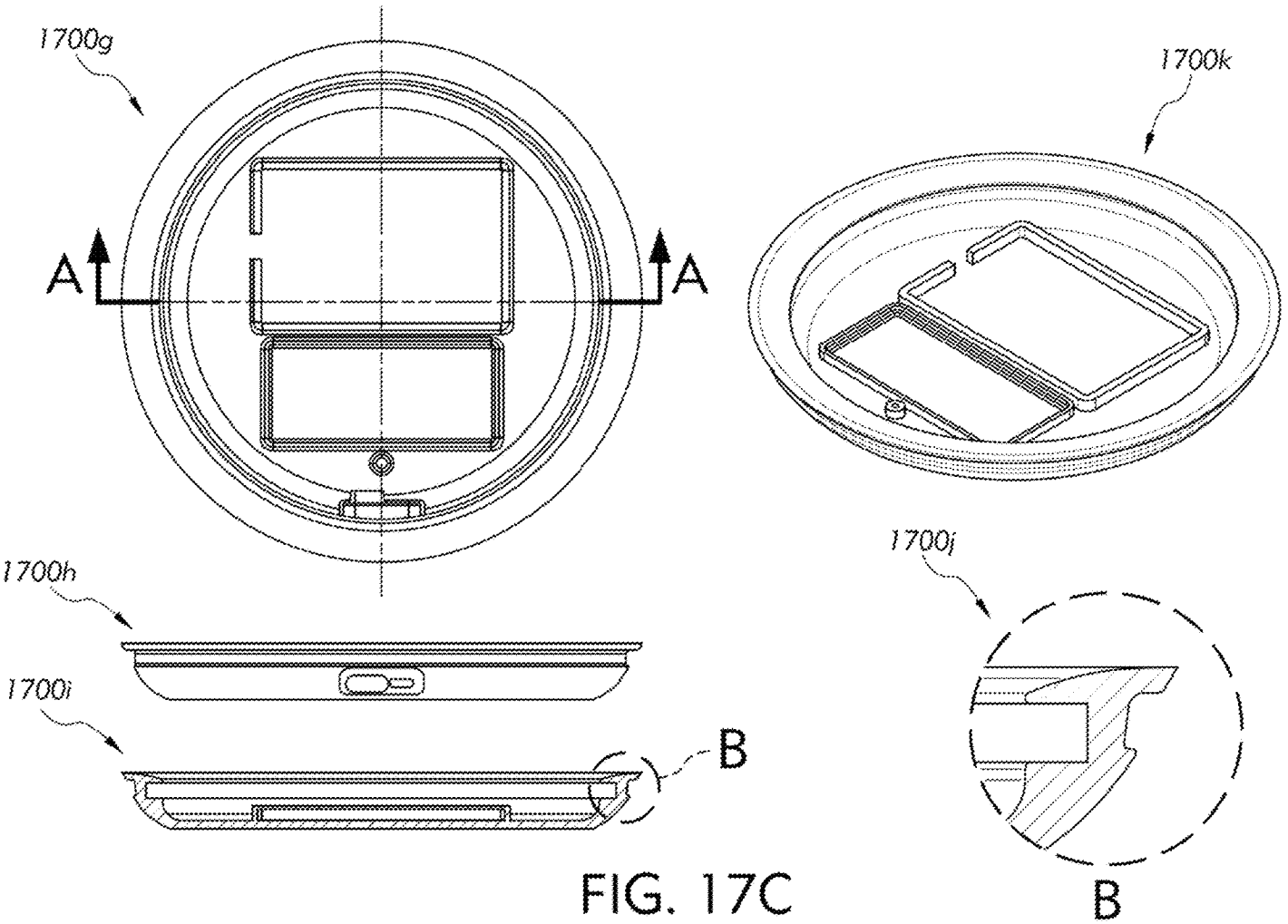

FIG. 17C shows an example embodiment of a lighting puck from a top view, side views, detail view and perspective view.

Figure 17D:
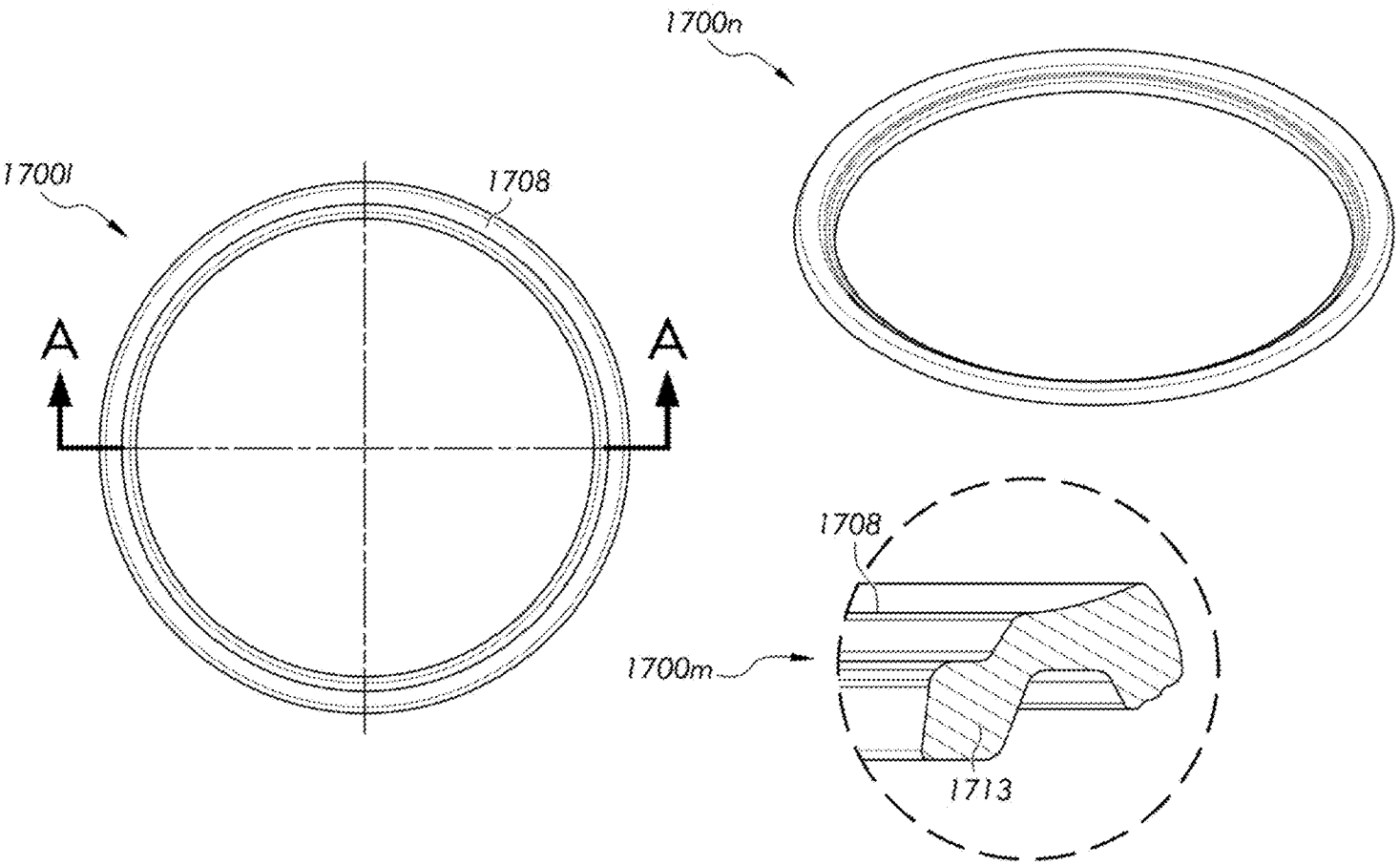

FIG. 17D shows an example embodiment of a lighting puck from a top view, side view and perspective view.

Figure 17E:
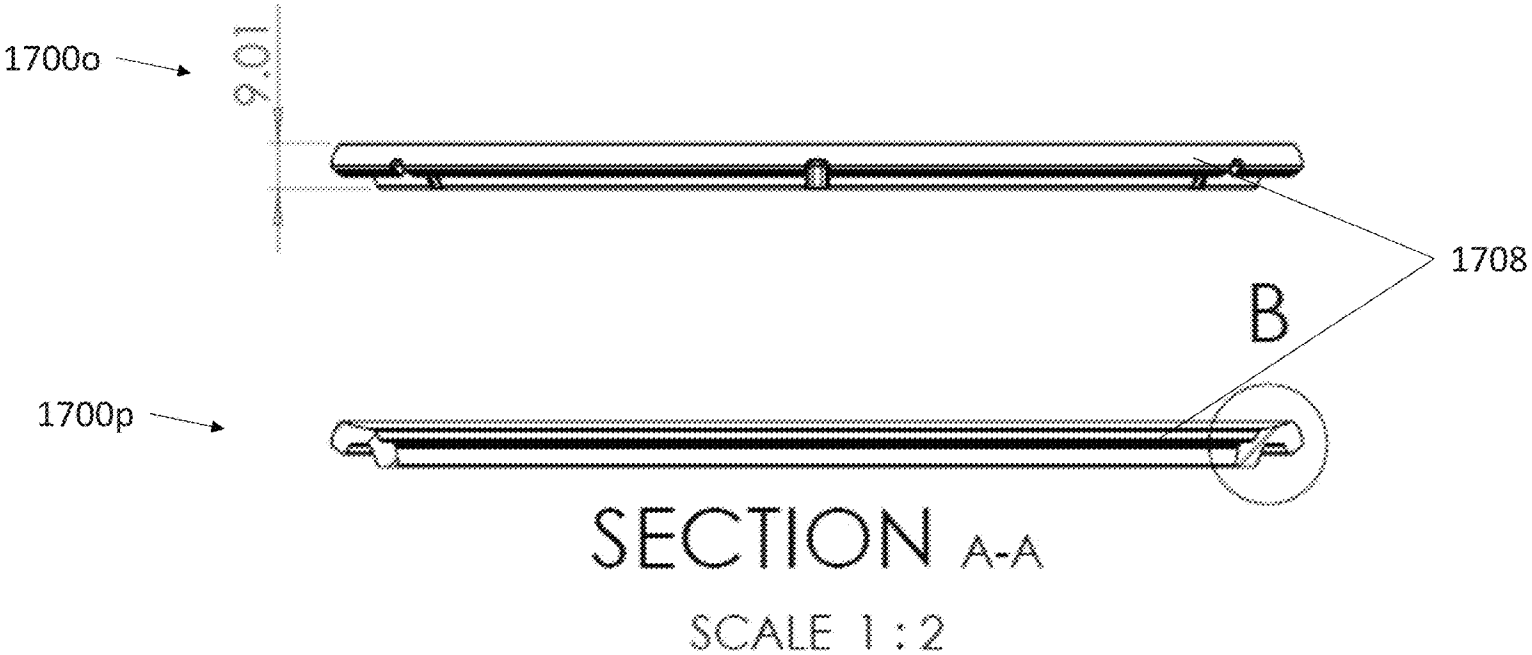

FIG. 17E shows an example embodiment of a lighting puck rim from a side view and cross-sectional side view.

FIG. 17F shows an example embodiment of a lighting puck sensor membrane, silicone rim, and detail view.

Figure 17G:
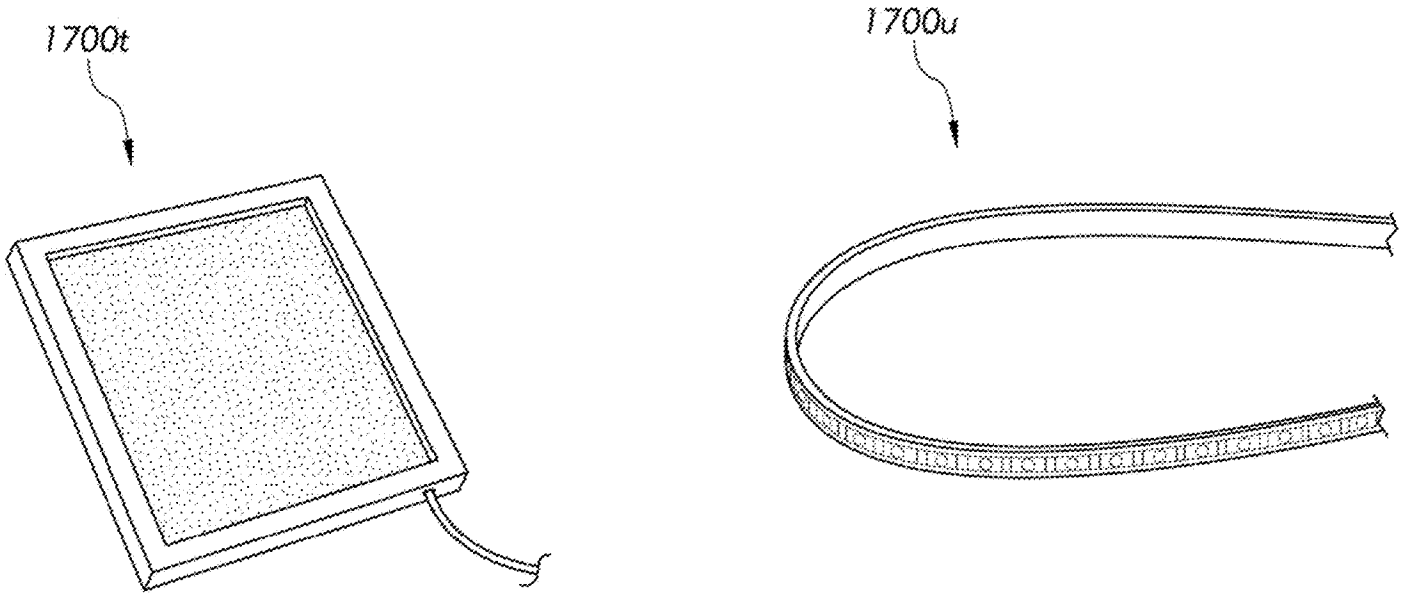

FIG. 17G shows an example embodiment of a lighting puck LED panel LED strip.

FIGS. 18A-18I show example embodiments of user interface screens for use with an LED lighting puck.

Figure 18A:
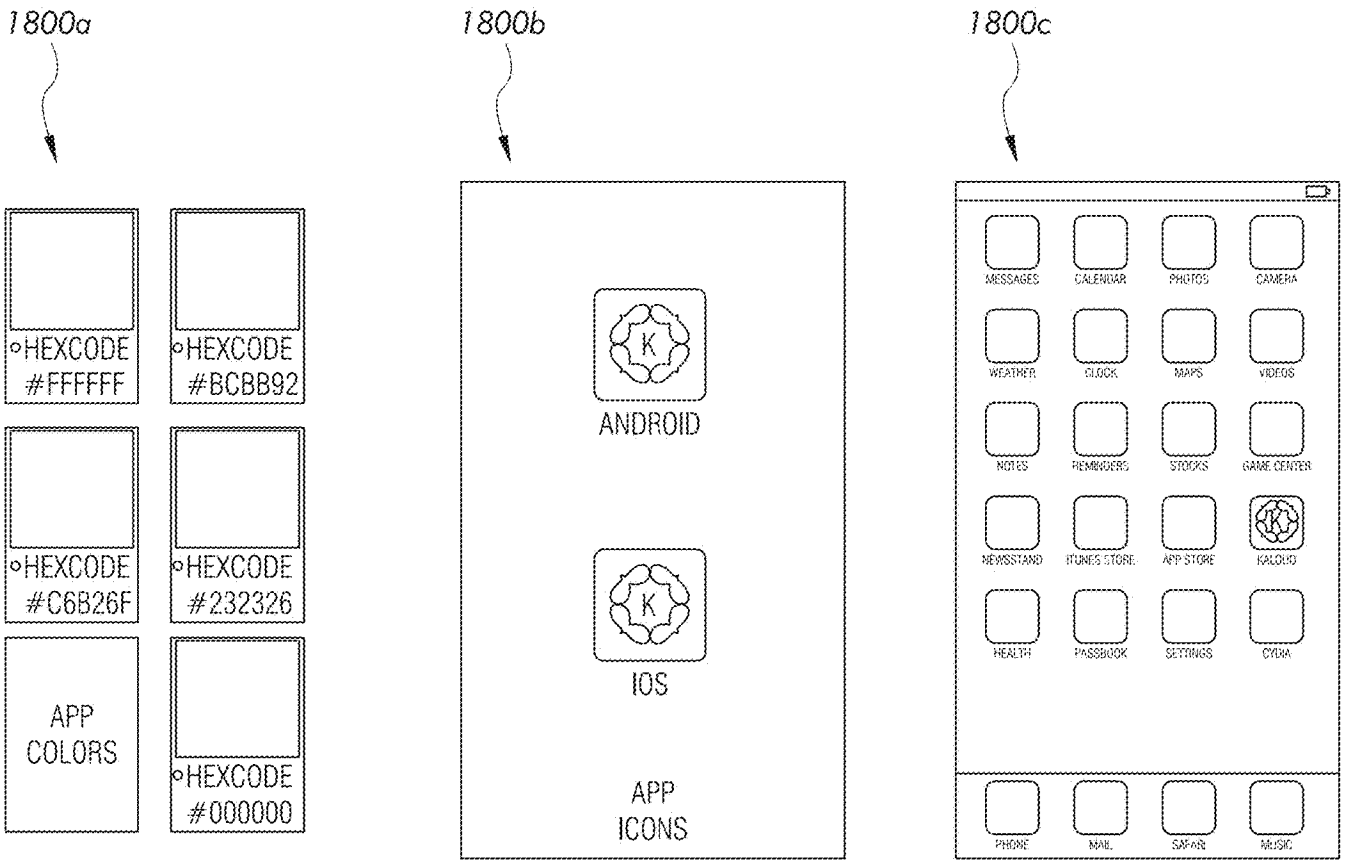
Figure 18B:
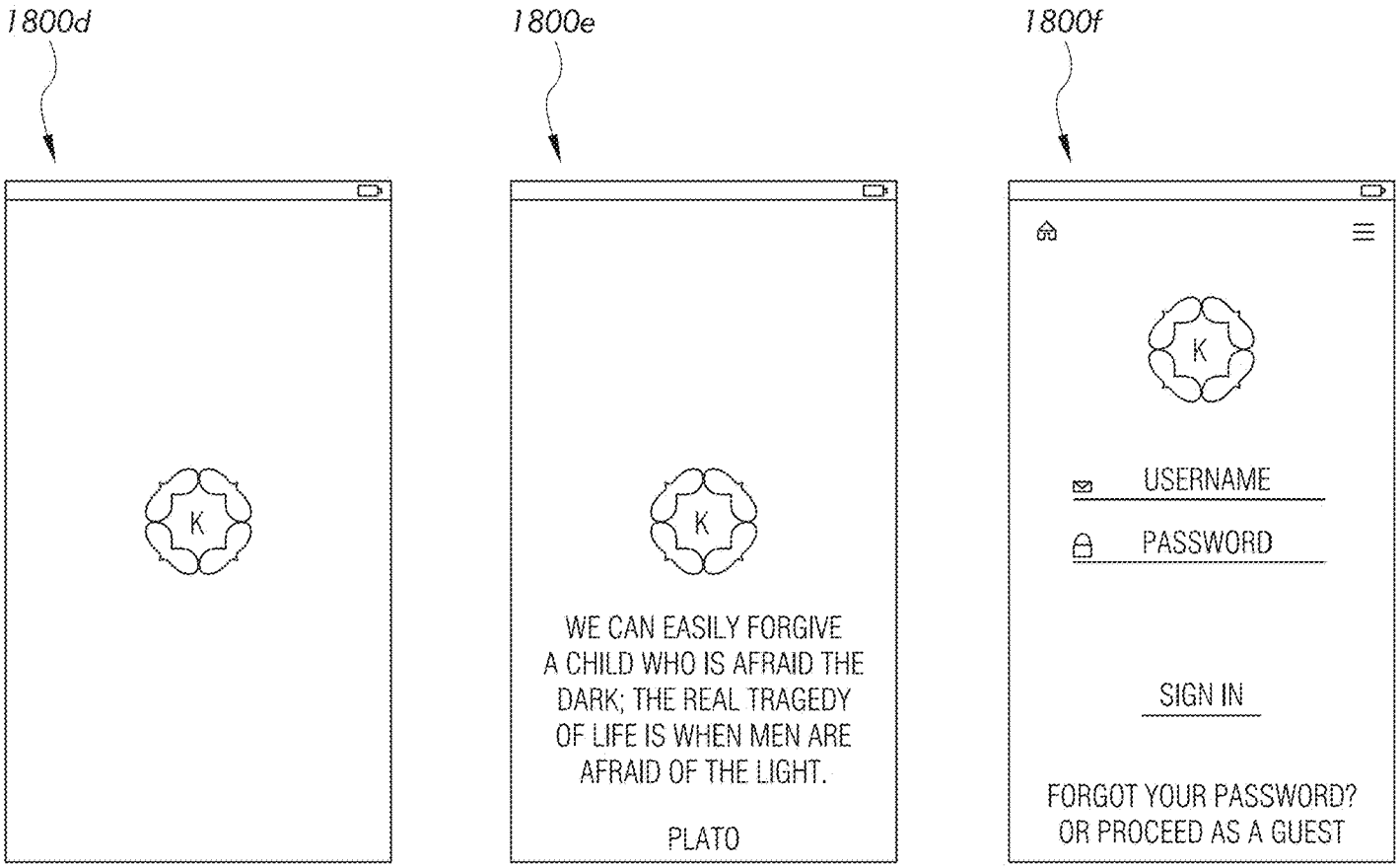
Figure 18C:
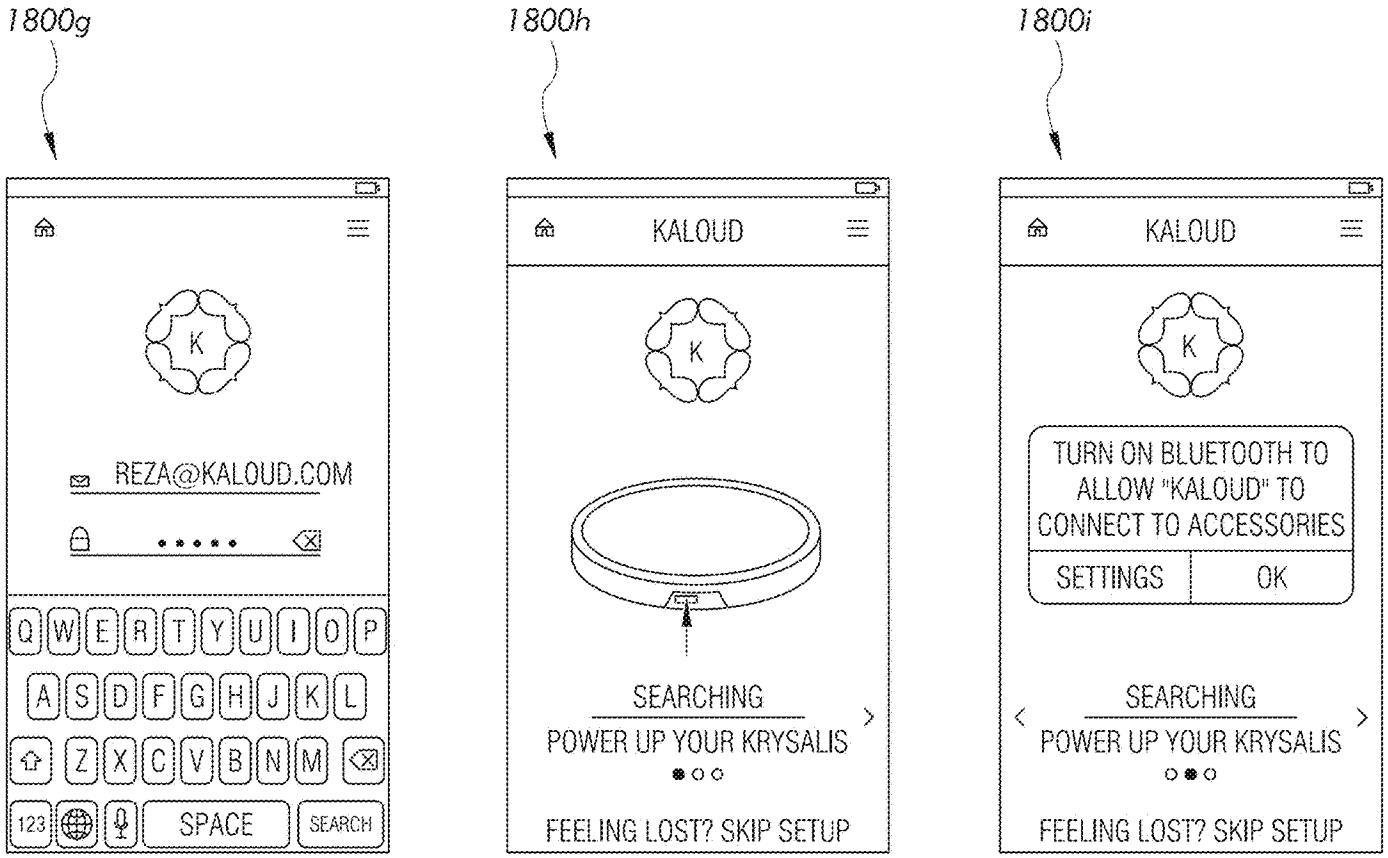
Figure 18D:
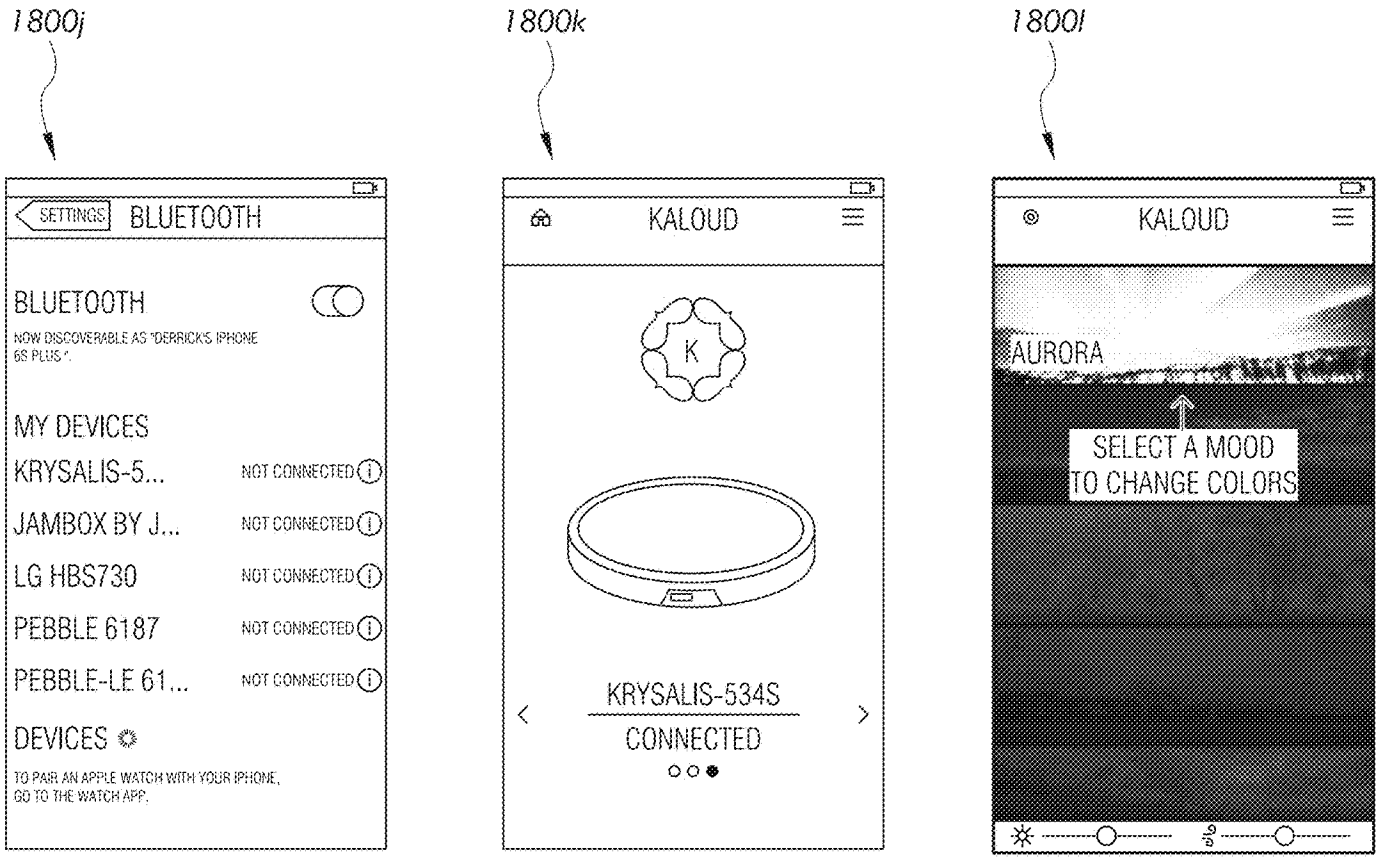
Figure 18E:
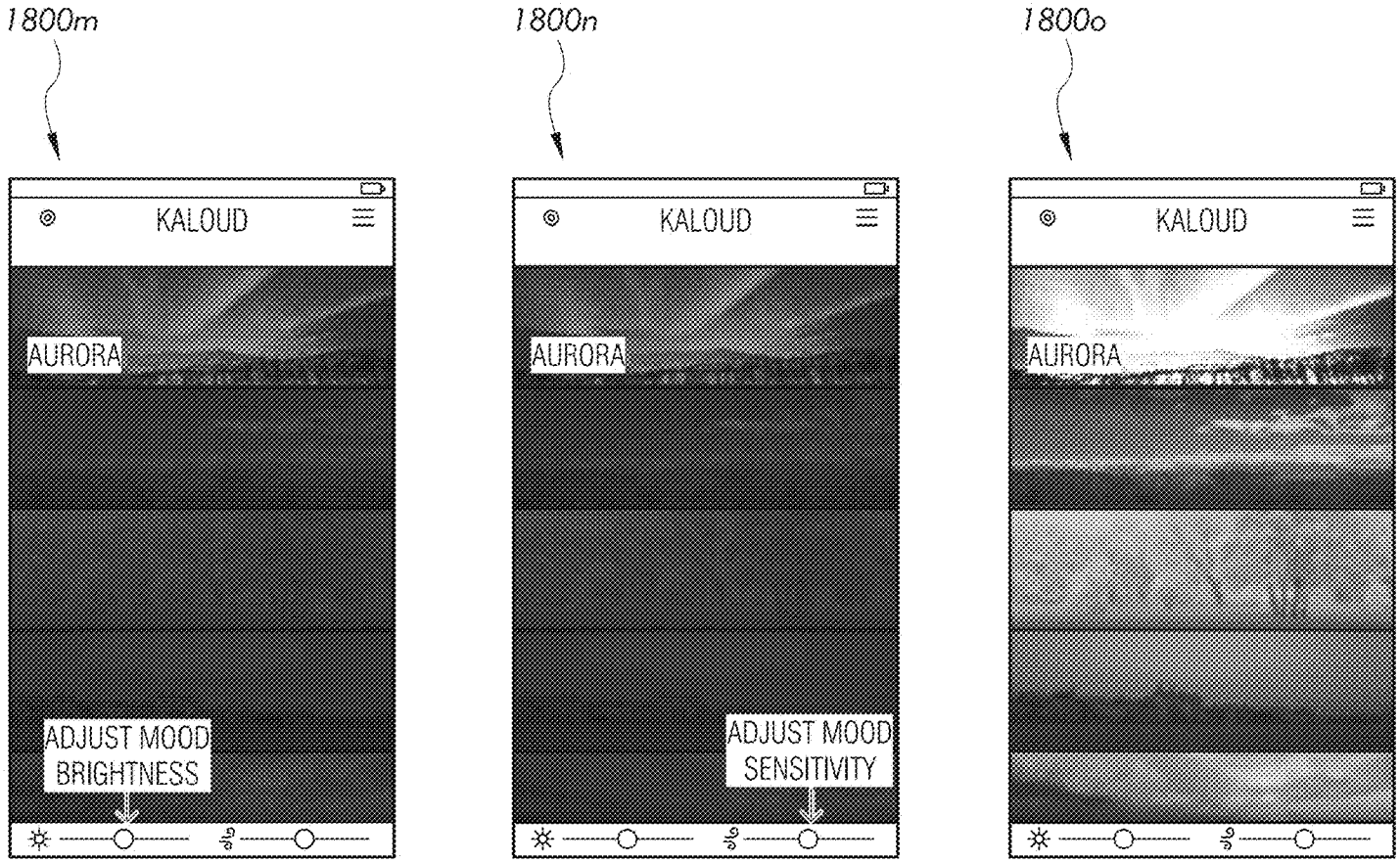
Figure 18F:
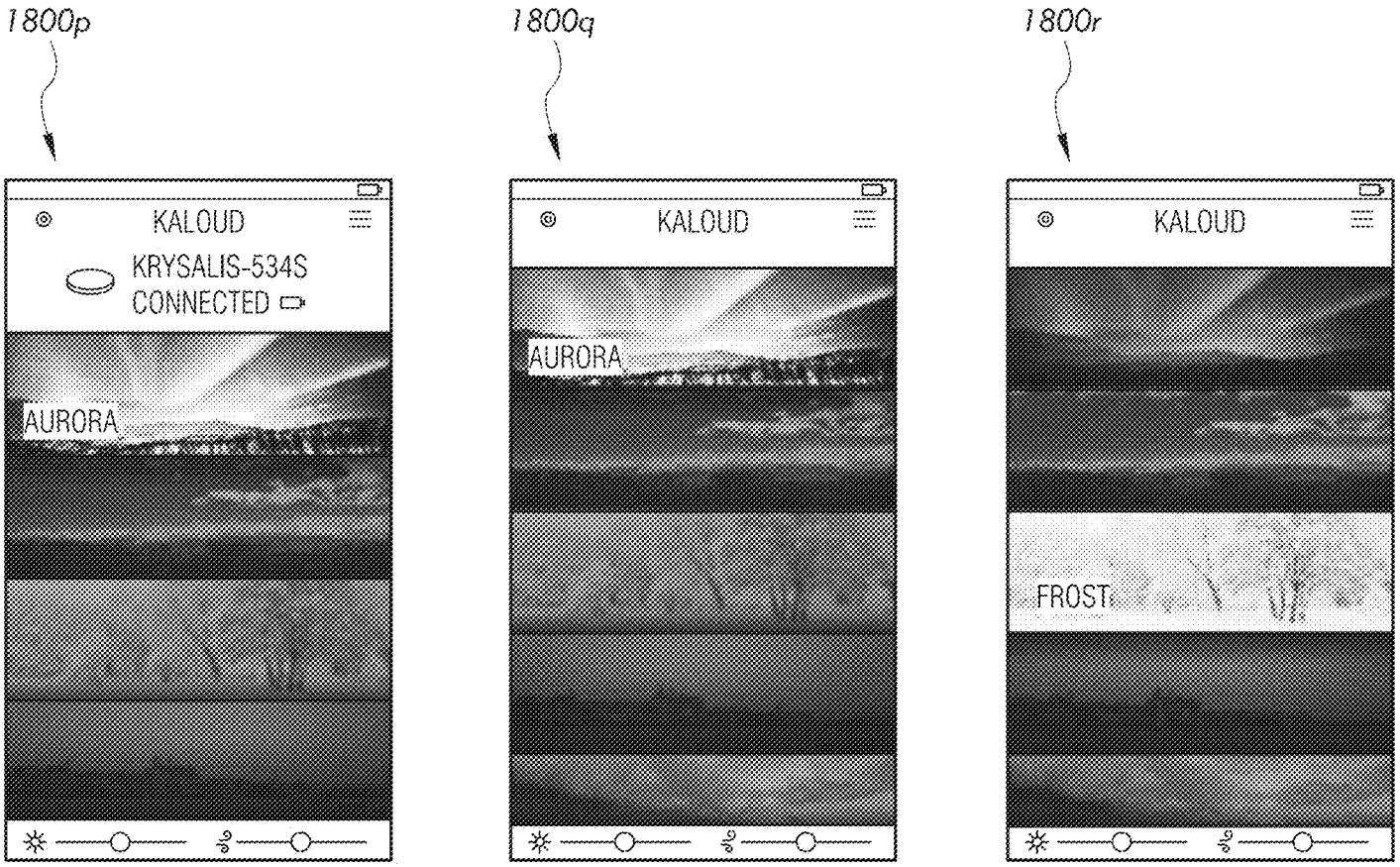
Figure 18G:
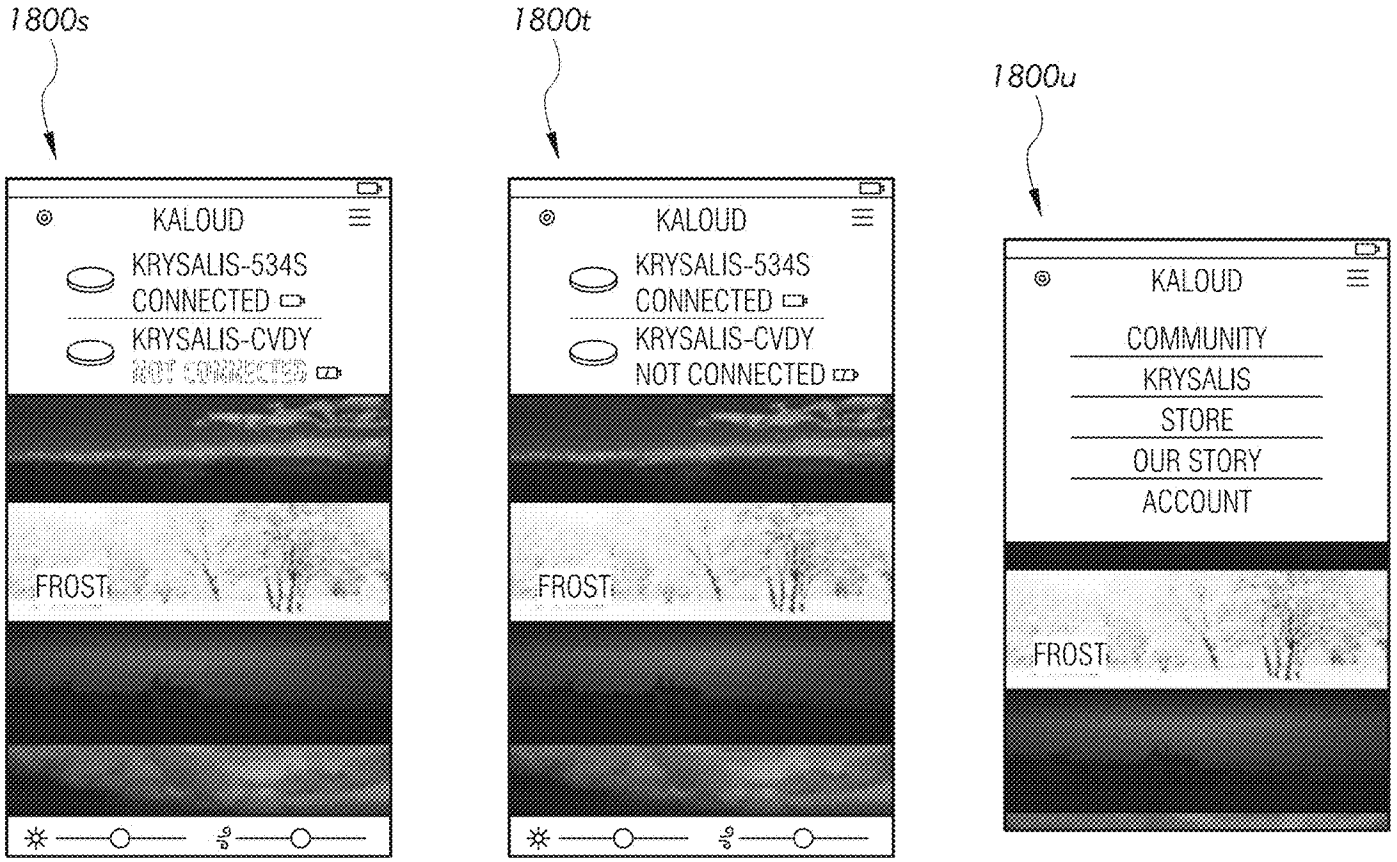
Figure 18H:
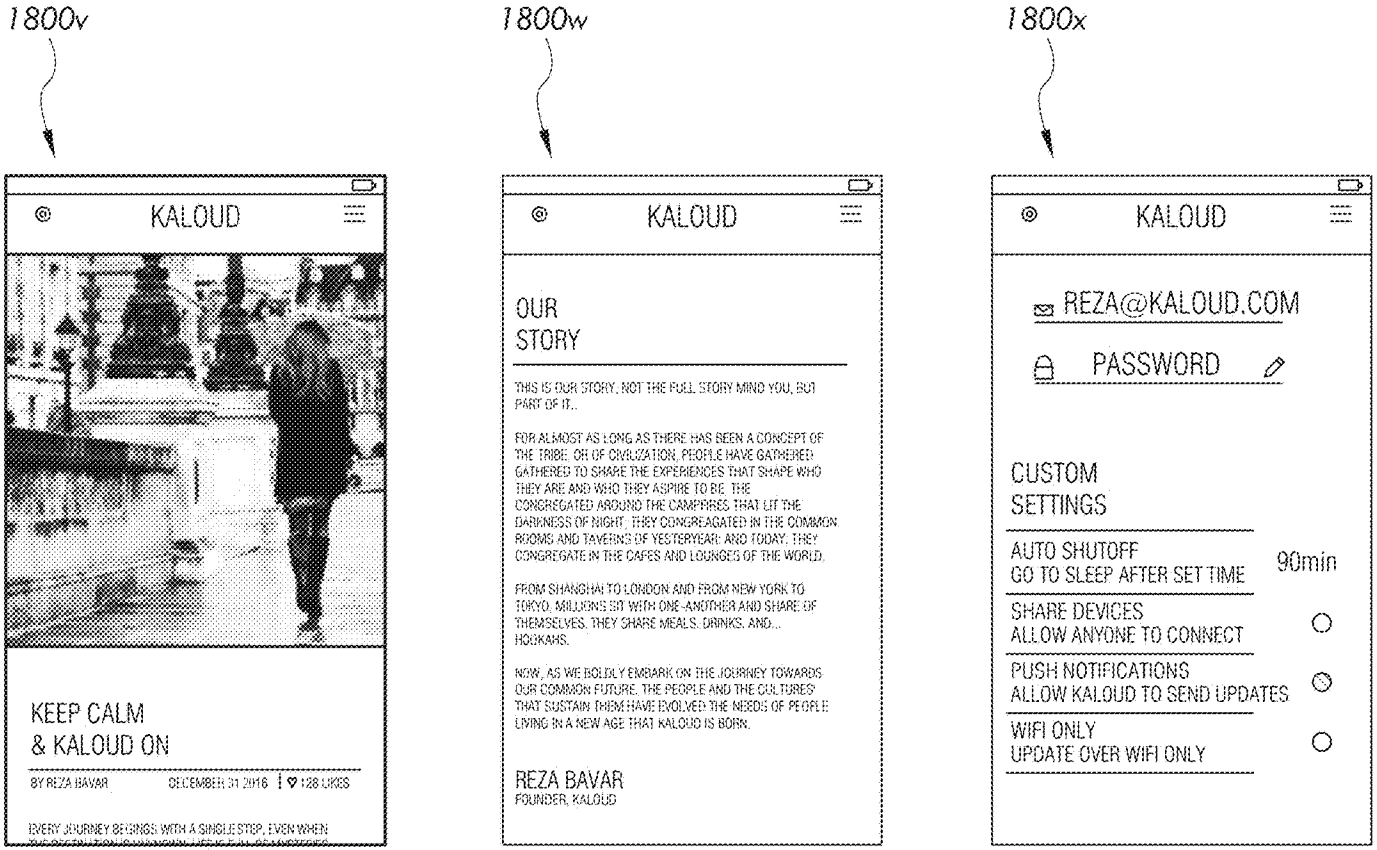
Figure 18I:
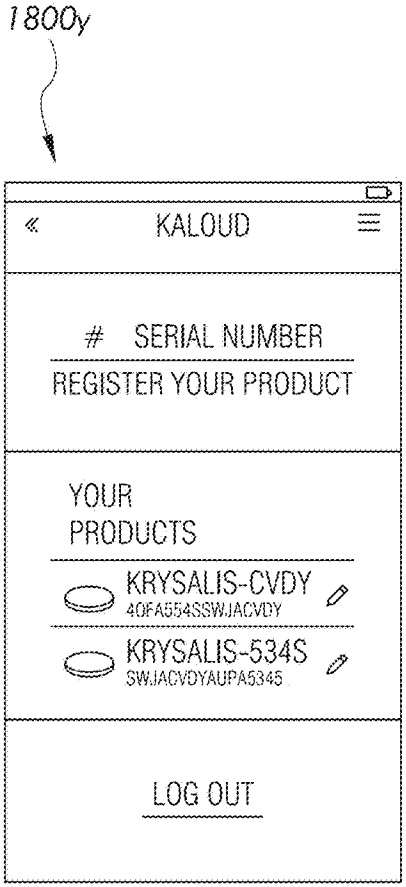
Figure 18J:
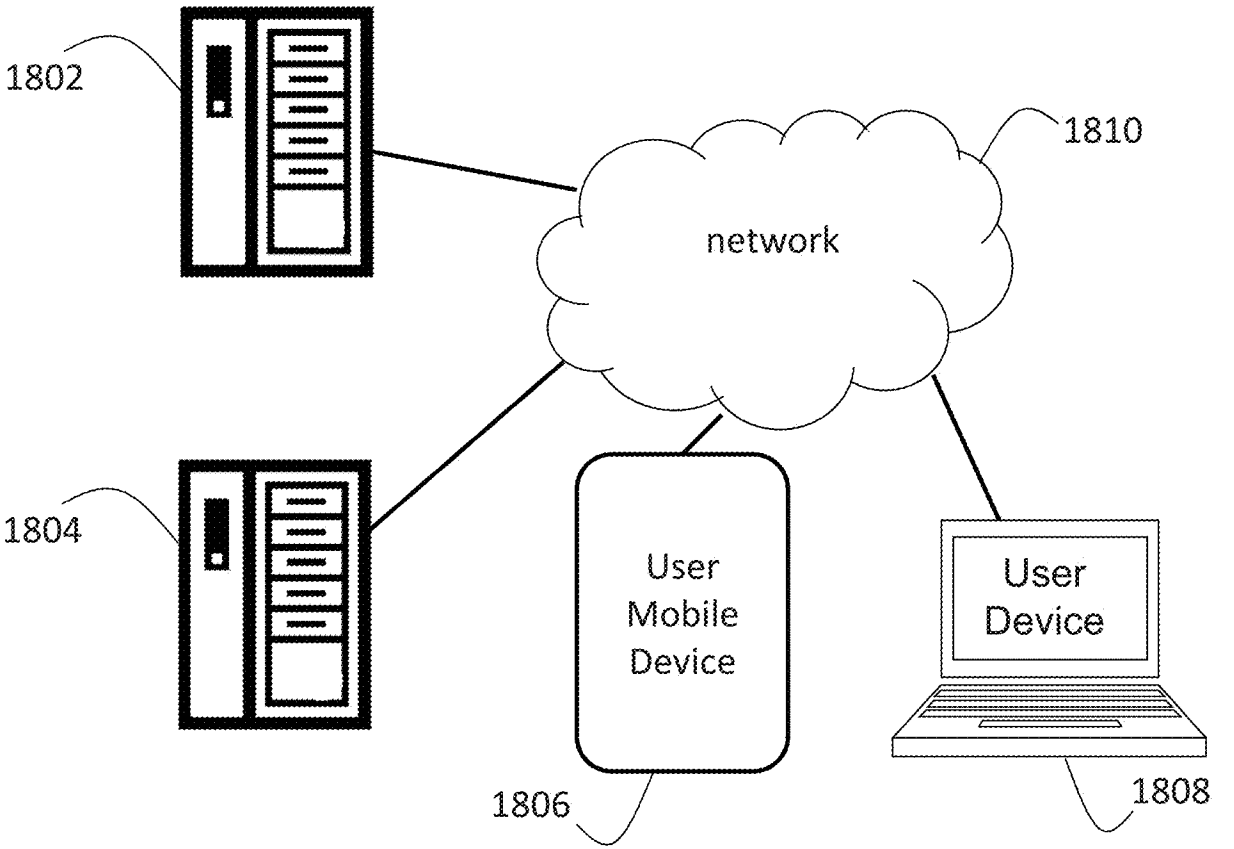

FIG. 18J shows an example embodiment of a basic network setup.

Figure 18K:
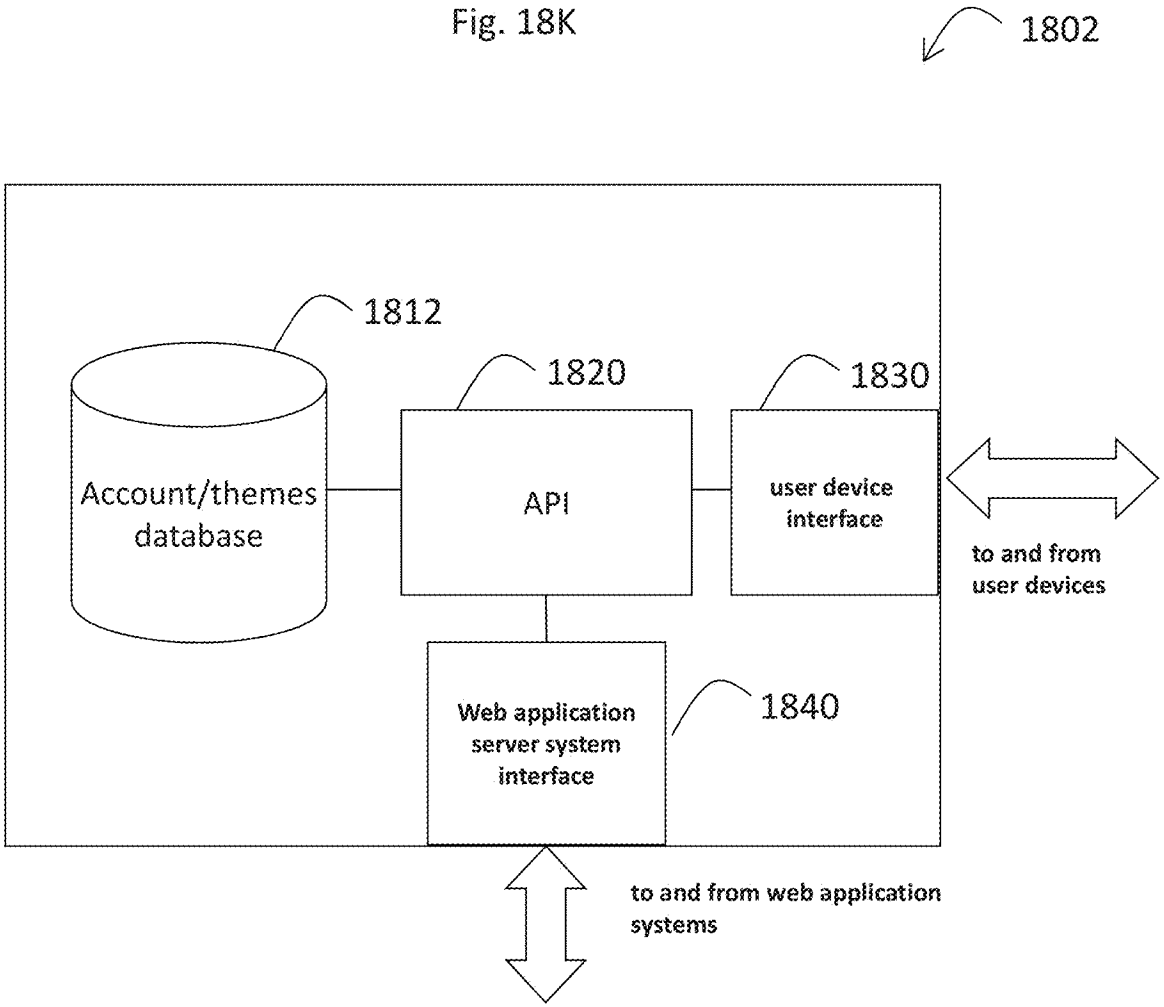

FIG. 18K shows an example embodiment of a network connected server system.

Figure 18L:
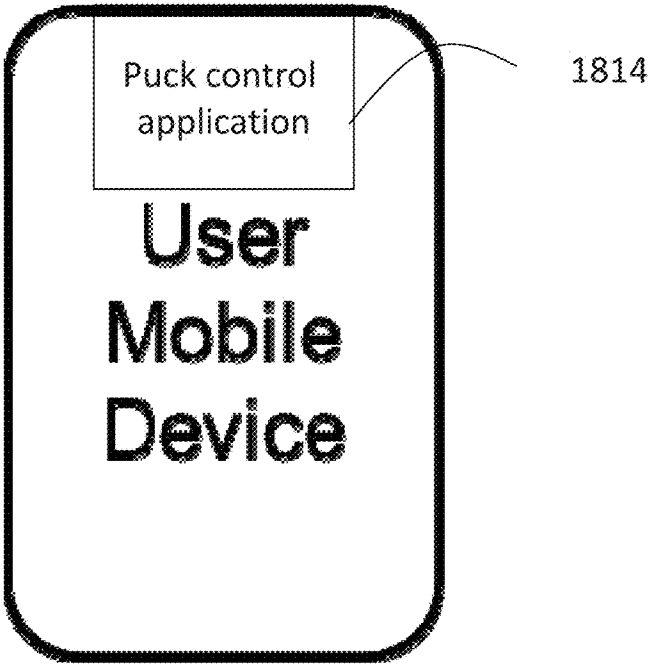

FIG. 18L shows an example embodiment of a user device.

Figure 19A:
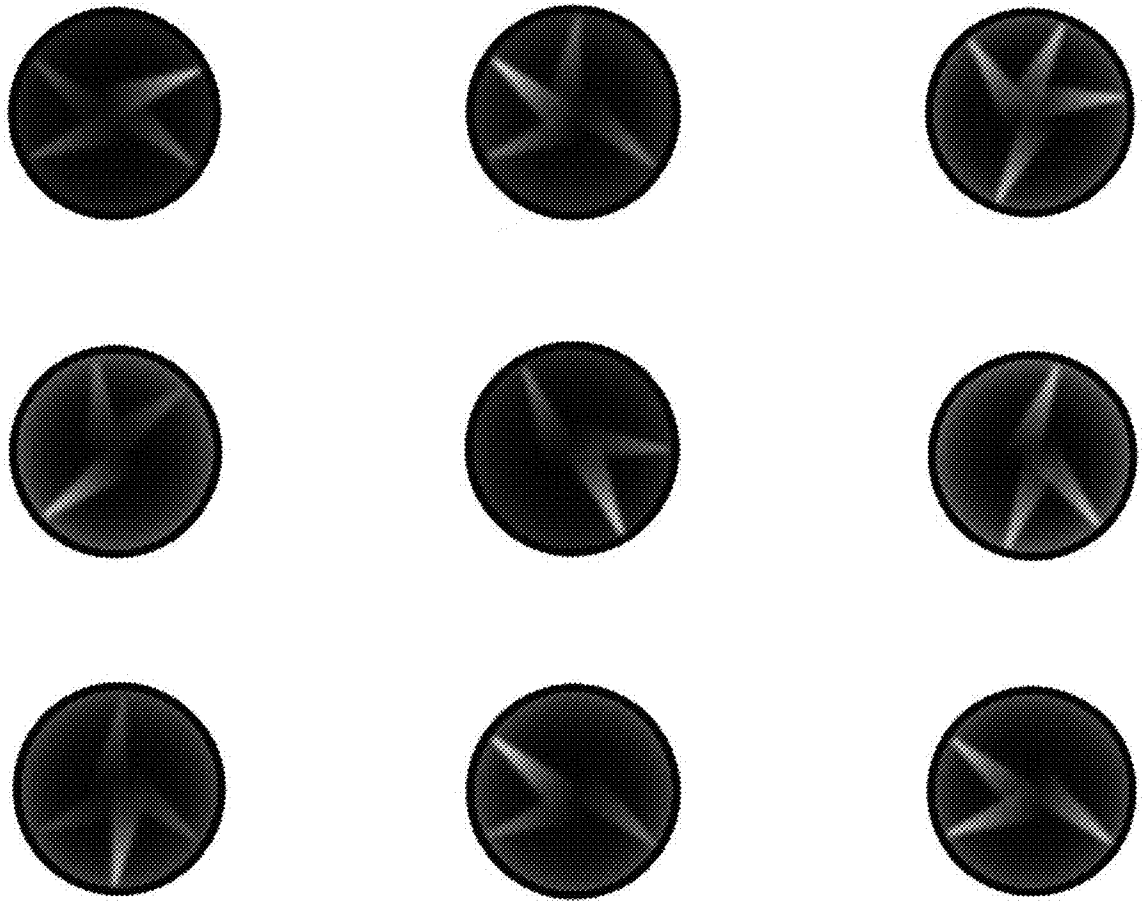
Figure 19B:
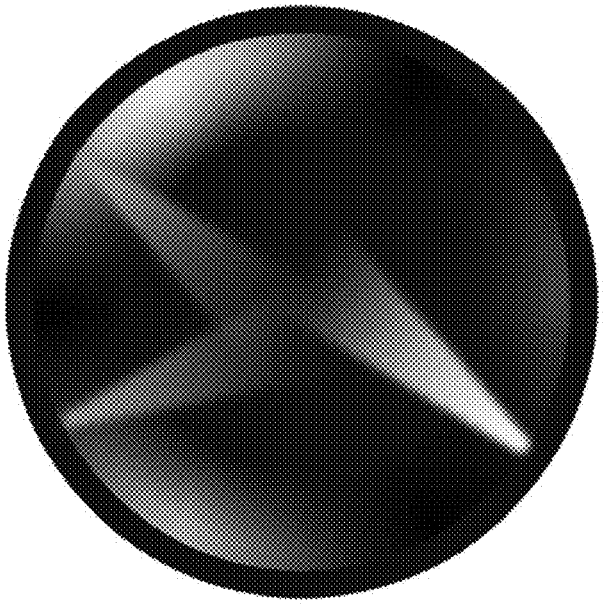
Figure 19C:
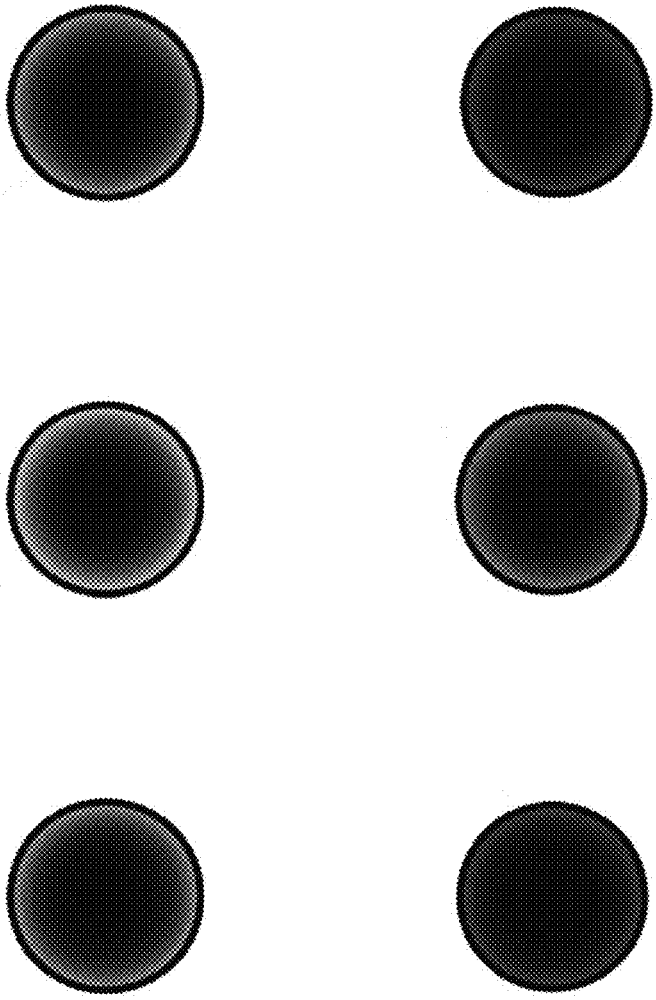

FIGS. 19A-19C show example embodiments of lighting schemes for an LED lighting puck.

Figure 20A:
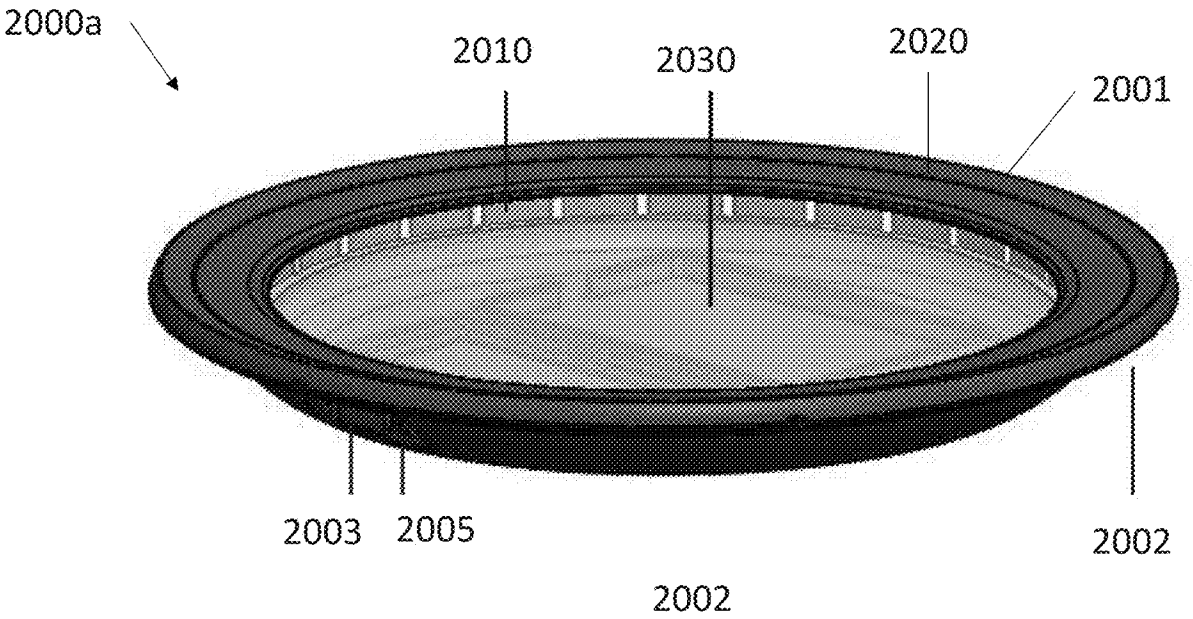
Figure 20B:
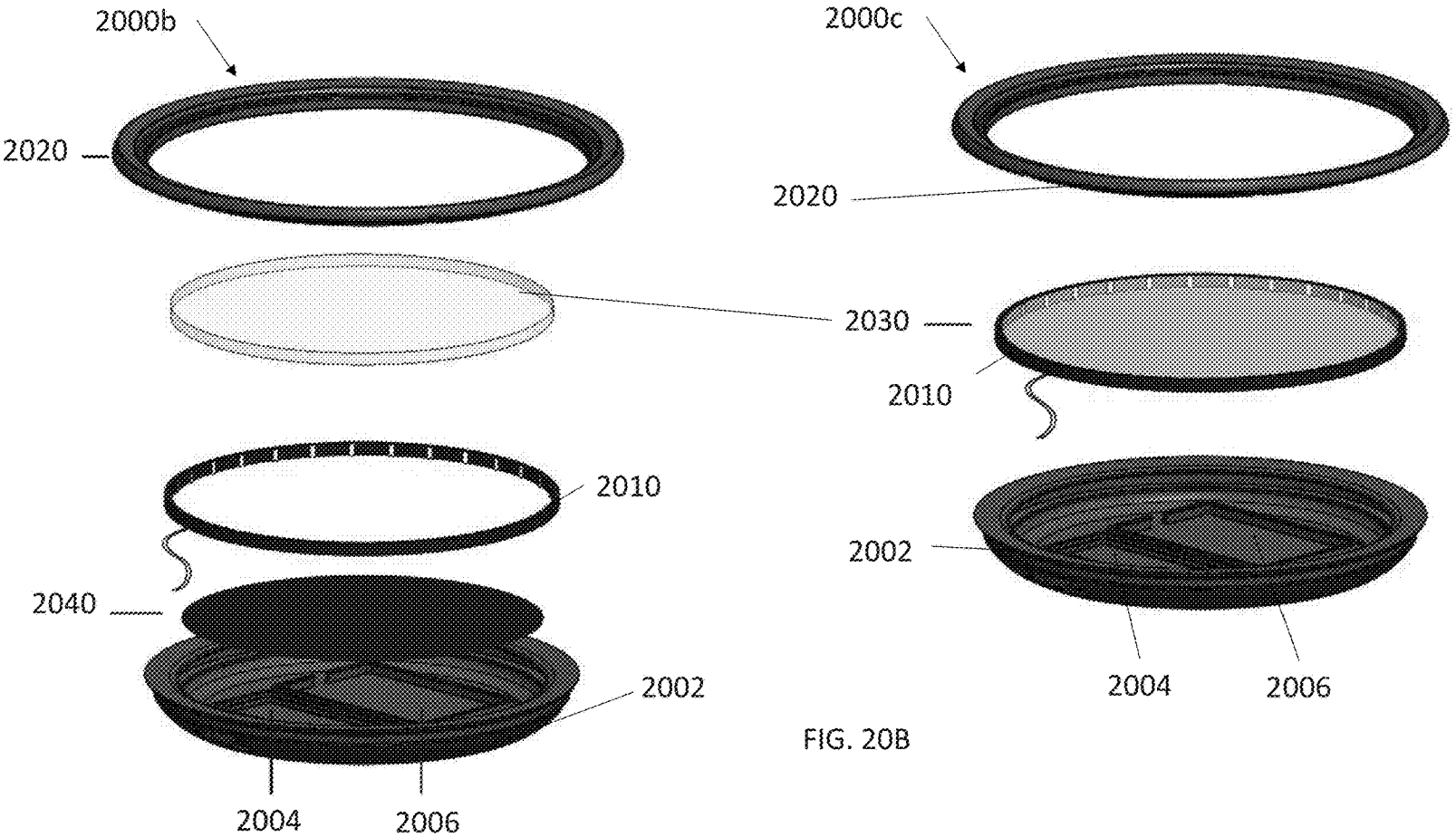
Figure 20C:
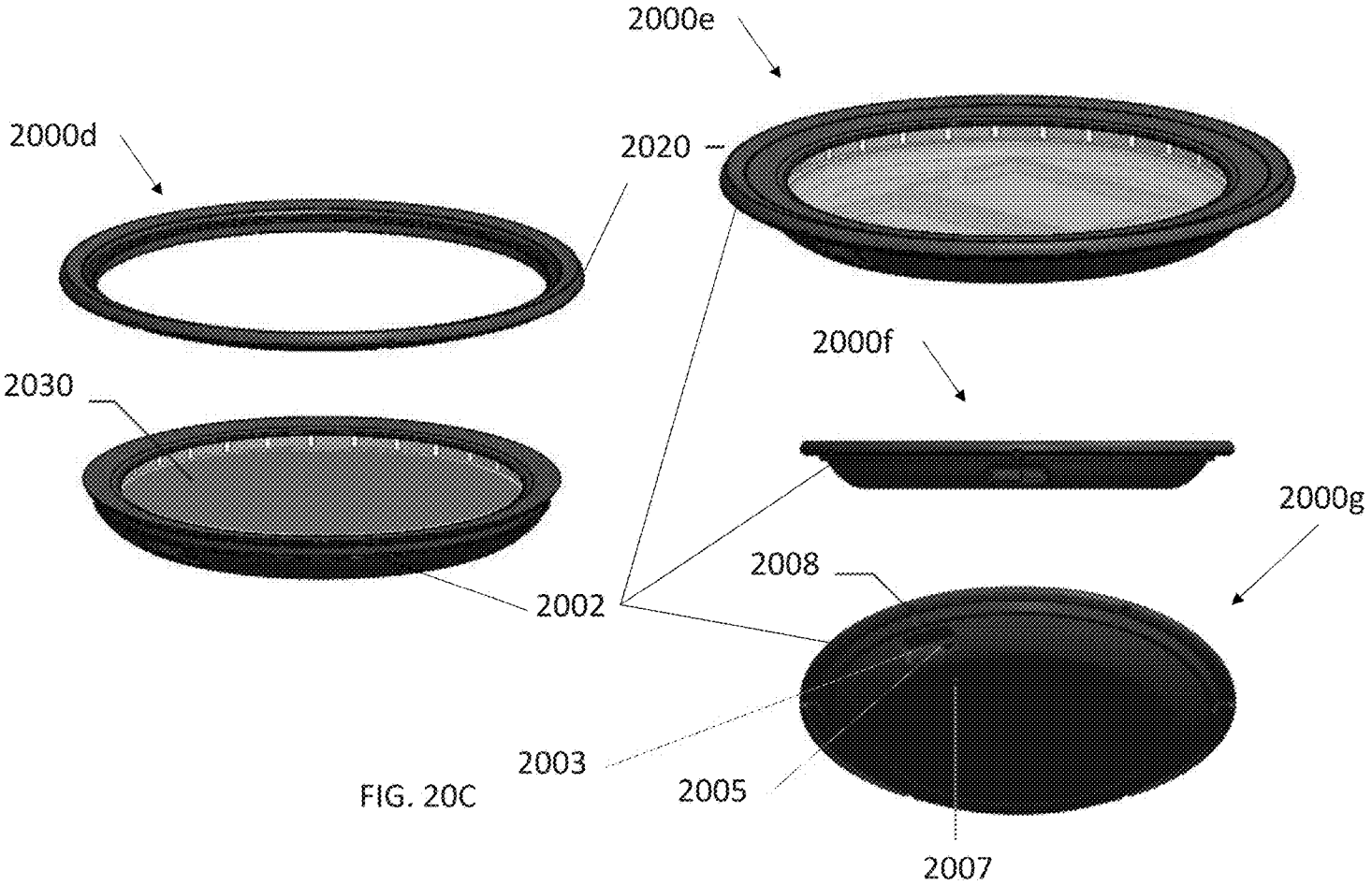

FIGS. 20A-20C show example embodiments of an LED lighting puck and steps for construction thereof.

Figure 21A:
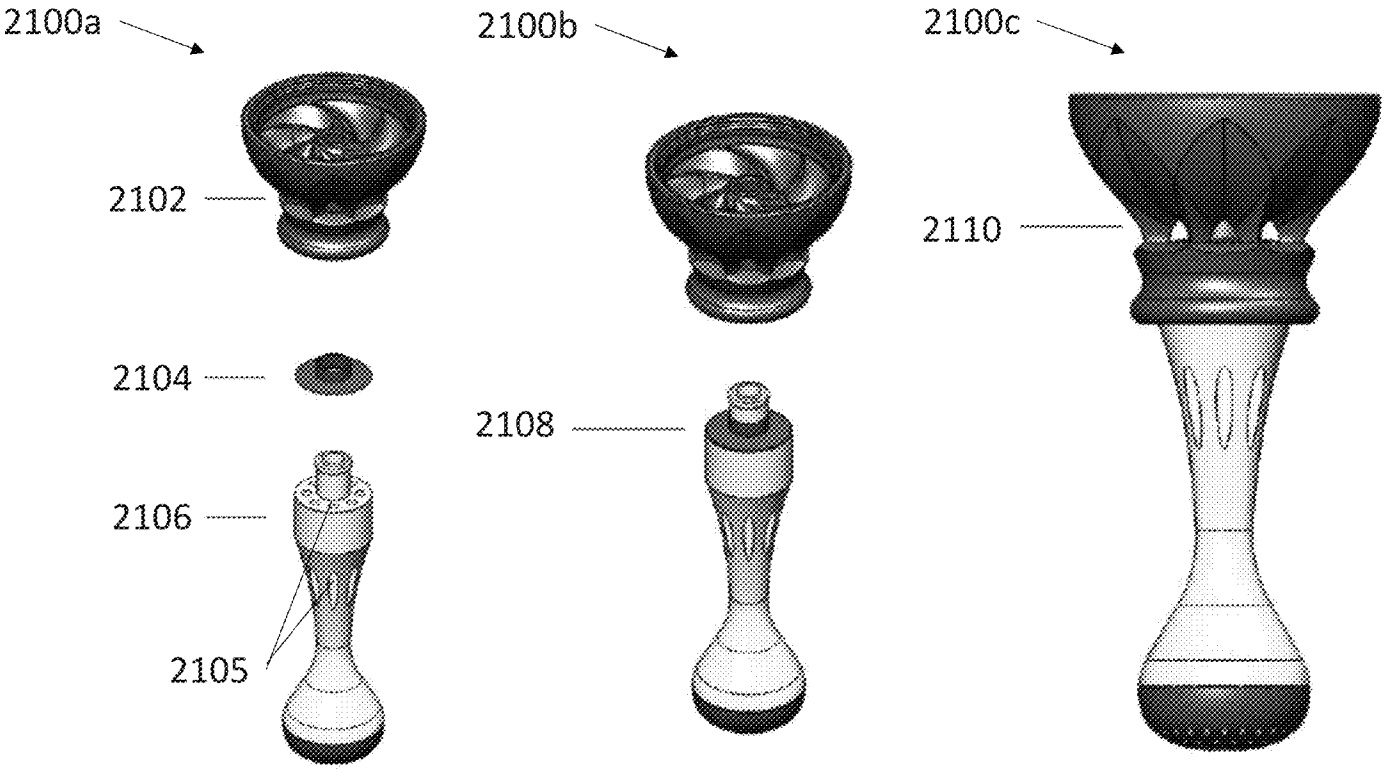

FIG. 21A shows an example embodiment of an upward purge valve assembly process.

Figure 21B:
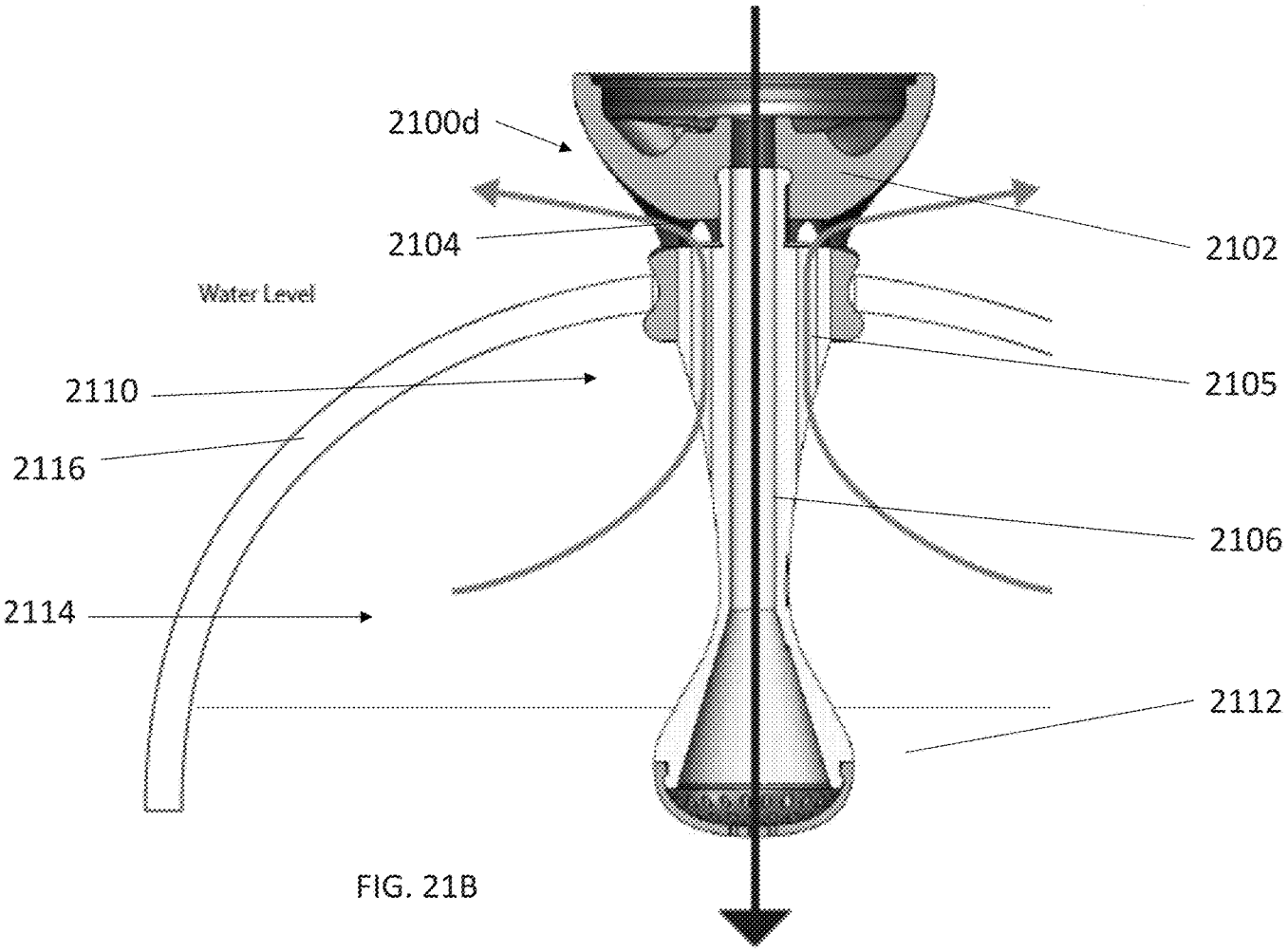

FIG. 21B shows an airflow diagram for an upward purge valve assembly.

DETAILED DESCRIPTION OF THE PREFERRED EMBODIMENTS

The following description of the preferred embodiments of the invention is not intended to limit the invention to these preferred embodiments, but rather to enable any person skilled in the art to make and use this invention. Further, the figures herein are not meant to be limiting based on any scale or size relation illustrated but rather are meant to be example embodiments illustrative of concepts. Although any methods, materials, and devices similar or equivalent to those described herein can be used in the practice or testing of embodiments, the preferred methods, materials, and devices are now described.

The above described drawing figures illustrate the described invention and method of use in at least one of its preferred, best mode embodiment, which is further defined in detail in the following description. Those having ordinary skill in the art may be able to make alterations and modifications to what is described herein without departing from its spirit and scope. While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. All features, elements, components, functions, and steps described with respect to any embodiment provided herein are intended to be freely combinable and substitutable with those from any other embodiment unless otherwise stated. Therefore, what is illustrated is set forth only for the purposes of example and should not be taken as a limitation on the scope of the present invention.

Figure 1:
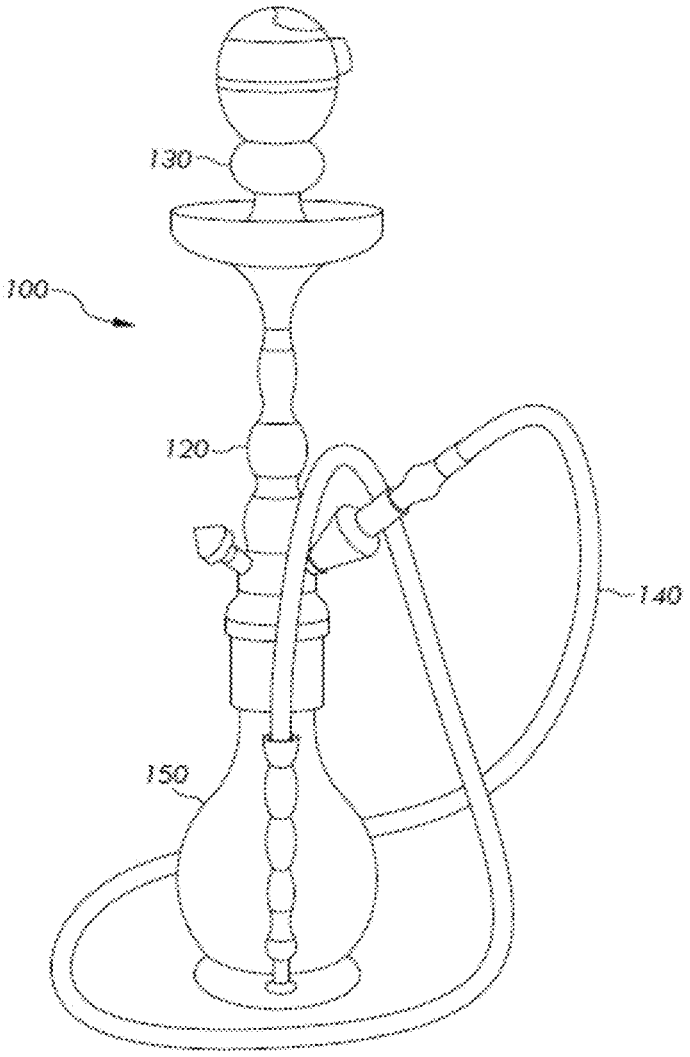
FIG. 1 (PRIOR ART)
FIG. 1 shows an example embodiment of a prior art water pipe.

FIG. 1 shows an example embodiment of a prior art water pipe, known also as a hookah pipe 100. As shown in FIG. 1, a head 130, body 120, base 150 and hose 140 are the primary components in a typical water pipe device. As shown in FIG. 1A, in general, the base 150 comprises a concave vessel having an open top portion for containing water or other liquid therein. The body 120 has a stem that extends into the base such that a distal end of the stem is partially submerged within the liquid contained in the base 150. The body 120 couples with an open top portion of the base 150 so as to form a substantially airtight seal therewith. Accordingly, a first base grommet may be provided to couple the body 120 and the base 150 so as to form the substantially airtight seal. In this manner, a chamber is formed by the base 150 and body 120. A hose 140 couples with the body 120 such that a proximal portion of the hose 140 has an airtight seal with the body 120. Accordingly, a hose grommet may be provided to couple the hose 140 and the body 120 so as to form the substantially airtight seal. In some embodiments, a hose valve (not shown) may be intermediate the hose 140 and the body. The head 130 couples to a proximal end of the body 120 such that a substantially airtight seal is formed therebetween. Accordingly, a third grommet may be provided to couple the head 130 and the body 120 so as to form the substantially airtight seal. In operation, organic matter to be smoked may be contained within a bowl of the head 130, and the head 130 can be covered with a cover, such as punctured foil, or a ventilated cover described in U.S. patent application Ser. No. 13/489,475, filed on Jun. 6, 2012, the entire contents and disclosure of which is herein incorporated by reference. Coals or other combustible heating material can be placed on or in the cover to heat the organic matter to be smoked, such as tobacco.

Critically, the head 130, body 120 and hose 140 each comprise a hollow tube such that when the base 150, head 130, body 120 and hose 140 are coupled, an airflow path is formed. A user of prior art hookah 100 will generally inhale at the distal end of hose 140 and thus draw heated air into head 130, causing the organic material therein to burn, releasing smoke that is subsequently drawn through the through body 120 and through the liquid in base 150. The smoke then rises through the liquid into the area above the liquid in base 150, becoming filtered in the process, and out through the hose 140 to be smoked by the user.

Other water pipe components, such as purge valves, ashtrays, base flavorings, etc. are generally known in the art and, while not specifically described herein, are intended to be useable in combination with the presently described embodiments without departing from the scope of the invention.

Figure 2A:
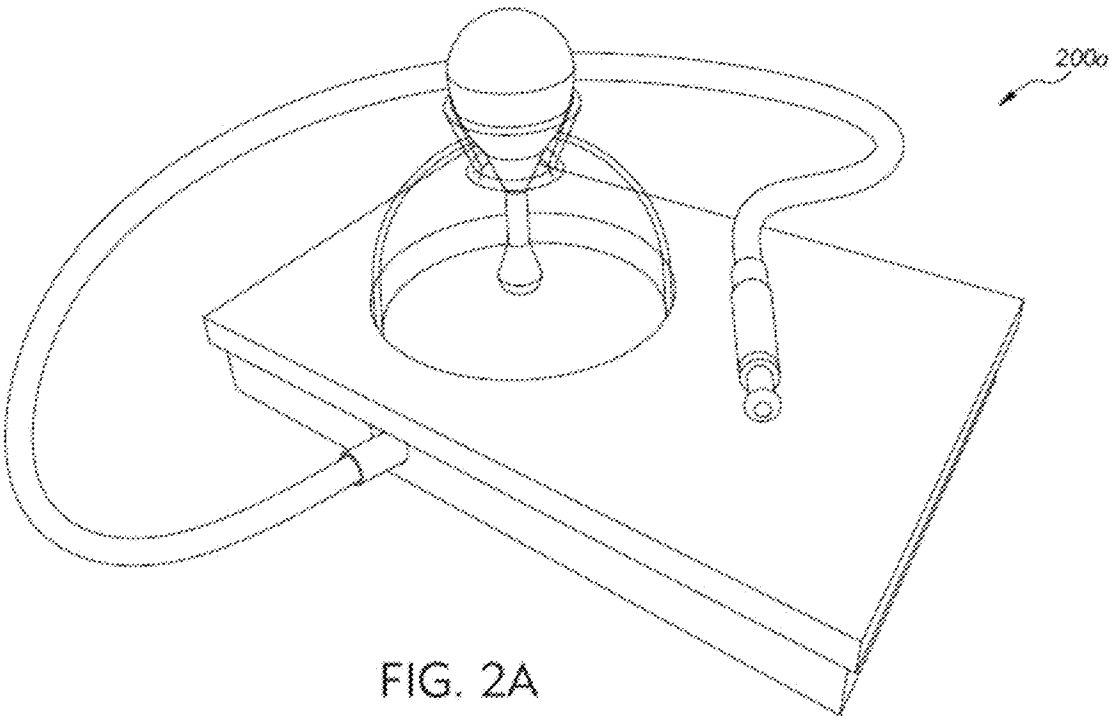
FIG. 2A shows an example embodiment image of a perspective view of a domed water pipe with supporting tray with an attached hose.
Figure 2B:
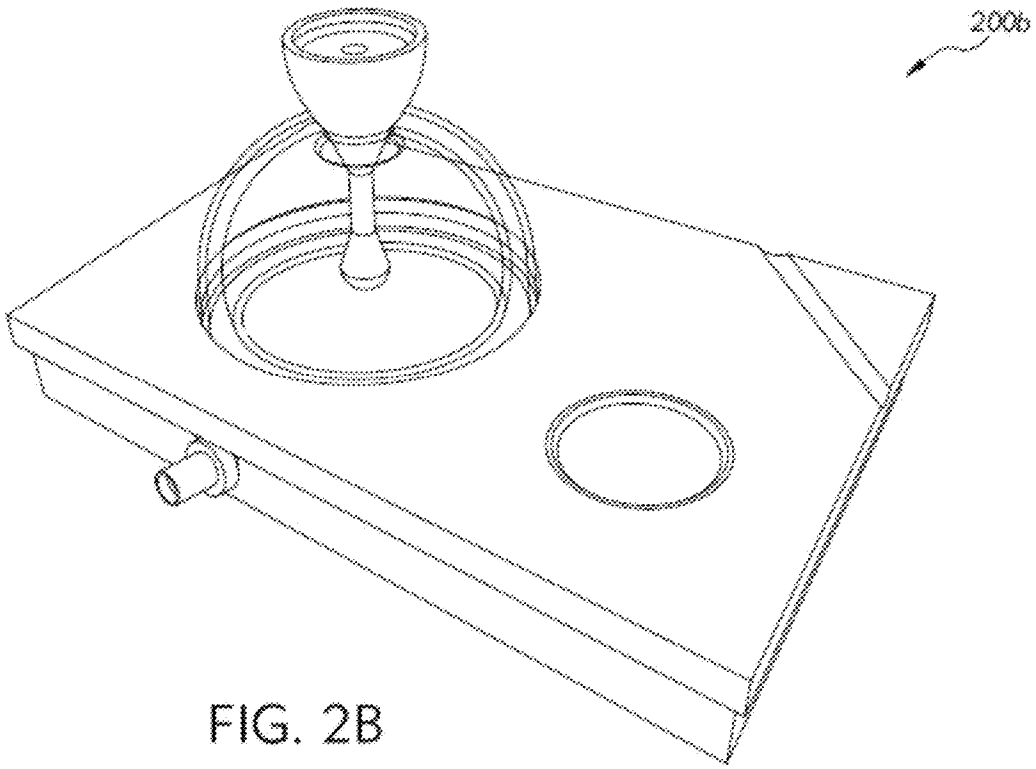
FIG. 2B shows an example embodiment image of a perspective view of a domed water pipe with supporting tray.
Figure 2C:
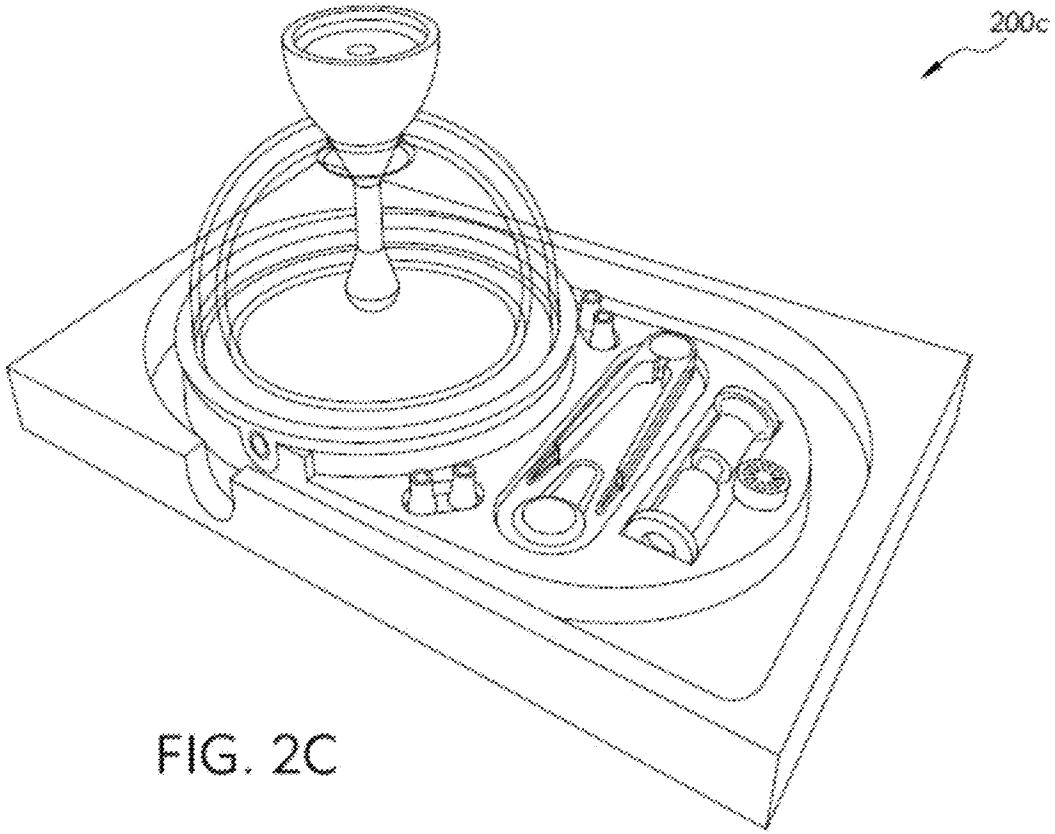
FIG. 2C shows an example embodiment image of a perspective view of a domed water pipe with supporting tray with a storage compartment.
Figure 2D:
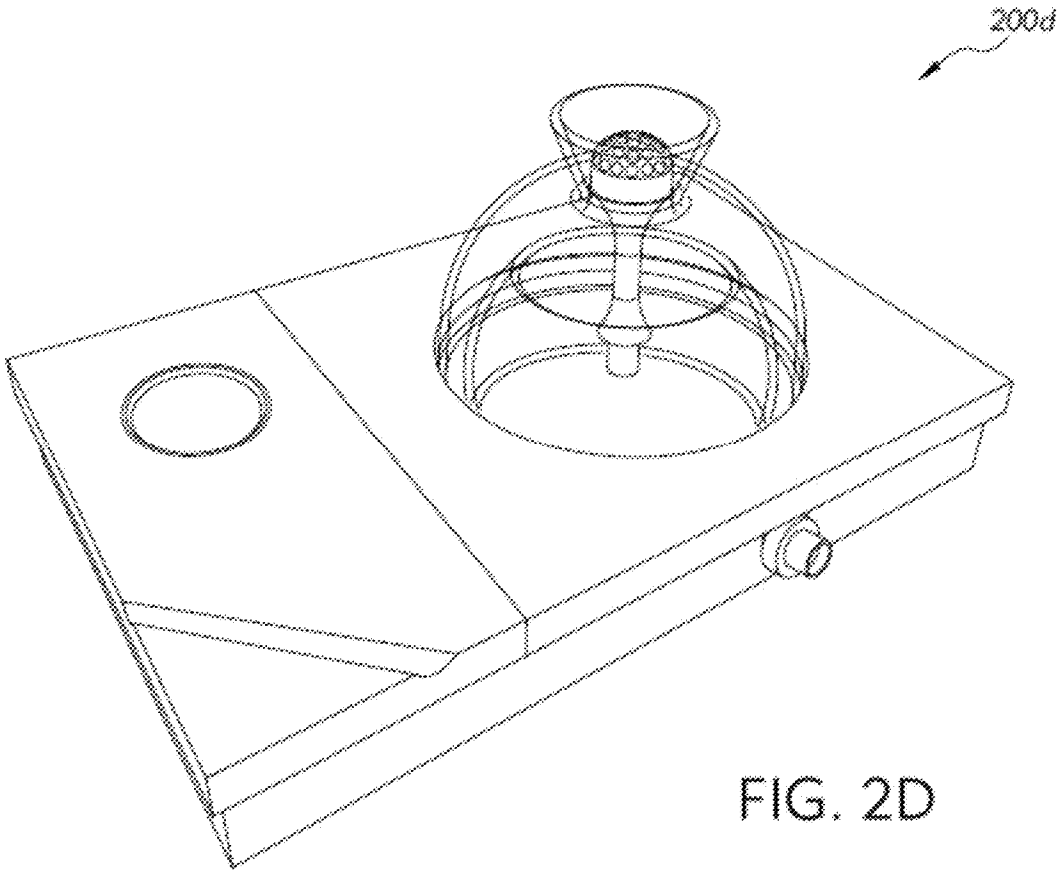
FIG. 2D shows an example embodiment image of a perspective view of a domed water pipe with supporting tray.

FIGS. 2A-2D show various example embodiments of domed water pipes. In particular, FIG. 2A shows an example embodiment image of a perspective view 200*s* of a domed water pipe with supporting tray with an attached hose. FIG. 2B shows an example embodiment image of a perspective view 200*b* of a domed water pipe with supporting tray. FIG. 2C shows an example embodiment image of a perspective view 200*c* of a domed water pipe with supporting tray with a storage compartment. FIG. 2D shows an example embodiment image of a perspective view 200*d* of a domed water pipe with supporting tray with a second bowl unit.

Figure 3A:
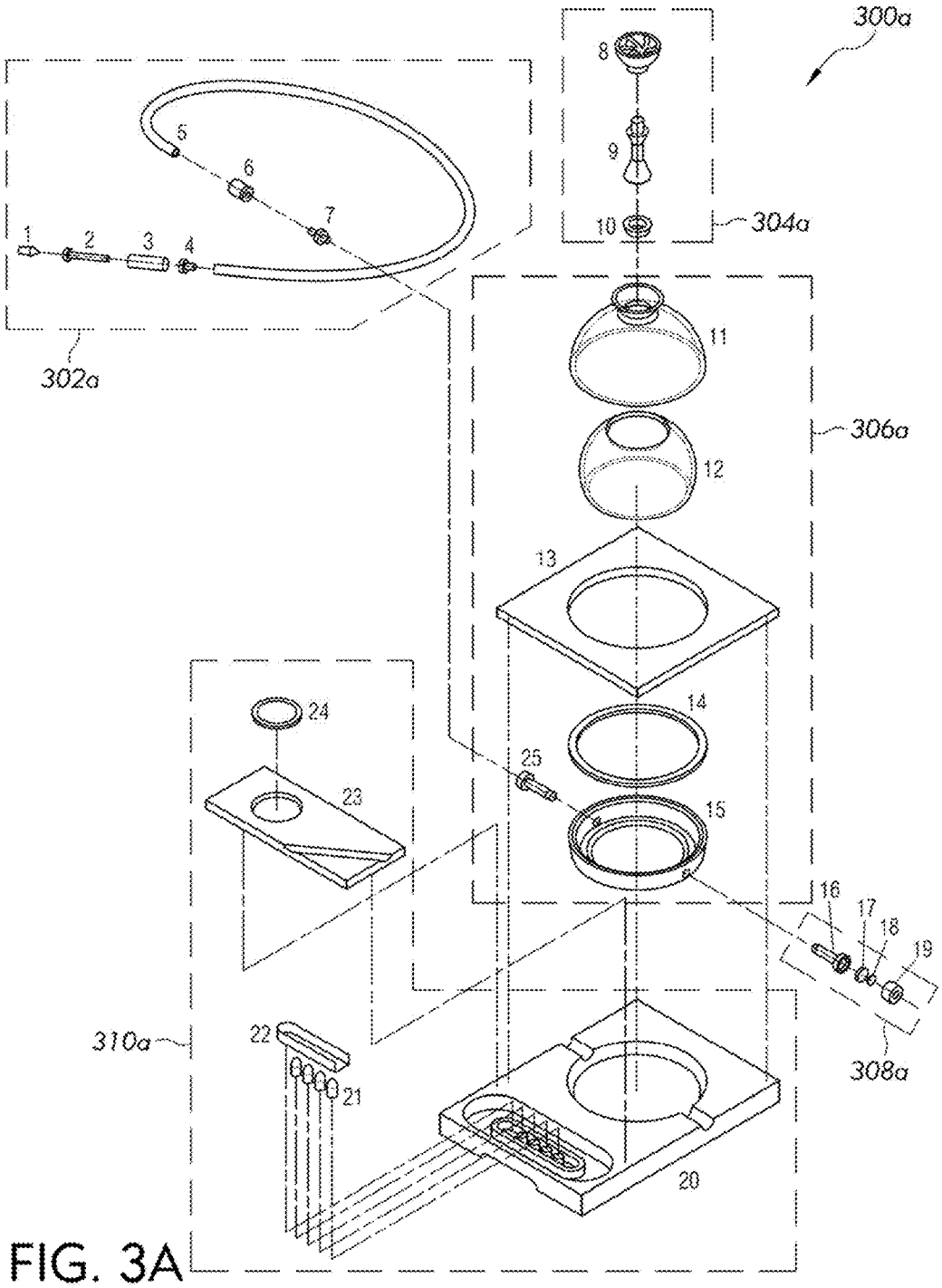
FIG. 3A shows an example embodiment of an exploded view of a domed water pipe with supporting tray.

FIG. 3A shows an example embodiment of an exploded view 300*a* of a domed water pipe with supporting tray. As shown in the example embodiment, multiple subsections will be described in turn, including a hose subsection 302*a*, a bowl subsection 304*a*, a manifold and glass subsection 306*a*, a purge valve subsection 308*a* and a tray subsection 310*a*. It should be understood that these subsections are not exhaustive and particular components can be considered in conjunction and operate with respect to components of other subsections. Furthermore, the components shown in FIG. 3A are not exhaustive and may include assemblies and sub-assemblies in various embodiments. The breakdown into subsections is to assist the reader with respect to clarity. Couplings, materials, orientations and other specifics related to the various components will be described with respect to individual parts in each figure description herein.

As shown in the example embodiment, hose subsection 302*a* can include components such as a hose tip 1, a MP body 2, a MP cover 3, a MP nipple 4, a hose 5, a hose end cover 6 and a hose plug 7. Bowl subsection 304*a* can include a bowl 8, a down-stem 9, and an aerator 10. Manifold and glass subsection 306*a* can include an outer vessel 11, an inner vessel 12, a first cover 13, a gasket 14, a manifold body 15 and a hose socket 25. Purge valve subsection 308*a* can include a purge nipple 16, a purge plate 17, an umbrella valve 18 and a purge cap 19. Tray subsection 310*a* can include a base 20, spare MP tips 21, tongs 22, a second cover 23 and an ash tray 24. Components and operation of each subsection will be described in turn herein, as well as interaction between the subsections.

Figure 3B:
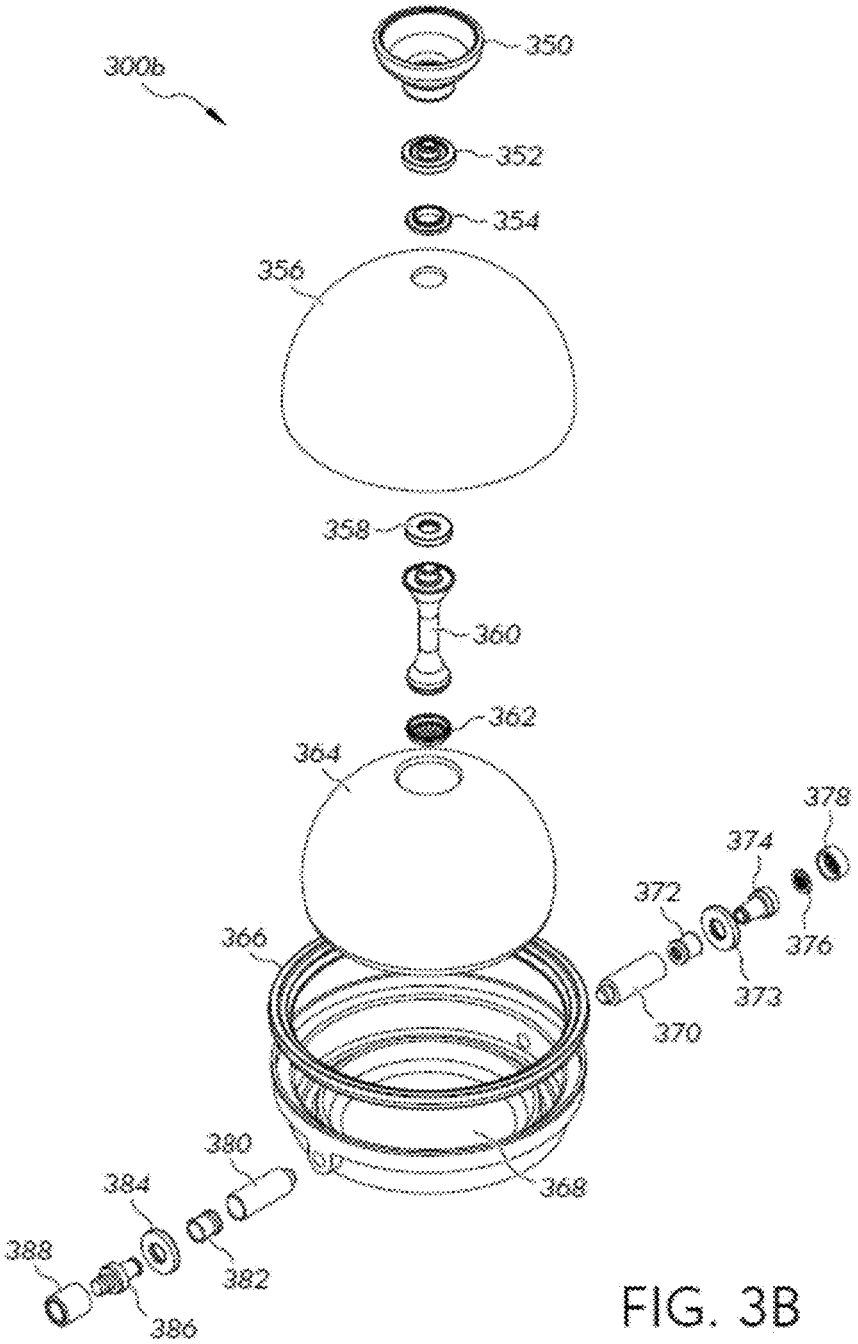
FIG. 3B shows an example embodiment of an exploded view of a domed water pipe.

FIG. 3B shows an example embodiment of an exploded view 300*b* of a domed water pipe. As shown in the example embodiment, a bowl 350 can be partially or completely silicone, silicone combined with materials such as wood, stone, glass, metal, or other some other material, or completely other materials and can be coupled with a bowl nipple 352 and separated from an exterior surface of an outer chamber 356 by a stem gasket 354. A stem gasket 358 can separate a proximal end of a downstem 360 from an interior surface of outer chamber 356 and removably couple with bowl 350, stem gasket 354 or both through a hole in the top of upper chamber 356. Downstem 360 can have a distal end that couples with an aerator cap 362 that rests within an interior of an inner chamber 364 in operation. Inner chamber can rest within an interior of a manifold 368 and exterior chamber 356 can be sealably coupled with manifold 368 by a main seal 366. In some embodiments, multiple sub-chambers can exist within inner chamber 364.

Coupled with a side of manifold 368 can be a manifold extender 370 can house a hose plug grommet 372 and be covered by an escutcheon 373. In turn, a purge nipple can fit within hose plug grommet 372 and be covered by a purge plate 376 and purge cover 378. Coupled with manifold 368 in another location can be a manifold extender 380, housing hose plug grommet 382. This can be covered by an escutcheon 384 that covers a hose receiver 386 and hose end cap that is operable to be coupled with a hose (not shown).

Figure 3C:
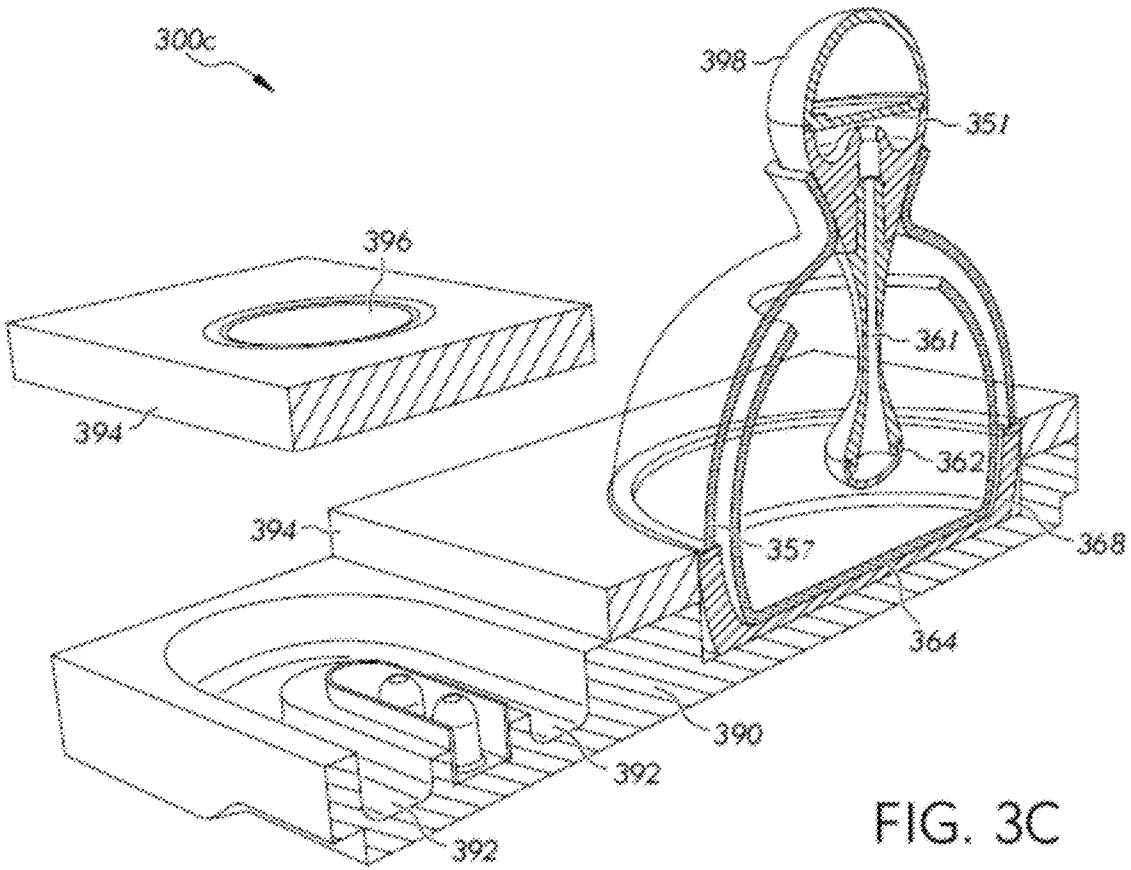
FIG. 3C shows an example embodiment of an exploded, side cross-sectional, view of a domed water pipe with supporting tray.
Figure 3D:
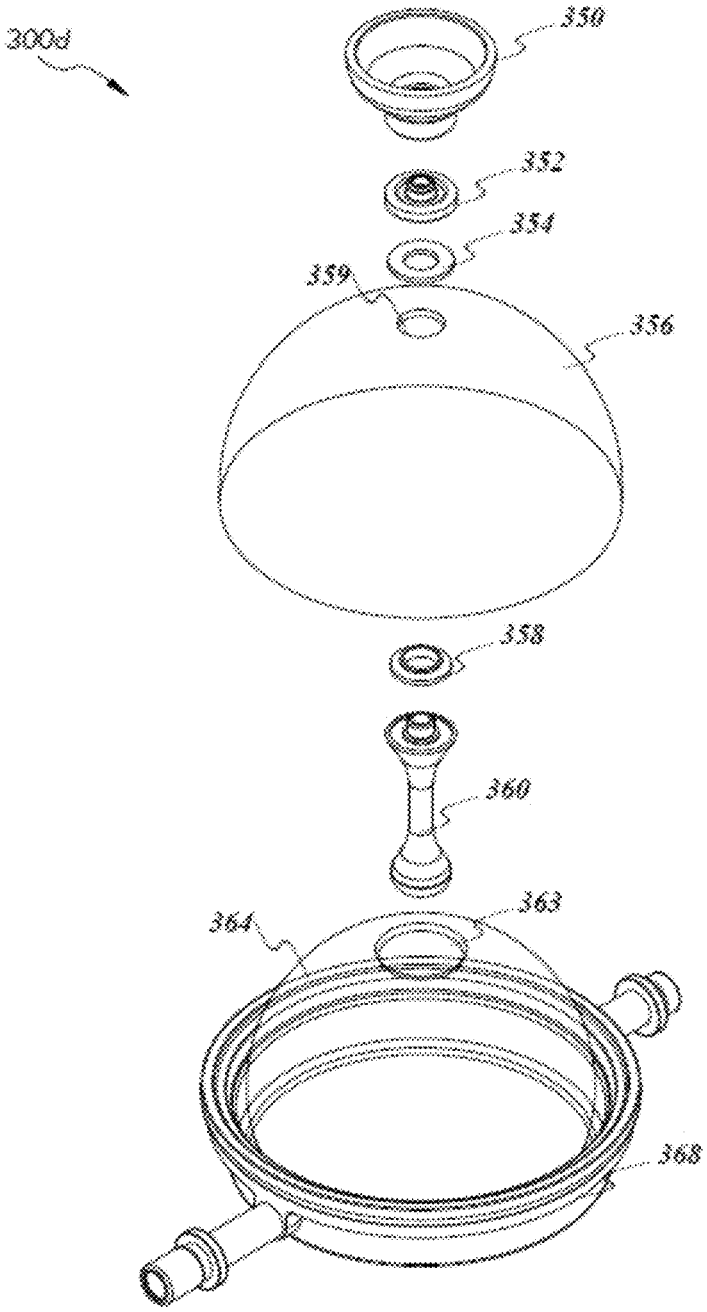
FIG. 3D shows an example embodiment of an exploded view of a domed water pipe.

FIG. 3C shows an example embodiment of a side cutaway view 300*c* of a domed water pipe with a tray 390 and covering 394. As shown in the example embodiment, a cap 398 can rest on or be coupled with a bowl 351, which can be directly coupled with a downstem 361 that is coupled with an aerator cap 362. Inner chamber 364 can be housed within manifold 368 and outer chamber 357. Tray 390 can have interior compartments 392. Cover 394 can be one or more pieces and can have a removable ashtray 396. Bowl 351, downstem 360 and aerator cap 362 can be supported by a flared upper section of outer chamber 357.

Figure 3E:
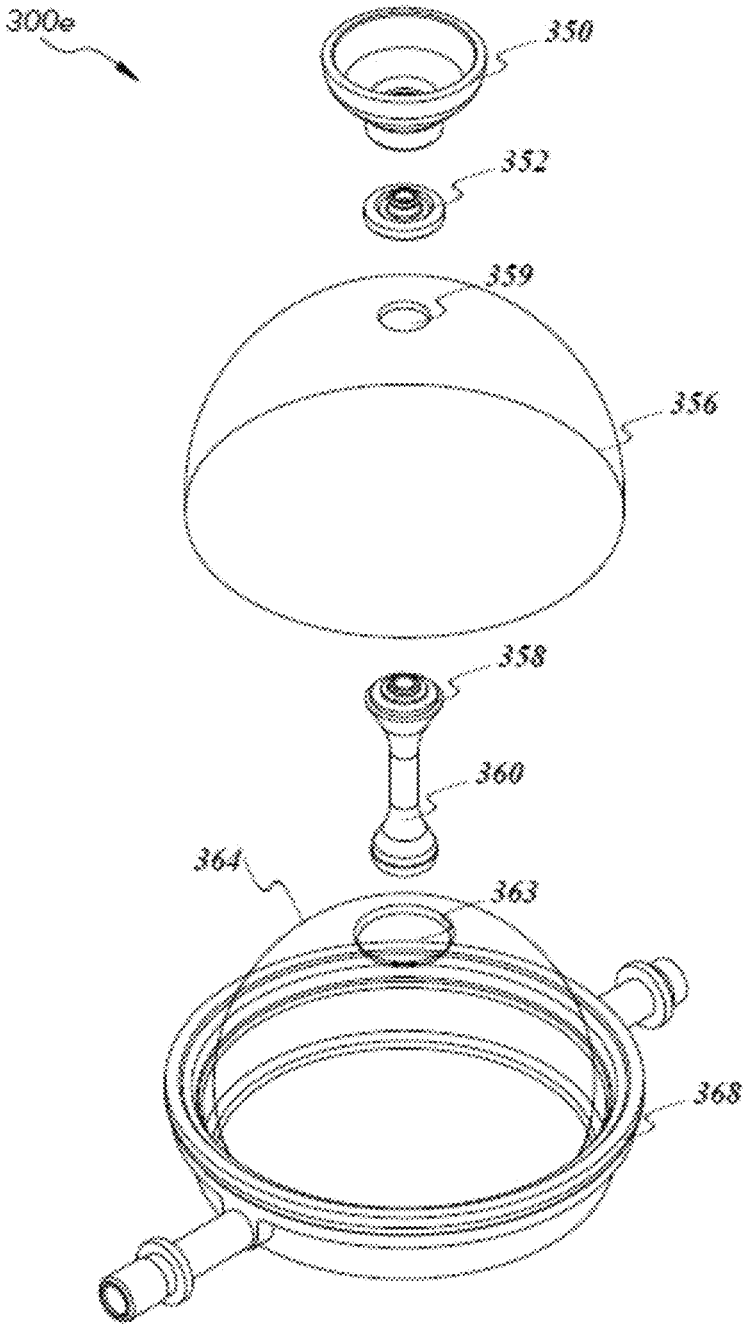
FIG. 3E shows an example embodiment of an exploded view of a domed water pipe.
Figure 3F:
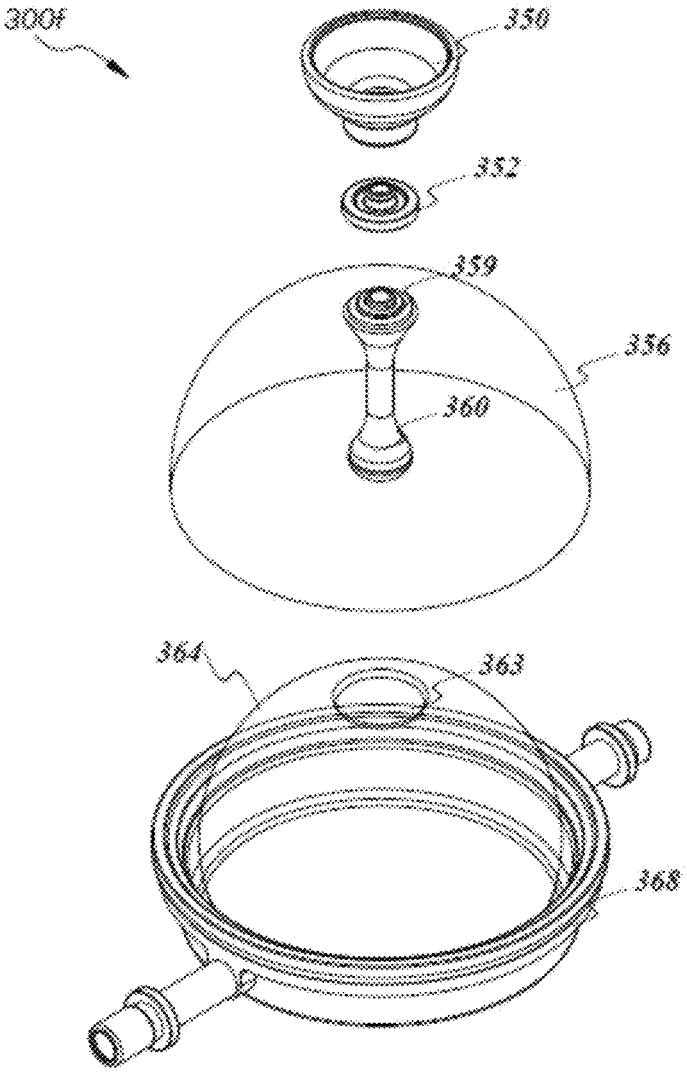
FIG. 3F shows an example embodiment of an exploded view of a domed water pipe.
Figure 3G:
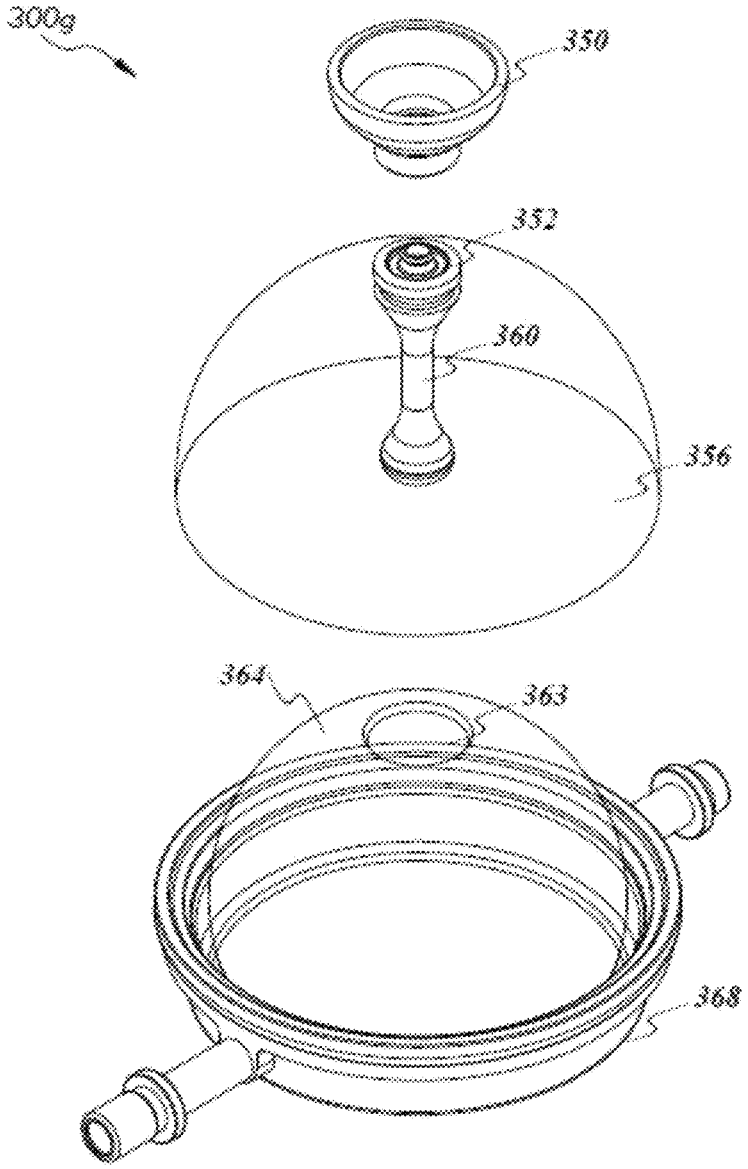
FIG. 3G shows an example embodiment of an exploded view of a domed water pipe.
Figure 3H:
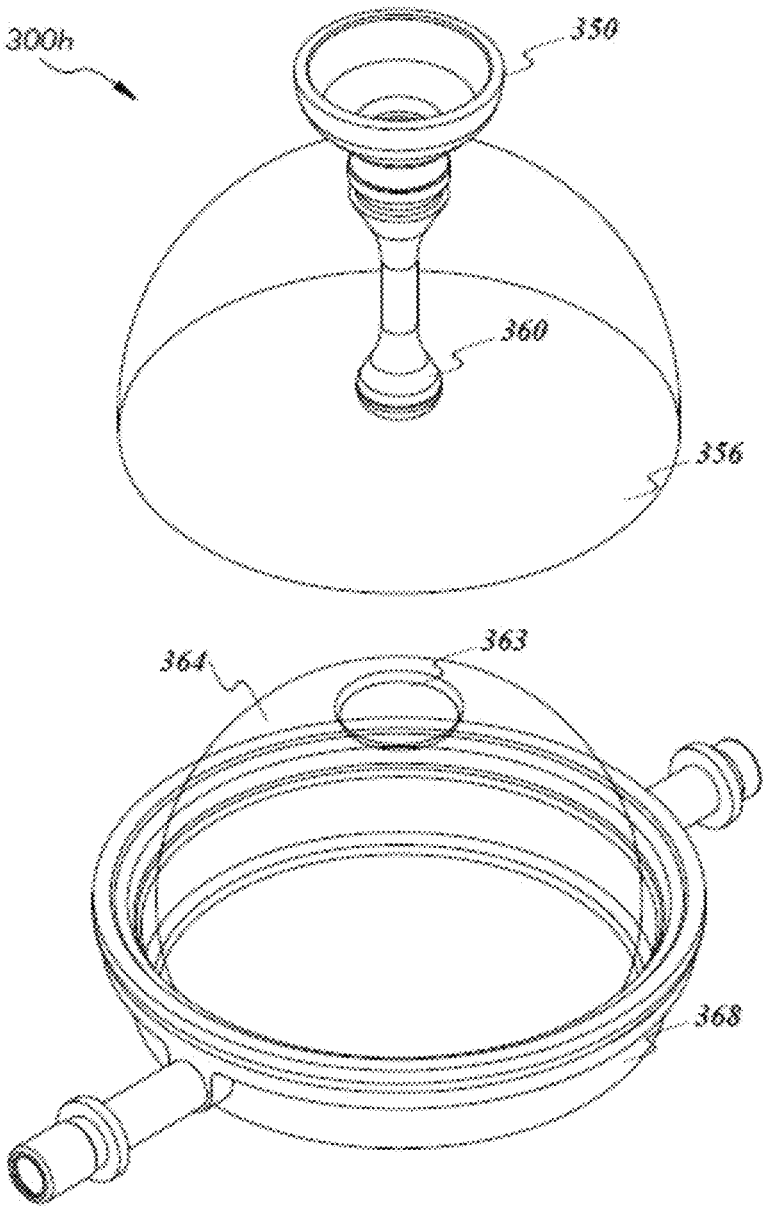
FIG. 3H shows an example embodiment of an exploded view of a domed water pipe.
Figure 31:
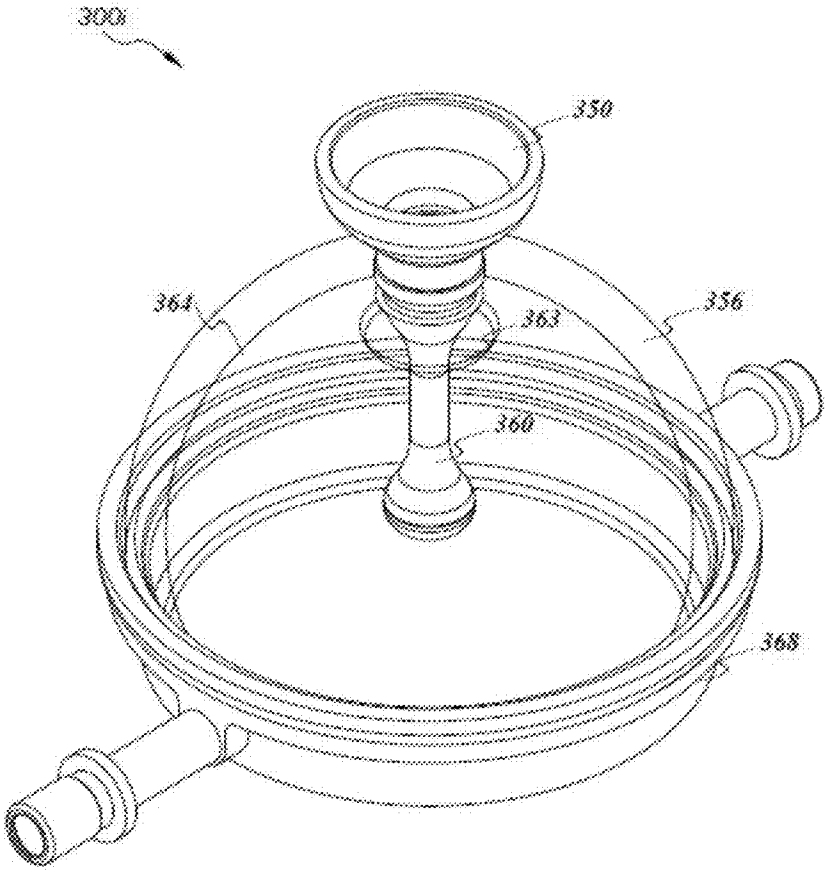
Figure 3J:
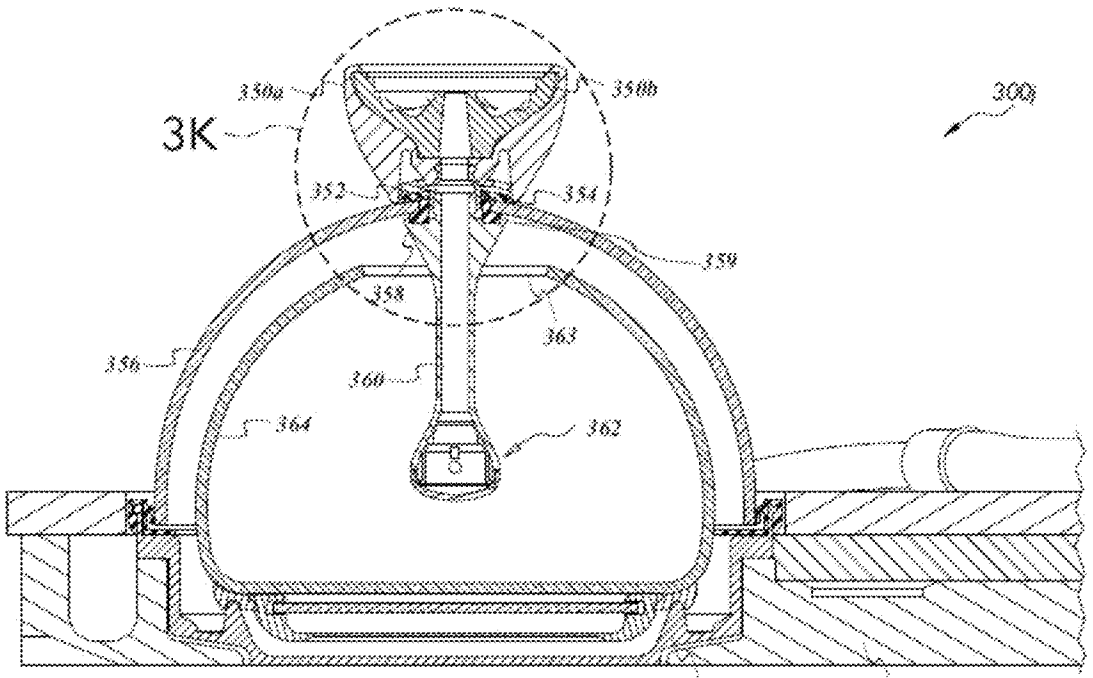
FIG. 3J shows a fully assembled, side cross-sectional, example embodiment of a domed water pipe and tray, in which a manifold is housed within the supporting tray.

FIGS. 3D-3K show an example embodiment of an exploded view 300*d*-300*k* respectively of an assembly process for a two-portion coupling air draw system mechanism as shown in FIG. 3B. As shown in the example embodiment, a bowl 350 can include a silicone housing 350*a* and glass core 350*b* as shown in FIG. 3J. This can be removably coupled to a bowl nipple 352 via an appropriate mechanism, such as a threaded screwing mechanism. A nipple gasket 354 can be placed over and coaxial with a central axis hole 359 of an outer vessel 356 exterior. Similarly, a downstem gasket 358 can be coupled with a downstem 360 and be arranged coaxially with the central axis hole 359 of the outer vessel 356 interior surface. Then the upper end of the downstem 360 can be coupled with the lower end of the bowl nipple 352 such that they are assembled in a fixed fashion with respect to each other and the outer vessel 356.

As described in FIG. 3E, fittings for gaskets 352, 358 can be snug and pressing gaskets 352, 358 together with their respective components 352, 360 can be sufficient in some embodiments. As shown in FIG. 3E, in some embodiments the downstem 360 and gasket 358 assembly is placed into position on the interior surface of the outer vessel 356 before the bowl nipple 352 and gasket 354 assembly are coupled to them on the exterior surface of the outer vessel 356 via the central axis hole 359, as shown in FIG. 3F. Next, as shown in FIG. 3F, the bowl 350 may then be coupled with the bowl nipple 352. Finally, the outer vessel 356 can be coupled with a manifold 368 assembly by firmly pressing it into place while carefully navigating the downstem 360 into a central axis hole 363 at the top of inner vessel 364 as shown.

FIG. 3J shows an example embodiment of a water pipe for a two portion coupling air draw system mechanism from a cross sectional side view 300*j*.

Figure 3K:
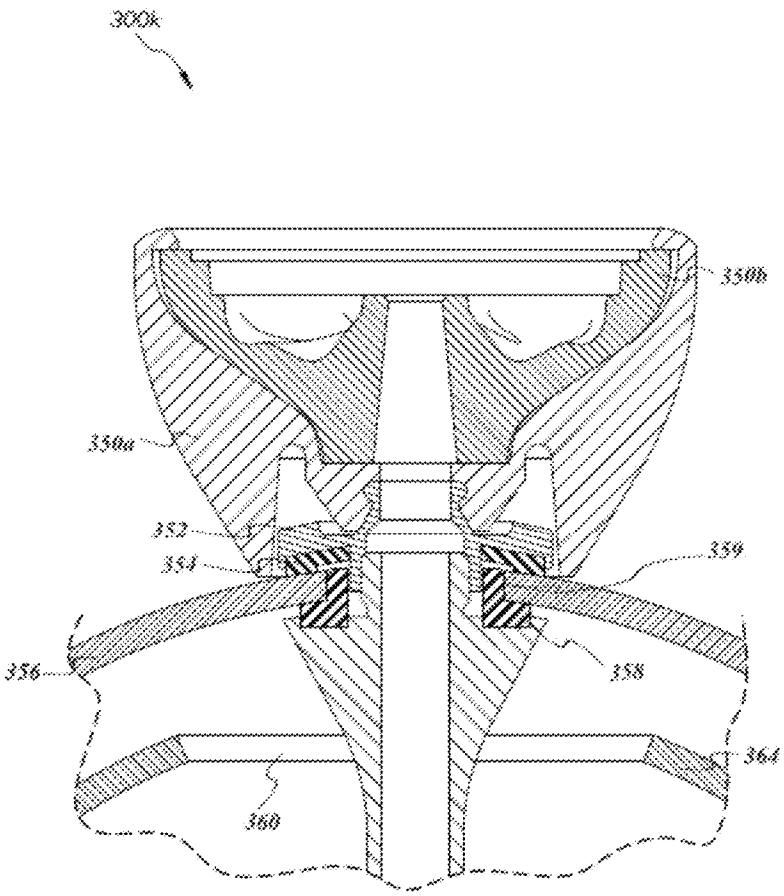
FIG. 3K shows a close-up example embodiment of the seal formed by a top and bottom down stem assemblies with an outer glass vessel.

FIG. 3K shows an example embodiment of a water pipe head detail 300*k* for a two portion coupling air draw system mechanism from a cross sectional side view.

Hose Subsection

Figures 2, 4A:
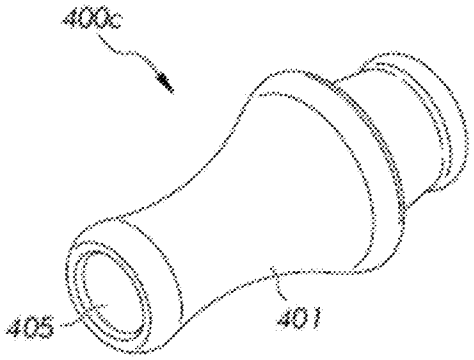
FIG. 4A shows an example embodiment of a hose tip side diagram, side cross-sectional diagram, side image, mockup and end view diagram.
Figures 3, 4A:
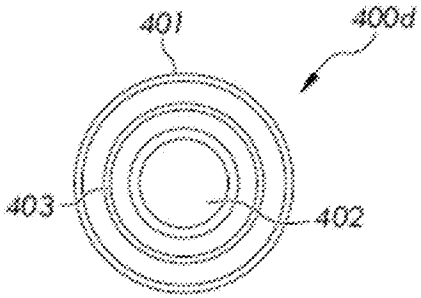
Figure 4A:
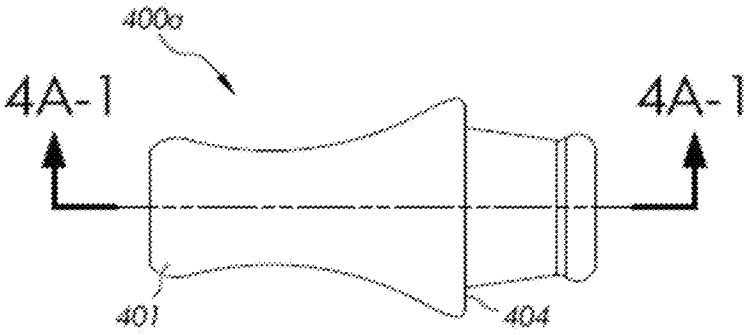
Figures 1, 4A:
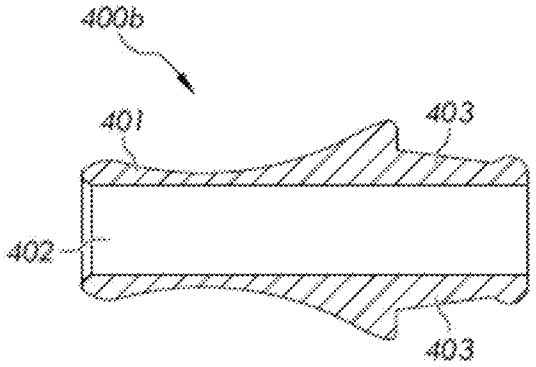

FIG. 4A shows an example embodiment of a hose tip 401 side diagram 400*a*, side cross-sectional diagram 400*b*, mockup 400*c* and end view diagram 400*d*. In various embodiments hose tips can be metal, plastic, rubber or other appropriate material and may be fixed or removable. In some embodiments they can include gripping mechanisms such as ridges, bumps or others that may be arranged in functional patterns or designs to aid in grasping. As shown in side cross-sectional diagram 400*b*, tip 401 includes a hollow cylindrical center 402 that is surrounded by a wall 403. A ridge 404 can provide a stopping point such that tip 401 can be coupled with a hose or intermediary component. Users will inhale through hole 405 in a proximal end of tip 401. Tip 401 can be about 35.51 millimeters long in some embodiments. Hose tip 401 can be an example embodiment of hose tip 1 of FIG. 3A.

Figures 1, 4B:
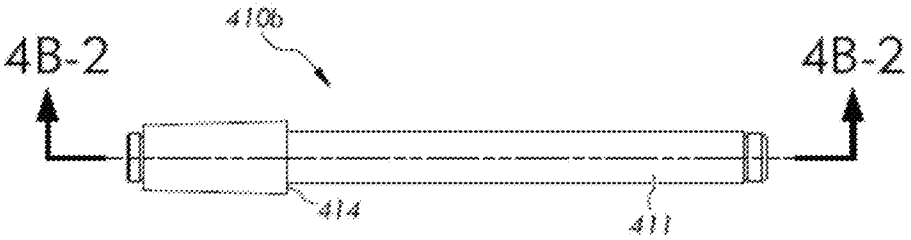
FIG. 4B shows an example embodiment of an MP Body end diagram, side diagram, side cross-sectional diagram and mockup.
Figures 3, 4B:
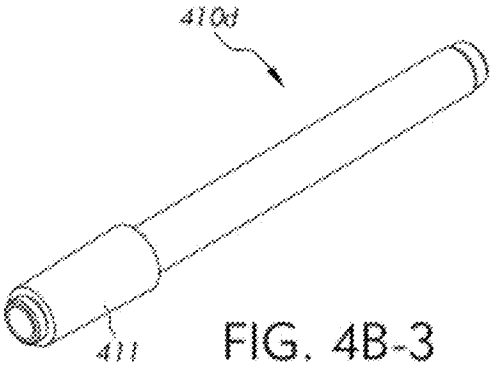
Figures 2, 4B:
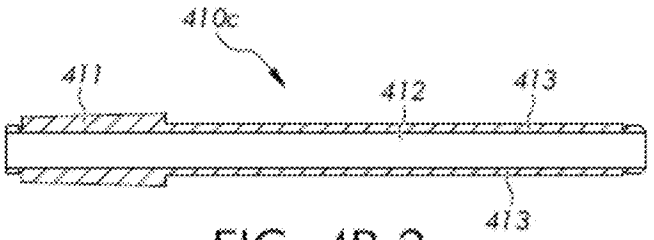
Figure 4B:
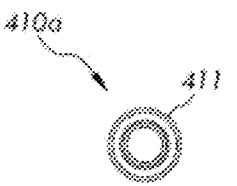

FIG. 4B shows an example embodiment of an MP body 411 end diagram 410*a*, side diagram 410*b*, side cross-sectional diagram 410*c* and mockup 410*d*. As shown in the example embodiment, MP body 411 can include a hollow cylindrical center 412 that is surrounded by a wall 413. A ridge 414 can provide a stopping point such that MP body 411 can be coupled with a hose or intermediary component. MP body 411 can be about 200 millimeters long in some embodiments MP body 411 can be an example embodiment of MP body 2 of FIG. 3A.

Figures 2, 4C:
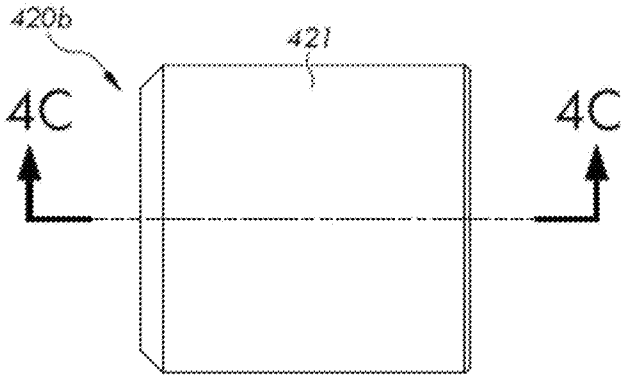
FIG. 4C shows an example embodiment of a hose end cover side cross-sectional diagram, end diagram, side diagram and mockup.
Figures 3, 4C:
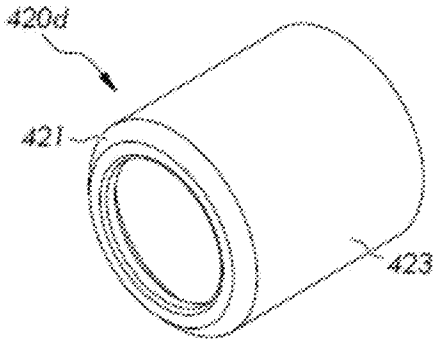
Figure 4C:
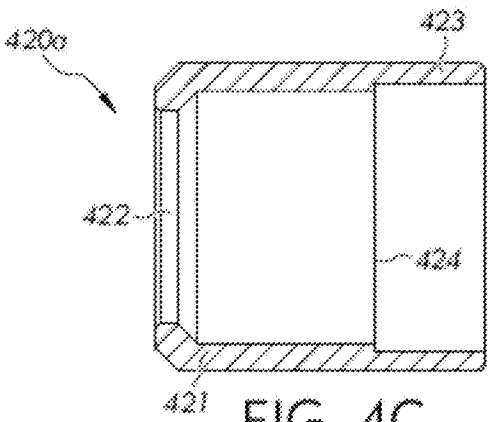
Figures 1, 4C:
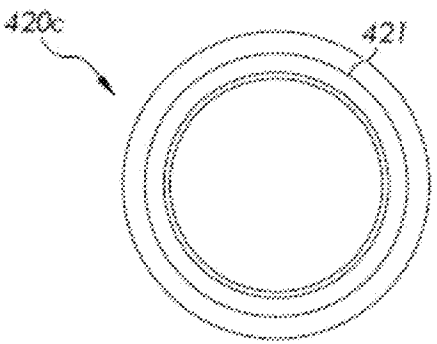

FIG. 4C shows an example embodiment of a hose end cover 421 side cross-sectional diagram 420*a*, end diagram 420*b*, side diagram 420*c* and mockup 420*d*. As shown in the example embodiment, hose end cover 421 can include a hollow cylindrical center 422 that is surrounded by a wall 423. In some embodiments, a grommet can be fixed or removable within hollow cylindrical center 422. An interior ridge 424 can provide a stopping point such that hose end cover 421 can be coupled with a hose or intermediary component. Hose end cover 421 can be about 30 millimeters long in some embodiments. Hose end cover 421 can be an example embodiment of hose end cover 6 of FIG. 3A.

Figures 1, 4D:
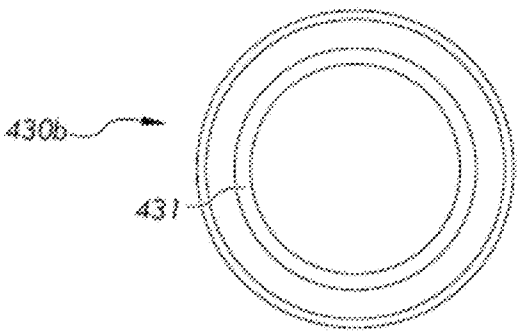
FIG. 4D shows an example embodiment of an MP tip adapter.
Figures 3, 4D:
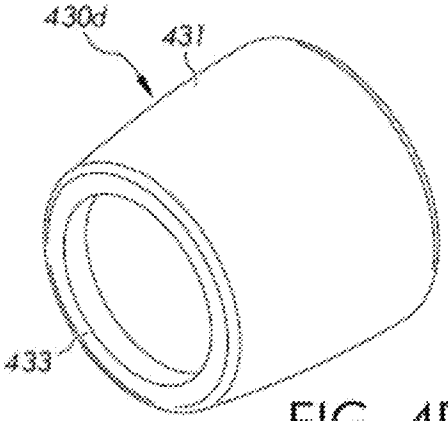
Figure 4D:
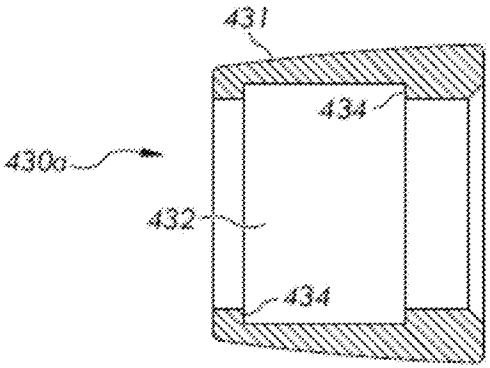
Figures 2, 4D:
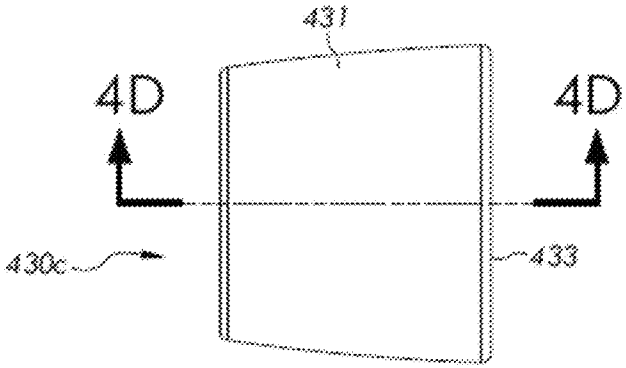

FIG. 4D shows an example embodiment of an MP nipple and tip adapter 431 side cross-sectional diagram 430*a*, end diagram 430*b*, side diagram 430*c* and mockup 430*d*. As shown in the example embodiment, MP nipple and tip adapter 431 can include a hollow cylindrical center 432 that is surrounded by a wall 433. In some embodiments, a grommet can be fixed or removable within hollow cylindrical center 432. At least one interior ridge 434 can provide a stopping point such that MP nipple and tip adapter 431 can be coupled with a hose or intermediary component. MP nipple and tip adapter 421 can be about 30 millimeters long in some embodiments.

Figure 4E:
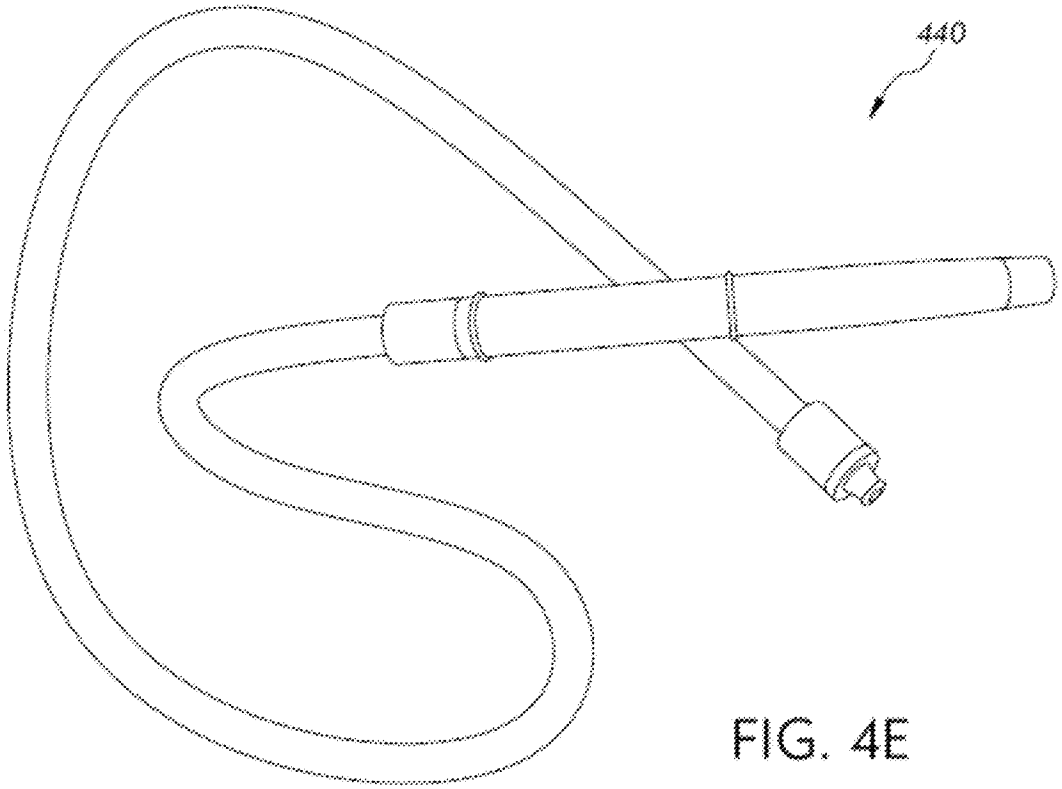
FIG. 4E shows an example embodiment of a hose.

FIG. 4E shows an example embodiment of a hose 440. Hose 440 can be a flexible cylindrical length and can include a hollow cylindrical interior. Hose 440 can be an example embodiment of hose 5 of FIG. 3A. In some embodiments, multiple hoses and purge systems can be used, as should be understood.

Figures 3, 4F:
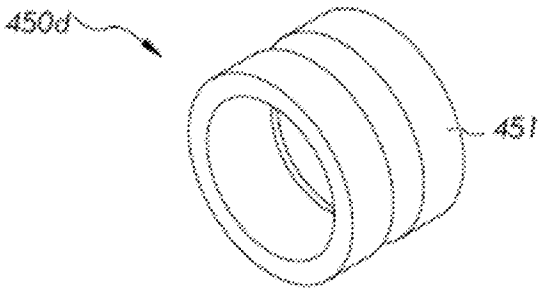
FIG. 4F shows an example embodiment of a MP grommet.
Figures 1, 4F:
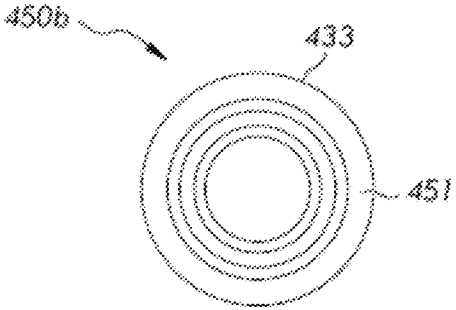
Figure 4F:
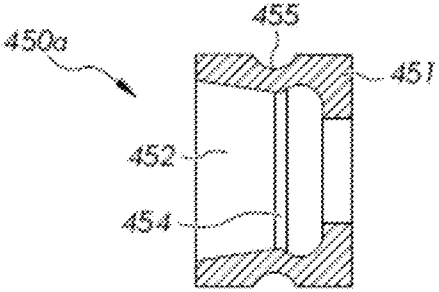
Figures 2, 4F:
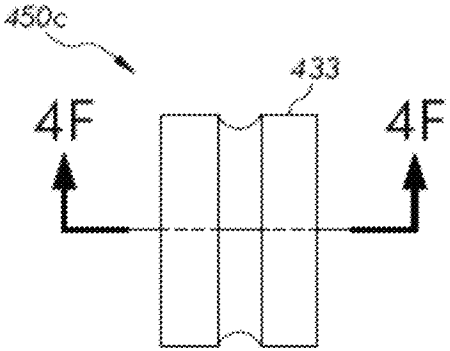

FIG. 4F shows an example embodiment of a MP Grommet 451 side cross-sectional diagram 450*a*, end diagram 450*b*, side diagram 450*c* and mockup 450*d*. As shown in the example embodiment, MP Grommet 451 can include a hollow cylindrical center 452 that is surrounded by a wall 453. In some embodiments, a grommet can be fixed or removable within hollow cylindrical center 452. At least one interior ridge 454 can provide a stopping point such that MP Grommet 451 can be coupled with a hose or intermediary component. MP Grommet 451 can include an exterior circumferential ridge 455 in order to couple with interior components of other components to remain in a fixed location with respect to the other component. MP Grommet 451 can be about 10.5 millimeters long in some embodiments.

Figures 1, 4G:
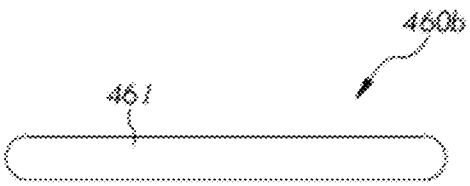
FIG. 4G shows an example embodiment of a MP large washer.
Figures 3, 4G:
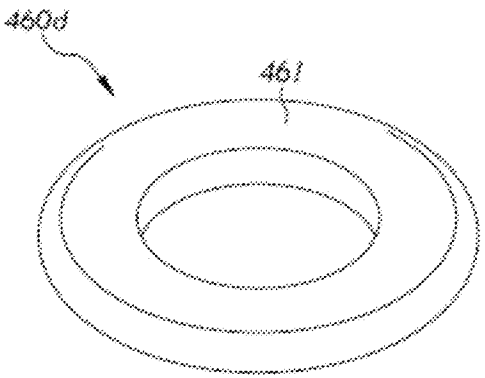
Figure 4G:
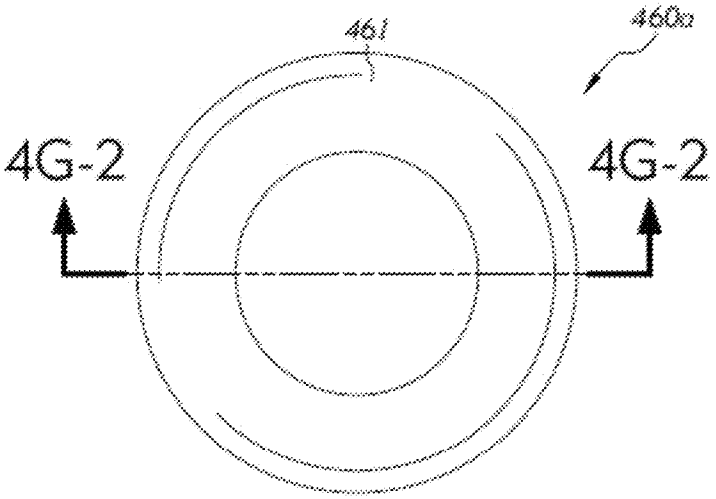
Figures 2, 4G:
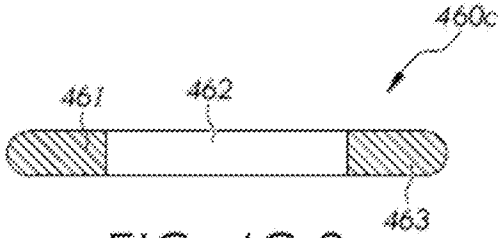

FIG. 4G shows an example embodiment of a MP large washer 461 side cross-sectional diagram 460*c*, end diagram 460*a*, side diagram 460*b* and mockup 460*d*. As shown in the example embodiment, MP large washer 461 can include a hollow cylindrical center 462 that is surrounded by a wall 463. In some embodiments, a grommet or other component can be fixed or removable within hollow cylindrical center 462. MP large washer 461 can be about 3 millimeters long in some embodiments.

Figures 1, 4H:
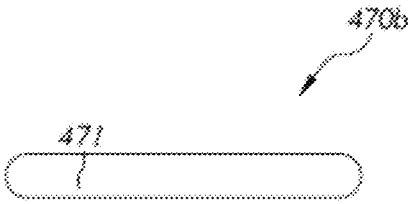
FIG. 4H shows an example embodiment of a MP small washer.
Figures 3, 4H:
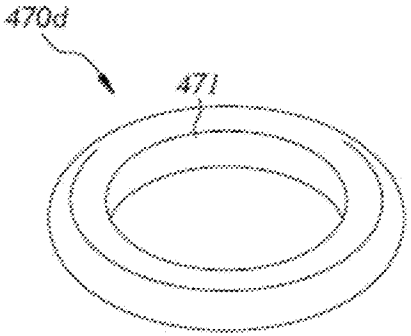
Figure 4H:
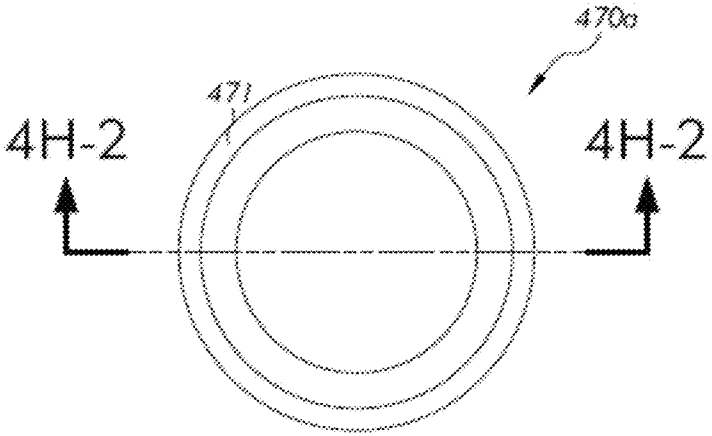
Figures 2, 4H:
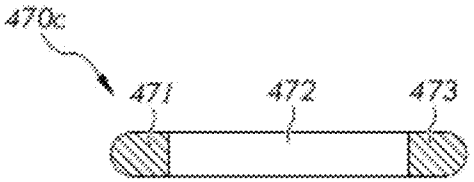

FIG. 4H shows an example embodiment of a MP small washer 471 side cross-sectional diagram 470*c*, end diagram 470*a*, side diagram 470*b* and mockup 470*d*. As shown in the example embodiment, MP small washer 471 can include a hollow cylindrical center 472 that is surrounded by a wall 473. In some embodiments, a grommet or other component can be fixed or removable within hollow cylindrical center 472. MP small washer 471 can be about 3 millimeters long in some embodiments.

Figures 1, 4I:
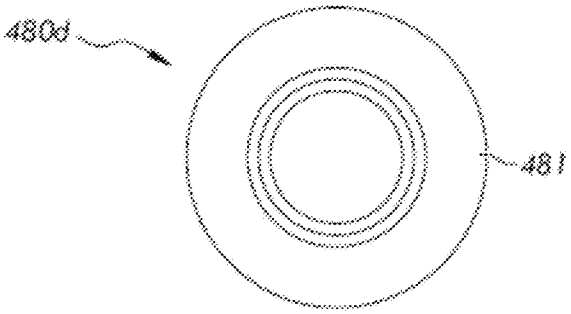
FIG. 4I shows an example embodiment of an MP hose receiver.
Figures 3, 4I:
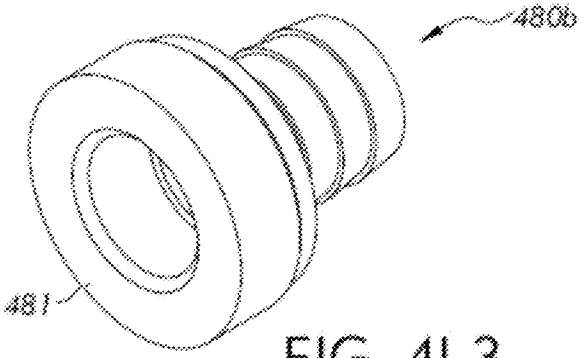
Figure 4I:
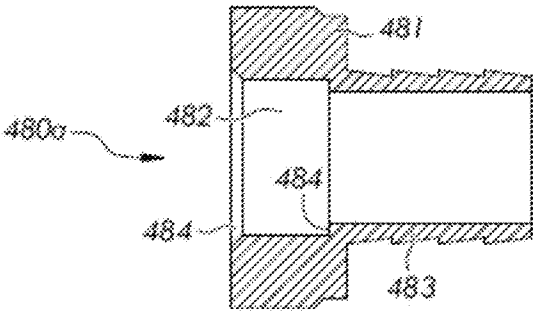
Figures 2, 4I:
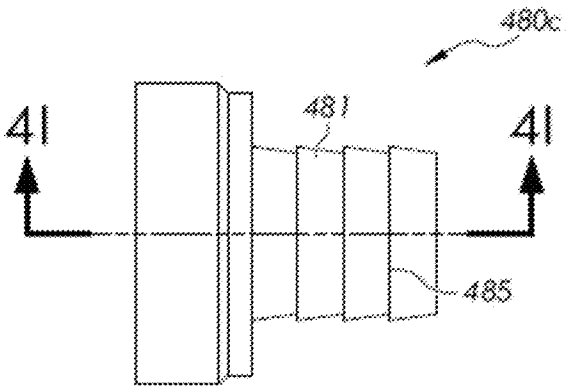

FIG. 4I shows an example embodiment of a MP hose receiver 481 side cross-sectional diagram 480*a*, end diagram 480*b*, side diagram 480*c* and mockup 480*d*. As shown in the example embodiment, MP hose receiver 481 can include a hollow cylindrical center 482 that is surrounded by a wall 483. In some embodiments, a grommet can be fixed or removable within hollow cylindrical center 482. At least one interior ridge 484 can provide a stopping point such that MP hose receiver 481 can be coupled with a hose or intermediary component. MP hose receiver 481 can include at least one exterior circumferential ridge 485 in order to couple with interior components of other components to remain in a fixed location with respect to the other component. MP hose receiver 481 can be about 26 millimeters long in some embodiments. FIG. 4I can be an example embodiment of MP nipple 4 of FIG. 3A.

Figures 1, 4J:
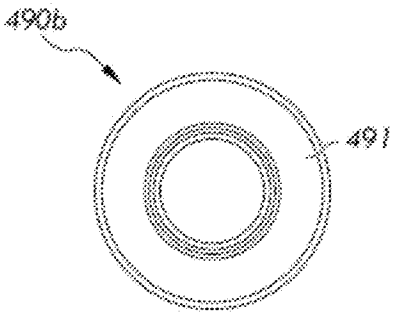
FIG. 4J shows an example embodiment of a MP hose end receiver.
Figures 3, 4J:
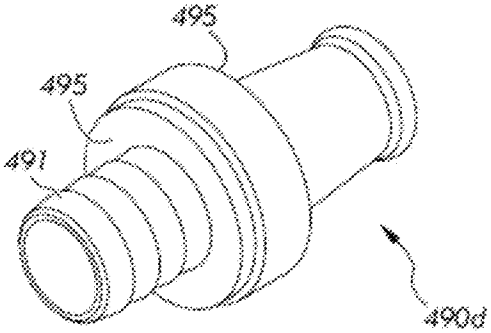
Figure 4J:
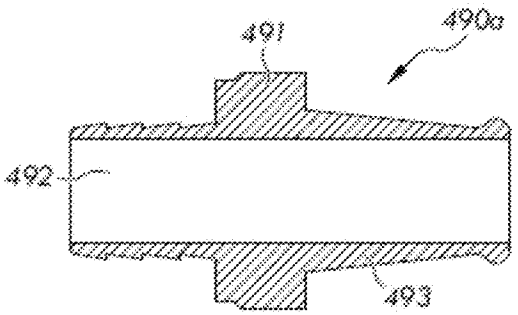
Figures 2, 4J:
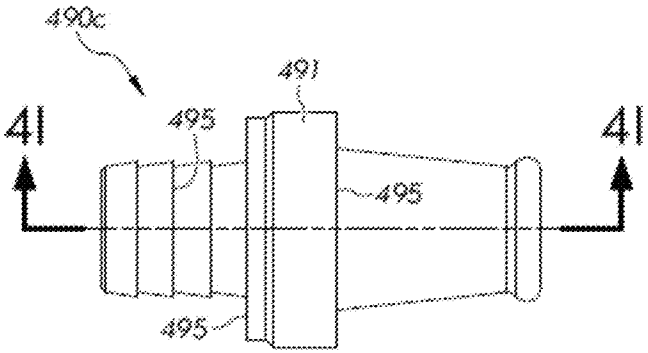

FIG. 4J shows an example embodiment of a hose end receiver 491 side cross-sectional diagram 490*a*, end diagram 490*b*, side diagram 490*c* and mockup 490*d*. As shown in the example embodiment, hose end receiver 491 can include a hollow cylindrical center 492 that is surrounded by a wall 493. Hose end receiver 491 can include at least one exterior circumferential ridge 495 in order to couple with interior components of other components to remain in a fixed location with respect to the other component. Hose end receiver 491 can be about 48.5 millimeters long in some embodiments. Hose end receiver 491 can be an example embodiment of hose plug 7 of FIG. 3A.

Figure 4K:
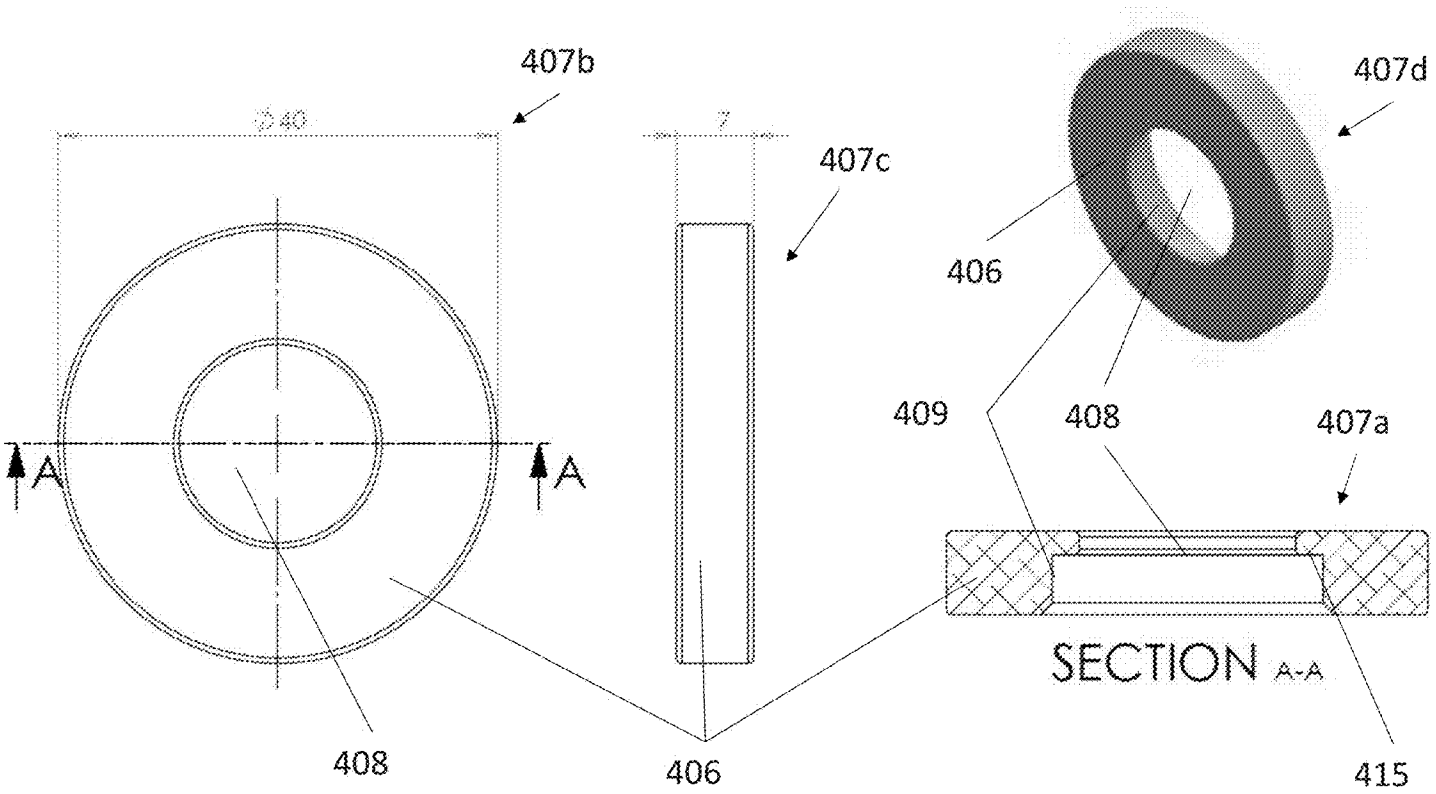
FIG. 4K shows an example embodiment of a hose end plug escutcheon.

FIG. 4K shows an example embodiment of a hose end plug escutcheon 406 side cross-sectional diagram 407*a*, end diagram 407*b*, side diagram 407*c* and mockup 407*d*. As shown in the example embodiment, end plug escutcheon 406 can be cylindrical or disk shaped and can include a hollow cylindrical center 408 that is surrounded and defined by a circumferential wall 409. Hose end plug escutcheon 406 can include at least one interior circumferential ridge 415 in order to couple with or otherwise retain other components, such as a grommet. Hose end plug escutcheon 406 can be about 40 millimeters diameter wide at its widest in some embodiments and about 7 millimeters thick. Hose end plug escutcheon can be an example embodiment of escutcheon 384 of FIG. 3B.

Figure 4L:
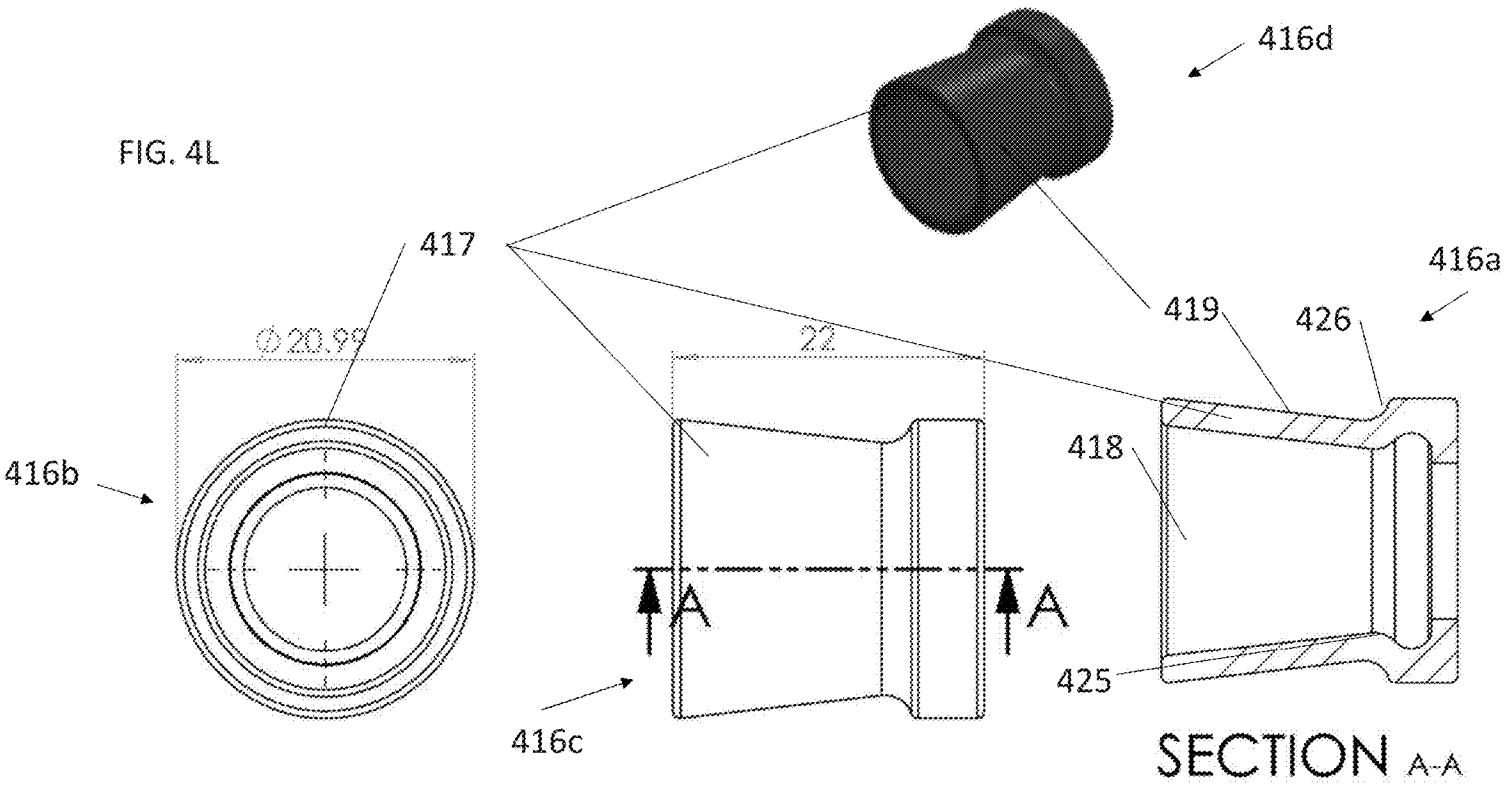
FIG. 4L shows an example embodiment of a hose plug grommet.

FIG. 4L shows an example embodiment of a hose plug grommet 417 side cross-sectional diagram 416*a*, end diagram 416*b*, side diagram 416*c* and mockup 416*d*. As shown in the example embodiment, hose plug grommet 417 can include a hollow cylindrical center 418 that is surrounded by a wall 419. In some embodiments, another grommet or component can be fixed or removable within hollow cylindrical center 418. At least one interior ridge 425 can provide a stopping point such that hose plug grommet 417 can be coupled with a hose or intermediary component. Hose plug grommet 417 can include an exterior circumferential ridge 426 in order to couple with interior components of other components to remain in a fixed location with respect to the other component. Hose plug grommet 417 can be about 22 millimeters long in some embodiments and about 20.99 millimeters in diameter at its widest. Hose plug grommet 417 can be an example embodiment of hose plug grommet 382 of FIG. 3B.

Figure 4M:
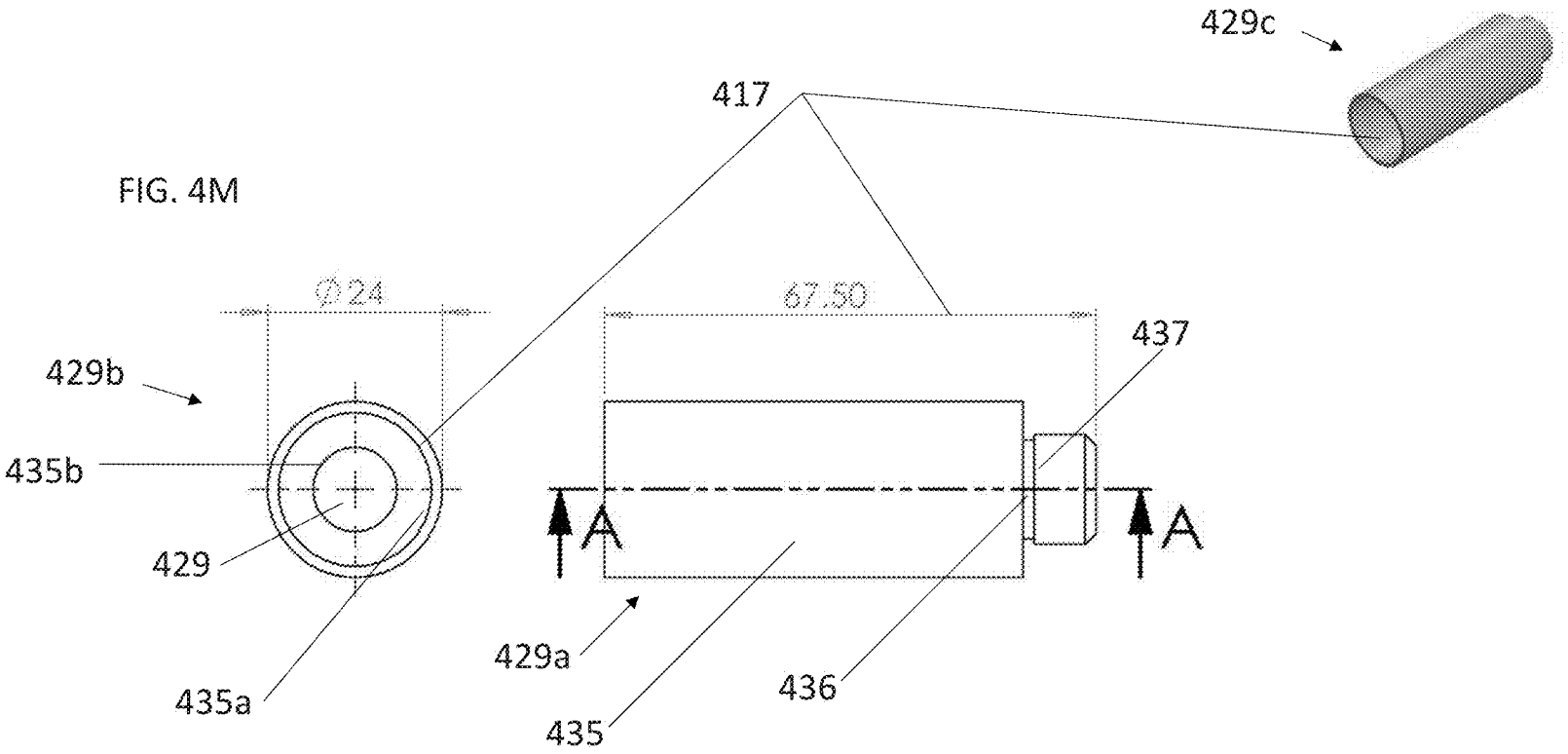
FIG. 4M shows an example embodiment of a manifold extension.

FIG. 4M shows an example embodiment of a manifold extension 427 side diagram 428*a*, end diagram 428*b* and mockup 428*c*. As shown in the example embodiment, manifold extension 427 can include a hollow cylindrical center 429 that is surrounded by a wall 435. Wall 435 can be unitary in some embodiments and can include a wider diameter section 435*a* and narrower diameter section 435*b*. These sections can transition abruptly or gradually at a neck 436. Wider diameter 435*a* section can allow for insertion of other components such as grommets, while narrower diameter section 435*b* can include coupling mechanisms on an exterior surface 437 such as ridges for inserting and coupling within other components such as a manifold. Manifold extension 427 can be about 67.5 millimeters long in some embodiments and about 24 millimeters in diameter at its widest. Manifold extension 427 can be an example embodiment of manifold extender 370 and 380 of FIG. 3B.

Figure 4N:
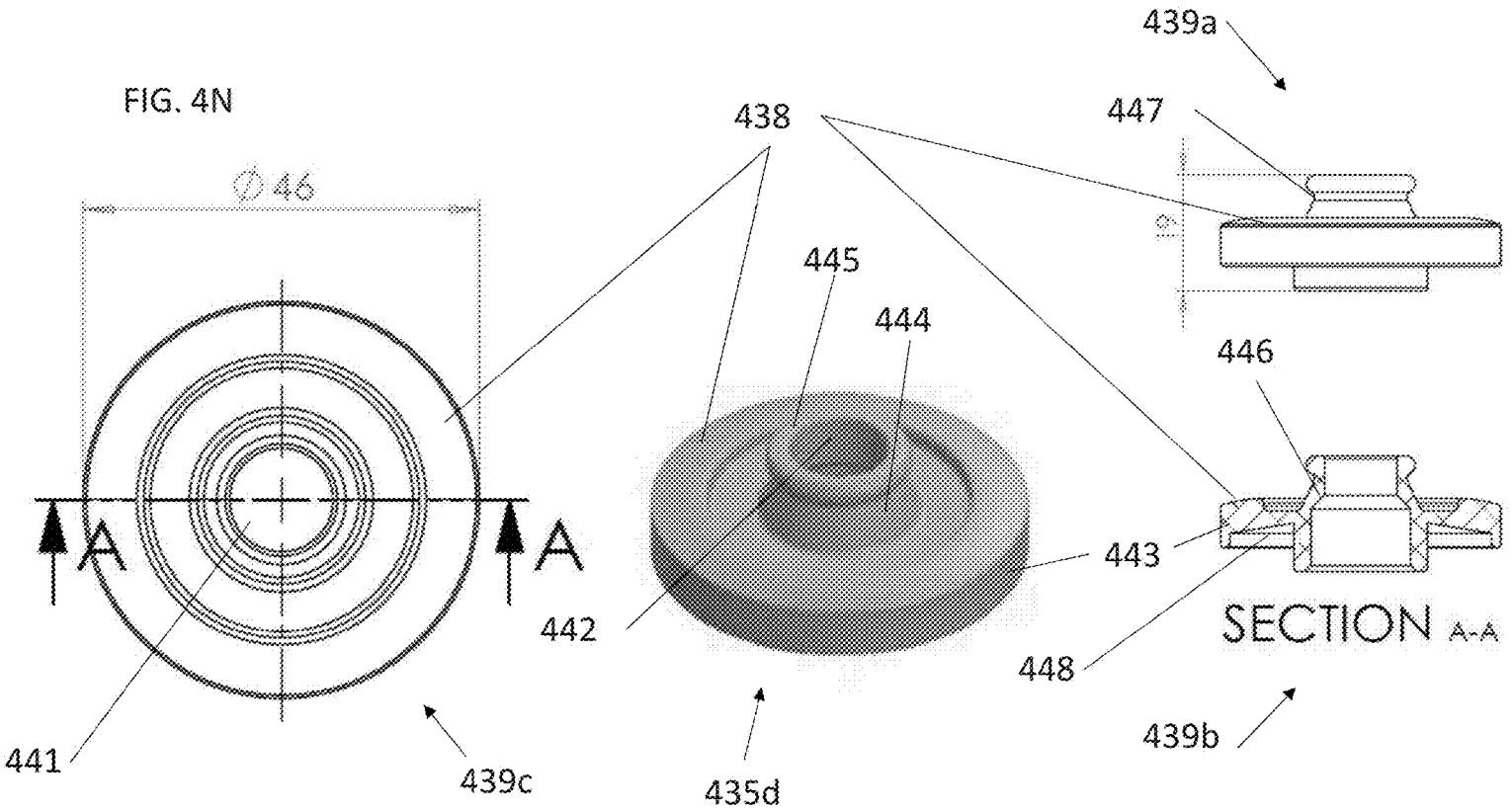
FIG. 4N shows an example embodiment of a bowl nipple.

FIG. 4N shows an example embodiment of a bowl nipple 438 side diagram 439*a*, side cross sectional diagram 439*b*, end diagram 439*c* and mockup 439*d*. As shown in the example embodiment, bowl nipple 438 can include a hollow cylindrical center 441 that is surrounded by an interior wall 442. Wall 442 can be unitary in some embodiments and can include a wider diameter section and narrower diameter section. An exterior of bowl nipple 438 can include a generally cylindrical shaped disk 443 at a distal end that has a tapered section 444 and a thicker cylindrical disk 445 at a proximal end. These sections can transition abruptly or gradually. Tapered section 444 can include ridges for coupling using a screwing mechanism in some embodiments. An interior of hollow cylindrical center 441 can include at least one ridge 446 for insertion of other components such as grommets, while an exterior surface 447 can include features such as ridges for inserting and coupling within other components such as a bowl. Bowl nipple 438 can be about 19 millimeters thick in some embodiments and about 46 millimeters in diameter at its widest. As shown in the example embodiment, a channel 448 can be located coaxially around cylindrical center 441 and may include an arched rim for holding or coupling with a grommet or gasket. As shown, channel 448 may have an exterior wall that does not extend as far distally as wall 442. Bowl nipple 438 can be an example embodiment of bowl nipple 352 of FIG. 3B.

Bowl Subsection

FIG. 5A shows an example embodiment diagram 500*a* of a bowl 502 and downstem 530 with aerator subassembly 540 in an upside-down orientation.

FIG. 5B shows an example embodiment diagram 500*b* of a bowl 502 and downstem 530 in an upside-down orientation.

FIG. 5C shows an example embodiment diagram 500*c* of a bowl 502 and downstem 530 with aerator subassembly 540 in an upside-down orientation. Downstem 530 can be an example embodiment of downstem 8 of FIG. 3A. Aerator subassembly 540 can be an example embodiment of aerator 10 of FIG. 3A FIG. 5D shows an example embodiment diagram 500*d* of a bowl 502 and downstem 530 with aerator subassembly 540.

FIG. 5E shows an example embodiment diagram 500*e* of a bowl 502 with separate chambers 504 and downstem 530 with aerator subassembly 540. As shown in the example embodiment, separate chambers 504 or compartments for tobacco or other organic material can provide containment in different locations within bowl 502. Chambers 504 are defined by walls 507 that can slope and meet at a lower end and a circumferential wall 508. In the example embodiment, the separate chambers 504 are shown in a spiral configuration with a central pipe 506 at the center. The separate compartments 504 can provide flavor mixing advantages not present in the art. For instance, one compartment 504 can be used for a first flavor of tobacco, or other organic material, while a second compartment 504 can be used for a second flavor, until each compartment 504 is filled. Unique and easily reproducible combinations can be created by a user based on this design. This is in stark contrast to the traditional single compartment design.

As shown for example in FIG. 5E, a bowl 502 preferably generally comprises a substantially hemispherical bowl head 505 extending vertically and radially from a substantially cylindrical bowl stalk 509. As shown, bowl stalk 509 may be flared outward at its bottom end to facilitate easier manipulation. The bowl 502 preferably further comprises interior 510 and exterior 511 surfaces separated by a rim portion 503. In some embodiments, located central to the bowl head 505, and forming a portion of the inner surface of the bowl 502, may be a hollow tube 506 extending the length of the bowl 502 from the bowl head 505 through the bowl stalk 509.

Bowl head 505 preferably further comprises a plurality of compartments 504*g* therein for containing the organic matter or other material to be smoked. Accordingly, internal walls 507 may separate adjacent compartments 504*g*. A plurality of internal walls 507 may extend inward from the interior surface of the bowl head to hollow tube 506, forming the plurality of compartments 504*g*. Accordingly, each internal wall 507 may partially or wholly separate adjacent compartments 504*g*. Compartments 504*g* may have varied dimensions and may be uniform or sized differently in different embodiments. In the example embodiment, each compartment is of equal depth and similar dimensions and shape. Each compartment may have a "U" shaped cross sectional profile when viewed from a side. Alternatively, each compartment may have a "V" shape, open-top square shape, open-top rectangular shape or other shapes.

As shown in FIG. 5W, in some embodiments the compartments 504*g* are slightly recessed from an upper elevation of the rim 503, forming a space 318 between a cover and the organic matter to be smoked so as to promote airflow from the organic matter to the hollow tube 506.

In at least one embodiment, bowl 502 is made of silicone material. Silicone may have advantages such as improved insulation around the head 505 and improved heat distribution inside the head 505 and may also provide improved uniformity of heat distribution. Improved insulation around head 505 may provide an improved user experience since users are less likely to burn themselves when handling bowl 502 when it is hot. Improved heat distribution inside head 505 may provide an improved user experience since it promotes even heating characteristics for organic matter in compartments 504*g*. As such, organic matter may be evenly heated and less likely to have some portions burn while others remain unheated. In other embodiments clay, marble, glass, or other appropriate materials may be used.

In accordance with the bowl of FIG. 5E, a user can insert a metered amount of tobacco, shisha or other organic material into one or more of compartments 504*g* before or after coupling bowl 502 with a stem of a water pipe in order to prepare the bowl 502 for smoking.

In another example embodiment, compartments can be arranged concentrically around the central pipe. In the example embodiment, the separate compartments are slightly recessed from the top of the head. That is, the barriers between separate compartments do not extend to the upper end of the head. In the example embodiment, this can create a small gap between the lower surface of a plate for coal support and the upper surface of the tobacco, or other organic material, to be heated where the tobacco, or other organic material, is inserted in the compartments to the same upper height as the upper end of the ridge barriers. This arrangement can serve to protect the tobacco, or other organic material, from becoming too hot and burning which can create an unpleasant and harsh smoke for the user. The small gap can also serve as a small compartment for pleasant smoke created by the heated tobacco, or other organic material, to reside before being drawn downward through the central pipe. In some embodiments, they can extend to the upper end of the head.

FIG. 5F shows an example embodiment diagram 500*f* of a bowl 502 and downstem 530.

FIG. 5G shows an example embodiment cross-sectional diagram 500*g* of a bowl 502, plate 520 and coupled cap 550. Bowl 502 can be an example embodiment of bowl 350 of FIG. 3D.

FIG. 5H shows an example embodiment cross-sectional diagram 500*h* of a bowl 502, plate 520 and coupled cap 530.

FIGS. 5G-5H show a perspective view of a head with separate compartments for tobacco, or other organic material, containment. In typical prior art heads, a single compartment is provided for housing tobacco. In the example embodiment, a plurality of separate compartments are shown for housing tobacco, or other organic material. Each compartment shown can extend radially outward in a spiral from a central pipe that extends through the head for a portion or from top to nearly the bottom. In operation, the central pipe can allow a user to draw air from above the central pipe through the central pipe. The separate compartments shown each have identical dimensions although in other embodiments differing dimensions can be used. For example, a single compartment can be half of the head while the other half of the head can be split in two for a total of three compartments. Similarly, in some embodiments compartments can be arranged differently.

FIGS. 5G-5H show a perspective cross-sectional view 500*g* and side cross-sectional view 500*h* of an example embodiment of a dual component bowl 502*g* in accordance with the present invention. In various embodiments, an outer bowl 502*h* is provided with an inner bowl 502*i* which can be a different material and can be fixed or removable with respect to outer bowl 502*h*. In the example embodiment, outer bowl 502*h* is a silicone bowl which does not readily transfer heat and provides some insulating features Inner bowl 502*i* is a glass bowl which provides heat transfer properties. Inner bowl 502*i* can be manufactured with a spiral pattern 1206, which in some embodiments can function similarly to the spiral features creating individual compartments. Further description of dual component bowls is given with respect to FIGS. 3D and 3E in U.S. patent application Ser. No. 14/948,168, which is incorporated by reference herein in its entirety.

As shown in FIG. 5H, air can be drawn into cap 550, through holes in platform 520 and through a central hole of bowl 502*g*.

FIG. 5I shows an example embodiment exploded view diagram 500*i* of a bowl 502, plate 520 and coupled cap 550.

FIG. 5J shows an example embodiment top diagram 500*j*, side diagram 500*k*, side cross-sectional diagram 500*l* and mockup 500*m* of a bowl 502*j*.

FIG. 5K shows an example embodiment side diagram 500*n*, side cross-sectional diagram 500*o*, top diagram 5009 and mockup 500*q* of a bowl 502*k*.

FIG. 5L shows an example embodiment of a down stem 561 side diagram 560*s*, side cross sectional diagram 560*t*, end diagram 560*r* and mockup 560*u*. As shown in the example embodiment, down stem 561 can include a hollow cylindrical center 562 that is surrounded by an interior wall 563. Wall 563 can be unitary in some embodiments and can include a wider distal diameter section 562*a*, tapered section 562*b* and narrower proximal diameter section 562*c*. An exterior of down stem 561 can include a generally cylindrical shape 567 with a proximal tapered section 564 ending in a ridge 565, whereby a proximal end section 566 extends further and generally has the same exterior circumference as cylindrical section 567. Proximal end section can include ridges for coupling using a screwing mechanism in some embodiments, while in other embodiments it may be smooth. A distal taper 568 can end in a distal cylindrical section 569 that includes a coupling mechanism such as a ridge for coupling with a diffuser cap. These sections can transition abruptly or gradually. An interior of hollow cylindrical center 562 can include at least one ridge 570 for insertion and retention of other components such filters and aerators. Down stem 561 can be about 123.25 millimeters long in some embodiments and about 45.03 millimeters in diameter at its widest. Down stem 561 can be an example embodiment of down stem 361 of FIG. 3C.

FIG. 5M shows an example embodiment of a down stem 561 coupled with a bowl 502*m*.

FIG. 5N shows an example embodiment of a diffuser cap 581 side diagram 580*y*, side cross sectional diagram 580*w*, and mockup 580*x*. As shown in the example embodiment, diffuser cap 581 can include a hollow cylindrical center 582 that is defined by a cylindrical interior wall 583 and a convex wall 584. Wall 584 can be unitary in some embodiments and can include various perforations or holes 585 that allow for air to pass through it. Cylindrical interior wall 583 can include ridges or other mechanisms that allow for coupling with a down stem distal end. Diffuser cap 581 can be about 13 millimeters long in some embodiments and about 38 millimeters in diameter at its widest. Diffuser cap 581 can be an example embodiment of aerator cap 362 of FIG. 3B.

FIG. 5O shows an example embodiment of a top end view 580*a* and bottom end view 580*z* of a diffuser cap.

FIG. 6A shows an example embodiment exploded view diagram 600*a* of an aerator subassembly. This aerator subassembly can fit within a downstem distal end and be held in place by a diffuser cap in various embodiments. As shown in the example embodiment, a filter top 602 can rest over and cover a filter mesh 610. Filter mesh 610 can in turn rest on carbon pellets 622, carbon sponge 620 or both. One or all of filter top 602, filter mesh 610, carbon 622 in the shape of pellets, rods, squares, or any other regular or irregular shape and carbon sponge 620 can be housed within filter body 630. In various embodiments, filter top 602 can be coupled with filter body 630. In some embodiments, coupling can be accomplished with ultra-sonic welding.

FIG. 6B shows an example embodiment diagram of a filter top 602 from a top view 600*b*, side view 600*c* and perspective view 600*d*. As shown in the example embodiment, filter top 602 can include solid ribs 604 and holes 606 that allow airflow through filter top 602. These holes can be arranged in a regular or irregular pattern. Filter top 602 can have a wall 1121 that defines a cylindrical empty chamber 1125. Filter top 602 can have a thickness and have a diameter of about 30.4 millimeters at its widest in some embodiments.

It should be noted that carbon filtration can be used in various locations in different embodiments. As such, carbon sponges (e.g. 620), carbon pellets (e.g. 622), filter meshes (e.g. 610) and other components may be housed within one or more enclosures in different locations. These can include, but are not limited to, a channel around an edge or edges of a manifold (e.g. 368 of FIG. 3B), a hose tip (e.g. 4001 of FIG. 4A), an MP core (e.g. 411 of FIG. 4B), a hose receiver (e.g. 481 of FIG. 4I), a hose end receiver (e.g. 491 of FIG. 4J), a manifold extension (e.g. 427 of FIG. 4M), or any other location as would be appropriate and effective for their purpose of filtering particulates from airflow within water pipes.

FIG. 6C shows an example embodiment diagram of a filter mesh 610 from a top view 600*e*, side view 600*f*, perspective view 600*g* and image view 600*h*. As shown in the example embodiment, filter mesh 610 can be a mesh or other fabric, operable to allow airflow therethrough. This fabric can be chosen as appropriate but should generally have a filtering effect on smoke drawn therethrough. Various fabrics are considered including synthetic and natural fabrics. Filter mesh 610 can have a thickness of about 1 millimeter and have a diameter of about 25 millimeters at its widest in some embodiments.

FIG. 6D shows an example embodiment diagram of a carbon sponge 620 from a top view 600*i* and a side view 600*j*. As shown in the example embodiment, carbon sponge can have a diameter of about 19.06 millimeters and a thickness of about 8 millimeters.

FIG. 6E shows an example embodiment diagram of a filter body 630 from a top view 600*k*, bottom view 600*l*, side view 600*m*, side cross-sectional view 600*n* and mockup 600*o*. As shown in the example embodiment, filter body 630 can include a cylindrical portion 632 and a flared portion 634. Filter body 630 can have at least one wall 640 that defines the cylindrical portion 632 and flared portion 634. At least one interior ridge 636 can provide a stopping point such that filter body 630 can be coupled with intermediary components. Flared portion can terminate in a rib structure 642 with holes 638 that allow airflow through filter body 630. These holes 638 can be arranged in a regular or irregular pattern. Filter body 630 can have a length of 24.04 millimeters, cylindrical portion 632 can have a diameter of about 30.4 millimeters at its widest and flared portion can have a diameter of about 30.4 millimeters at an end opposite cylindrical portion 632 in some embodiments.

In some embodiments substances other than tobacco can be smoked through the water pipes disclosed herein. In some of these embodiments, additional, substitute or complementary components may be required for safety, health, enjoyment and other functional reasons.

Manifold and Glass Subsection

FIG. 7A shows an example embodiment of an outer vessel 701 top view diagram 702*a* and isometric view diagram 702*b*. As shown in the example embodiment, outer vessel 701 can be defined by a wall 704 that is generally dome shaped in a half sphere. A circular hole 703 can be substantially centrally located at the top of the dome. The bottom of the dome can be substantially open. Outer vessel can be about 254 millimeters in diameter at its widest. Outer vessel 701 can be an example embodiment of outer vessel 11 of FIG. 3A.

FIG. 7B shows an example embodiment of an outer vessel 701 side view diagram 702*c*, side cross-sectional diagram 702*d* and side cross-sectional detail diagram 702*e*. As shown in the example embodiment, outer vessel 701 can be about 138 millimeters tall in total. Wall 704 can include a domed height of about 126 centimeters and a vertical true cylindrical height of about 12 millimeters at the bottom of outer vessel 701. Hole 703 can be about 30 millimeters in diameter. Wall 704 can be about five millimeters thick and hole 703 can be cut from wall 704 before being ground and polished to smooth out edges. Similarly, the bottom edge of wall 704 can be cut, ground flat and polished.

FIG. 7C shows an example embodiment of an inner vessel 721 an inner vessel picture 720*a*, mockup 720*b* and top view diagram 720*c*. As shown in the example embodiment, inner vessel 721 can be defined by a unitary bottom 725 and wall 724 that is generally dome shaped in a half sphere. A circular hole 723 can be substantially centrally located at the top of the dome. Bottom 725 of inner vessel can have a lower surface that is generally flat. Inner vessel 721 can be an example embodiment of inner vessel 12 of FIG. 3A.

FIG. 7D shows an example embodiment of an inner vessel 721 side view diagram 720*d*, side cross-sectional diagram 720*e* and side cross-sectional detail diagram 720*f*. As shown in the example embodiment, inner vessel 721 can be about 146.73 millimeters tall in total and about 213.93 millimeters in diameter at its widest. Hole 723 can be between 57 and 59 millimeters in diameter. Wall 724 can be about five millimeters thick and hole 723 can be cut from wall 724 before being ground and polished to smooth out edges and achieve desired angles.

FIG. 7E shows an example embodiment of an outer vessel 731 top view diagram 730*g* and isometric view diagram 730*h*. As shown in the example embodiment, outer vessel 731 can be defined by a wall 734 that is generally dome shaped in a half sphere. A circular hole 732 can be substantially centrally located at the top of the dome. As shown in the example embodiment, a flared lip 733 can be provided where hole 732 is narrowest. Flared lip 733 can provide a mounting location for a bowl subassembly that can be supported by an upward facing surface of flared lip 733. The bottom of the dome can be substantially open. Outer vessel 731 can be about 254 millimeters in diameter at its widest, while hole 732 can be about 42 millimeters at its narrowest. Outer vessel 731 can be an example embodiment of outer vessel 326 of FIG. 3C.

FIG. 7F shows an example embodiment of an outer vessel 731 side view diagram 730*i*, side cross sectional view diagram 730*j* and hole detail 730*k*. As shown in the example embodiment, outer vessel 731 can be about 165 millimeters tall in total. Wall 734 can include a domed height of about 138.36 centimeters and a vertical true cylindrical height of about 12 millimeters at the bottom of outer vessel 731. Wall 704 can be about five millimeters thick and flared lip 733 can be cut from wall 704 before being ground and polished to smooth out edges. Similarly, the bottom edge of wall 704 can be cut, ground flat and polished. Flared lip 733 can make about a 90-degree angle with the complementary portion of flared lip 733 located on the opposite side of hole 732.

FIG. 7G shows an example embodiment 7301 of an outer vessel coupled with a main seal and manifold from a cross-sectional side view. As shown in the example embodiment, an outer vessel 731 can be removably coupled with a manifold 902 by a main seal 810. This coupling can be substantially airtight and prevent air leaks in various embodiments. As such, the coupling can be tuned to various tolerances.

FIG. 7H shows an example embodiment of an outer vessel coupled with a main seal and manifold from a cross-sectional side view 730*m* and detailed view 730*n*. These mechanisms will be described further with respect to FIGS. 8A-8D and 9A-9C.

FIG. 7I shows an example embodiment of an outer vessel 731 side cross-sectional view diagram 730*o*. As shown in the example embodiment, a bowl 730 can rest in or otherwise be coupled with a flared lip 733 of an outer chamber 731.

FIG. 7J shows an example embodiment of an outer vessel 731 side cross-sectional view diagram 730*p* and detailed view 730*q*. As shown in the example embodiment, a bowl 730 can rest in or otherwise be coupled with a flared lip 733 of an outer chamber 731 and be affected by different tolerances due to the material of outer chamber 731. For example, when glass is used three different adaptable areas may require consideration and adjustment in developing appropriate couplings. Curvature flex 741 allows for bowls of a silicone material to hold to a full range of curvatures on the inner and upward facing flared lip 733. An adjustable height 742 of bowl 760 allows for changes in flared lip 733 thickness to be accounted for, even when changing. Adjustable height 742 can also provide for adaptation of locations where bowl 760 interfaces with the glass, relative to a height position of the curve accounted for by curvature flex 741. An adaptable inner diameter 743 can be accomplished by providing a moat 765 or other channel on an interior underside of bowl 760, around a central axis. This allows an outer arm 766 to flex inward toward the central axis of the bowl and thereby account for various inner diameter changes of outer chamber 731.

In various embodiments, inner and outer vessels can be different shapes and sizes and can be made of various materials. These can include cube shapes, donut shapes, cylinder shapes, irregular shapes, regular shapes and others as appropriate and glass, wood, stone, and others, as appropriate. Additionally, a diameter or other measurement at an upper opening of a hole in an outer vessel and a diameter or other measurement of a bottom opening of a hole in the outer vessel can be sized as desired or appropriate. This also applies to openings for an inner vessel. It should be understood that this applies to various differently sized embodiments.

In some embodiments, ice or other air or fluid cooling chambers can exist within inner or outer vessels or within an interior space of a tray. These can allow for air cooling to allow for improved smoking experiences for users. One or more of inner and outer vessels can be glass in various embodiments and may have dome shapes of varying volumes, as should be understood. In many embodiments, glass chambers can be hand blown and may be within 2 mm accuracy to a standard size. In some embodiments, glass can have nanocoating of one or more materials to protect it from corrosion or other undesirable effects. In some embodiments, one or both of an inner or outer chamber can have an etching to show users one or more recommended liquid filling levels for liquid to cool smoke. In some embodiments, an outer chamber neck can eliminate a need for some sealing components, as a downstem assembly may effectively seal the neck. In some embodiments, a secondary cooling system can be provided, including an electronic refrigeration system. In some embodiments, a plurality of inner chambers can be provided within an inner chamber, outer chamber or both. It should be understood that each of these can have a variety of different sized and shaped necks to provide different advantages and smoking experiences. In some embodiments, these can be suspended, coupled with, integrated with and otherwise related to the chambers themselves, while in other embodiments they may be separate from but otherwise related to the chambers themselves.

FIG. 8A shows an example image 800*a* of a purge valve assembly 830 coupled with a manifold 820, and manifold 820 coupled with a main seal 810.

FIG. 8B shows an example embodiment of a main seal 810 top diagram 800*b*, side diagram 800*d*, side cross-sectional diagram 800*e* and mockup 800*c*. As shown in the example embodiment, main seal 810 can include a hollow cylindrical center 812 that is surrounded by a wall 814. In some embodiments, at least one interior ridge 816 can provide a support such that an upper vessel can be coupled with main seal 810. Main seal 810 can be about 277 millimeters wide at largest diameter in some embodiments. Main seal 810 can be an example embodiment of gasket 14 of FIG. 3A.

FIG. 8C shows an example embodiment of main seal 810 as a side cross-sectional detail diagram 800*f*. As shown in the example embodiment, main seal 810 can include a unitary wall 814 that includes a ridge 816, that serves as a horizontal shelf to support an outer chamber. A secondary shelf 818 can initially be somewhat horizontal and bend vertically downward such that it removably couples with an outer surface of the outer chamber and maintains the outer chamber in place when in use. Empty space 819 between a primary wall 815 and secondary wall 817 can allow for wall 814 to bend such that it provides a snug fit between a manifold body and an outer vessel.

FIG. 8D shows an example embodiment of two images of a main seal 810 cross section.

FIG. 9A shows an example embodiment image of a manifold 902 from a top perspective view 900*a* that is coupled with a main seal 904. Also shown are purge valve opening 906 and hose opening 908. Manifold 902 can be an example embodiment of manifold body 15 of FIG. 3A.

FIG. 9B shows an example embodiment image of a manifold 902 from a side perspective view 900*b* that is coupled with a main seal 904. Also shown are purge valve opening 906 and hose opening 908.

FIG. 9C shows an example embodiment of a manifold 902 top view diagram 900*c*, side view diagram 900*d*, side cross-sectional diagram 900*e* and mockup 900*f*. As shown in the example embodiment, manifold 902 can include a flat center surface 910 that is surrounded by a cylindrical inner wall 912. Around inner wall 912 can be a depression 914 and an outer wall 916. In some embodiments, additional ridges can and walls can be provided. Depression 914 can provide a location for a bottom seal to rest that can also extend over inner wall 912 and parallel and above center surface 910. As such, an opening can be provided that is partially defined by inner wall 912 and center surface 910.

An inner chamber can rest on the bottom seal, above inner wall. In some embodiments, an outer chamber can also rest on a portion of the bottom seal, circumferentially around the inner chamber. In some embodiments, a main seal can be coupled with an upper ridge 918 and the outer chamber can rest on a portion of the main seal. In the example embodiment, a maximum diameter of manifold 902 is about 273 millimeters and a maximum height of manifold 902 can be about 68 millimeters at its largest. Purge valve opening 906 and hose opening 908 can be cylindrically shaped holes that are located across from each other in outer wall 916.

FIG. 9D shows an example embodiment of a bottom seal 932 from a top view diagram 930*a*, side view diagram 930*b*, side cross-sectional diagram 930*c* and mockup 930*d*. As shown in the example embodiment, bottom seal 932 can include hollow central cylindrical hole 934 that is defined by a cylindrical wall 936. Cylindrical wall 936 can include an upper portion 938 with a small exterior circumference and a lower portion with a larger exterior circumference. As shown in the example embodiment, a largest bottom seal 932 exterior circumference diameter can be 39 millimeters.

FIG. 10A shows an example embodiment of a puck glass 1002 side diagrams 1000*a*, 1000*b*, bottom diagram 1000*c* and top diagram 1000*d*. As shown in the example embodiment, puck glass 1002 can have a design etched in its upper surface such that it provides ridges, light refraction through the glass or other functional features. As shown in the example embodiment, a largest puck glass circumference can be 154 millimeters, while the design can have a largest circumference of 140 millimeters. Puck glass 1002 can have about a five-millimeter thickness.

FIG. 10B shows of puck glass 1002 side diagrams 1000*e*, 1000*f*. As shown in the example embodiment, puck glass can have a thickness of 18 millimeters and can have chamfered edges or corners. Chamfers can be less than 0.5 millimeters in some embodiments and in various embodiments each surface of puck glass 1002 should be polished. In various other embodiments, chamfers can be different dimensions but generally they are 0.5 millimeters or less.

FIG. 10C shows an example embodiment of a vessel gasket 1010 top view diagram 1000*g*, side view diagram 1000*h* and mockup 1000*i*. As shown in the example embodiment, vessel gasket 1010 can be disk shaped and can have a central hole with a diameter of about 22 millimeters and an outer diameter of about 42 millimeters. Vessel gasket can be about 3.18 millimeters thick.

FIG. 10D shows an example embodiment image 1000*j* of a cover 1020 coupled with a base 1030, ashtray 1040 and manifold 1050.

FIG. 10E shows an example embodiment of a cover 1020 top view diagram 1000*k*, ash tray depression side view diagram 10001, channel side cross-sectional diagram 1000*m* and cover mockup 1000*n*. As shown in the example embodiment cover 1020 can include a hole 1022, channel 1024 and ash tray depression 1026. Cover 1020 can have a width of about 380 millimeters and a length of about 537.4 millimeters. Hole 1022 can have a diameter of about 280 millimeters, channel 1024 can have a depth of about 5 millimeters and a width of about 14.09 millimeters and ash tray depression 1026 can have a diameter of about 91 millimeters and a radial depth of about 14 millimeters.

Channel 1024 can traverse an upper surface of cover 1020 in any direction including obliquely across a corner, as shown. Channel 1024 can be sized to about the same as a standard hose, such that when not in use or while users are resting, a hose body or grip can be conveniently placed in the channel and not fall. Further, in some embodiments channel 1024 can include surface features to increase frictions such as bumps, ridges or others, such that hoses are less likely to move.

Ash tray depression 1026 can provide a convenient location to ash coals or other combustible material. Ash tray depression 1026 can also provide a location for a removable ash tray to be located when in use. While ash tray depression 1026 is generally circular and partially spherical in the example embodiment, those in the art would understand that other shapes and cross sections can be used, such as square, rectangular, oval or others.

Purge Valve Subsection

FIG. 11A shows an example embodiment of a purge nipple 1101 side view diagram 1100*a*, side cross-sectional diagram 1100*b*, end diagram 1100*c* and mockup 1100*d*. As shown in the example embodiment, purge nipple 1101 can include a hollow cylindrical center 1102 that is surrounded by a wall 1103. In some embodiments, a grommet can be fixed or removable within hollow cylindrical center 1102. At least one interior ridge 1104 can provide a stopping point such that purge nipple 1101 can be coupled with intermediary or other components. Purge nipple 1101 can be about 34.9 millimeters long and have a diameter of 25 millimeters at its widest in some embodiments. Purge nipple 1101 can be an example embodiment of purge nipple 16 of FIG. 3A.

FIG. 11B shows an example embodiment of a purge plate 1110 end view diagram 1110*e*, side diagram 1110*f* and mockup 1110*g*. As shown in the example embodiment, purge plate 1110 can include a hollow cylindrical center 1112 that is surrounded by one or more solid radial spokes 1114 that are separated by gaps 1113. Purge plate 1110 can be about 1.9 millimeters thick and have a diameter of 22 millimeters at its widest in some embodiments. Purge plate 1110 can be an example embodiment of purge plate 17 of FIG. 3A.

FIG. 11C shows an example embodiment of an umbrella valve 1140 from a side cross sectional view 1100*p*, side view 1100*q*, top view 1100*r* and mockup 1100*s*. While purge mechanisms are traditionally ball valves in water pipes, disclosed herein are umbrella valve purge components that provide advantages over the prior art.

As shown in the example embodiment, umbrella valve 1140 can include a stem 1142 that couples with other components of a valve assembly to maintain umbrella valve 1140 in position with the overall valve assembly. Umbrella valve 1140 can be maintained in place by stem 1142 in a bore or stem 1142 can be removed if necessary such that umbrella valve 1140 rests in place within the assembly. Umbrella valve 1140 can be generally disk shaped and may be slightly conical on one or both sides. It also can be polished in some embodiments. Umbrella valve 1140 can have a preload or may be standardized without a preload in various embodiments. As shown in the example embodiment, a preload can include a 0.2 millimeter maximum, while it can be customized in various other embodiments. This can be adjusted by 0.05 millimeters for various opening pressures.

In the example embodiment, umbrella valve has a diameter of 0.709 millimeters and has a height of 0.565 millimeters when attached to a stem length. In some embodiments, one or both sides of umbrella valve 1140 can have various surface features can exist that are circular, rounded, oval or shaped otherwise in order to provide different movement characteristics to umbrella valve 1140. In some embodiments, providing few surface features with large surface area can promote a high flow while including multiple features that are smaller can promote a higher backward pressure resistance.

FIG. 11D shows an example embodiment of a purge cap 1120 end view diagram 1100*h*, side view diagram 1100*i* and mockup 1100*j*. As shown in the example embodiment, purge cap 1120 can include a solid center 1122 that is surrounded by one or more solid radial spokes 1124 that are separated by gaps 1123. Purge cap 1120 can have a wall 1121 that defines a cylindrical empty chamber 1125. Purge cap 1120 can have a wall length of about 12 millimeters and have a diameter of 28 millimeters at its widest in some embodiments. At least one interior ridge 1126 can provide a stopping point such that purge cap 1120 can be coupled with intermediary components. Purge cap 1120 can be an example embodiment of purge cap 19 of FIG. 3A.

FIG. 11E shows an example embodiment of images of a purge cap 1100*k*, purge plate 11001, purge cap and plate 1100*m*, purge nipple 1100*n* and purge cap and nipple subassembly 1100*o*.

Tray Subsection

FIG. 12A shows an example embodiment of a tray 1210 having an interior space 1220 coupled with a manifold 1201 in an image 1200*a* from a perspective view.

FIG. 12B shows an example embodiment of a tray 1210 from a top view diagram 1200*b*, bottom view diagram 1200*c* and mockup 1200*c*. As shown in the example embodiment, tray 1210 can include an interior space 1220 that is surrounded by one or more tray walls 1224 defining at least one interior compartments 1226. Interior compartments 1226 can be uniquely shaped for storage of specific items and shaped generally for general or multipurpose use. Tray 1210 can have a manifold hole 1212 that defines a location for placing or coupling with a complementary sized manifold, dome or both. In some embodiments, there can also be seals to prevent manifolds, domes or both from moving with respect to tray 1210.

Tray 1210 can have an overall length of about 525.40 millimeters and have an overall width of about 368 millimeters in some embodiments. One or more handle relief locations in exterior side walls, lower surfaces or combinations of both can allow for users to easily move and transport tray 1210 by hand. Mating depressions 1228 can be provided in upper surfaces of tray 1210 in order to allow users to mate complementary sized protrusions in a lower surface of a cover to provide stability. Additionally or alternatively, seals can be provided between a cover and tray 1210. In some embodiments tray 1210 can be removably coupled with a cover using a latch or other component. Tray 1210 can be an example embodiment of base 20 of FIG. 3A.

It should be understood that trays can be sized and shaped differently in different embodiments and may include additional or reduced features and functionality. For example, trays can be circular, oval shaped, triangular, square or other base shapes and can be three dimensionally shaped such as pyramids, s or others. Additionally, trays can be manufactured from one or a combination of various materials including wood, stone, plastic, metal, carbon fiber and others in different embodiments.

FIG. 12C shows an example embodiment of a tray 1210 from a lengthwise side diagram view 1200*e* and widthwise side diagram view 1200*f* Tray 1210 can have an overall height of about 53 millimeters in some embodiments. As shown, one or more cutouts 1216 or holes can be provided in one or more walls of tray 1210 to allow hoses, purge manifolds or other components and assemblies to protrude out of the interior of tray 1210. Cutouts 1216 can include sealing components in some embodiments.

In various embodiments, various surfaces and walls of trays and covers can include beverage holders, food holders, plate holders, drawers, cabinets, cupboards and numerous other compartments, chambers and special or general purpose surfaces.

FIG. 12D shows an example embodiment of an ash tray 1230 from a side diagram view 1200*j*, side-cross sectional diagram view 1200*k*, top diagram view 1200*g*, bottom diagram view 1200*h* and mockup 1200*i*. In many embodiments, ash trays 1230 can be removable for cleaning. As shown in the example embodiment ash tray can be 89 millimeters in diameter at its widest and 5 millimeters thick or tall. A ridged area 1232 can serve several purposes including gripping for movement, elevation for providing improved airflow and support for items placed on it and others. Ash tray 1230 can be an example embodiment of ash tray 24 of FIG. 3A.

Purge Cycle Operation

FIG. 13A shows an example embodiment a side cross-sectional diagram view 1300*a* of a domed water pipe 1302 with supporting tray 1304. As shown in the example embodiment, a tray can support a manifold 1306 having a hose attachment 1308 and space for a light 1316 located below an inner vessel 1312. Inner vessel 1312 can be used to contain a liquid chamber 1318 and an outer vessel 1314 can be placed over and around inner vessel 1314 to create a smoke chamber 1320. An aerator 1322 can be located at a distal end of a downstem 1324, such that it is at least partially submerged in liquid in liquid chamber 1318 when in use or prepared for use. Downstem 1324 can extend through holes in the upper surfaces of inner vessel 1312 and outer vessel 1314 and can include one or more purge valves 1326 located near its proximal end and at least partially above the upper hole in outer vessel 1314. Downstem 1324 can terminate in a bowl 1330 at its proximal end with one or more chambers for holding shisha 1328 or other organic material for smoking. Charcoal 1332 can be placed above shisha 1328 in order to heat it and can be covered by a cap 1334 in use, such that airflow can be regulated effectively.

FIG. 13B shows an example embodiment of a side cross-sectional diagram view of a domed water pipe 1302 with supporting tray 1304 including an intake airflow cycle 1300*b*. As shown in the example embodiment, during intake airflow cycle 1300*b*, a user can draw air through a hose attachment 1308. This causes air to travel through cap 1334 and around charcoal 1332. This air can then travel passed shisha 1328, which is being heated by charcoal 1332 within bowl 1330. Airflow continues through downstem 1324 and is initially cleaned in aerator 1322. Once inside liquid chamber 1318, the airflow is further cleansed by liquid contained therein. Airflow bubbles within liquid chamber and exits through the hole in the upper surface of inner vessel 1312 into the smoke chamber 1320 made between inner vessel 1312 and outer vessel 1314. This allows the air to be cooled by both the large surface area of the interior of outer vessel 1314 and the surface area inner vessel 1312, especially when liquid within liquid chamber 1318 is cool. Airflow then continues through gaps between manifold and smoke chamber 1320, through the hose attachment 1308, hose (not pictured) and into the user's lungs for enjoyment.

FIG. 13C shows an example embodiment of a side cross-sectional diagram view 1300*c* domed water pipe 1302 with supporting tray 1304 including a first purge airflow cycle. 1300*c*. As shown in the example embodiment, purge airflow cycle 1300*c*, a user can push air through a hose attachment 1308. This causes air to travel through manifold 1306 and into smoke chamber 1320. Once in smoke chamber, airflow continues through the one or more purge valves 1326 that is coupled or part of downstem 1324 before exiting the domed water pipe 1302. The operation of purge airflow cycle 1300*c* allows users to purge smoke chamber 1320 of overly heated or stale smoke that may remain within domed water pipe 1302.

FIG. 13D shows an example embodiment of a side cross-sectional diagram view domed water pipe 1302 head purge detail 1300*d*. As shown in the example embodiment, when one or more purge valve 1326 are coupled with or part of a downstem 1324, they can have multiple positions including closed 1326*a* and open 1326*b*. In operation, closed purge valves 1326 can operate by gravity or other mechanisms such that they close purge channels 1336. Then, in operation during a purge cycle, open purge valves 1326*b* can allow airflow to escape in a gap between bowls 1330 and one or more portions of an outer vessel 1314, here an outwardly flared upper cap area.

FIG. 13E shows an example embodiment of a side cross-sectional diagram view of domed water pipe 1302 with supporting tray 1304 including a second purge airflow cycle 1300*e*. As shown in the example embodiment, purge airflow cycle 1300*c*, a user can push air through a hose attachment 1308. This causes air to travel through manifold 1306 and into smoke chamber 1320. Once in smoke chamber, airflow continues through one or more purge valves 1326 in tray 1304 and coupled directly with manifold 1306 before exiting the domed water pipe 1302. The operation of purge airflow cycle 1300*c* allows users to purge smoke chamber 1320 of overly heated or stale smoke that may remain within domed water pipe 1302.

FIG. 14A shows an example embodiment of a domed water pipe assembly including a manifold 1402 with coupled purge valve 1404 and coupled main seal 1406. Also shown are outer chamber 1408, inner chamber 1410, downstem 1412, aerator 1414 and bowl 1416.

FIGS. 14B-14C show an example embodiment of a domed water pipe assembly including a manifold 1402 with coupled purge valve 1404 and coupled main seal 1406. Also shown are outer chamber 1408, inner chamber 1410, downstem 1412, aerator 1414 and bowl 1416 with coupled cap 1418. Inner chamber 1410 is shown as containing liquid 1420 and a lighting element 1422 can be seen through chambers 1408, 1410, as housed within manifold 1402 and below inner chamber 1408. Also shown is a hose 1424 coupled with manifold 1402.

FIGS. 14D-14E show an example embodiment of a domed water pipe assembly, including a manifold 1402 with coupled purge valve 1404 and coupled main seal 1406. Also shown are outer chamber 1408, inner chamber 1410 and bowl 1416 with coupled cap 1418. Inner chamber 1410 is shown as containing liquid 1420 and smoke is shown between inner chamber 1410 and outer chamber 1408.

FIGS. 15A-15L show example embodiments of platforms where like numbered elements correspond between the figures in their generally functionality. For example, a platform 1520*a* of FIG. 15A corresponds generally with a platform 1520*c* of FIG. 15C.

FIGS. 15A-15B show an example embodiment of a grinder platform setup. FIGS. 15C-15D show an example embodiment of a spiral platform setup. FIGS. 15E-15F show an example embodiment of a rose platform setup. FIG. 15G-15H show an example embodiment of a rose platform setup. FIG. 15I-15J show an example embodiment of another rose platform setup. FIG. 15I-15J show an example embodiment of a rose-spiral platform setup. FIG. 15K-15L show an example embodiment of a wall platform setup.

FIG. 15A shows an example embodiment of a platform 1520 from a top view 1500*a* and side perspective view 1500*b*. As shown in FIG. 15A, platform 1520 preferably comprises a recessed tray 1522 for containing a heating source. In the example embodiment, a raised surface 1523 can provide a slight elevation over a normal tray (not shown) or recessed tray 522 for charcoal or other heating elements to promote airflow below them. In FIGS. 15A, 15C and 15K these are chevron shaped and as shown are in concentric rings whereby those in the inner ring are smaller and offset from those in the outer ring. In FIGS. 15G and 15I these are rounded rectangular shaped about a central focal point and as shown are in concentric rings whereby those in the inner ring are smaller and offset from those in the outer ring. As shown in bottom view diagram 1500*r* of FIG. 15I, spiral and other ridge features can be included on a bottom surface of platform 1520 to provide airflow management in various embodiments.

The platform 1520 also preferably comprises a plurality of perimeter bowl vents 1524 for permitting airflow between a heating chamber and a bowl while in operation. As shown, eight perimeter bowl vents 1524 may be used although other numbers of perimeter bowl vents 1524 are also contemplated. The platform 1520 also preferably comprises a plurality of perimeter vertical protrusions 1530 that mate with corresponding protrusions 1544 of a cap to form adjustable side vents 1526 for controlling the airflow between the exterior atmosphere and the heating chamber. In various embodiments, this mating may occur using screws and threading. As shown in the example embodiment, platform 1520 can have a radius of about 37.25 millimeters.

As a cap 1540 is rotated relative to the platform 1520, for instance by rotating cap 1540 using a rim 1590, respective protrusions 1530 and spaces therebetween (i.e. the formed circumferential vents 1526) may transition between fully open, partially open and fully closed with respect to adjustable side vents 1560. In this manner, airflow to the heating chamber may be controlled. In some embodiments, the cap 1540 may further comprise additional upper vents 1572, which may or may not be adjustable in different embodiments. Perimeter bowl vents 1524 may have differing dimensions in various embodiments.

Platform 1520 may be comprised of aluminum, copper, steel, or any other material that is suitable for this purpose. Similarly, cap 1540 may be comprised of aluminum, copper, steel, or any other material that is suitable for this purpose.

Recessed tray 1522 may include walls 1528 which are flared inward from their upper edges. Walls 1528 may prevent coals or other heating elements from sliding or otherwise moving around within heating chamber 1570 during adjustment by users. The inward flare of walls 1528 may further promote airflow within heating chamber 1570 by channeling air toward the heating elements. In the example embodiment, recessed tray 1522 has a star configuration with eight points. Other embodiments may incorporate other shapes without departing from the scope of the invention. It has been discovered, however that the eight-pointed star configuration provides benefits over other shapes, including benefits of even heating and air flow, particularly when combined with the multi-chambered bowl described herein.

Circumferential vents 1526 may comprise alternating spaces between vertical protrusions 1530. The inner surface 1532 of each vertical protrusion 1530 may create a substantially "V" shape with the point directed inward, toward the center of heating chamber 1570 from the circumferential vents 1526 on either side of the vertical protrusion. Accordingly, air may be channeled toward heating elements on recessed tray 1522. Additionally, the point of each "V" may correspond with each star point of recessed tray 1522. It has been discovered that embodiments utilizing such an arrangement benefit from the created air channels which may promote circulation within heating chamber 1570 and promote even heating of the coals or other heating elements during use.

Perimeter bowl vents 1524 may be diamond shaped holes allowing airflow from the interior of heating chamber 1570 into a bowl. Each perimeter bowl vent 1524 is preferably located near, such as directly in front of, a circumferential vent 1526. This may promote a mixture of cool air from the exterior of the cap 1540 with heated air from the interior of heating chamber 1570 such that during inhalation by a user, strictly heated air is not the only air being pulled through the water pipe. An upper surface of plate 1520 can be a recessed holder to provide stability for a coal, such that the coal will not slide or fall off the upper surface of the plate by accident, as may occur if a user accidentally bumps the water pipe. The recessed holder can also have angled interior surfaces so as to direct airflow around and to and from a coal. The recessed holder can have a uniform flat bottom surface to promote uniform heating of tobacco, or other organic material, below the plate. The upper surface of the plate can have openings around the recessed holder to provide airflow to underlying tobacco, or other organic material, when the plate 1520 is placed atop a head.

Rim 1590 may be an outward extension of cap 540 from a central axis that allows users to rotate cap 1540 with respect to platform 1522. This may allow for different configurations of adjustable side vents 1560 with respect to circumferential vents 1526, allowing a user to control air flows into and out of heating chamber 1570. Rim 1590 is shown as a series of pointed extensions, attaching to cap 1540 at protrusions 1544. In some embodiments, rim may be insulated such that it may be handled by hand. Although rim 1590 is shown as circumferentially surrounding cap 1540, it should be understood that it may only protrude outward in a single location, in a plurality of locations, or in partial circumferential areas.

A user can place or otherwise couple a platform 1522 on a rim of a bowl filled with tobacco, shisha or other organic matter already prepared as described above. Then a user can place coals or other combustible material on platform 1522. Once the coals or other combustible material are in place, they can be heated by a heat source, for example a match or lighter, before a user places or otherwise couples a ventilated cap 1540 on platform 1522.

A cap can be a ventilated cover for protecting a coal from undesired wind. In some embodiments, the ventilated cover can be monolithic and has air vents at regular intervals around an upper circumference. Air vents can also be provided around a lower circumference of the cover. An outer structure can provide a cool handling location for grabbing, adjusting, or moving the cover, even with a lit, hot coal underneath.

FIGS. 15M-15T illustrate an example embodiment of a ventilated cover 1540*a*-1540*t* for use in accordance with at least one embodiment of the present invention. The ventilated cover 1540 can include upper holes of varying sizes and shapes including diamonds, triangles and others, side ventilation holes 1560 and a rim 1590 for adjusting an orientation of cover 1540.

In some embodiments, the ventilated cover can be an adjustable structure with inner and outer sections. In such embodiments, inner and outer sections can be rotated with respect to each other in order to adjust the size of the air vents. This allows a user to customize the size of the air vents in varying environmental conditions, such as windy, still, indoor, or outdoor. Keys can also allow users to adjust ventilation covers. Additional description of the features and operation of similar covers is given in the patent and applications incorporated by reference in the cross-references herein.

Tongs with Spring Mechanism

FIG. 16A shows an example embodiment of tongs 1601 for use with a selectively grasping a heating element from a top view, 1600*a*, side view 1600*b* and perspective view 1600*c*. As shown, tongs 1601 can be mechanized with a spring mechanism that biases them in one direction or another. Tongs can be about 180 millimeters long and 26 millimeters tall in general and about 53 millimeters wide in an open orientation.

FIG. 16B shows an example embodiment of an exploded diagram 1600*d* of tongs 1601, that can include a top cap 1602 over a low profile flathead bolt 1604 that is threaded 1606, and fits through a small washer 1608 and into a first tong arm 1610. A wave spring 1612 and torsion spring 1614 within a compartment in tong arm 1610 one can be coupled with a complementary compartment in tong arm two 1616. Tong arm one 1610 can be oriented such that a rounded end near an elbow faces toward a similar shaped curvature of a second tong arm 1616. A base cap 1618 can have a threaded end 1620 that fits through a hole in one or both tong arms. Tong arm one and tong arm two can thus be biased in an open or closed position from each other. One or both tong arms 1610, 1616 can also have openings near their terminus 1622, 1624 respectively, such that they allow heat to pass through the openings. Additionally, one or more materials can be used to construct or manufacture tong arms. Tong components can be made of one or more materials, including combinations of stone handles, metal tips, wood, glass and others as appropriate.

FIG. 16C shows an example embodiment of a cross sectional view 1600*e* and feature diagram 1600*f* of tongs 1601.

FIG. 17A shows an example embodiment of a puck 1701 from a top view 1700*a*, side view 1700*b* and perspective view 1700*c*. As shown in the example embodiment, puck 1701 can include an internal, generally cylindrical space 1702 for electronic components that measures about 150 millimeters in diameter by about 15.25 millimeters in height that is defined by a wall 1703 and that can be sealed by a glass sheet 1704. Puck 1701 can be about 28.2 millimeters in height, about 195.82 millimeters across a top diameter and about 150.79 millimeters across an internal bottom diameter.

FIG. 17B shows an example embodiment of a puck 1701 from a perspective view 1700*d*, side cross sectional view 1700*e* and perspective cross sectional view 1700*f*. As shown in the example embodiment, an LED strip area 1705 can be about 4 millimeters by 2 millimeters around an internal circumference within cylindrical space 1702. A reflective glass 1706 that is about 1 millimeter thick can be located parallel to and below glass sheet 1704, which can be transparent or opaque, in an area about 15.26 millimeters tall. Reflective glass 1706 can be about 150.35 millimeters in diameter in some embodiments. Walls 1703 can be silicone and can house a pressure sensor 1707 below reflective glass 1706 that can sense pressure on a side or bottom of puck 1701.

FIG. 17C shows an example embodiment of a puck from a top view 1700*g*, side view 1700*h*, side cross sectional view 1700*i*, cross sectional detail 1700*j* and mockup 1700*k*. As shown in the example embodiment, a puck can be about 177.93 millimeters in diameter at its widest and about 19.96 millimeters tall when fully assembled. A ridge 1711 around part or all of an outer circumference of puck 1701 can allow it to be coupled in a fixed location within a manifold, gasket or other location for use.

FIG. 17D shows an example embodiment of a puck rim 1708 from a top view 17001, cross sectional detail view 1700*m* and mockup 1700*n*. A ridge 1713 around part or all of an outer circumference of puck rim 1708 can allow it to be coupled in a fixed location within a manifold, gasket or other location for use or to be coupled with a puck body 1703.

FIG. 17E shows an example embodiment of a puck rim 1708 from a side view 1700*o* and from a side cross sectional view 1700*p*.

FIG. 17F shows an example embodiment of pressure sensor membranes 1700*q*, silicone rim 1700*r* and cross sectional view 1700*s* of circuit board 1709 and battery 1710.

FIG. 17G shows an example embodiment of an LED panel 1700*t* and LED strip 1700*u*. It should be understood that in various embodiments, different LED lighting setups can be used and can be controlled in different fashions. For example, multiple controllers, can be used to control multiple sets of LEDs independently of each other. LED arrangements can include flat surface arrangements facing upward, individual LEDs located in specific locations and various others. In some embodiments LED's or other display panels are operable to display images and holograms.

FIG. 18A shows an example embodiment of a user interface application color selection 1800*a*, application icon 1800*b* and interface 1800*c*. As shown in the example embodiment 1800*a*, users can select from one of a variety of colors and color schemes for their user interface experience. As shown in the example embodiment 1800*b*, users can be presented with different icons based on the operating system they are using. As shown in the example embodiment 1800*c*, users can select an appropriate icon to begin using their application.

FIG. 18B shows an example embodiment of a user interface application welcome screen 1800*d*, application introduction screen 1800*e* and login 1800*f*. As shown in the example embodiment 1800*d*, users can see a logo or other welcoming message upon loading the application. As shown in the example embodiment 1800*e*, users can see an introduction background and message after a welcome screen. As shown in the example embodiment 1800*f*, users can enter a username and password or sign up for an account at a login screen, which can then be authenticated via a local or remotely stored database, for instance on a server via a computer network.

FIG. 18C shows an example embodiment of a user interface login entry 1800*g*, device searching 1800*h* and pairing introduction 1800*i*. As shown in the example embodiment 1800*g*, a user can enter credentials such as a username and password via a user interface such as a touchscreen. As shown in the example embodiment 1800*h*, a user can select a search for local devices option to search for devices with which to couple their control device. As shown in the example embodiment 1800*i*, a user can select a device connectivity for their control device in order to search for devices.

FIG. 18D shows an example embodiment of a user interface pairing selection 1800*j*, pairing confirmation 1800*k* and mood selection 1800*l*. As shown in the example embodiment 1800*j*, users can select a device from a list of locally located devices for pairing with the control device. As shown in the example embodiment 1800*k*, the control device can display a paired device after pairing with the control device. As shown in the example embodiment 1800*l*, users can select a mood from a listing of one or more moods in order to control the paired device lighting output.

FIG. 18E shows an example embodiment of a user interface mood brightness selection 1800*m*, mood sensitivity 1800*n* and mood theme 1800*o*. As shown in the example embodiment 1800*m*, users can selectively choose a brightness level for lighting of a paired device via a scroll wheel or other selection. As shown in the example embodiment 1800*n*, users can selectively choose a sensitivity level for changing lighting of a paired device via a scroll wheel or other selection. As shown in the example embodiment 1800*o*, users can select a theme, here "Aurora."

FIG. 18F shows an example embodiment of a user interface mood pairing 1800*p*, mood 1800*q* and mood 1800*r*. As shown in the example embodiment 1800*p*, users can view a paired device and theme selection for the paired device. As shown in the example embodiment 1800*q*, users can change a paired device theme, here "Aurora." As shown in the example embodiment 1800*r*, users can preview a different theme for the paired device, here "Frost."

FIG. 18G shows an example embodiment of a user interface mood description 1800*s*, mood description 1800*t* and interface 1800*u*. As shown in the example embodiment 1800*s*, users can view multiple pairable devices via a user interface screen, including pairing status. As shown in the example embodiment 1800*t*, users can view multiple pairable devices via a user interface screen, including pairing status that has been selectively changed or updated. As shown in the example embodiment 1800*u*, users can view different application options including community, devices, store, story and account or others.

FIG. 18H shows an example embodiment of a user description 1800*v*, description 1800*w* and settings selection 1800*x*. As shown in the example embodiment 1800*v*, users can view and scroll through articles. As shown in the example embodiment 1800*w*, users can read and scroll through a story. As shown in the example embodiment 1800*x*, users can select and modify settings for applications, paired devices and accounts.

FIG. 18I shows an example embodiment of a user interface product description 1800*y*. As shown in the example embodiment 1800*y*, users can view device specific information.

FIG. 18J is an example embodiment of a basic network setup. As shown in FIG. 18J, a server system 1800*aa* with multiple servers 1802 and 1804 which can include applications distributed on one or more physical servers, each having one or more processors, memory banks, operating systems, input/output interfaces, and network interfaces, all known in the art, and a plurality of end user devices 1806, 1808 coupled to a network 1810 such as a public network (e.g. the Internet and/or a cellular-based wireless network, or other network), private network or both. User devices include for example mobile devices 1806 (e.g. smartphones, tablets, or others) desktop or laptop devices 1808, wearable devices (e.g. watches, bracelets, glasses, etc.), other devices with computing capability and network interfaces and so on. The server system 1800*aa* includes for example servers operable to interface with websites, webpages, web applications, social media platforms, advertising platforms, and others.

FIG. 18K is an example embodiment of a network connected server system 1802. As shown in FIG. 18K, a server system 1802 according to an embodiment of the invention including at least one user device interface 1830 implemented with technology known in the art for communication with user devices. The server system can also include at least one web application server system interface 1840 for communication with web applications, websites, webpages, websites, social media platforms, and others. The server system 1802 can further include an application program interface (API) 1820 that is coupled to a database 1812 and can communicate with interfaces such as the user device interface 1830 and web application server system interface 1840, or others. The API 1820 can instruct the database 1812 to store (and retrieve from the database) information such as link or URL information, user account information, associated account information, messaging information, themes information, device information or others as appropriate. The database 1812 can be implemented with technology known in the art such as relational databases and/or object oriented databases or others.

FIG. 18L is an example embodiment of a user device. As shown in FIG. 18L, a diagram of a user mobile device 1806 according to an embodiment of the invention that includes a network connected puck control application 1814 that is installed in, pushed to, or downloaded to the user mobile device 1806. In many embodiments user mobile devices 1806 are touch screen devices such as smart phones or tablets. User mobile devices 1806 are implemented with memory, processors, communications links, transmitter/receivers, power supplies such as batteries, interfaces such as screens displaying GUI's, buttons, touchpads, software stored in memory and executed by processors, audio input and output components, video input and output components, and others. Software can include computer readable instructions stored on computer readable media such as computer memory.

Those in the art will understand that the user interface screens 1800*a*-1800*y* in FIGS. 18A-18I can be visually displayed by user interfaces of the user mobile device 1806 and navigated by analyzing user inputs and executing appropriate instructions stored in non-transitory memory. Puck control application 1814 can include various additional functionality, including allowing users to synchronize music, sounds, video, or holographic images with lighting and projections provided by a lighting puck. This can be accomplished by transmitting instructions to a puck device that is paired with the user mobile device using wireless or wired technological pairing as known in the art or later developed. This information can be received by the puck device via a transmitter/receiver over a protocol as known or later developed, such as Bluetooth, Wi-Fi or others.

FIG. 19A-19C show example embodiments of lighting functionality. As shown in the example embodiments, numerous lighting schemes are contemplated that can be used with regard to one or more lighting pucks, for example in FIGS. 20A-20C, controllable by an application as described with respect to FIG. 18 or both.

A first lighting scheme called Aurora can include a slowly transitioning light color base that changes or transitions about once every 7 seconds. This can allow for randomly appearing details that may activate three adjacent or nearly adjacent LED lights for each detail. Details can occur at the same time, for instance three details may occur at once. Fade in and fade out effects can be used and may take a period of time to occur, for example three seconds. Detail colors can be selected at random. Changes in air pressure as sensed by a pressure sensor can increase detail frequency. For example, fade in and fade out may occur more quickly, in one second intervals. Details may be limited to three at a time or another number as appropriate. A base spectrum may be all available colors and a detail spectrum may be all available colors in Aurora embodiments.

A second lighting scheme called Fathom can include a slowly transitioning light color base that changes or transitions about once every 7 seconds. This can allow for randomly appearing details that may activate three adjacent or nearly adjacent LED lights for each detail. Details can occur at the same time, for instance three details may occur at once. Fade in and fade out effects can be used and may take a period of time to occur, for example three seconds. Detail colors can be selected at random from a fixed color scheme. Changes in air pressure as sensed by a pressure sensor can increase detail frequency. For example, fade in and fade out may occur more quickly, in one second intervals. Details may be limited to three at a time or another number as appropriate. A base spectrum may be dark blues, teals, purples and blues and a detail spectrum may include whites or light blues in Fathom embodiments. Dark blues can be HSB 205, 75, 40; RGB 25, 70, 100. Teals can be HSB 180, 100, 75; RGB 0, 190, 190. Purples can be HSB 240, 65, 75; RGB 65, 65, 190. Blues can be HSB 240, 100, 75; RGB 0, 0, 190. Whites can be HSB 0, 0, 100; RGB 255, 255, 255. Light blues can be HSB 180, 100, 100; RGB 0, 255, 255.

A third lighting scheme called Rise can include a slowly transitioning light color base that changes or transitions about once every 7 seconds. This can allow for randomly appearing details that may activate three adjacent or nearly adjacent LED lights for each detail. Details can appear randomly in the arrays that may activate three adjacent or nearly adjacent LED lights for each detail. Details can occur at the same time, for instance three details may occur at once. Fade in and fade out effects can be used and may take a period of time to occur, for example three seconds. Detail colors can be selected at random. Changes in air pressure as sensed by a pressure sensor can make base colors change to blue with a number (e.g. three) of randomly selected LED's appearing yellow at different times. Fade in and fade out may occur more quickly, in one second intervals. Details may be limited to three at a time or another number as appropriate and may occur every one second. A base spectrum may be golds, red oranges, purples and blues and a detail spectrum may include yellows in Rise embodiments. Golds can be HSB 35, 100, 75; RGB 190, 110, 0. Red Orange can be HSB 20, 85, 70; RGB 180, 75, 25. Purples can be HSB 255, 60, 40; RGB 55, 40, 100. Blues can be HSB 230, 70, 75; RGB 55, 80, 180. Yellows can be HSB 60, 100, 100; RGB 255, 255, 0. Air pressure changes can cause blue bases with yellow details, where blue bases can be HSB 0, 100, 100; RGB 255, 255, 255 and yellows be HSB 60, 100, 100; RGB 255, 255, 0.

A fourth lighting scheme called Ember can include a slowly transitioning light color base that changes, rotates or transitions about once revolution every 30 seconds. This can include red, black, orange, black, yellow, black, red rotating. Brighter details can appear randomly in the arrays that may activate three adjacent or nearly adjacent LED lights for each detail. Details can occur at the same time, for instance three details may occur at once. Fade in and fade out effects can be used and may take a period of time to occur, for example half of a second. Detail colors can be selected at random from a fixed selection of colors. Changes in air pressure as sensed by a pressure sensor can make base colors change to blue with a number (e.g. three) of randomly selected LED's appearing different colors at different times. Fade in and fade out may occur every three seconds. Details may be limited to three at a time or another number as appropriate and may occur every three seconds. A base spectrum may be reds, oranges, blacks and yellows and a detail spectrum may include bright oranges, bright yellow oranges and bright yellows in Ember embodiments. Oranges can be HSB 20, 85, 75; RGB 190, 80, 30. Reds can be HSB 10, 90, 50; RGB 130, 30, 15. Blacks can be HSB 0, 0, 0; RGB 0, 0, 0. Yellows can be HSB 45, 80, 90; RGB 230, 185, 50. Bright Yellows can be HSB 180, 100, 100; RGB 0, 255, 255. Bright Oranges can be HSB 0, 0, 100; RGB 255, 255, 255. Bright Yellow Oranges can be HSB 180, 100, 100; RGB 0, 255, 255.

A fifth lighting scheme called Clarity can include a slowly transitioning light color base that changes or transitions about once every 7 seconds from blue to golden yellow. Changes in air pressure as sensed by a pressure sensor can change a color to white, where increased air pressure change causes brightness to increase. A base spectrum may be blues and yellows and a detail spectrum may include whites in Clarity embodiments. Blues can be HSB 196, 100, 93; RGB 0, 175, 240. Yellows can be HSB 45, 85, 100; RGB 255, 200, 40. Whites can be HSB 0, 100, 100; RGB 255, 255, 255.

A sixth lighting scheme called Serenity can include a slowly transitioning red color base that changes or transitions about once every 7 seconds to different shades. Changes in air pressure as sensed by a pressure sensor can cause colors to blend together and rotate radially around the ring of about once every three seconds or alternatively change the color to purple, where increased air pressure change causes brightness to increase. A base spectrum may be maroons, reds and purples and a detail spectrum may include whites in Serenity embodiments. Maroons can be HSB 345, 90, 45; RGB 115, 10, 35. Reds can be HSB 355, 90, 75; RGB 190, 20, 35. Purples can be HSB 300, 100, 40; RGB 100, 0, 100. Whites can be HSB 0, 100, 100; RGB 255, 255, 255.

Various other lighting schemes are contemplated and many different effects can be used including flashes, fades and others.

FIG. 20A shows an example embodiment of an LED Puck 2001 full assembly diagram 2000*a* from a perspective view.

FIG. 20B shows an example embodiment of an LED Puck 2001 assembly exploded diagram 2000*b* and partial assembly diagram 2000*c* from a perspective view. As shown in the example embodiment, a tear away bumper 2020 can be used to hold or otherwise couple a glass cover 2030 in place within or above a puck body 2002. Glass layer 2030 can be glass that is etched or not etched. Similarly, it could also be any transparent or transparent material operable to serve the purpose of allowing lighting through. An opaque or reflective material layer 2010 can be located below glass cover 2030 and can seal an inner chamber area within puck body 2002. This layer 2010 can help to deflect or reflect light upward that is emitted by LED's or back reflected downward through a glass chamber or water within the chamber in use. Puck body 2002 is generally disk shaped and includes a hollow internal chamber for housing electronics include a PCB location area 2004 and battery placement area 2006. These areas may or may not have internal walls or other structures to rigidly define and hold components.

Etched glass layer 2030 can have a thickness that is generally about as wide as an LED strip 2010. LED strip 2010 has a length that is generally about equal to a circumference of glass layer 2030. As such, LED strip 2010 can be wrapped around and coupled with the edge of glass layer 2030, for instance using an adhesive, as shown in diagram 2000*c*. Power and operation control for one or more LED's housed in or on LED strip 2010 can be provided by wiring that is coupled with one or both of a battery housed in battery placement area 2006 and a PCB held in PCB location area 2004.

FIG. 20C shows an example embodiment of an LED Puck 2001 partial assembly exploded diagram 2000*d* and full assembly diagram from a perspective view 2000*e* and full assembly diagram from a side view 2000*f* and bottom perspective view 2000*g*. Glass layer 2030 and LED strip 2010 can be placed in a channel within puck body 2002, above layer 2040, which is located above internal electronics. Tear away bumper 2020 can then be coupled with a rim of puck body 2002, for example an upper, exterior or interior surface of body 2002 using adhesives, latches, gaskets or other operable mechanisms or components suitable for the purpose of affixing bumper 2020 with body 2002. As shown in the example embodiment, one or more airflow channels 2008 can allow air pressure to be sensed or transferred from a manifold exterior to a base area below the LED puck body 2002. These channels can be placed at regular or irregular intervals around the puck body 2002.

As shown in the example embodiment, a hole in the bottom of puck body 2002 can allow a pressure sensor within body 2002 to be in fluid communication with the air outside body 2002. As such, an appropriate pressure sensor that monitors ambient air pressure for changes can detect air pressure changes. This pressure sensor can be mounted to the bottom of a PCB housed within body 2002. Further, the PCB can be rated at a lower IPX rating such that it is not required to be waterproof. Monitoring the pressure of humid air including smoke provides that in the example embodiment, only the pressure sensor is exposed, while the remainder of the PCB is housed safely above the pressure sensor within body 2002 while being protected from the humidity and smoke. Also, shown in the example embodiment are a power button 2003 and a battery charging port 2005, in this embodiment a microUSB port. In some embodiments, different sensor are used including motion sensors, noise sensors, lighting sensors and others. Some embodiments of pucks include speakers for playing audio sounds. In some embodiments pucks include additional non-transitory memory coupled with PCB's and associated controllers.

FIG. 21A shows an example embodiment of an upward purge valve assembly overview first step 2100*a*, second step 2100*b* and third step 2100*c*. As shown in the example embodiment a head 2102, upward purge valve 2104 and downstem 2106 with one or more purge airways 2105 may be coupled together. First upward purge valve 2104 can be coupled with downstem 2106 to form upward purge subassembly 2108. In this step, upper purge airways 2105 are covered by upward purge valve 2104. Next, subassembly 2108 is coupled with head 2102 to form full upward purge assembly 2110. Full upward purge assembly 2110 has a housing with airways 2105 that lead upward and outward with respect to downstem 2106.

FIG. 21B shows an airflow diagram 2100*d* through a full upward purge assembly 2110. As shown in the example embodiment, on an inhale or draw by a user, air is pulled down through a centralized hole and pathway through bowl 2102 and downstem 2106 into water 2112 held in a chamber 2114 defined by a wall 2116. Upon exhale or purging, air is pushed into the chamber through a hose (not shown) where it can then enter one or more airways 2105 where it pushes up the upward purge valve 2104 which is otherwise sealed by gravity or inward air pressure during inhalation. It should be understood that wall 2116 and upward purge assembly 2110 form a substantially airtight seal such that air does not readily escape on its own.

The enablements described in detail above are considered novel over the prior art of record and are considered critical to the operation of at least one aspect of the invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus, if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense, it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that the named inventor believes that the claimed subject matter is what is intended to be patented.

What is claimed is:

1. A water pipe apparatus for smoking, comprising:

a manifold coupled with a hose;

an interior chamber for containing a liquid and having an interior chamber opening;

an exterior chamber operable to fit over and substantially around the interior chamber;

a bowl head for containing material to be smoked; and a stem, coupled to the bowl head and extending from an exterior to the exterior chamber through the interior chamber opening and into the liquid contained in the interior chamber, wherein the interior chamber, exterior chamber, and manifold form a sealed smoke chamber allowing smoke to flow when drawn through the hose by a user, and wherein the interior chamber opening is larger than the stem and is operable to allow smoke pulled by a user through the liquid to pass from the interior chamber into the exterior chamber before being inhaled by a user through the hose.

2. The water pipe apparatus for smoking of claim 1, further comprising:

wherein the interior chamber rests on a surface within the manifold.

3. The water pipe apparatus for smoking of claim 1, further comprising:

a seal that rests between the manifold and the exterior chamber to form the sealed smoke chamber.

4. The water pipe apparatus for smoking of claim 1, further comprising:

a tray, comprising:

an opening to receive the manifold; and a hole to allow the hose to pass through a wall of the tray.

5. The water pipe apparatus for smoking of claim 4, wherein the tray further comprises:

a removable lid that, when coupled with the tray, forms at least one tray chamber within the tray.

6. The water pipe apparatus for smoking of claim 1, wherein the stem is permanently coupled to the bowl head.

7. The water pipe apparatus for smoking of claim 6, wherein the stem is inserted into an exterior chamber opening from above.

8. The water pipe apparatus for smoking of claim 1, wherein the stem is removably coupled to the bowl head.

9. The water pipe apparatus for smoking of claim 8, wherein the stem is removably coupled to the bowl head by a screwing mechanism.

10. The water pipe apparatus for smoking of claim 8, wherein the stem is inserted into an exterior chamber opening from below before coupling with the bowl head.

11. The water pipe apparatus for smoking of claim 1, further comprising:

an aerator assembly comprising a carbon filter.

12. The water pipe apparatus for smoking of claim 11, wherein the aerator assembly is removably coupled with a lower end of the stem.

13. The water pipe apparatus for smoking of claim 1, wherein the exterior chamber further comprises:

a flared lip around an exterior chamber opening.

14. The water pipe apparatus for smoking of claim 1, wherein the stem further comprises:

at least one purge airway.

15. The water pipe apparatus for smoking of claim 14, wherein the stem further comprises:

at least one purge valve, operable to allow airflow outward from a location inside the exterior chamber to an area outside the exterior chamber.

16. The water pipe apparatus for smoking of claim 1, further comprising:

a purge valve of the manifold.

17. The water pipe apparatus for smoking of claim 16, wherein the purge valve further comprises:

an umbrella valve comprising a stem coupled to a disk.

18. The water pipe apparatus for smoking of claim 1, wherein the exterior chamber is a dome shape with an upper opening and a lower opening that has a diameter substantially larger than that of the upper opening.

19. The water pipe apparatus for smoking of claim 1, wherein the interior chamber is a dome shape with an upper opening and a lower surface.

20. The water pipe apparatus for smoking of claim 1, further comprising:

an LED light puck, operable to rest within the manifold and light the interior chamber from below.

* * * * *